US012496498B2

(12) United States Patent
Harbert et al.

(10) Patent No.: US 12,496,498 B2
(45) Date of Patent: Dec. 16, 2025

(54) GOLF CLUB HEADS

(71) Applicant: Taylor Made Golf Company, Inc., Carlsbad, CA (US)

(72) Inventors: Christopher John Harbert, Carlsbad, CA (US); Joseph Henry Hoffman, Carlsbad, CA (US); Christopher Rollins, Calsbad, CA (US); Todd P. Beach, Carlsbad, CA (US); Mark Vincent Greaney, Carlsbad, CA (US); Justin D. Kleinert, San Clemente, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 497 days.

(21) Appl. No.: 18/082,735

(22) Filed: Dec. 16, 2022

(65) Prior Publication Data

US 2023/0166163 A1 Jun. 1, 2023

Related U.S. Application Data

(63) Continuation-in-part of application No. 18/082,271, filed on Dec. 15, 2022, which is a continuation-in-part of application No. 17/547,519, filed on Dec. 10, 2021, now Pat. No. 11,701,555, which is a continuation of application No. 17/006,561, filed on Aug. 28, 2020, now Pat. No. 11,219,803.

(60) Provisional application No. 63/292,708, filed on Dec. 22, 2021, provisional application No. 62/894,523, filed on Aug. 30, 2019.

(51) Int. Cl.
*A63B 53/04* (2015.01)

(52) U.S. Cl.
CPC ..... *A63B 53/0441* (2020.08); *A63B 53/0412* (2020.08); *A63B 53/0437* (2020.08); *A63B 53/0445* (2020.08); *A63B 53/0466* (2013.01)

(58) Field of Classification Search
CPC ..... A63B 53/0416; A63B 53/0441
See application file for complete search history.

(56) References Cited

U.S. PATENT DOCUMENTS

| | | | | |
|---|---|---|---|---|
| 1,291,967 A | | 1/1919 | Mcdougal | |
| 1,402,537 A | | 1/1922 | Reach | |
| 1,660,126 A | * | 2/1928 | Heeter | A63B 53/0466 D21/733 |
| D89,332 S | * | 2/1933 | Bartsch | D21/733 |
| 2,520,950 A | * | 9/1950 | Miller | A63B 53/04 D21/750 |

(Continued)

FOREIGN PATENT DOCUMENTS

| | | | | |
|---|---|---|---|---|
| CN | 101868281 A | * | 10/2010 | A63B 53/007 |
| DE | 202014105738 U1 | * | 3/2016 | A63B 53/0487 |

(Continued)

OTHER PUBLICATIONS

AdamsGolf, "DiXX Blu Putter," retrieved from https://web.archive.org/web/20080913151800/http://www.adamsgolf.com/products/shortgame/dixx.php, document dated Sep. 13, 2008, 1 page.

*Primary Examiner* — Alvin A Hunter
(74) *Attorney, Agent, or Firm* — Dawsey Co., LPA; David J. Dawsey

(57) ABSTRACT

Aspects of the invention are directed to golf club having a crown, a sole, a face, and a face alignment feature located on the face.

27 Claims, 80 Drawing Sheets

(56) References Cited

U.S. PATENT DOCUMENTS 2,842,369 A * 7/1958 East ..... A63B 53/0466 473/242
2,908,504 A * 10/1959 Pratt ..... A63B 69/3623 434/252
2,934,347 A * 4/1960 Siniscalchi ..... A63B 69/3632 473/242
2,954,231 A 9/1960 Macintyre
3,753,564 A * 8/1973 Brandell ..... A63B 69/3614 473/220
D231,624 S 5/1974 Wilmoth
D237,289 S 10/1975 Calton
4,157,830 A * 6/1979 Taylor ..... A63B 69/3632 473/314
4,725,062 A * 2/1988 Kinney, III ..... A63B 53/04 473/330
5,098,103 A * 3/1992 MacKeil ..... A63B 60/00 473/330
5,213,328 A 5/1993 Long
5,433,446 A * 7/1995 Lindstedt, Jr. ..... A63B 69/3632 473/242
5,489,094 A 2/1996 Pritchett
5,649,871 A * 7/1997 Ryan ..... A63B 69/3632 473/268
5,776,011 A * 7/1998 Su ..... A63B 53/0466 473/345
5,788,584 A 8/1998 Parente
5,935,020 A 8/1999 Stites
6,126,556 A * 10/2000 Hsieh ..... A63B 53/047 473/340
6,139,445 A * 10/2000 Werner ..... A63B 53/04 473/331
6,248,024 B1 * 6/2001 Nelson ..... A63B 53/04 473/347
6,425,832 B2 * 7/2002 Cackett ..... A63B 53/02 473/348
6,454,664 B1 * 9/2002 Long ..... A63B 60/00 473/345
6,475,099 B1 * 11/2002 Sumitomo ..... A63B 53/0466 473/331
6,565,452 B2 * 5/2003 Helmstetter ..... A63B 53/0466 473/324
6,582,322 B2 * 6/2003 Long ..... A63B 53/04 473/409
6,669,580 B1 * 12/2003 Cackett ..... B29C 70/865 473/348
6,729,967 B2 5/2004 Ford
D496,084 S 9/2004 Imamoto
D505,701 S 5/2005 Dogan
6,929,565 B2 8/2005 Nakahara
6,969,326 B2 11/2005 De Shiell
7,022,030 B2 4/2006 Best
D529,564 S 10/2006 Grace
7,166,038 B2 1/2007 Williams
7,235,021 B2 6/2007 Solheim
7,261,646 B2 * 8/2007 De Shiell ..... A63B 60/02 473/345
7,267,620 B2 * 9/2007 Chao ..... A63B 53/0466 473/348
7,303,487 B2 12/2007 Kumamoto
7,344,451 B2 3/2008 Tang
7,377,858 B2 5/2008 Kubota
7,396,289 B2 7/2008 Soracco
7,481,715 B2 * 1/2009 Byrne ..... A63B 69/3617 473/238
7,510,481 B2 3/2009 Sevon
7,828,669 B1 * 11/2010 Stites ..... A63B 53/047 473/238
7,871,336 B2 * 1/2011 Breier ..... A63B 60/02 473/246
7,993,216 B2 8/2011 Lee
8,025,589 B2 9/2011 Brinton
8,083,612 B2 12/2011 Stites
8,096,896 B2 * 1/2012 De Schiell ..... A63B 53/0466 473/347
D662,560 S * 6/2012 Piniarski ..... D21/733
8,348,780 B2 1/2013 Stites
8,353,786 B2 1/2013 Beach
8,414,410 B1 * 4/2013 Flaherty ..... A63B 53/0466 473/238
8,414,419 B2 * 4/2013 Curtis ..... A63B 60/00 473/345
8,496,544 B2 * 7/2013 Curtis ..... A63B 60/00 473/345
8,535,173 B2 * 9/2013 Golden ..... A63B 53/02 473/288
8,556,742 B2 * 10/2013 John ..... A63B 53/047 473/238
8,628,433 B2 * 1/2014 Stites ..... A63B 60/00 473/328
8,636,609 B2 1/2014 Chao
8,690,700 B2 * 4/2014 Flaherty ..... A63B 53/0466 473/238
8,721,471 B2 5/2014 Albertsen
8,727,909 B2 5/2014 Guerrette
8,771,095 B2 * 7/2014 Beach ..... A63B 53/04 473/226
8,821,312 B2 9/2014 Burnett
8,827,831 B2 9/2014 Burnett
8,876,625 B2 * 11/2014 Curtis ..... A63B 53/0466 473/345
8,894,501 B1 * 11/2014 Stillwagon ..... A63B 53/04 473/220
9,011,267 B2 4/2015 Burnett
9,056,230 B2 * 6/2015 Golden ..... A63B 60/02
9,089,749 B2 7/2015 Burnett
9,168,434 B2 10/2015 Burnett
9,174,101 B2 11/2015 Burnett
9,333,400 B2 5/2016 Girard
D767,694 S * 9/2016 Nielson ..... D21/733
9,468,817 B2 * 10/2016 Beach ..... A63B 53/0466
9,573,028 B2 * 2/2017 Curtis ..... A63B 53/0466
9,662,548 B2 5/2017 Guerrette
9,750,991 B2 9/2017 Chao
9,764,204 B2 * 9/2017 Beach ..... A63B 53/0487
9,814,944 B1 * 11/2017 Greaney ..... A63B 53/0466
9,849,352 B2 * 12/2017 Sander ..... A63B 53/0466
9,855,473 B2 * 1/2018 Beach ..... A63B 53/0487
9,962,582 B2 * 5/2018 Antku ..... A63B 53/0466
10,052,530 B2 * 8/2018 Greaney ..... A63B 60/00
10,065,084 B2 * 9/2018 Myrhum ..... A63B 60/52
10,065,090 B2 9/2018 Guerrette
10,155,145 B2 12/2018 Girard
10,195,497 B1 2/2019 Greaney
10,207,160 B2 2/2019 Johnson
10,265,586 B2 * 4/2019 Greaney ..... A63B 53/04
10,265,587 B2 * 4/2019 Greaney ..... A63B 53/0466
10,293,219 B2 * 5/2019 Hayashi ..... A63B 53/0466
10,300,351 B2 * 5/2019 Greaney ..... A63B 60/00
D857,816 S * 8/2019 Bazzel ..... D21/733
10,391,369 B2 * 8/2019 Greaney ..... A63B 53/0466
10,398,949 B2 * 9/2019 Hayashi ..... A63B 53/0466
10,413,784 B2 9/2019 Beach
10,449,423 B2 * 10/2019 Greaney ..... A63B 53/04
10,463,926 B2 * 11/2019 Greaney ..... A63B 60/00
10,463,927 B2 11/2019 Bovee
10,500,448 B2 * 12/2019 Sander ..... A63B 53/0466
10,543,405 B2 * 1/2020 Greaney ..... A63B 60/02
10,556,157 B2 * 2/2020 Greaney ..... A63B 53/0466
10,576,335 B2 3/2020 Greaney
10,632,350 B2 4/2020 Beach
10,751,585 B2 8/2020 Johnson
10,799,778 B2 10/2020 Guerrette
10,814,190 B2 * 10/2020 Beach ..... A63B 53/04
10,874,922 B2 12/2020 Harbert
10,881,916 B2 * 1/2021 Greaney ..... A63B 60/52
10,888,746 B1 1/2021 Greaney
10,960,277 B2 * 3/2021 Greaney ..... A63B 60/02
11,045,696 B2 6/2021 Burnett
11,130,024 B2 * 9/2021 Greaney ..... A63B 60/02
11,179,608 B2 * 11/2021 Greaney ..... A63B 60/00

(56) References Cited

U.S. PATENT DOCUMENTS 11,219,803 B2 * 1/2022 Greaney ..... A63B 53/0433
11,318,358 B1 * 5/2022 Story ..... A63B 53/0408
11,666,806 B2 * 6/2023 Story ..... A63B 53/0437 473/345
11,691,054 B2 * 7/2023 Greaney ..... A63B 53/04 473/330
11,701,555 B2 * 7/2023 Greaney ..... A63B 53/0445 473/324
11,701,557 B2 * 7/2023 Greensmith ..... A63B 53/0454 473/345
11,731,014 B2 * 8/2023 Greaney ..... A63B 53/0433 473/219
11,964,191 B2 * 4/2024 Greaney ..... A63B 60/00
12,005,322 B2 * 6/2024 Greaney ..... A63B 53/0466
12,179,070 B2 * 12/2024 Greaney ..... A63B 53/0466
12,214,265 B1 * 2/2025 Evans ..... A63B 53/0454
12,239,888 B2 * 3/2025 Greaney ..... A63B 53/0412
2002/0055395 A1 * 5/2002 Douglas ..... A63B 53/0487 473/340
2003/0013544 A1 * 1/2003 Long ..... A63B 53/04 473/330
2004/0162156 A1 * 8/2004 Kohno ..... A63B 53/0466 473/314
2004/0192468 A1 * 9/2004 Onoda ..... A63B 53/0466 473/345
2005/0164800 A1 * 7/2005 Wood ..... A63B 53/0466 473/238
2006/0287130 A1 * 12/2006 Allen ..... A63B 53/0487 473/340
2007/0232409 A1 * 10/2007 Byrne ..... A63B 69/3617 473/328
2007/0275791 A1 * 11/2007 Shear ..... A63B 60/42 473/324
2008/0015045 A1 * 1/2008 Payne ..... A63B 53/0487 473/252
2008/0096688 A1 * 4/2008 Yokota ..... A63B 60/02 473/345
2009/0191980 A1 * 7/2009 Greaney ..... A63B 53/0466 473/345
2009/0314398 A1 12/2009 Shaar, Jr.
2010/0173720 A1 7/2010 Kim
2010/0331096 A1 * 12/2010 Curtis ..... A63B 53/0466 473/282
2010/0331106 A1 * 12/2010 Golden ..... A63B 60/00 473/345
2011/0081982 A1 * 4/2011 John ..... A63B 53/0466 473/257
2011/0105243 A1 * 5/2011 Brunski ..... A63B 60/00 473/342
2011/0159986 A1 6/2011 Chao
2012/0094782 A1 * 4/2012 Beach ..... A63B 53/0466 473/340
2012/0295731 A1 * 11/2012 Brekke ..... A63B 53/0466 473/292
2013/0079175 A1 * 3/2013 Lee ..... A63B 53/0487 473/340
2013/0123040 A1 * 5/2013 Willett ..... A63B 60/00 473/327
2013/0172103 A1 * 7/2013 Greensmith ..... A63B 53/0466 473/345
2013/0303306 A1 * 11/2013 Curtis ..... A63B 60/00 473/345
2014/0057738 A1 2/2014 Albertsen
2014/0162801 A1 * 6/2014 Stillwagon ..... A63B 53/04 473/220
2014/0179460 A1 6/2014 Beach
2014/0206469 A1 7/2014 Girard
2014/0213390 A1 7/2014 Guerrette
2014/0228153 A1 8/2014 Albertsen
2014/0274446 A1 9/2014 Greaney
2014/0295990 A1 * 10/2014 Beach ..... A63B 60/00 473/340
2014/0342848 A1 11/2014 Burnett
2014/0371002 A1 12/2014 Burnett
2015/0024867 A1 * 1/2015 Curtis ..... A63B 60/00 473/330
2015/0174460 A1 * 6/2015 Beach ..... A63B 53/04 473/324
2015/0182822 A1 7/2015 Burnett
2015/0231455 A1 8/2015 Burnett
2016/0016054 A1 1/2016 Burnett
2016/0236046 A1 8/2016 Girard
2016/0375321 A1 * 12/2016 Greaney ..... A63B 71/0619 473/219
2017/0232313 A1 8/2017 Guerrette
2018/0071589 A1 * 3/2018 Beach ..... A63B 53/0466
2018/0185719 A1 7/2018 Johnson
2018/0345099 A1 12/2018 Harbert
2019/0009140 A1 * 1/2019 Hayashi ..... A63B 53/0466
2019/0009145 A1 1/2019 Guerrette
2019/0038943 A1 * 2/2019 Greaney ..... A63B 71/0619
2019/0060719 A1 * 2/2019 Greaney ..... A63B 60/00
2019/0083861 A1 * 3/2019 Greaney ..... A63B 71/0619
2019/0111326 A1 4/2019 Girard
2019/0184246 A1 6/2019 Harbert
2019/0232120 A1 8/2019 Johnson
2019/0232121 A1 * 8/2019 Greaney ..... A63B 53/0466
2019/0336834 A1 * 11/2019 Greaney ..... A63B 53/0412
2021/0001189 A1 1/2021 Johnson
2021/0060392 A1 * 3/2021 Greaney ..... A63B 53/0437
2021/0069559 A1 3/2021 Albertsen
2021/0113896 A1 4/2021 Greensmith
2021/0138323 A1 5/2021 Harbert
2021/0146203 A1 5/2021 Greaney
2021/0170248 A1 6/2021 Girard
2021/0213334 A1 7/2021 Honea
2022/0176211 A1 * 6/2022 Greaney ..... A63B 53/0412
2022/0212067 A1 * 7/2022 Greaney ..... A63B 53/0433
2022/0212069 A1 * 7/2022 Greaney ..... A63B 71/0619
2023/0117902 A1 * 4/2023 Greaney ..... A63B 53/0441 473/324
2023/0119368 A1 * 4/2023 Greaney ..... A63B 53/0466 473/324
2023/0166163 A1 * 6/2023 Harbert ..... A63B 53/0441 473/324
2023/0356038 A1 * 11/2023 Greaney ..... A63B 53/0437
2023/0405417 A1 * 12/2023 Greaney ..... A63B 53/023
2024/0100402 A1 * 3/2024 Harbert ..... A63B 53/0408
2024/0316414 A1 * 9/2024 Greaney ..... A63B 60/00
2024/0316416 A1 * 9/2024 Greaney ..... A63B 53/0466

FOREIGN PATENT DOCUMENTS

DE 102015118096 A1 * 6/2016 ..... A63B 53/0487
JP H05137820 A * 6/1993 ..... A63B 53/0441
JP 2019013376 A * 1/2019 ..... A63B 53/0466
JP 3233491 U * 8/2021 ..... A63B 53/0429
KR 20070059753 A * 6/2007 ..... A63B 53/04
KR 100771481 B1 * 10/2007 ..... A63B 53/04
KR 20090092049 A * 8/2009 ..... A63B 53/0441
WO WO-2005035073 A1 * 4/2005 ..... A63B 53/0487

* cited by examiner

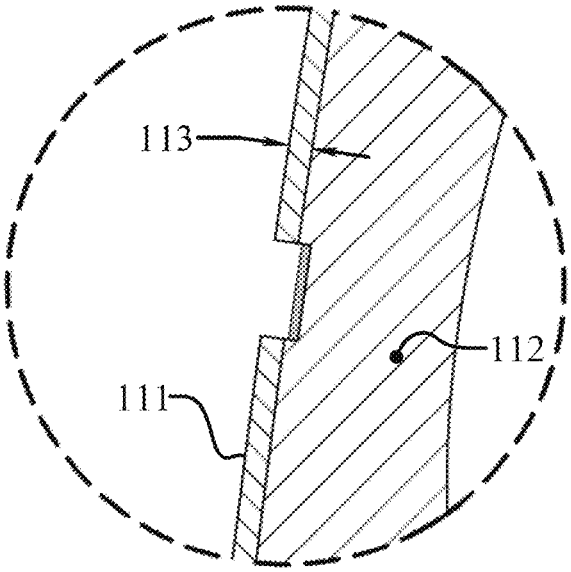
*Fig. 105*
*Fig. 106*
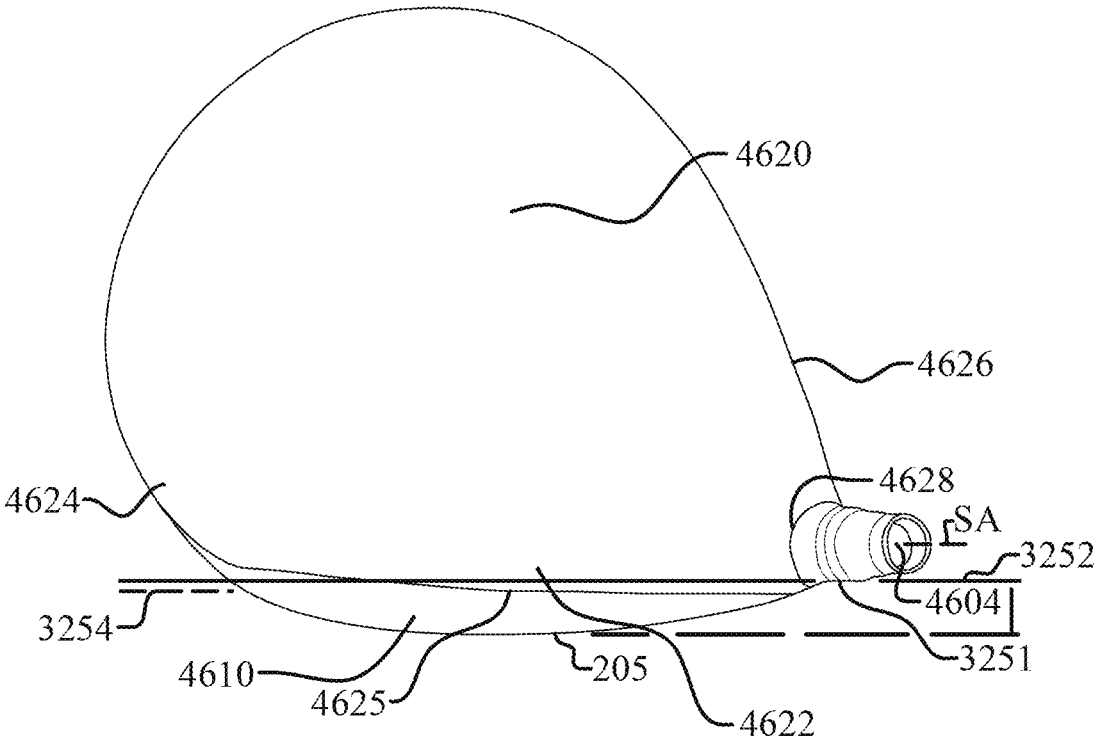

GOLF CLUB HEADS

CROSS-REFERENCE TO RELATED APPLICATIONS

This application is a continuation-in-part of U.S. patent application Ser. No. 18/082,271, filed Dec. 15, 2022, which is a continuation-in-part of U.S. patent application Ser. No. 17/547,519, filed Dec. 10, 2021, which is a continuation of U.S. patent application Ser. No. 17/006,561, filed Aug. 28, 2020, now U.S. Pat. No. 11,219,803, which claims the benefit of U.S. Provisional Application No. 62/894,523, filed Aug. 30, 2019, all of which are incorporated by reference herein in their entirety. This application claims the benefit of U.S. provisional patent application Ser. No. 63/292,708, filed on Dec. 22, 2021, all of which is incorporated by reference as if completely written herein. This application is related to U.S. patent application Ser. No. 17/547,519 filed Dec. 20, 2021, which is a continuation of U.S. patent application Ser. No. 17/006,561, filed Aug. 28, 2020, which claims the benefit of U.S. Provisional Application No. 62/894,523, filed Aug. 30, 2019, all of which are incorporated by reference herein in their entireties.

FIELD

This disclosure relates to golf clubs. More specifically, this disclosure relates to golf club alignment.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

Golf club alignment features, such as golf club head toplines, are currently painted in an imprecise manner. To paint an alignment feature on a golf club head, workers manufacturing the golf club head typically apply masking stickers that provide for a guide in painting the alignment feature. However, masking stickers and other guides are not easily affixed or aligned on the golf club head consistently. Because the location of the masking stickers ultimately determines the alignment feature shape and angle, the current manufacturing methods lead to variability between golf club heads manufactured to the same specifications, and consequently, variability in the performance of the product.

SUMMARY

Aspects of the invention are directed to golf club heads including a body having a face, a crown and a sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color with the shade or color of the face.

In some embodiments the golf club head includes a body having a face, a sole and a crown, the crown having a first portion having a first color or shade and a second portion having a second color or shade, the face crown and sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color and the area of shade or color of the face, and the club head also includes a secondary alignment feature including a paint or masking line which delineates the transition between the first portion of the crown having an area of contrasting shade or color with the shade or color of the face; and a second portion of the crown having an area of contrasting shade or color with the shade or color of the first portion, the secondary alignment feature comprising a first elongate side having a length of from about 0.5 inches to about 1.7 inches, and a second and third elongate side extending back from the face and rearward from and at an angle to the first elongate side.

In some embodiments the golf club heads have a body having a face, a crown and a sole together defining an interior cavity, the golf club body also includes a heel and a toe portion and a portion of the crown comprises an electronic display, wherein the electronic display includes an organic light-emitting diode (OLED) display for providing active color and wherein the OLED display is divided into independently operating electronic display zones.

In some embodiments the golf club heads have a body having a face, a crown and a sole together defining an interior cavity, the golf club body also includes a heel and a toe portion and a portion of the crown or a layer covering at least a portion of the crown of the golf club head is covered by a dielectric coating system.

In some embodiments, a golf club head is provided with a golf club body. The golf club body has a face, a crown and a sole, together defining an interior cavity. The golf club body also includes a heel and a toe portion, and has an x, y and z axes which are orthogonal to each other having their origin at USGA center face. At least one of the sole, crown, or face may be at least in part a composite material. The golf club head further has a primary alignment feature comprising a paint or masking line which delineates a transition between at least a first portion of the crown having an area of contrasting shade or color with a shade or color of the face and a $CG_x$ of 0 to about −4 mm. The primary alignment feature has a Sight Adjusted Perceived Face Angle (SAPFA) of from about −2 to about 10 degrees, a Sight Adjusted Perceived Face Angle 25 mm Heelward (SAPFA25H) of from about −5 to about 2 degrees, a Sight Adjusted Perceived Face Angle 25 mm Toeward (SAPFA25T) of from 0 to about 9 degrees, a Sight Adjusted Perceived Face Angle 50 mm Toeward (SAPFA50T) of from about 2 to about 9 degrees, and a Radius of Curvature (circle fit) of from about 300 to about 1000 mm.

In some embodiments, score lines are provided in a location on the face corresponding to center of gravity at the negative location with respect to the x-axis.

In some embodiments, a toe side roll contour is more lofted than the center face roll contour, a heel side roll contour is less lofted than the center face roll contour, a crown side bulge contour is more open than the center face bulge contour, and a sole side bulge contour is more closed than the center face bulge contour.

In some embodiments, the golf club body has a discretionary mass on the sole positioned at an angle with respect to the striking face, the discretionary mass positioned toeward along the negative x-axis and rearward along the positive y-axis.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIG. 46 is a front view of the club head.

FIG. 47 is toe-side view of a front portion of the club head.

FIG. 48 is a toe-side view of the entire club head.

FIG. 49 is a heel-side view of the club head.

FIG. 50 is a rear view of the club head.

FIG. 51 is a bottom view of the club head.

FIG. 52 shows the hosel region of the club head from the heel side.

FIG. 53 shows the hosel region of the club head from the front.

FIG. 54 is a cross-section view showing a toe portion of the club head from the heel side.

FIG. 55 is a cross-section view showing a heel portion of the club head from the toe side.

FIG. 56 is a top view of the club head.

FIG. 57 is a top view of the club head with the crown panel removed.

FIG. 58 is a heel-side view of the club head with the crown and sole panels removed.

FIG. 59 is a toe-side view of the club head with the crown and sole panels removed.

FIG. 60 is a rear view of the club head with the crown and sole panels removed.

FIG. 61 is a front view of the club head with the crown panel removed.

FIG. 62 is a cross-sectional view of an upper-front portion of the club head.

FIG. 63 is a cross-section view of an upper-front portion of the body of the club head.

FIG. 64 shows a toe-side portion of the club head with the crown panel removed.

FIG. 65 shows a heel-side portion of the club head with the crown panel removed.

FIG. 66 shows an upper-front-toe portion of the body of the club head.

FIG. 67 shows a front-heel portion of the body of the club head.

FIG. 104 is a partial cross-sectional view of an embodiment of the face.

FIG. 105 is a partial cross-sectional view of an embodiment of the face.

FIG. 106 is a top view of the club head.

FIG. 107 is a front view of the club head.

FIG. 108 is a top view of the club head.

DETAILED DESCRIPTION

Figure 1A:
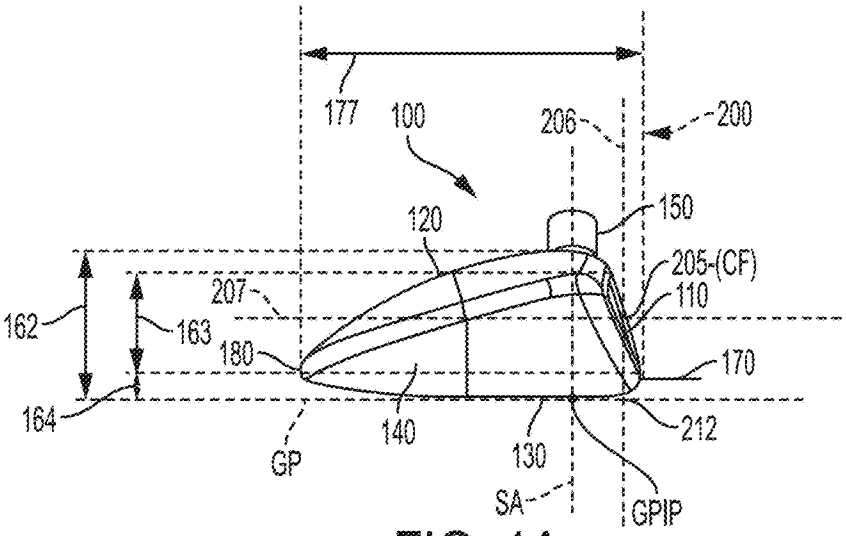
FIG. 1A is a toe side view of a golf club head in accord with one embodiment of the current disclosure.

Disclosed are various golf clubs as well as golf club heads including alignment features along with associated methods, systems, devices, and various apparatus. It would be understood by one of skill in the art that the disclosed golf clubs and golf club heads are described in but a few exemplary embodiments among many. No particular terminology or description should be considered limiting on the disclosure or the scope of any claims issuing therefrom.

The sport of golf is fraught with many challenges. Enjoyment of the game is increased by addressing the need to hit the golf ball further, straighter, and with more skill. As one progresses in golfing ability, the ability to compete at golf becomes a source of enjoyment. However, one does not simply hit a golf ball straighter or further by mere desire. Like most things, skill is increased with practice—be it repetition or instruction—so that certain elements of the game become easier over time. But it may also be possible to improve one's level of play through technology.

Much technological progress in the past several decades of golf club design has emphasized the ability to hit the golf ball further. Some of these developments include increased coefficient of restitution (COR), larger golf club heads, lighter golf club heads, graphite shafts for faster club speed, and center of gravity manipulation to improve spin characteristics, among others. Other developments have addressed a golfer's variability from shot-to-shot, including larger golf club heads, higher moment of inertia (MOI), variable face thickness to increase COR for off-center shots, and more. Still further developments address a golfer's consistent miss-hits—of which the most common miss-hit is a slice—including flight control technology (FCT), such as loft and lie connection sleeves to adjust, inter alia, face angle), moveable weights, sliding weight technologies, and adjustable sole pieces (ASP). Such technologies aid golfers in fixing a consistent miss, such that a particular error can be addressed.

As such, modern technology has done much to improve the golfer's experience and to tailor the golf club to the needs of the particular player. However, some methods are more effective than others at achieving the desired playing results. For example, research suggests that—for a drive of about 280 yards—a 1° difference in face angle at impact may account for about 16 yards of lateral dispersion in the resultant shot. Similarly, for moveable weights, changes in balance of weight by 12 grams moving for about 50 mm may result in about 15 yards of lateral dispersion on the resultant shot. However, it is also understood that a change in lie angle of the golf club head affects the face angle, but at a much smaller degree. As such, simply by increasing lie angle by 1°, the face angle alignment of the golf club head may be adjusted by 0.1° open or closed. As such, for better players who are simply trying to tune their ball flight, adjusting lie angle may be much more finely tunable than adjusting face angle. However, for many golfers, slicing (a rightward-curving shot for a right-handed golfer, as understood in the art) is the primary miss, and correction of such shot is paramount to enjoyment of the game.

One of the major challenges in the game of golf involves the difference between perception and reality. Golf includes psychological challenges—as the player's confidence wanes, his or her ability to perform particular shots often wanes as well. Similarly, a player's perception of his or her own swing or game may be drastically different from the reality. Some technology may address the player's perception and help aid in understanding the misconceptions. For example, technology disclosed in U.S. Pat. No. 8,771,095 to Beach, et. al, entitled "CONTRAST-ENHANCED GOLF CLUB HEADS," filed Mar. 18, 2011, provides a player with a clearer understanding of his or her alignment than some of the preexisting art at the time, which may improve that player's ability to repeat his or her shots. However, it may be more helpful to provide those players a method to address the misconceptions and provide correction for them.

We have now surprisingly found that alignment features that includes all or a portion of the interface region between the areas of contrasting shade or color on the crown of the club head and the face of the club head and/or all or a portion of the interface region between areas of contrasting shade or color on different portions on the crown of the club head allows for improved performance in the resulting clubs by accounting for not only the actual alignment of the club head by the golfer during the shot but also as modified by the perceived alignment of the club head by the golfer. One example of a combination of contrasting colors or shades would be for example a black or metallic grey or silver color contrasting with white, but also included are other combinations which provide at a minimum a "just noticeable difference" to the human eye.

Figure 11:
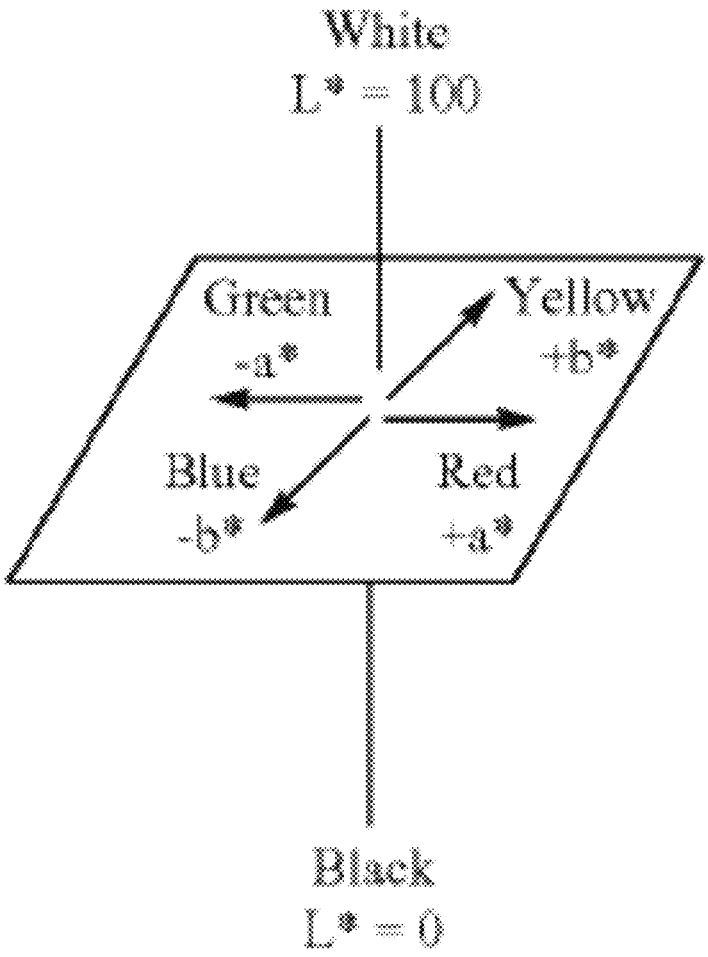
FIG. 11 is a reference to the CIELAB color system.

Although a "just noticeable difference" in terms of colors of a golf club head is to a degree somewhat subjective based on an individual's visual acuity, it can be quantified with reference to the CIELAB color system, a three dimensional system which defines a color space with respect to three channels or scales, one scale or axis for Luminance (lightness) (L) an "a" axis which extends from green (−a) to red (+a) and a "b" axis from blue (−b) to yellow (+b). This three dimensional axis is illustrated in FIG. 11.

A color difference between two colors can then be quantified using the following formula;

$$\Delta E^*_{ab}=\sqrt{(L^*_2-L^*_1)^2+(a^*_2-a^*_1)^2+(b^*_2-b^*_1)^2}$$

where ($L^*_1$, $a^*_1$ and $b^*_1$) and ($L^*_2$, $a^*_2$ and $b^*_2$) represents two colors in the L,a,b space and where $\Delta E^*_{ab}=2.3$ sets the threshold for the "just noticeable difference" under illuminant conditions using the reference illuminant D65 (similar to outside day lighting) as described in CIE 15.2-1986.

Thus, for the alignment features of the golf clubs of the present invention, a contrasting color difference, $\Delta E^*_{ab}$, is greater than 2.3, preferably greater than 10, more preferably greater than 20, even more preferably greater than 40 and even more preferably greater than 60.

For general reference, a golf club head 100 is seen with reference to FIGS. 1A-1D. One embodiment of a golf club head 100 is disclosed and described with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

The metal wood club head 100 has a volume, typically measured in cubic-centimeters ($cm^3$), equal to the volumetric displacement of the club head 100, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 130 $cm^3$ and about 280 $cm^3$, or between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$, between about 390 $cm^3$ and about 500 $cm^3$, or between about 420 $cm^3$ and about 500 $cm^3$. In some embodiments, the head volume is between about 370 $cm^3$ and about 500 $cm^3$.

In the case of a driver, the golf club head has a volume between approximately 300 $cm^3$ and approximately 460 $cm^3$, and a total mass between approximately 145 g and approximately 245 g. In the case of a fairway wood, the golf club head 10 has a volume between approximately 100 $cm^3$ and approximately 250 $cm^3$, and a total mass between approximately 145 g and approximately 260 g. In the case of a utility or hybrid club the golf club head 10 has a volume between approximately 60 $cm^3$ and approximately 150 $cm^3$, and a total mass between approximately 145 g and approximately 280 g.

A three dimensional reference coordinate system 200 is shown. An origin 205, also referred to as face center and/or center face, (CF) of the coordinate system 200 is located at the center of the face (CF) of the golf club head 100. See U.S.G.A. "Procedure for Measuring the Flexibility of a Golf Clubhead," Revision 2.0, Mar. 25, 2005, for the methodology to measure the center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The x-axis 208 is tangential to the face 110 and parallel to a ground plane (GP). The golf club head 100 includes a leading edge 170 and a trailing edge 180. For the purposes of this disclosure, the leading edge 170 is defined by a curve, the curve being defined by a series of forward most points, each forward most point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1B:
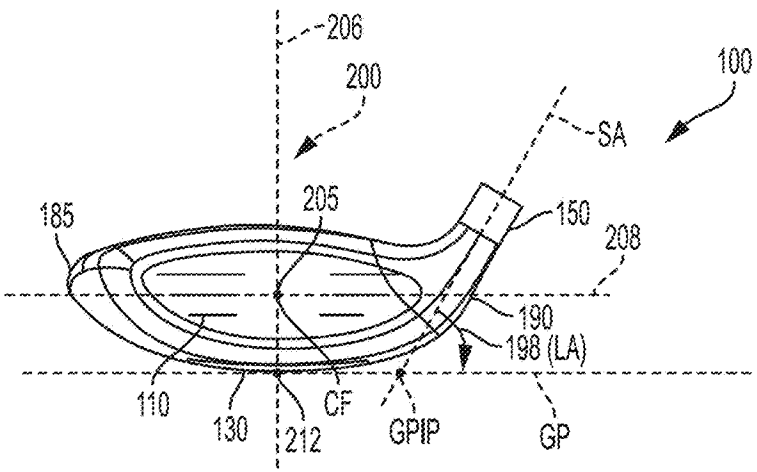
FIG. 1B is a face side view of the golf club head of FIG. 1A.
Figure 1C:
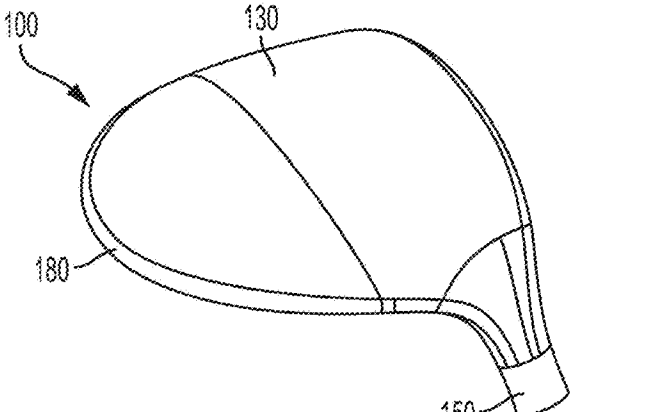
FIG. 1C is a perspective view of the golf club head of FIG. 1A.
Figure 1D:
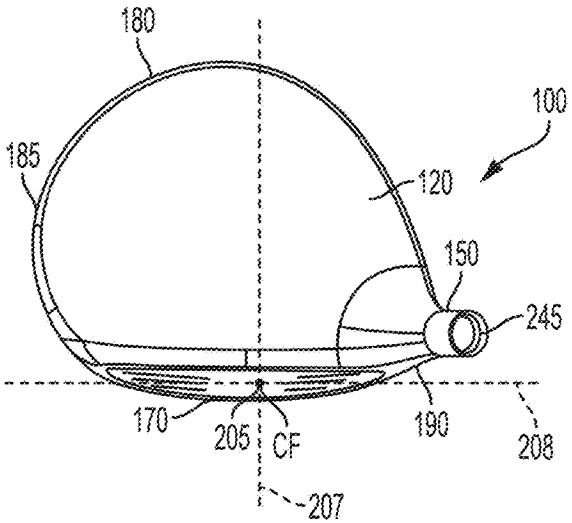
FIG. 1D is a top view of the golf club head of FIG. 1A.

As seen with reference to FIG. 1B, the x-axis 208 is parallel to the GP onto which the golf club head 100 may be properly soled—arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 (LA) is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

Figure 2:
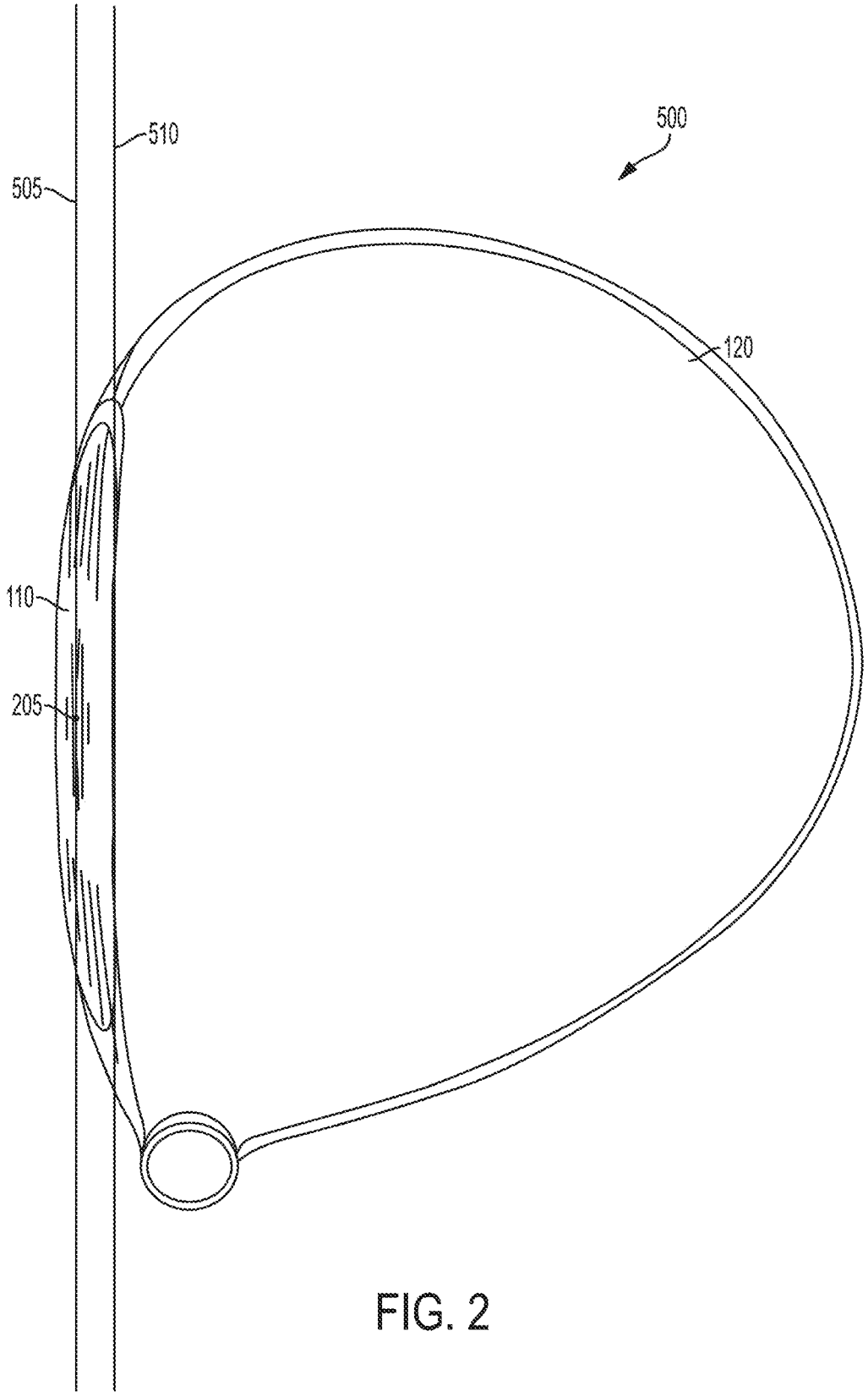
FIG. 2 is a top view of a golf club head in accord with one embodiment of the current disclosure.

As seen with reference to FIG. 2, a golf club head 500 includes a painted crown 120 and unpainted face 110. Painted or otherwise contrast-enabled crowns have been utilized as described in U.S. Pat. No. 8,771,095 to Beach, et. al, entitled "CONTRAST-ENHANCED GOLF CLUB HEADS," filed Mar. 18, 2011, to provide golfers with aided alignment. Typically the golfer employs the crown to face transition or top-line to align the club with the desired direction of the target line. The top-line transition is clearly delineated by a masking line between the painted crown and the unpainted face. While such features may have been described to some degree, use of the features to bias alignment has not been conceived in the art. With the golf club head 500 of the current embodiment, one of skill in the art would understand that the high-contrast described in U.S. Pat. No. 8,771,095 to Beach, et. al. entitled "CONTRAST-ENHANCED GOLF CLUB HEADS," filed Mar. 18, 2011, may be beneficial for emphasizing various alignment features. As such, the disclosure is incorporated by reference herein in its entirety.

For reference, a face angle tangent 505 is seen in FIG. 2. The face angle tangent 505 indicates a tangent line to the center face 205. The face angle tangent 505 in the current embodiment is coincident with the x-axis 206 (as seen with reference to prior FIGS.). Also seen in FIG. 2 is a top tangent 510. In the current embodiment, the top tangent 510 is a line made tangent to a top of the face 110 because, in the current embodiment, a joint between the face 110 and the crown 120 is coincident with paint lines. The top tangent 510 in the several embodiments of the current disclosure will follow the contours of various paint lines of the crown 120, and one of skill in the art would understand that the top tangent 510 need not necessarily be coincident with a tangent to the face 110. However, in the current embodiment, the top tangent 510 is parallel to the face angle tangent 505. As such, the paint of the crown 120 can be described as appearing square with the face angle.

The purpose of highlighting such features of the golf club head 500 is to provide a basis for the discussion of alignment with respect to the current disclosure. Through variations in alignment patterns, it may be possible to influence the golfer such that the golfer alters his or her play because of the appearance of misalignment. If a player perceives that the golf club head is such that the face is open with reference to the intended target, he or she would be more likely to try to "square up" the face by manually closing it. Many golfers prefer not to perceive a metal wood golf club head as appearing closed, as such an appearance is difficult to correct. However, even if such a player were to perceive the metal wood head as being closed, such perception does not mean that the golf club head is aligned in a closed position relative to the intended target.

Figure 3:
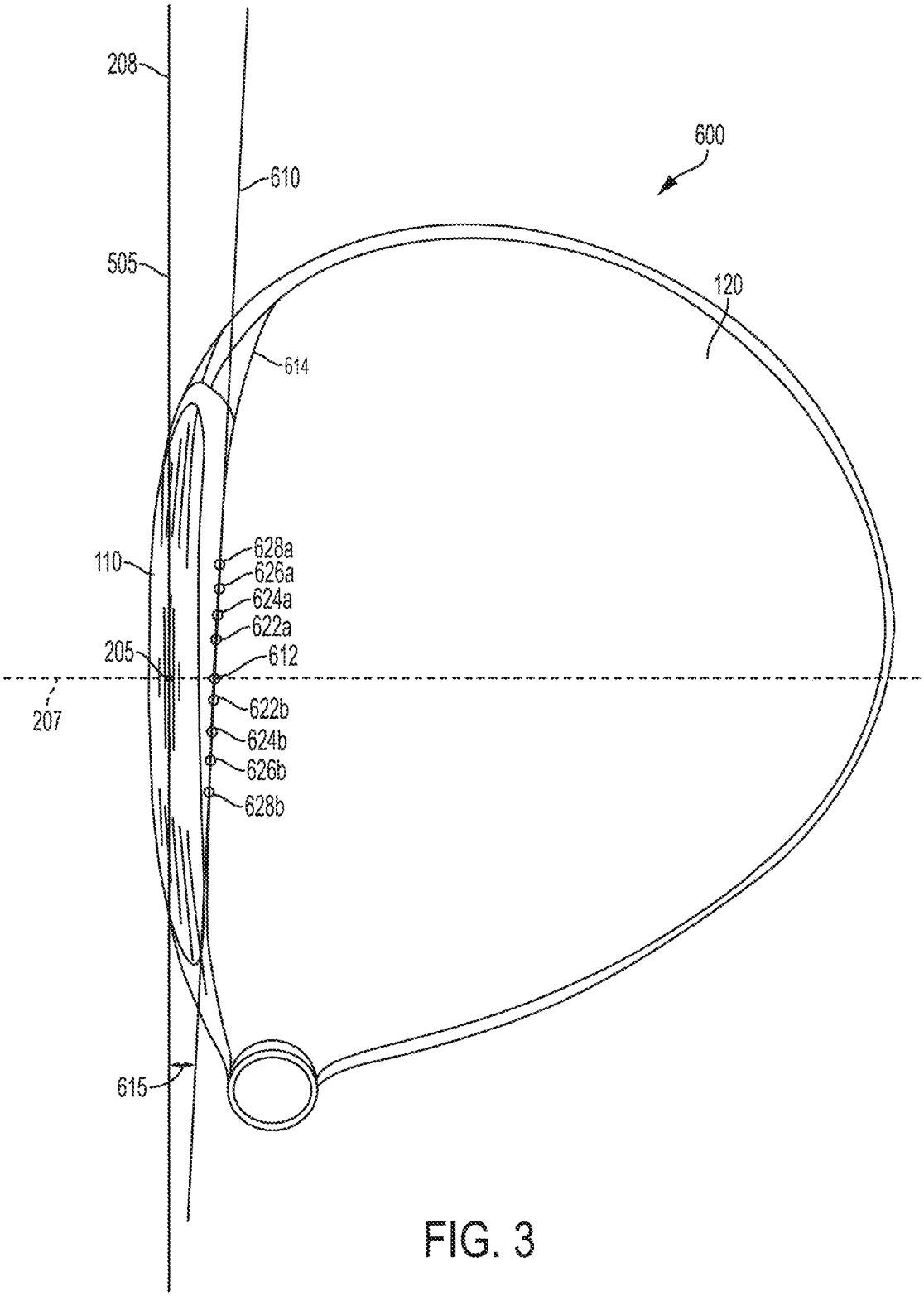
FIG. 3 is a top view of a golf club head in accord with one embodiment of the current disclosure.

As seen with reference to FIG. 3, a golf club head 600 includes similar head geometries to golf club head 500. However, the golf club head 600 includes a feature to alter the perceived angle of the face 110 for the user. In the current embodiment, a top tangent 610 that is aligned at an angle 615 with respect to the face angle tangent 505 such that the perceived angle of the face (Perceived Face Angle, PFA) is different from the actual alignment of the face angle tangent 505. In the current embodiment, the angle 615 is about 4°. In various embodiments, the angle 615 may be 2°-6°. In various embodiments, the angle 615 may be less than 7°. In various embodiments, the angle 615 may be 5-10°. In various embodiments, the angle 615 may be less than 12°. In various embodiments, the angle 615 may be up to 15°. As indicated with respect to top tangent 510, the top tangent 610 is an indicator of the alignment of an edge of an area of contrasting paint or shading of the crown 120 delineated by a masking line between the painted crown and the unpainted face relative to the color or shading of the face 110 and is the line that is tangent to an edge 614 of the contrasting crown paint or crown shading at a point 612 where the edge 614 intersects a line parallel to the y-axis 207.

In various embodiments, a perceived angle may be determined by finding a linear best-fit line of various points. For such approximation, a perceived angle tangent may be determined by best fitting points on the edge 614 at coordinates of the x-axis 208 that are coincident with center face 205—point 612—and at points ±5 mm of CF 205 (points 622*a,b*), at points ±10 mm of CF 205 (points 624*a,b*), at points ±15 mm of CF 205 (points 626*a,b*), and at points ±20 mm of CF 205 (points 628*a,b*). As such, nine points are defined along the edge 614 for best fit of the top tangent 610. In the current embodiment, the perceived angle tangent is the same as the top tangent 610.

However, such method for determining the perceived angle tangent may be most useful in cases where the edge 614 of an area of contrasting paint or shading of the crown 120 relative to the color or shading of the face 110 includes different radii of relief along the toe portion and the heel portion. In such an embodiment, a line that is tangent to the edge 614 at point 612 may not adequately represent the appearance of the alignment of the golf club head 600. Such an example can be seen with reference to FIG. 4.

Figure 4:
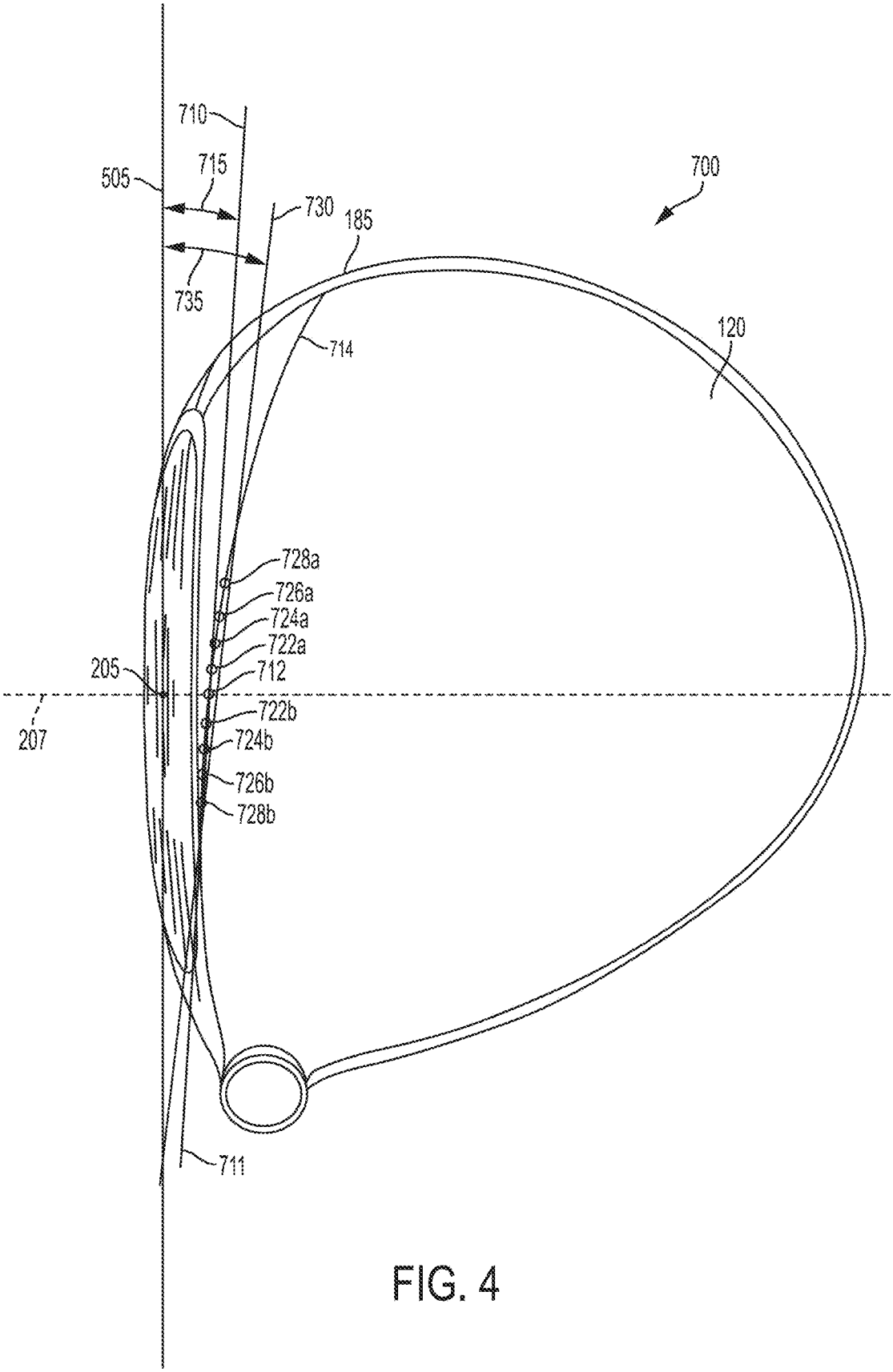
FIG. 4 is a top view of a golf club head in accord with one embodiment of the current disclosure.

As seen in FIG. 4, a golf club head 700 includes an edge 714 of an area of contrasting paint or shading of the crown 120 relative to the color or shading of the face 110 that is more aggressively rounded proximate the toe 185 than prior embodiments. As such, a line 711 that is literally tangent to the edge 714 at a point 712 that is coincident with the y-axis 207 may not adequately describe the perception. Such a line would be the top tangent 710. However as noted previously with reference to golf club head 600, points 712, 722*a,b*, 724*a,b*, 726*a,b*, and 728*a,b*, can be used to form a best fit line 730 that is aligned at a perceived angle 735 that is greater than an angle 715 of the top tangent 710. In various embodiments, the perceived angle 735 may be within the increments of angle 615, above, or may be up to 20° in various embodiments. In most embodiments, the perceived angle 735 may be 8-10°. In various embodiments, the perceived angle 735 may be 9-10°. In various embodiments, the perceived angle 735 may be 7-11®. In various embodiments, the perceived angle 735 may be 7-8.5°. In various embodiments, alignment may be influenced by the inclusion of an alignment feature that does not invoke an edge such as edges 614, 714. As seen with reference to FIG. 5, various embodiments of alignment features may be suggestive of the face angle and, as such, provide an appearance of alignment to the golfer without modifying paint lines.

Figure 5:
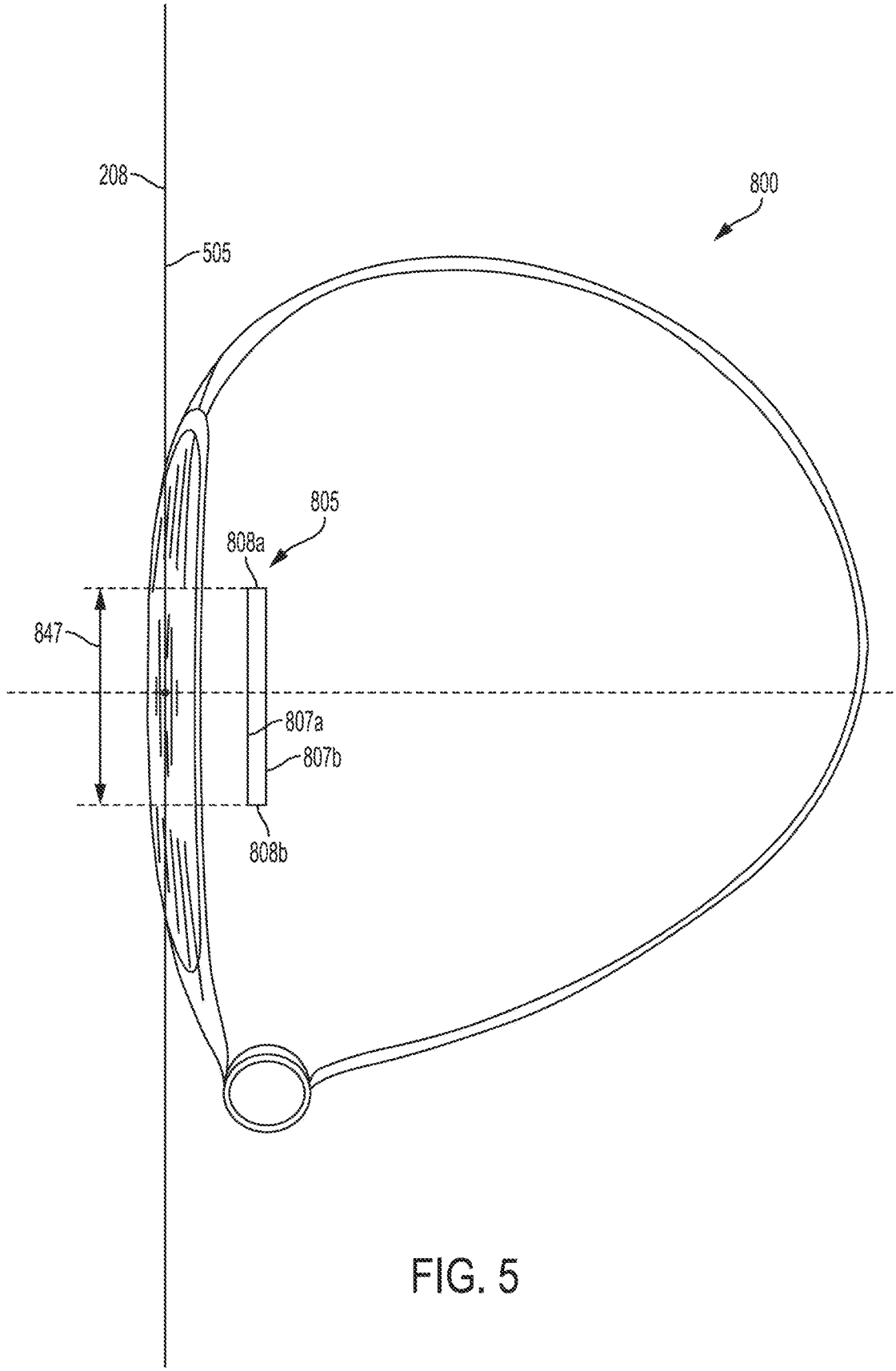
FIG. 5 is a top view of a golf club head in accord with one embodiment of the current disclosure.

A golf club head 800, as seen in FIG. 5, includes an alignment feature 805. The alignment feature 805 of the current embodiment includes at least one elongate side 807—and in the current embodiment, two elongate sides 807*a* and 807*b* are included. The alignment feature 805 of the current embodiment also includes two additional sides 808*a* and 808*b*. As can be seen, the alignment feature 805 is arranged such that the at least one elongate side 807 is aligned about parallel to the x-axis. As such, a golfer is able to use the alignment feature 805 by aligning the direction of the elongate side 807 in an orientation that is about perpendicular to the intended target. The alignment feature 805 has a length 847 as measured parallel to the x-axis 208. In the current embodiment, the length 847 is about the same as the diameter of a golf ball, or about 1.7 inches. However, in various embodiments, the length 847 may be 0.5 inches, 0.75 inches, 1 inch, 1.25 inches, 1.5 inches, 1.75 inches, 2 inches, 2.25 inches, 2.5 inches, or various lengths therein. If the length 847 of the dominant elongate side 807*a* or 807*b* is less than about 0.3 inches, the impact of the alignment feature 805 on biasing the golfer's perception decreases substantially.

However, with sufficient use, the alignment feature 805 can become the primary focus of the golfer's attention and, as such, modifications to the arrangement of the alignment feature 805 with respect to the x-axis 208 (which is coincident with the face angle tangent 505) may allow the golfer to bias his or her shots and thereby modify his or her outcome.

Figure 6:
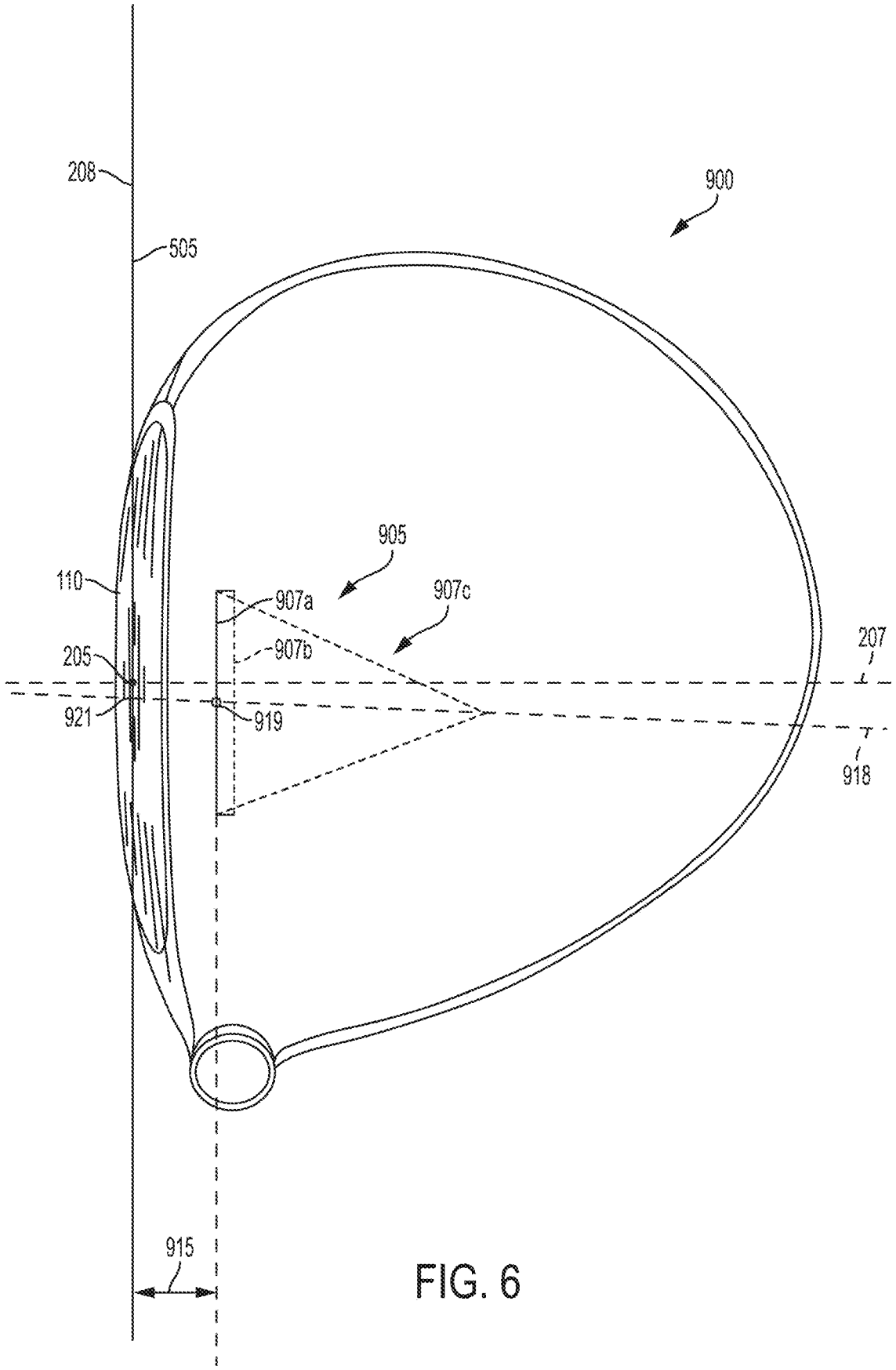
FIG. 6 is a top view of a golf club head in accord with one embodiment of the current disclosure.

As seen with reference to FIG. 6, a golf club head 900 includes an alignment feature 905. The alignment feature 905 of the current embodiment includes one elongate side 907*a* on a side of the alignment feature 905 that is proximate the face 110. The alignment feature 905 includes several potential rear portions. Similar to golf club head 800, golf club head 900 includes the alignment feature 905 having a potential second elongate side 907*b* in one embodiment. In another embodiment, an extended rear portion 907*c* may also be included or may be included separately from elongate side 907*b*. In the current embodiment, the elongate side 907*b* is oriented at an angle 915 with respect to the face angle tangent 505.

For the embodiment including second elongate side 907*b*, the second elongate side 907*b* is about parallel to the elongate side 907*a*. As such, the embodiment is similar to golf club head 800 but is oriented at angle 915. With respect to extended rear portion 907*c*, the orientation of such an embodiment may appear less askew and, consequently, may be more effective at modifying the golfer's perception of the club's alignment. A perpendicular reference line 918 is seen as a reference for being orthogonal to the elongate side 907*a*. The perpendicular reference line 918 intersects the elongate side 907*a* at a point 919 that bisects the elongate side 907*a*. Further, the perpendicular reference line 918 intersects the x-axis 208 at an intersection point 921 that is heelward of the center face 205. In the current embodiment, the intersection point 921 is heelward of center face 205 by about 2 mm. In various embodiments, the intersection point 921 may be about the same as center face 205. In various embodiments, the intersection point 921 may be up to 2 mm heelward of center face 205. In various embodiments, the intersection point 921 may be up to 5 mm heelward of center face 205. In various embodiments, the intersection point 921 may be somewhat toeward of center face 205. In various embodiments, the intersection point 921 may be ±2 mm of the center face 205.

Figure 7:
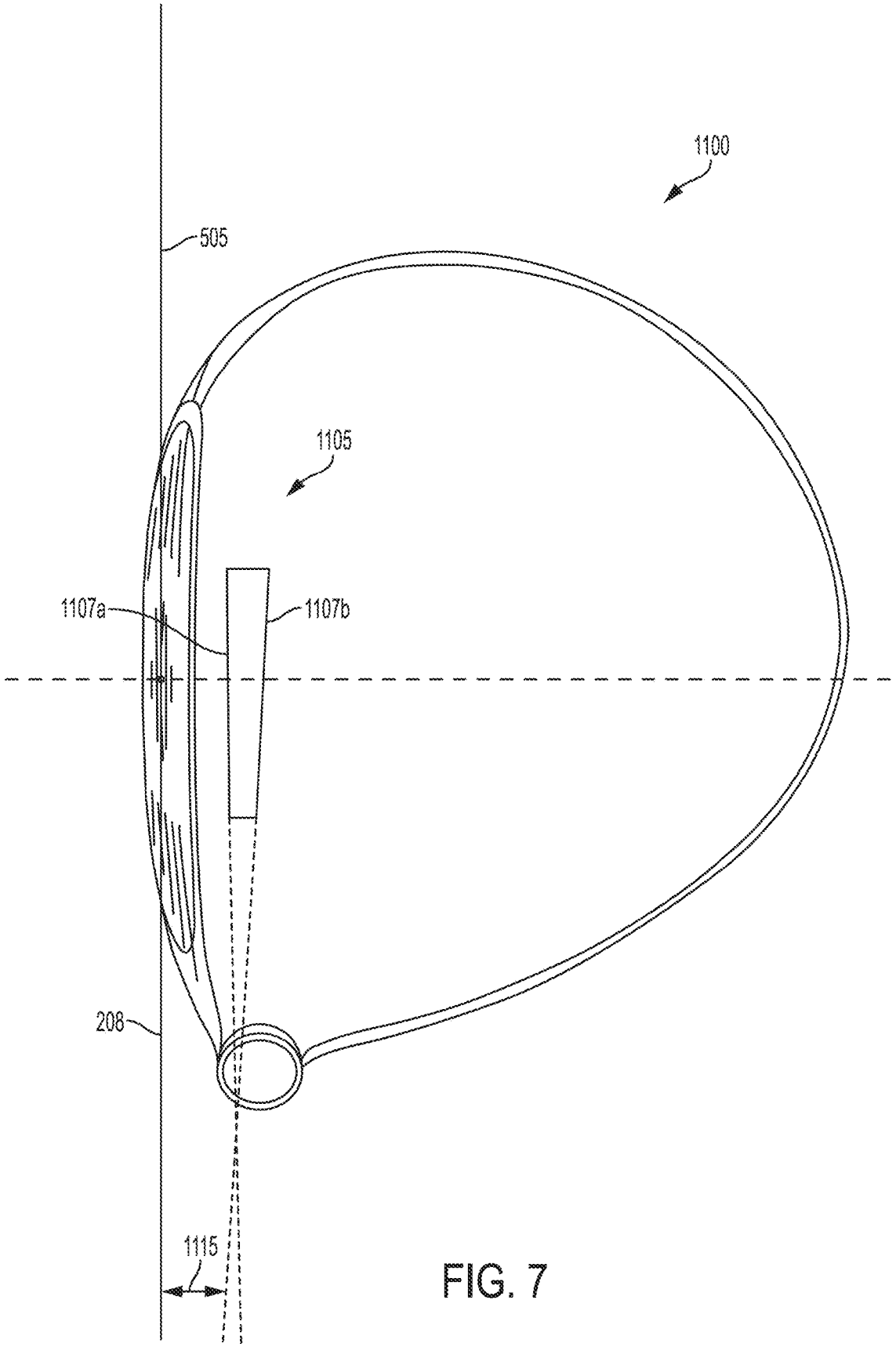
FIG. 7 is a top view of a golf club head in accord with one embodiment of the current disclosure.

Another embodiment of a golf club head 1100, shown in FIG. 7, includes an alignment feature 1105. The alignment feature has a first elongate side 1107*a* and a second elongate side 1107*b*. In the current embodiment, however, the first elongate side 1107*a* is about parallel with the face angle tangent 505 and the x-axis 208. However, the second elongate side 1107*b* is oriented at an angle 1115 with respect to the face angle tangent 505 such that the golfer's perception of alignment may be altered.

A preferred method for measuring the perceived face angle observed by a golfer further takes into account the fact that most golfers have a dominant left eye and when they address the ball with the club head, a direct line between the left eye and center face would actually cross the topline heel ward of center face and thus this is where an alignment feature which includes an edge of an area of contrasting paint or shading of the crown 120 relative to the color or shading of the face 110 would exert the most effect on the golfer's perception of the face angle. This perceived face angle is thus called a Sight Adjusted Perceived Face Angle (SAPFA) and is measured using the apparatus shown in FIGS. 8A-8C.

Figure 8B:
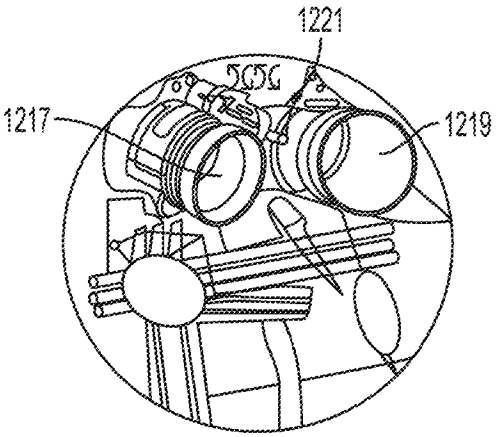
FIG. 8B is a close up view of the arrangement of the laser and cameras in the apparatus used for measuring a Sight Adjusted Perceived Face Angle in accordance with the current disclosure.
Figure 8A:
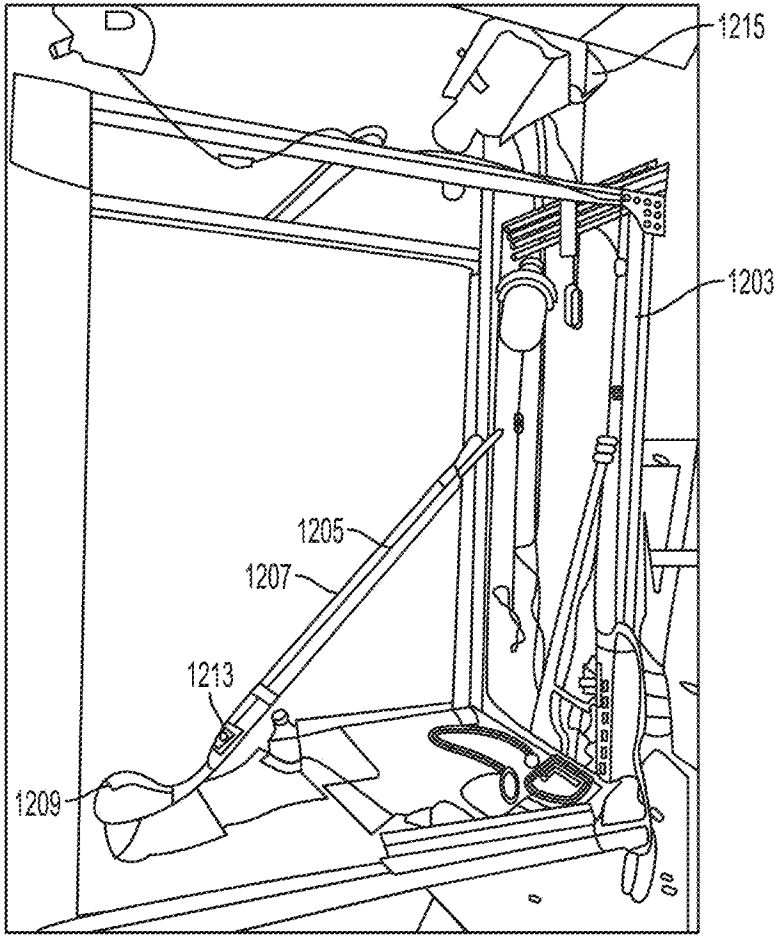
FIG. 8A is a front view of the apparatus used for measuring a Sight Adjusted Perceived Face Angle in accordance with the current disclosure.
Figure 8C:
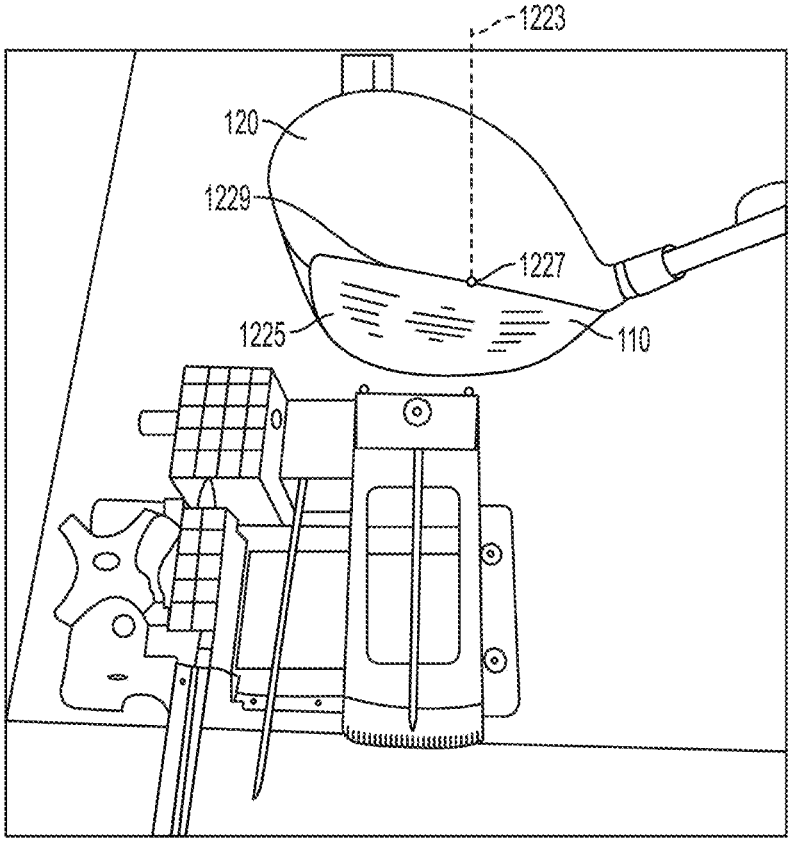
FIG. 8C is a side view of a golf club head fixture in an 69apparatus used for measuring a Sight Adjusted Perceived Face Angle in accordance with the current disclosure.

The apparatus used is shown in FIGS. 8A, 8B and 8C and includes a frame 1203 which holds a fixture 1205 for holding and aligning a golf club shaft 1207 and attached golf club head 1209 at a Lie Angle of 45°. The face of the golf club head 1209 is also set at a face angle of 0° using a face angle gauge 1211. The face angle gauge may be any commonly used in the industry such as a De la Cruz face angle gauge). After setting the loft and lie angle the club is clamped in the fixture using a screw clamp 1213. The frame 1203 also includes an attachment point 1215 for mounting two cameras 1217 and 1219 and a Calpac Laser CP-TIM-230-9-1L-635 (Fine/Precise Red Line Laser Diode Module Class II: 1 mW/635 nm), 1221. The center of the lens of camera 1219 is situated at the x, y and z coordinates (namely 766 mm, 149 mm, 1411 mm) using the previously defined x y and z axes with USGA center face (as measured using the procedure in U.S.G.A. "Procedure for Measuring the Flexibility of a Golf Clubhead," Revision 2.0, Mar. 25, 2005, "USGA Center Face") as the origin, and where a positive x coordinate represents a position heel ward of center face, a positive y coordinate represent a position rearward of center face and a positive z coordinate represents a position above center face. The laser is situated between the two cameras.

As shown in FIG. 8C the laser produces a line 1223 having an axis parallel to the camera axis and projecting along the y axis which is adjusted such that the line intersects USGA Center Face 1225. The point 1227 at which the line then intersects the edge of an area of contrasting paint or shading of the crown 120 relative to the color or shading of the face 110 which in this case corresponds to the white paint line of the crown 1229 is then physically marked on the paint line using a marker and acts as the datum or reference point. A camera is then activated to take an image of the club head including the datum or reference point 1227 and the paint line 1229.

The image from the camera is then analyzed using an image analyzer software package (which can be any of these known in the art able to import an image and can fit a line to the image using a curve fitting function). A best fit line to the paint line is then determined. For most embodiments the best fit to the paint line results from fitting the line to a quadratic equation of the form $y=ax^2+bx+c$. Two points are then selected on this best fit line at arc length between +/−0.25 mm from the datum point. A straight line is then drawn between the two points and a line perpendicular to this line is then drawn through the datum. The Sight Adjusted Perceived Face Angle (SAPFA) is then measured as the angle between the perpendicular line and the y axis.

Using this method the Sight Adjusted Perceived Face Angle (SAPFA) of the golf clubs of the present invention may be from −2 to 10, preferably from 0 to 6, more preferably from 0.5 to 4 even more preferably from 1 to 2.5 and most preferably from 1.5 to 2 degrees.

EXAMPLES

Four identical club heads were taken and the paint line edge of an area of contrasting paint or shading of the crown 120 relative to the color or shading of the face 110 was varied and the Sight Adjusted Perceived Face Angles (SAPFA) measured.

In addition to the Sight Adjusted Perceived Face Angles (SAPFA) four additional measurements were taken to describe the paint line edge alignment feature of the four clubs and these values are summarized in Table 1.

In addition to the SAPFA, three additional angles were measured at different points as measured from the datum along the best fit line to the paint line edge alignment feature determined as for the SAPFA. The first angle was obtained at a point along the best fit line at an arc length 25 mm heelward of the datum. Again as for the SAPFA measurement, two points at arc length between +/−0.25 mm from the 25 mm point were selected. A straight line is then drawn between these two points and a line perpendicular to this line is then drawn at the 25 mm point. The angle is then measured between this perpendicular line and the y axis.

This angle is reported as the Sight Adjusted Perceived Face Angle 25 mm Heelward ("$SAPFA_{25H}$").

The second angle was obtained at a point along the best fit line at an arc length 25 mm toeward of the datum. Again as for the SAPFA measurement, two points at arc length between +/−0.25 mm from the 25 mm point were selected. A straight line is then drawn between the two points and a line perpendicular to this line is then drawn at the 25 mm point. The angle is then measured between this perpendicular line and the y axis. This angle is reported as the Sight Adjusted Perceived Face Angle 25 mm Toeward ("$SAPFA_{25T}$").

In addition, to capture any effect of greater rounding of the paint line edge alignment feature towards the toe of the golf club head, a third angle was obtained at a point along the best fit line at an arc length 50 mm toeward of the datum. Again as for the SAPFA measurement, two points at arc length between +/−0.25 mm from the 25 mm point were selected. A straight line is then drawn between the two points and a line perpendicular to this line is then drawn at the 50 mm point. The angle is then measured between this perpendicular line and the y axis. This angle is reported as the Sight Adjusted Perceived Face Angle 50 mm Toeward ("$SAPFA_{50T}$").

Finally, in an attempt to describe more of the paint line edge alignment feature, the image of the paint line edge alignment feature imported into the image analyzer as for the SAPFA measurement was also fit to a circle using the formula $(x-a)^2 (y-b)^2=r^2$, and the radius of curvature of this circular fit line determined and reported in Table 1 as the Radius of Curvature (circle fit).

TABLE 1

| Example No. | Sight Adjusted Perceived Face Angle (SAPFA) (degrees) | Radius of Curvature (circle fit, mm) | Angle 25 mm Heelward (degrees) | Angle 25 mm Toeward (degrees) | Angle 50 mm Toeward (degrees) |
|---|---|---|---|---|---|
| 1 | 3.5722 | 570.47 | 1.1377 | 5.9453 | 8.2757 |
| 2 | 5.2813 | 419.53 | 1.7509 | 8.6871 | 11.9168 |
| 3 | 0.2927 | 781.02 | −1.4461 | 2.0189 | 3.7129 |
| 4 | −0.5925 | 568.21 | −3.06 | 1.8533 | 4.245 |

Each club was then hit between 6 to 12 times by 10 different players into a blank screen with no trajectory or other feedback available to the player, and a Trackman 3e launch monitor and the TPS software package were used to calculate the total dispersion from a center target line with a positive total dispersion indicating the number of yards right of the center target line and a negative total dispersion indicating the number of yards left of the center target line. Thus, a player who has a tendency to slice the ball i.e. produce a ball flight right of the target line would be assisted in producing a shot closer to the target line if the golf club tended to yield a more negative dispersion.

Figure 9:
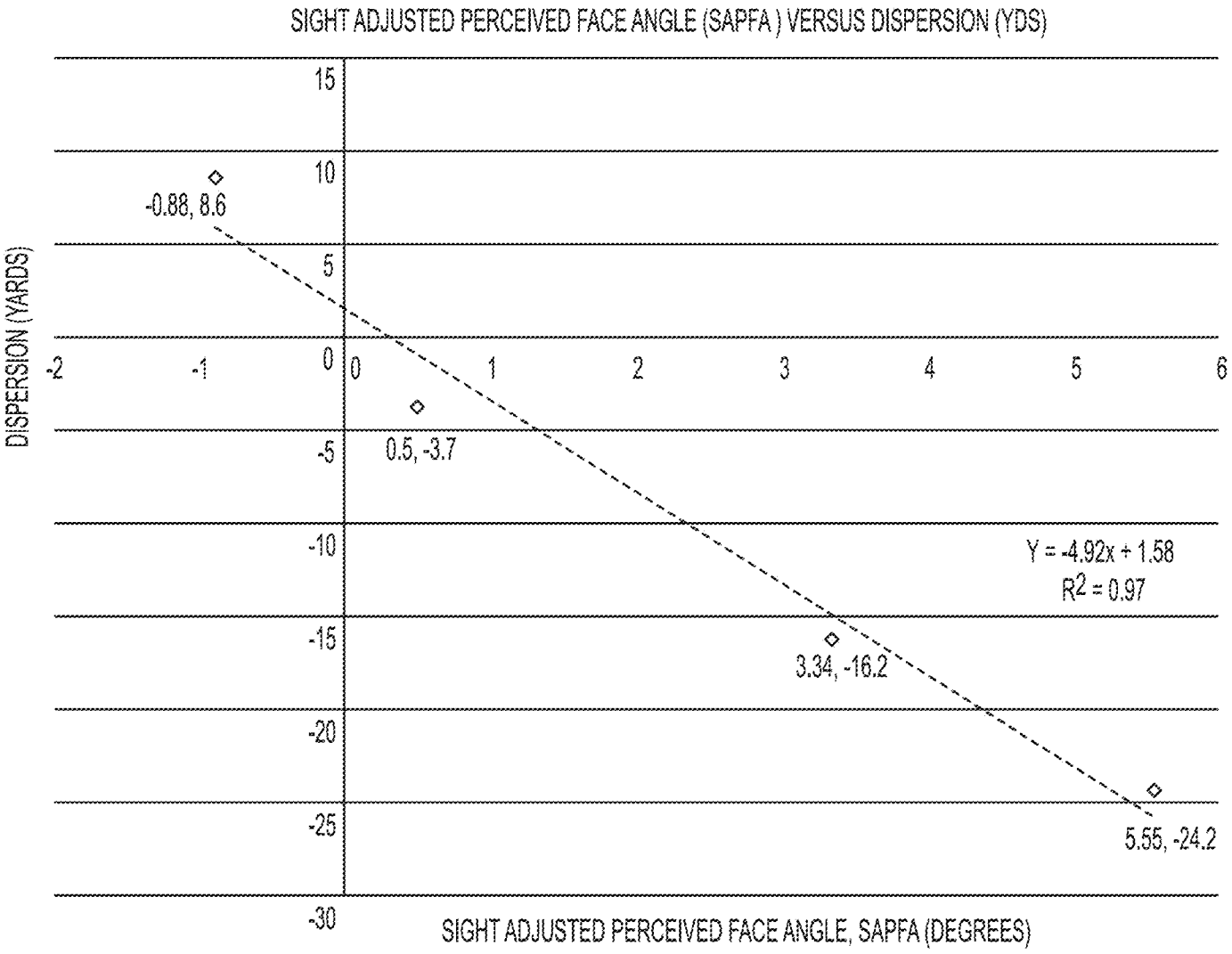
FIG. 9 is a graph of the Sight Adjusted Perceived Face Angle vs. the Dispersion in Ball Flight for four clubs having the alignment features in accordance with the current disclosure.

The graph in FIG. 9 plots the Sight Adjusted Perceived Face Angle (SAPFA) versus the average total dispersion of each club when hit 6-12 times by each player. The data show that adjustment of the edge of an area of contrasting paint or shading of the crown relative to the color or shading of the face such that the Sight Adjusted Perceived Face Angle (SAPFA) of the golf club goes from −0.88 degrees through 0.5 degrees through 3.34 degrees to 5.55 degrees results in an overall change in total dispersion from 8.6 yards to the right of the target line to 24.2 yards to the left of the target i.e. an absolute change in total dispersion of 32.8 yards from the same club head by solely manipulating the appearance of the paint line comprising the primary alignment feature.

The golf club heads of the present invention have a Sight Adjusted Perceived Face Angle (SAPFA) of from about −2 to about 10, preferably of from about 0 to about 6, more preferably of from about 0.5 to about 4 even more preferably of from about 1 to about 2.5 and most preferably of from about 1.5 to about 2 degrees.

The golf club heads of the present invention also have a Sight Adjusted Perceived Face Angle 25 mm Heelward ("$SAPFA_{25H}$") of from about −5 to about 2, more preferably of from about −3 to 0, even more preferably of from about −2 to about −1 degrees.

The golf club heads of the present invention also have a Sight Adjusted Perceived Face Angle 25 mm Toeward ("$SAPFA_{25T}$") of from 0 to about 9, more preferably of from about 1 to about 4.5, even more preferably of from about 2 to about 4 degrees.

The golf club heads of the present invention also have a Sight Adjusted Perceived Face Angle 50 mm Toeward ("$SAPFA_{50T}$") of from about 2 to about 9, more preferably of from about 3.5 to about 8, even more preferably of from about 4 to about 7 degrees.

The golf club heads of the present invention also have a Radius of Curvature (circle fit) of from about 300 to about 1000, more preferably of from about 400 to about 900, even more preferably of from about 500 to about 775 mm.

In other embodiments, the golf club head in addition to having a first or primary alignment feature as described earlier with reference to FIGS. 1-4, may also have a second or secondary alignment feature including the alignment features as described earlier with reference to FIGS. 5, 6 and 7.

Figure 10B:
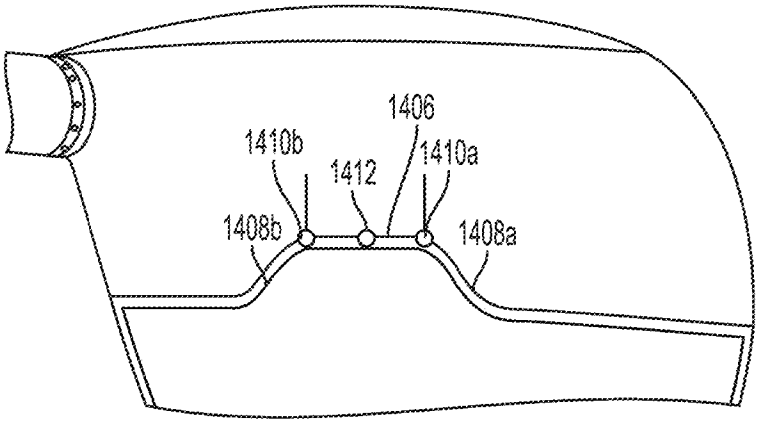
FIG. 10B is a top view of a golf club head in accord with one embodiment of the current disclosure.
Figure 10A:
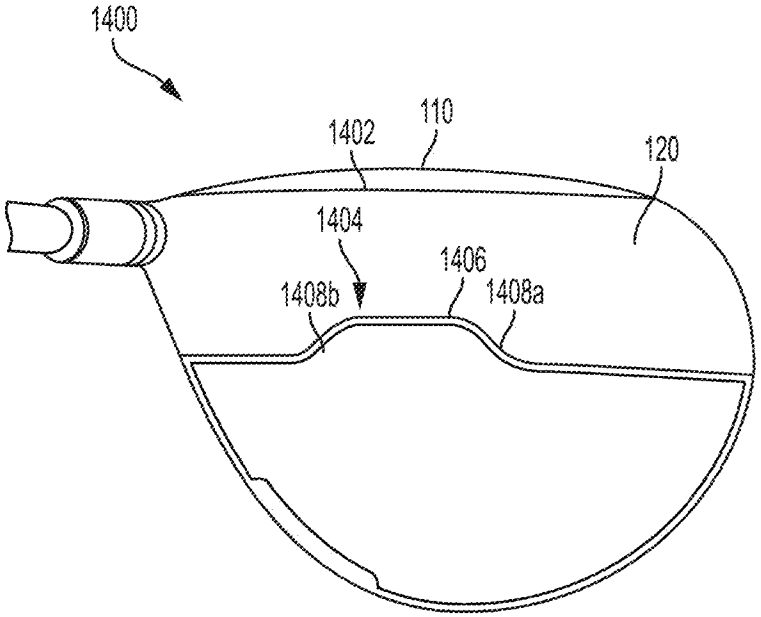
FIG. 10A is a top view of a golf club head in accord with one embodiment of the current disclosure.

In an embodiment shown in FIGS. 10A and 10B, the golf club head 1400 can have a crown having a first portion having a first surface characteristic including a first color, shade, texture, and/or visible surface feature and a second portion having a second surface characteristic including a second color, shade, texture, and/or visible surface feature, and a primary alignment feature consisting of a an edge 1402 of an area of contrasting surface characteristic of the first portion of the crown 120 relative to a surface characteristic of the face 110 as described earlier and illustrated in FIGS. 3 and 4. In a further embodiment a contrast exists between a surface characteristic of a portion of the face and another portion of the face, or a portion of the face and a portion of the crown, and/or two different portions of the crown, may be achieve via a first portion having a first visible surface feature and a second portion having a second visible surface feature different from the first visible surface feature. For example in one embodiment the first visible surface feature is a first visible unidirectional pattern such as one associated with an outermost unidirectional prepreg ply layer, whereas the second visible surface feature is a second visible unidirectional pattern such as one associated with an outermost unidirectional prepreg ply layer and the second visible unidirectional pattern is oriented differently that the first visible unidirectional pattern. In one such embodiment the second visible unidirectional pattern has a second visible orientation direction, the first visible unidirectional pattern has a first visible orientation direction, and an angle between the first visible orientation direction and the second visible orientation direction is at least 30 degrees, and in further embodiments is at least 45 degrees, 60 degrees, 75 degrees, or 90 degrees. Thus, the first portion and the second portion may have the same color, shade, or texture, yet still be easily distinguishable via the different visible surface features.

Further embodiments incorporate any combination of different visible surface features such as (a) a visible weave pattern versus a visible unidirectional pattern, (b) differing visible weave patterns such as a twill weave pattern versus a plain weave pattern, (c) the same visible weave pattern but oriented differently in the first portion and the second portion, such as differing by at least 30, 45, 60, 75, or 90 degrees, and/or (d) differing visible fiber content such as a first visible fiber content and a second visible fiber content, different from the first, which allows for situations such (i) a parallel visible unidirectional patterns but with the first portion having a greater density of visible fibers than the second portion, or vice versa, and/or (ii) situations having the same weave pattern and orientation, but different weave density, and/or (iii) chopped fiber materials wherein the first portion has a different fiber density than the second portion and therefore has a differing visible surface feature. Further, any of these examples may have the same texture, for example by having a smooth external clearcoat layer, but still have differing visible surface features, however in further embodiments they may also present different textures. Further embodiments incorporate other differing surface characteristics including, but not limited to, differences in gloss, reflectivity, iridescence, pearlescence, metamerism, and/or texture. Any of the disclosed differing surface characteristics may also be incorporated by attaching a separate component, such as a coating, sticker, decal, badge, or film, or by removing, texturing, or ablating a portion of a paint, coating, or finish by any known material removal, texturing, or ablating process, but with specific embodiments disclosed later herein. In one specific embodiment the separate component creating the alignment feature is located beneath and external transparent layer and is therefore positioned during manufacturing; while in another embodiment the separate component creating the alignment feature is externally attached to a finished club head.

Figure 100:
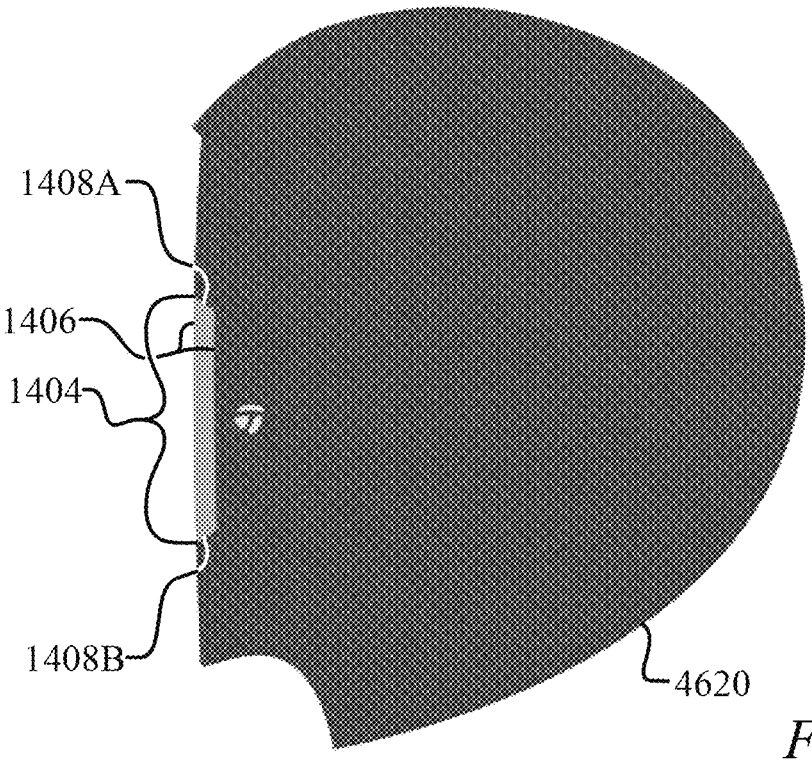
FIG. 100 is a top view of an embodiment of a crown.
Figure 101:
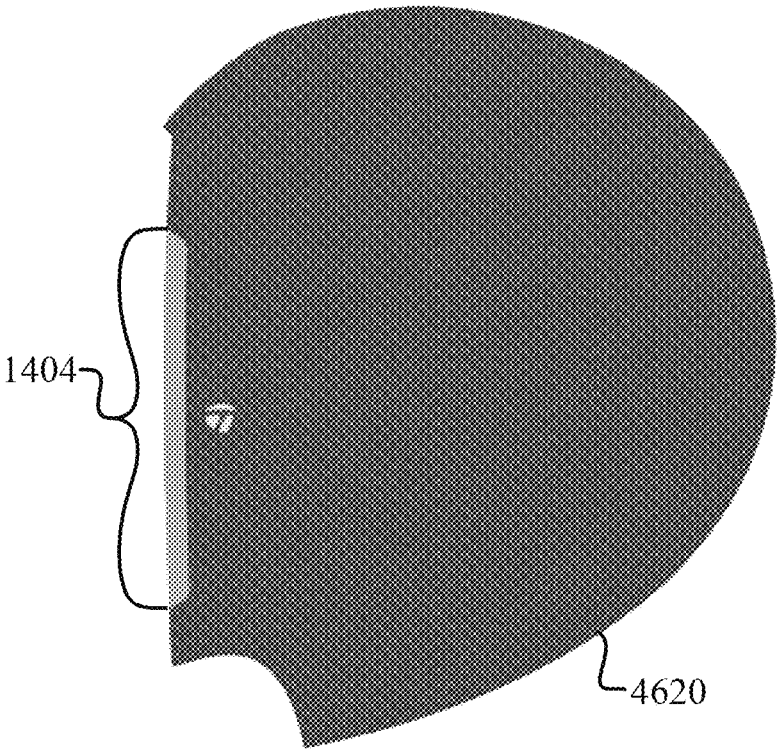
FIG. 101 is a top view of an embodiment of a crown.
Figure 102:
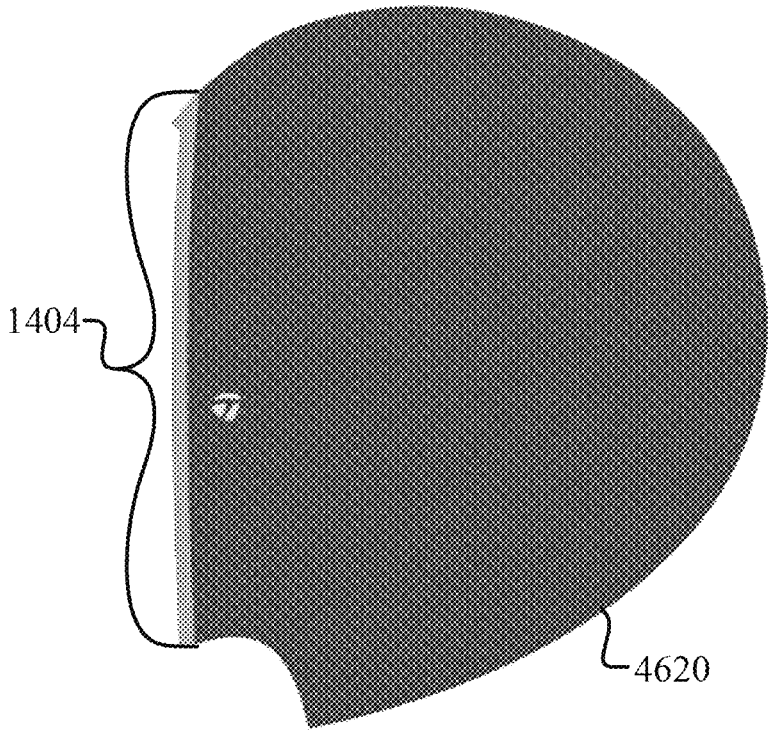
FIG. 102 is a top view of an embodiment of a crown.

As additionally seen in FIGS. 100-102, the club head may further incorporate a secondary alignment feature 1404 proximate the face but rearward of the primary alignment feature and delineated by a change in surface characteristic, again including a color, shade, texture, and/or visible surface feature, at a secondary feature delineation line which delineates the transition between the first portion of the crown having an area of contrasting first crown surface characteristic including a first color, shade, texture, and/or visible surface feature, with a second portion of the crown having a second crown surface characteristic including a second color, shade, texture, and/or visible surface feature. The secondary alignment feature a comprises an elongate side 1406 having a length of at least 10 mm, and in further embodiments at least 20 mm, 30 mm, 40 mm, 50 mm, 60 mm, or 70 mm. The secondary alignment feature may also have a second and third elongate side 1408*a* and 1408*b* extending back from the face and at an angle to elongate side 1406 and rearward of elongate side 1406.

Figure 95:
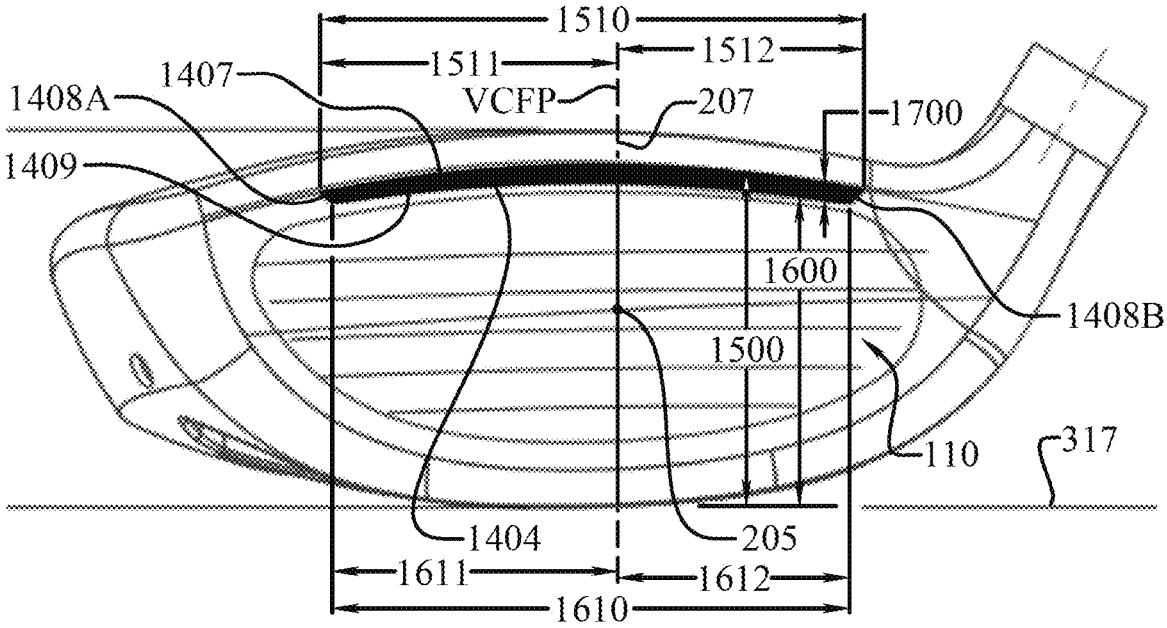
FIG. 95 is a front view of the club head.

As seen in FIGS. 95-108, in another embodiment the club head may further incorporate a face secondary alignment feature 1404 located on a portion of the face and delineated by a change in surface characteristic, again including a color, shade, texture, and/or visible surface feature, at a secondary feature delineation line which delineates the transition between a first portion of the face having an area of contrasting first face surface characteristic including a first color, shade, texture, and/or visible surface feature, with a second portion of the face having a second face surface characteristic including a second color, shade, texture, and/or visible surface feature. All of the disclosure herein relating to the face secondary alignment feature 1404 also applies to the secondary alignment feature 1404 located on the crown. The face secondary alignment feature 1404 a comprises an upper elongate side 1407 having an upper side length 1510, and a lower elongate side 1409 having a lower side length 1610. As seen in FIG. 95, the upper side length 1510 and the lower side length 1610 are measured along the x-axis 208 in the x-z vertical plane containing the x-axis 208 and the z-axis 206 based upon a projection of the face secondary alignment feature 1404 on the x-z plane. Similarly, the upper side length 1510 can be broken down into a toeward upper side length 1511 and a heelward upper side length 1512, with both measured in the same manner as the upper side length 1510 but from a vertical center face plane VCFP, which contains the y-axis 207 seen in FIGS. 1A-1D. Likewise, the lower side length 1610 can be broken down into a toeward lower side length 1611 and a heelward lower side length 1612, with both measured in the same manner as the lower side length 1610 but from the vertical center face plane VCFP. Similarly, the face secondary alignment feature 1404 has a face alignment feature height 1700, which is the distance between the upper elongate side 1407 and the lower elongate side 1409 in the z-axis 206 direction, again based upon a projection of the face secondary alignment feature 1404 on the x-z plane. Additionally, each point along the upper elongate side 1407 has an upper elongate side elevation 1500, measured vertically down to the ground plane 317, and each point along the lower elongate side 1409 has a lower elongate side elevation 1600, measured vertically down to the ground plane 317. Similarly, as seen in FIG. 109, each point along the upper elongate side 1407 has an upper elongate apex-plane offset distance 1530, measured vertically upward to the apex plane 4623, and each point along the lower elongate side 1409 has a lower elongate apex-plane offset distance 1630, measured vertically upward to the apex plane 4623. The apex plane 4623 is a plane parallel to the ground plane 317 and contacting the crown apex 4621, and an apex height is the distance between the apex plane 4623 and the ground plane 317.

In one embodiment the upper side length 1510 and/or the lower side length 1610 is at least 75% of the apex height, and in further embodiments at least 85%, 95%, 105%, 115%, 125%, 135%, or 145%. In another embodiment the upper side length 1510 and/or the lower side length 1610 is no more than 250% of the apex height, and in further embodiments no more than 225%, 200%, 175%, or 150%. In one embodiment the upper side length 1510 and/or the lower side length 1610 is at least 35% of the club head depth, illustrated in FIG. 12, and in further embodiments at least 40%, 45%, 50%, or 55%. In another embodiment the upper side length 1510 and/or the lower side length 1610 is no more than 95% of the club head depth, and in further embodiments no more than 90%, 85%, 80%, or 75%. In one embodiment the upper side length 1510 and/or the lower side length 1610 is at least 100% of Zup, which is the elevation of the club head center of gravity above the ground plane 317, and in further embodiments at least 125%, 150%, 175%, 200%, 225%, 250%, 275%, or 300%. In another embodiment the upper side length 1510 and/or the lower side length 1610 is no more than 600% of Zup, and in further embodiments no more than 550%, 500%, 450%, 425%, or 400%. In one embodiment the upper side length 1510 and/or the lower side length 1610 is at least 8 times the greatest face alignment feature height 1700, and in further embodiments at least 11, 14, 17, 20, or 23 times. In another embodiment the upper side length 1510 and/or the lower side length 1610 is no more than 50 times the greatest face alignment feature height 1700, and in further embodiments no more than 47, 44, 41, 38, 35, or 33 times. In one embodiment the upper side length 1510 and/or the lower side length 1610 is at least 30 mm, and in further embodiments at least 40 mm, 50 mm, 60 mm, 70 mm, 80 mm, 90 mm, or 100 mm. In another embodiment the upper side length 1510 and/or the lower side length 1610 is no more than 110 mm, and in further embodiments no more than 105 mm, 95 mm, 85 mm, 75 mm, or 65 mm.

In one embodiment the upper side length 1510 is greater than the lower side length 1610. In another embodiment the second elongate side 1408*a* and/or the third elongate side 1408*b* is not vertical when viewed in a front elevation view such as FIG. 95. Further, again when viewed in viewed in a front elevation view, the second elongate side 1408*a* and the third elongate side 1408*b* are both at an angle from the vertical center face plane and the angles are not equal; whereas in another embodiment an extension of the second elongate side 1408*a* and an extension the third elongate side 1408*b* intersect at a location below the ground plane 317. In one embodiment the upper side length 1510 decreases as the loft of the club head increases. For example in one embodiment a set of at least 2, 3, or 4 club heads having a volume of 400 cc or more, the upper side length 1510 is less in the higher lofted club head; while in another embodiment the decrease of the upper side length 1510, in millimeters, is at least multiplied by the increase in loft, in degrees, between the 2 club heads, where in one embodiment β is 1, while in further embodiments β is 2, 3, 4, 5, or 6. For example in another embodiment a set of at least 2, 3, or 4 club heads having a volume of 150-250 cc, the upper side length 1510 is less in the higher lofted club head; while in another embodiment the decrease of the upper side length 1510, in millimeters, is at least β multiplied by the increase in loft, in degrees, between the 2 club heads, where in one embodiment β is 1, while in further embodiments β is 2, 3, 4, 5, or 6. For example in another embodiment a set of at least 2, 3, or 4 club heads having a volume of 75-145 cc, the upper side length 1510 is less in the higher lofted club head; while in another embodiment the decrease of the upper side length 1510, in millimeters, is at least multiplied by the increase in loft, in degrees, between the 2 club heads, where in one embodiment β is 1, while in further embodiments β is 2, 3, 4, 5, or 6. In still another embodiment any of these relationships is true for a set having at least one club head with a volume of 400 cc or more, and at least one club head with a volume of 150-250 cc; while a further embodiment also add at least one club head with a volume of 75-145 cc.

In one embodiment the toeward upper side length 1511 is at least 105% of the heelward upper side length 1512, and in further embodiments at least 110%, 115%, or 120%. In another embodiment the toeward upper side length 1511 is no more than 170% of the heelward upper side length 1512, and in further embodiments no more than 160%, 150%, 140%, or 130%. Similarly, in one embodiment the toeward lower side length 1611 is at least 105% of the heelward lower side length 1612, and in further embodiments at least 110%, 115%, or 120%. In another embodiment the toeward lower side length 1611 is no more than 170% of the heelward lower side length 1612, and in further embodiments no more than 160%, 150%, 140%, or 130%. In a further embodiment the heelward upper side length 1512 and/or the heelward lower side length 1612 is at least 50% of Zup, and in additional embodiments at least 60%, 70%, 80%, 90%, or 100%

Figure 31:
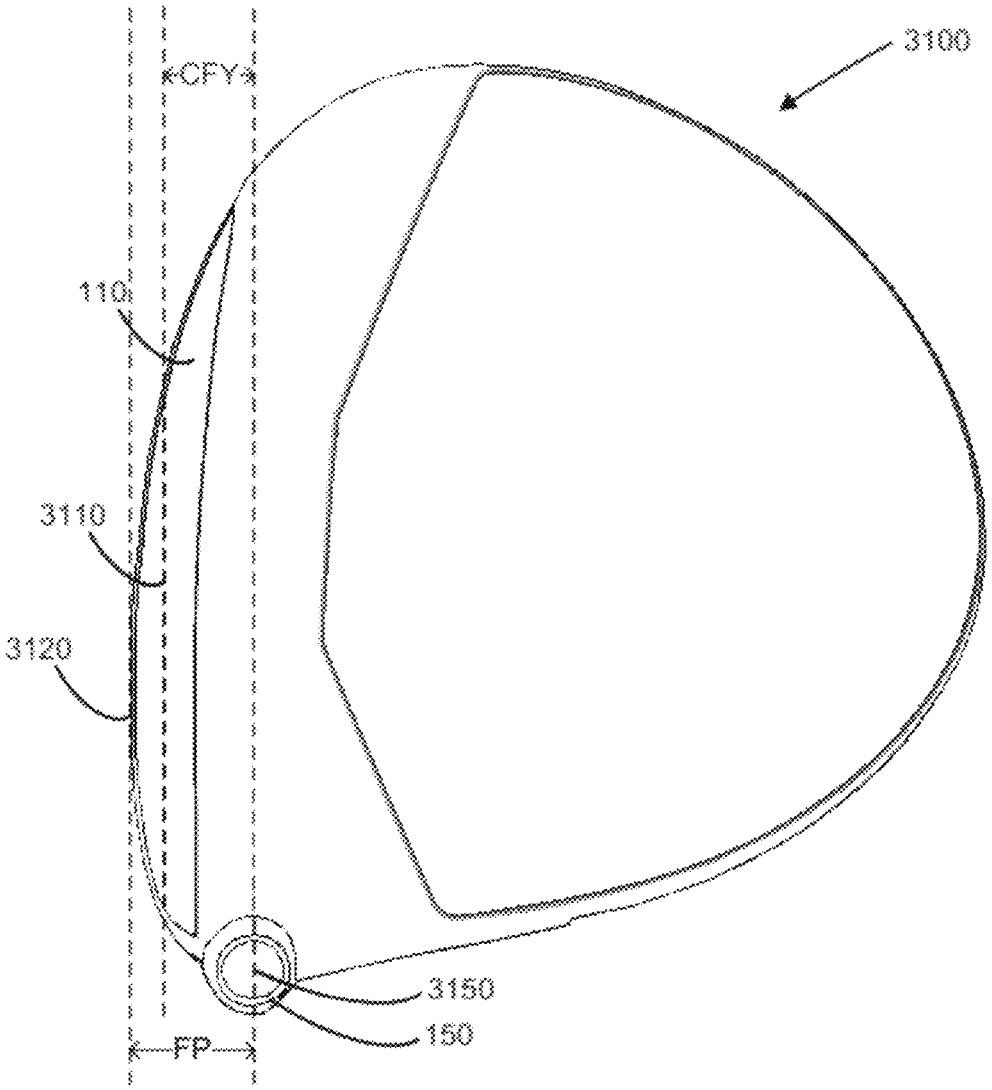
FIG. 31 is a top view of a golf club head in accord with one embodiment of the current disclosure.

In one embodiment the face alignment feature height 1700 varies. In the embodiment illustrated in FIG. 95 the face alignment feature height 1700 varies at a heelward end portion and/or a toeward end portion. In a further embodiment the face alignment feature height 1700 is constant throughout at least 50% of the upper side length 1510, and in further embodiment at least 60%, 70%, 80%, or 90%. As illustrated in FIG. 31, a center-face y-axis location is defined as the distance CFY measured in the y-axis direction 207 from the center-face location 3110 to the shaft axis plane. In one embodiment the greatest face alignment feature height 1700 is at least 10% of CFY, while in further embodiment it is at least 12.5%, 15%, or 17.5%. In another embodiment the greatest face alignment feature height 1700 is no more than 70% of CFY, and in additional embodiments no more than 60%, 50%, 45%, 40%, or 35%.

In one embodiment the face alignment feature height 1700 increases as the loft of the club head decreases. For example in one embodiment a set of at least 2, 3, or 4 club heads having a volume of 400 cc or more, the face alignment feature height 1700 is greater in the lower lofted club head; while in another embodiment the increase of the face alignment feature height 1700, in millimeters, is at least β multiplied by the decrease in loft, in degrees, between the 2 club heads, where in one embodiment β is 0.1, while in further embodiments β is 0.15, 0.2, or 0.25. For example in one embodiment a set of at least 2, 3, or 4 club heads having a volume of 150-250 cc, the face alignment feature height 1700 is greater in the lower lofted club head; while in another embodiment the increase of the face alignment feature height 1700, in millimeters, is at least β multiplied by the decrease in loft, in degrees, between the 2 club heads, where in one embodiment β is 0.1, while in further embodiments β is 0.15, 0.2, or 0.25. For example in one embodiment a set of at least 2, 3, or 4 club heads having a volume of 75-145 cc, the face alignment feature height 1700 is greater in the lower lofted club head; while in another embodiment the increase of the face alignment feature height 1700, in millimeters, is at least β multiplied by the decrease in loft, in degrees, between the 2 club heads, where in one embodiment β is 0.1, while in further embodiments β is 0.15, 0.2, or 0.25. In still another embodiment any of these relationships is true for a set having at least one club head with a volume of 400 cc or more, and at least one club head with a volume of 150-250 cc; while a further embodiment also add at least one club head with a volume of 75-145 cc.

In the embodiment seen in FIGS. 49, 52, 56, and 106, and discussed in more detail later, a forwardmost point on the constant diameter portion of the external hosel surface 3251 defines a vertical forward hosel plane 3252, which is parallel to the shaft axis plane. A secondary offset vertical forward hosel plane 3254 is shown in FIG. 106 and is parallel to the vertical forward hosel plane 3252 and located an offset hosel plane distance in front of the vertical forward hosel plane 3252. In one embodiment the offset hosel plane distance is 3 mm, while in further embodiments it is 2 mm, or 1 mm. In one embodiment at least a portion of the upper elongate side 1407 is behind the secondary offset vertical forward hosel plane 3254 and a portion of the upper elongate side 1407 is forward of the secondary offset vertical forward hosel plane 3254.

A further embodiment has an upper elongate side elevation 1500 that varies by at least 2.5% of a minimum upper elongate side elevation 1500, and in further embodiments at least 5%, 7.5%, or 10%. An additional embodiment has an upper elongate side elevation 1500 that varies by no more than 25% of the minimum upper elongate side elevation 1500, and in further embodiments no more than 22.5%, 20%, 17.5%, 15%, or 12.5%. Similarly, a further embodiment has a lower elongate side elevation 1600 that varies by at least 2.5% of a minimum lower elongate side elevation 1600, and in further embodiments at least 5%, 7.5%, or 10%. An additional embodiment has a lower elongate side elevation 1600 that varies by no more than 25% of the minimum lower elongate side elevation 1600, and in further embodiments no more than 22.5%, 20%, 17.5%, 15%, or 12.5%.

Figure 96:
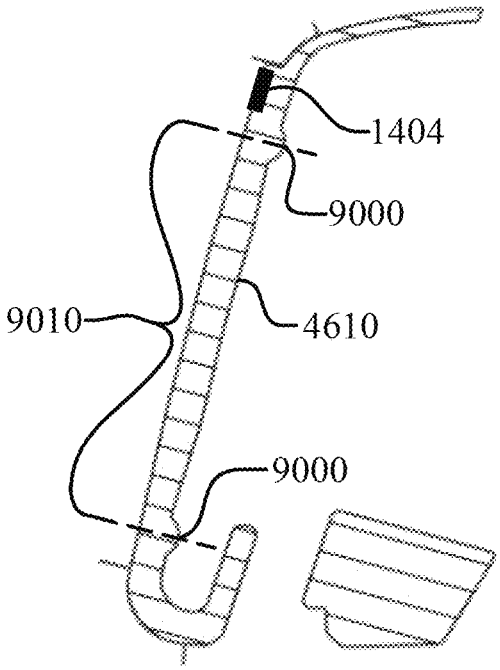
FIG. 96 is a cross-sectional view of the club head.

In one embodiment, seen in FIG. 96, the face 110 includes a face plate 4610 welded in a face opening in the face 110 and creating a fusion zone 9000 and establishing a center of fusion perimeter 9010 around the perimeter of the face plate 4610. In one embodiment the portion of the face surrounding the face opening is formed of a stainless steel alloy, which in a further embodiment is a martensitic type stainless steel alloy, precipitation hardening stainless steel alloy, austenitic type stainless steel alloy, duplex stainless steel alloy, or ferritic stainless steel alloy. In another embodiment the portion of the face surrounding the face opening is formed of a martensitic stainless steel alloy, which in a further embodiment is selected from the group of 410, 420, 431, 440, or 450, and in a further embodiment is an age hardened martensitic stainless steel alloy. In another embodiment the face plate 4610 is formed of a maraging steel alloy, which in a further embodiment is selected from the group of grade 200, grade 250, grade 300, and grade 350, while in another embodiment it is C300 steel alloy. In one embodiment the face secondary alignment feature 1404 is located entirely on the stainless steel alloy portion of the face.

Figure 103:
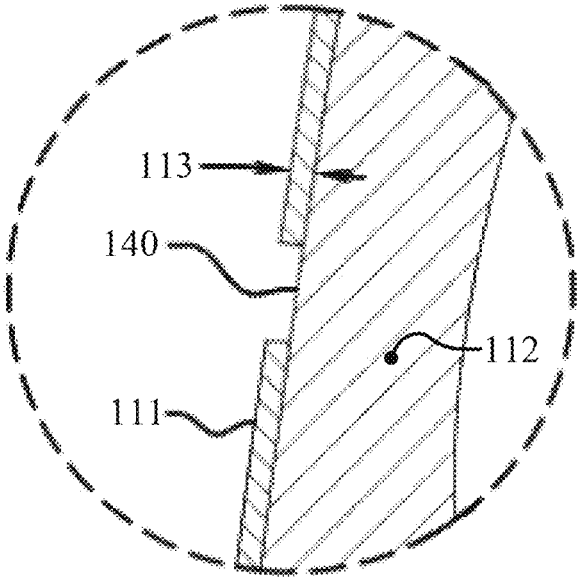
FIG. 103 is a partial cross-sectional view of an embodiment of the face.
Figure 104:
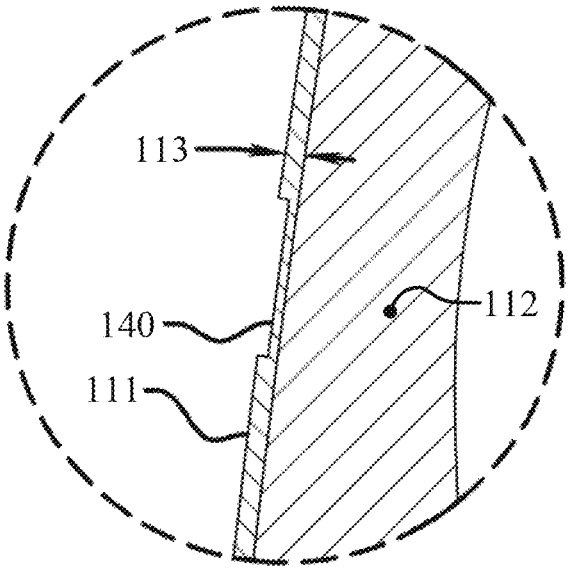
Figure 107:
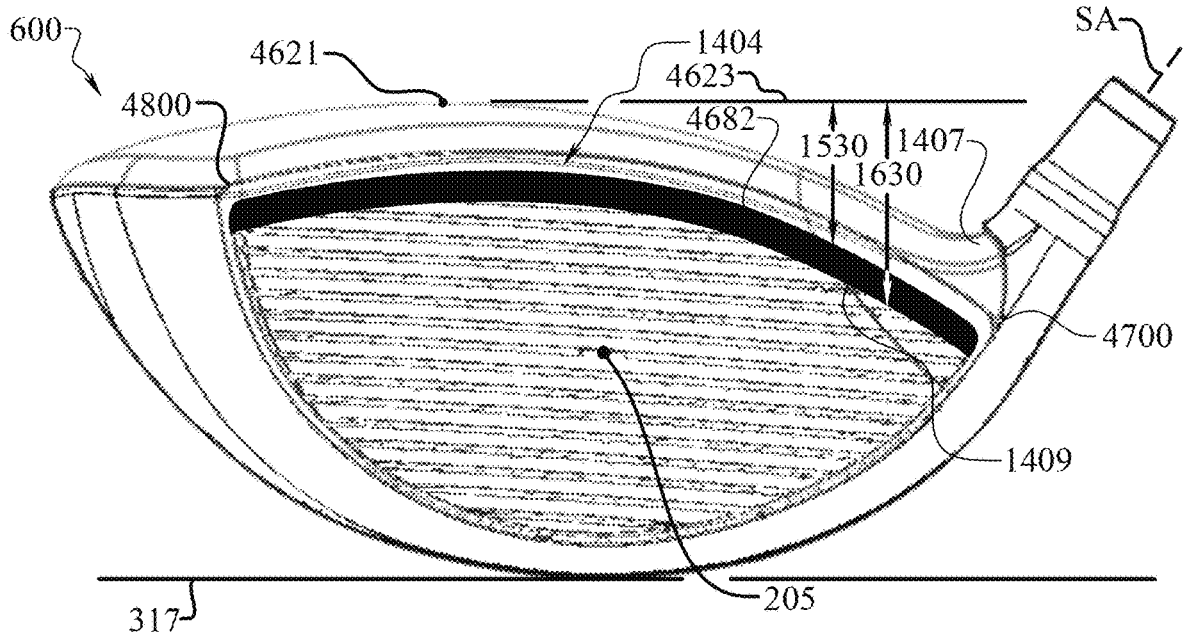
Figure 108:
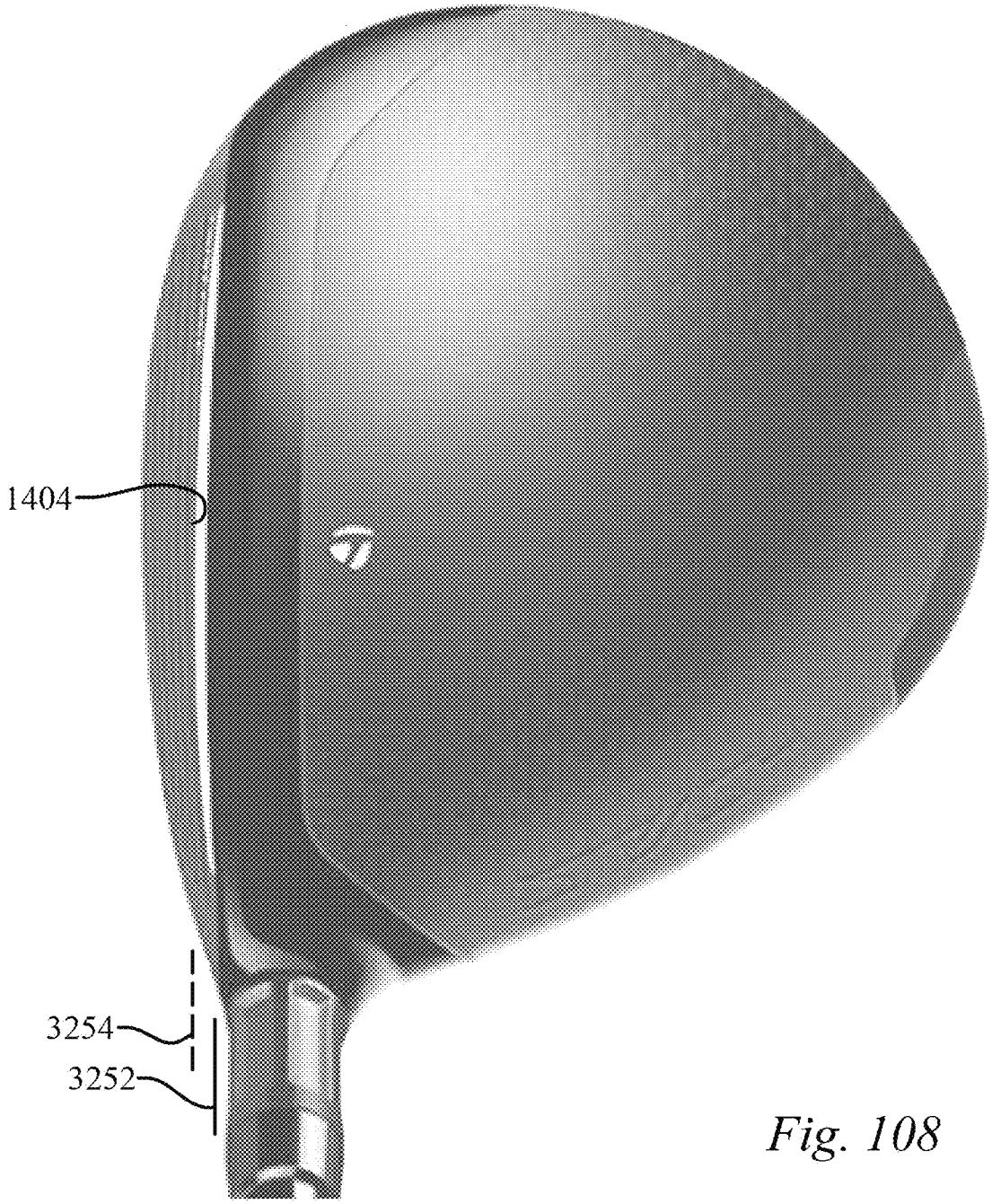

In one embodiment, illustrated in FIGS. 103-105, the face 110 has a face coating 111, having a coating thickness 113, applied to the face substrate 112 through any number of processes including, but not limited to, physical vapor deposition (PVD) and chemical vapor deposition (CVD). In one embodiment the coating thickness 113 is 0.3-15 microns. In one embodiment the face secondary alignment feature 1404 is formed by removing a portion of the face coating 111. In one such embodiment seen in FIG. 103 the face coating 111 is entirely removed in face secondary alignment feature 1404 leaving an exposed portion of the face substrate 112, which in one embodiment is stainless steel alloy. While in another embodiment seen in FIG. 104 only a portion of the face coating 111 is removed and thus the face secondary alignment feature 1404 is created by the formation of a recess in the face coating 111 that does not extend through the entire coating thickness 113, which may alone create the contrasting face surface characteristic when compared to the adjacent face coating 111 that has not been removed. While in still a further embodiment seen in FIG. 105 the face secondary alignment feature 1404 is formed by removing the full coating thickness 113 and a portion of the face substrate 112 leaving a recess in the face substrate 112.

Further, in any of the embodiments in which the entire coating thickness 113 is removed, the face substrate 112 may be left raw and exposed to the environment in the finished club head as sold and played, and the raw exposed face substrate 112 creates the contrasting face surface characteristic when compared to the adjacent face coating 111 and/or crown. This is why in some embodiments the face secondary alignment feature 1404 is strategically placed on the portion of the face 111 formed of stainless steel alloy and at least a safety zone distance away from the center of fusion perimeter 9010, seen in FIG. 96, around a portion of the perimeter of the face plate 4610. In one embodiment the safety zone distance is at least 50% of maximum thickness of the face plate 4610, and at least 60%, 70%, or 80% in further embodiments. In another embodiment the safety zone distance is at least 0.5 mm, while in further embodiments it is at least 1.0 mm, 1.5 mm, or 2.0 mm. Thus, in some embodiments of face secondary alignment feature 1404 is delineated from the other portion of the face 110 by the change in surface characteristics between the exposed face substrate 112 and the adjacent portion of the face 110 where the face coating 111 has not been removed.

In another embodiment the upper elongate side 1407 is within a predefined proximity distance of the crown leading edge 4625, disclosed in great detail later herein, utilizing the disclosed simple proximity method with the first end of the string is placed at a point on the upper elongate side 1407. Then if a portion of the crown leading edge 4625 is contacted by the second end of the string, the upper elongate side 1407 is within the predefined proximity distance to the crown leading edge 4625. In one embodiment the predefined proximity distance is 4 mm, while in further embodiments it is 3 mm, 2 mm, 1 mm, or 0.75 mm. Further, the upper elongate side 1407 may be recessed in relation to the crown leading edge 4625, or alternatively stated the crown leading edge 4625 may be proud of the upper elongate side 1407, as disclosed later in great detail regarding the proud relationship of the crown leading edge 4625 with respect to the face perimeter, and all of that later disclosure applies equally to the relationship of the crown leading edge 4625 to the upper elongate side 1407, as well as the gap therebetween.

With reference again to FIG. 107, in another embodiment at least a portion of the face secondary alignment feature 1404 has an upper elongate apex-plane offset distance 1530 that is least 30% of Zup, while in further embodiments it is at least 35%, 40%, 45%, 50%, 55%, 60%, 65%, or 70%. However, in another embodiment a maximum upper elongate apex-plane offset distance 1530 is no more than 120% of Zup, while in further embodiments it is no more than 110%, 100%, 90%, 85%, 80%, or 75%. In another embodiment a minimum upper elongate apex-plane offset distance 1530 is at least 10% of Zup, while in further embodiments it is at least 12%, 14%, 16%, 18%, 20%, 22%, 24%, 26%, 28%, 30%, 32%, or 34%. However, in another embodiment the minimum upper elongate apex-plane offset distance 1530 is no more than 35% of Zup, while in further embodiments it is no more than 32.5%, 30%, 29%, 28%, 27%, 26%, 25%, 24%, 23%, or 22%. In a further embodiment the maximum upper elongate apex-plane offset distance 1530 is at least 100% greater than the minimum upper elongate apex-plane offset distance 1530, and in further embodiments at least 125%, 150%, 175%, or 200%. In one embodiment the maximum upper elongate apex-plane offset distance 1530 occurs at a point located between the vertical center face plane and hosel portion 4604, and the minimum upper elongate apex-plane offset distance 1530 occurs at a point located between the vertical center face plane and the toe 185. In still a further embodiment the minimum upper elongate apex-plane offset distance 1530 occurs at a point located between the vertical center face plane and a parallel plane containing the crown apex 4621.

Figure 97:
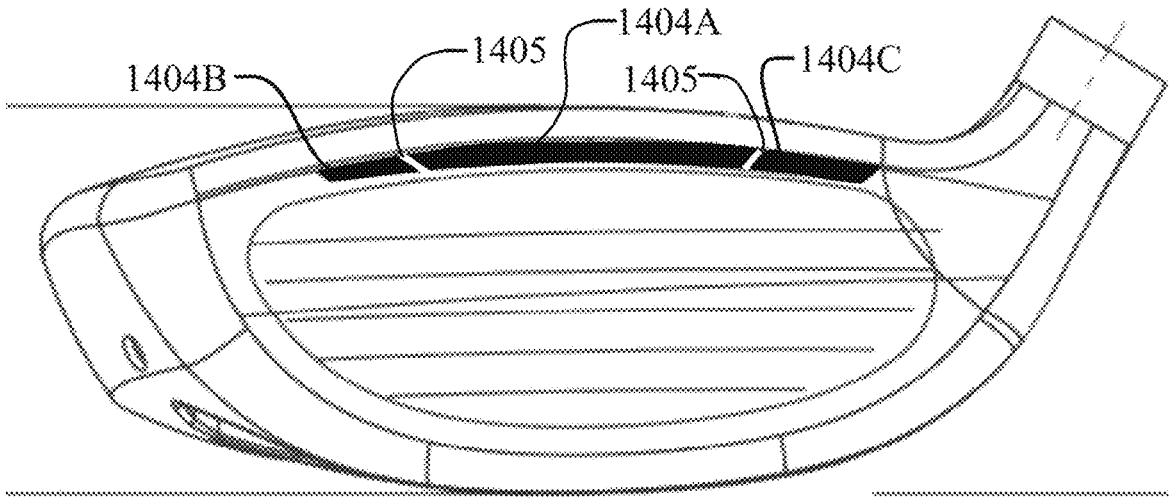
FIG. 97 is a front view of the club head.
Figure 98:
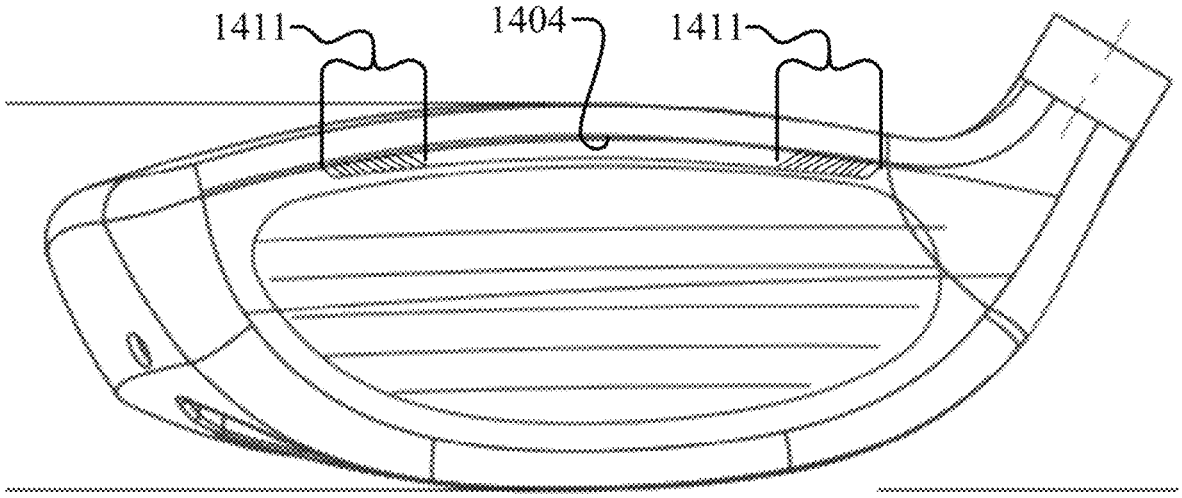
FIG. 98 is a front view of the club head.
Figure 99:
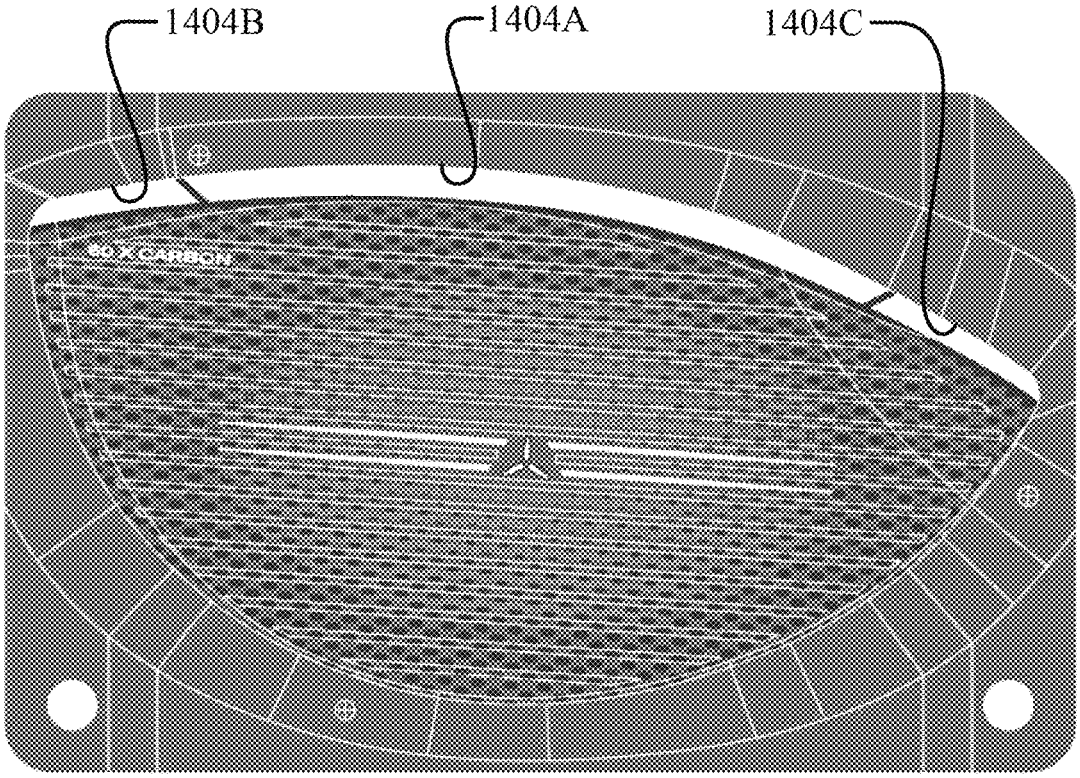
FIG. 99 is a front view of an embodiment of a face plate.

In some embodiments the face secondary alignment feature 1404 is composed of multiple sections, which in one embodiment includes a central face secondary alignment portion 1404A, a toeward face secondary alignment portion 1404B, and a heelward face secondary alignment portion 1404C, as seen in FIG. 97, separated by breaks 1405. In one embodiment the breaks 1405 separate the portions 1404A, 1404B, 1404C by a distance of less than 5 mm, and in further embodiments less than 4 mm, 3 mm, or 2 mm. Any of the disclosure with respect to the second elongate side 1408*a* and/or the third elongate side 1408*b*, as well as their angles, also applies to the breaks 1405. In one embodiment the length of the central face secondary alignment portion 1404A is greater than the length of the toeward face secondary alignment portion 1404B and/or the length of the heelward face secondary alignment portion 1404C. In one embodiment the length of the central face secondary alignment portion 1404A is at least 2 times greater than the length of the toeward face secondary alignment portion 1404B and/or the length of the heelward face secondary alignment portion 1404C; and in further embodiments at least 3, 4, 5, or 6 times greater. In a further embodiment seen in FIG. 98, the face secondary alignment feature 1404 may include at least one gradient region 1411, although the face secondary alignment feature 1404 may be a gradient provided the disclosed contrast is achieved. In the embodiment of FIG. 98 the face secondary alignment feature 1404 has a uniform central region, flanked by two gradient regions 1411.

Another embodiment may incorporate a tertiary alignment feature having a face portion, located on a portion of the face, and a crown portion, located on a portion of the crown; in other words the tertiary alignment feature continues from a portion of the face to a portion of the crown. All of the disclosure relating to the primary and secondary alignment features applies equally to the tertiary alignment feature, which may exist in conjunction with the primary alignment feature and/or secondary alignment feature, or may be present independent of primary alignment feature and/or secondary alignment feature.

Any of the alignment features may also incorporate a color changing paint in which the color of the material changes with the angle of observance. Thus, in one embodiment when viewed from the address position, the color is high contrast with respect to the face and/or crown, while when viewing the golf club head face-on the color is medium to low contrast with respect to the face and/or crown. In further embodiments any of the alignment features may incorporate paint, ink, coatings, and/or films that have hydrophilic and/or hydrophobic attributes. Accordingly, the alignment feature may have a higher level of hydrophilicity than the level of hydrophilicity of other areas of the face and/or crown. Hydrophilic means attracting water and hydrophobic means repelling water.

As one skilled in the art will understand, the face of every golf club head has a face surface roughness and a face area. Further, the alignment feature has an alignment feature surface roughness. In one embodiment the alignment feature surface roughness is less than the face surface roughness, while conversely in another embodiment the face surface roughness is less than the alignment feature surface roughness. In a further embodiment the alignment feature surface roughness of at least 10 pin greater than the adjacent face surface roughness, and in some embodiments with very low face surface roughness the alignment feature surface roughness may be at least twice the adjacent face surface roughness. In a further low face surface roughness face embodiment it is preferred to have an alignment feature surface roughness of less than fifteen times the adjacent face surface roughness. In one particular embodiment a polished PVD face of the golf club head may have a face surface roughness of 5-20 pin, whereas the alignment feature surface roughness may be about 60-90 pin. In another embodiment the face surface roughness is preferably 5-70 μin when measured in a parallel direction to the grooves, and the alignment feature surface roughness is preferably 50-90 pin when measured in a parallel direction to the grooves.

As disclosed throughout, numerous methods and/or components may be used to create the alignment features. Such techniques include etching methods, oxidation techniques, peening methods, engraving techniques, media blasting processes, machining methods, cutting processes, painting, and/or application of durable inks and/or coatings. For example, etching techniques using laser processing, chemical processing, or through the use of a photosensitive light-activated coating process may be used. Further, lasers also can be configured to produce markings that do not remove material to alter the thickness of the face or face coating; instead, the laser energy oxidizes the material of the face or face coating, resulting in a visible change. This change leads to a marking that is visible without impacting the spin of a golf ball. One such laser type used is a Yttrium-Aluminum-Garnet (YAG) laser, such as the HM 1400 marketed by GSI Lumionics of Ottawa, Canada. Preferably, a 6-inch diameter lens having a 254 mm focal length is used.

The Sight Adjusted Perceived Face Angle Secondary Alignment Feature, ("$SAPFA_{SAF}$") of the secondary alignment feature constituting elongate side 1406 and the second and third elongate sides 1408*a* and 1408*b* may be measured by importing the image of the club head obtained as per the measurement for the SAPFA. Points 1410*b* and 1410*a* are selected which are the innermost ends of the radii connecting lines 1408*b* and 1408 a with elongate side 1406 as shown in FIG. 10B. A best fit quadratic line is then fit for the secondary alignment feature between point 1410 a and 1410*b* and then a datum 1412 is determined as the center point along the arc length of the best fit line, again as for the SAPFA measurement, two points at arc length between +/−0.25 mm from the datum were selected. A straight line is then drawn between these two points and a line perpendicular to this line is then drawn at the datum. The Sight Adjusted Perceived Face Angle Secondary Alignment Feature, ("$SAPFA_{SAF}$") is then measured as the angle between this perpendicular line and the y axis.

In some embodiments, the golf club heads of the present invention also have a Sight Adjusted Perceived Face Angle Secondary Alignment Feature, ("$SAPFA_{SAF}$") of from about −2 to about 6, more preferably of from 0 to about 5, even more preferably of from about 1.5 to about 4 degrees.

The primary and secondary alignment features as described herein typically utilize paint lines which demark the edge of an area of contrasting paint or shading of the crown relative to the color or shading of the face. Preferably the contrasting colors are white in the crown area and black in the face area. Typically painting or shading of golf club heads is performed at the time of manufacture and thus are fixed for the lifetime of the club absent some additional painting performed after purchase by the owner. It would be highly advantageous if the profile of the alignment feature could be adjusted by the user using a simple method which would allow adjustment of the perceived face angle by the user in response to the golfer's observed ball direction tendency on any given day.

In some embodiments of the golf club heads of the present invention the crown comprises a rotatable or otherwise movable portion, with one side of said portion including the edge of an area of contrasting paint or shading of the crown relative to the color or shading of the face or the color or shading of the second portion of the crown which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$") to produce the desired ball flight. The movable portion of the crown is held in position by a fastening device such as a screw or bolt which is loosened to allow for rotation or movement and then subsequently tightened to fix the position of the crown after adjustment.

In addition to a portion of the crown being movable other embodiments include a movable layer or cover on top of the crown with one side of said movable layer or cover including the edge of an area of contrasting paint or shading of the crown relative to the color or shading of the face or the color or shading of the second portion of the crown which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$"). The movable portion of the layer or cover is again held in position by a fastening device such as a screw or bolt or other fastening means which is loosened to allow for rotation or movement and then subsequently tightened to fix the position of the movable layer or cover after adjustment.

In other embodiments a portion of the crown may comprise electronic features which can be selectively activated to generate the required appearance including but not limited to light emitting diodes (LED), organic LED's (OLED), printed electronics with illumination devices, embedded electronics with illumination devices, electroluminescent devices, and so called quantum dots.

In other embodiments, a portion of the crown may comprise a coating that alters its characteristics when exposed to external conditions including but not limited to thermochromic coatings, photochromic coatings, electrochromic coatings and paramagnetic paint.

In one preferred embodiment, at least a portion of the crown of the golf club head or a layer covering at least a portion of the crown of the golf club head comprises an electronic graphic display. The display provides active color and graphic control for either the entire top portion of the crown or layer covering at least a portion of the crown or a portion thereof. The display may be constructed from flexible organic light-emitting diodes (OLED) displays, e-ink technology, digital fabrics, or other known means of active electronic color and graphic display means. For example, an organic light emitting diode (OLED) (e.g., a light emitting polymer (LEP), and organic electro luminescence (OEL)) is a light-emitting diode (LED) whose emissive electroluminescent layer is composed of a film of organic compounds. The layer usually contains a polymer substance that allows suitable organic compounds to be deposited in rows and columns onto a carrier substrate such as the at least a portion of the crown of the golf club head or a layer covering at least a portion of the crown of the golf club head, by a simple "printing" process. The resulting matrix of pixels can emit light of different colors.

In some embodiments, the at least a portion of the crown of the golf club head or a layer covering at least a portion of the crown of the golf club head is segmented into portions which may be controlled differently from each other. For example, one side of the alignment feature has a static surface color and the other side a second static and contrasting surface color display capability.

The display is operatively connected to a microprocessor disposed in the golf club head (e.g., via wires). The microprocessor is further operatively connected to a data port, for example a universal serial bus (USB) port (e.g., via wires). The data port allows transfer and retrieval of data to and from the microprocessor. Data ports and data transfer protocols are well known to one of ordinary skill in the art. The data port (USB port) may be disposed in the rearward area of the golf club head.

Data can be obtained from a variety of sources. In some embodiments, an Internet website is dedicated to support of the golf club head of the present invention. For example, the website may contain downloadable data and protocols (e.g., colors, color patterns, images, video content, logos, etc.) that can be uploaded into the microprocessor of the golf club head (via the data port, via a cable, via a computer). As an example, the website may have a gallery for choosing colors to be displayed, as well as patterns of the colors In some embodiments, data can be uploaded from other sources, for example DVDs, CDs, memory devices (e.g., flash memory), and the like. Sources may also include cellular phones, smart phones, personal digital assistants (PDAs), digital vending kiosks, and the like. In some embodiments, the data can be uploaded and downloaded via other mechanisms, for example wired or wireless mechanisms. Such mechanisms may include Bluetooth™, infrared datalink (IrDa), Wi-Fi, UWB, and the like.

In some embodiments, one or more control buttons are disposed on the golf club head allowing a user to manipulate the display as desired. The control buttons are operatively connected to the microprocessor. The microprocessor is configured to receive input signals from the control buttons and further send output commands to manipulate the. The control buttons may be operatively connected to the display and/or the microprocessor via one or more wires.

The microprocessor and/or display are operatively connected to a power source, for example a battery. The battery may be rechargeable. In some embodiments, the battery comprises a control means for turning on and off the device. All wires and data ports and other electronic systems are adapted to sustain the impact forces incurred when a golfer hits a golf ball with the golf club head.

In other embodiments of the golf club heads of the present invention a method to accomplish user adjustably of the alignment feature would involve at least a portion of the crown of the golf club head or a layer covering at least a portion of the crown of the golf club head being covered by a dielectric electroluminescent coating system using as one example the materials and methods as described in U.S. Pat. No. 6,926,972 by M. Jakobi et al., issuing on Aug. 9, 2005 and assigned to the BASF Corporation, the entire contents of which are incorporated by reference herein. Using this technology an electric current (provided by a small battery fixed securely in the golf club head cavity) could be selectively employed to use electroluminescence to highlight (or eliminate) a particular color thereby adjusting the alignment feature orientation.

In some embodiments, the golf club head may include sensors, such as described in U.S. patent application Ser. No. 15/996,854, filed Jun. 4, 2018, which is incorporated herein by reference. For example, the golf club may include one or more sensors for measuring swing speed, face angle, lie angle, tempo, swing path, face angle to swing path relationships, dynamic loft, and shaft lean. Other measurements may include back stroke time, forward stroke time, total stroke time, tempo, impact stroke speed, impact location, back stroke length, back stroke rotation, forward stroke rotation, rotation change, lie, and loft. Further measurements may include golf shot locations during play and golf shot distance data. Additional and different measurements may also be captured. The measurements may be captured during a full swing, short game, putting, or during other golf swings.

The one or more sensors may include motion sensors, accelerometers, gyro sensors, magnetometers, global positioning system (GPS) sensors, optical markers, or other sensors. The one or more sensors may be attached to the golf club head, integrated into a display of the golf club, attached to or integrated into the shaft of the golf club (e.g., proximate to the butt end of golf club grip, along the shaft, or at another location), housed within the golf club grip, and/or attached to or integrated into another portion of the golf club. In an embodiment, multiple sensors are provided on the golf club, such as at the same or different portions of the golf club. For example, a first sensor may be attached to or integrated into the golf club head and a second sensor housed within the grip of the golf club or attached to the golf club shaft. Additional and different multiple sensor arrangements may be used.

In an embodiment, a display or another electronic feature of the golf club may display one or more of the measured values on the crown or another portion of the golf club head. For example, the display or another electronic feature may be a removable display device, or may integrated into user device, such as a PDA, smart phone, iPhone, iPad, iPod, or other computing device. The one or more measured values may be displayed using an application running on the display device or using a device associated with the display or other electronic feature of the golf club head. In some embodiments, the sensors may be configured to communicate with an external device, such as a computing device (e.g., personal computer (PC), laptop computer, tablet, smart phone, cell phone, iPhone, iPad, Personal Digital Assistant (PDA), server computer, or another computing device), a launch monitor, a club fitting platform, or another device. In these embodiments, the one or more measured values may be displayed using an application running on the external device. In some embodiments, the one or more sensors interact with an external device, such as a video camera, to capture one or more measured values.

Referring back to FIG. 1B, a coordinate system for measuring a center of gravity (CG) location is located at the face center 205. In one embodiment, the positive x-axis 208 is projecting toward the heel side of the club head and the negative x-axis 208 is projecting toward the toe side of the golf club head. Further, the positive z-axis 206 is projecting toward the crown side of the club head and the negative z-axis 206 is projecting toward the sole side of the golf club head. Finally, the positive y-axis 207 is projecting toward the rear of the club head parallel to a ground plane. Unless noted otherwise, as used herein a first location is forward of a second location when the first location is nearer face center 205 along the y-axis 207 than is the second location; and likewise the first location is behind the second location when the first location is further from face center 205 along the y-axis 207 than is the second location. Unless noted otherwise, as used herein a first location is toeward of a second location when the first location is further from the hosel portion along the x-axis 208 than is the second location; and likewise the first location is heelward of the second location when the first location is closer to the hosel portion along the x-axis 208 than is the second location.

In exemplary embodiments, a projected CG location on the striking face is considered the "sweet spot" of the club head. The projected CG location is found by balancing the clubhead on a point. The projected CG location is generally projected along a line that is perpendicular to the face of the club head. In some embodiments, the projected CGy (y-axis coordinate) location is less than 2 mm above the center face location, less than 1 mm above the center face, or up to 1 mm or 2 mm below the center face location 205. In some embodiments, the golf club head has a CG with a CGx (x-axis) coordinate between about −10 mm and about 10 mm from the center face location 205, a CGy between about 15 mm and about 50 mm, and a CGz (z-axis coordinate) between about −10 mm and about 5 mm. In some embodiments, the CGy is between about 20 mm and about 50 mm.

The golf club head also has moments of inertia defined about three axes extending through the golf club head CG orientation, including: a CGz extending through the CG in a generally vertical direction relative to the ground plane when the club head is at address position, a CGx extending through the CG in a heel-to-toe direction generally parallel to the striking face 110 and generally perpendicular to the CGz, and a CGy extending through the CG in a front-to-back direction and generally perpendicular to the CGx and the CGz. The CGx and the CGy both extend in a generally horizontal direction relative to the ground plane when the club head 100 is at the address position.

The club head and many of its physical characteristics disclosed herein will be described using "normal address position" as the club head reference position, unless otherwise indicated. At normal address position, the club head rests on a flat ground plane. Unless noted otherwise, as used herein, "normal address position" means the club head position wherein a vector normal to a center face 205 substantially lies in a first vertical plane (i.e., a vertical plane is perpendicular to the ground plane), a centerline axis of a hosel bore establishes a shaft axis that lies in a second vertical plane, and the first vertical plane and the second vertical plane substantially perpendicularly intersect.

The moment of inertia about the golf club head CGx is calculated by the following equation:

$$I_{CG_x}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CGx and the CGz. The CG xy-plane is a plane defined by the CGx and the CGy.

The moment of inertia about the golf club head CGy is calculated by the following equation:

$$I_{CG_y}=\int(x^2+z^2)dm$$

In the above equation, x is the distance from a golf club head CG yz-plane to an infinitesimal mass dm and z is the distance from a golf club head CG xy-plane to the infinitesimal mass dm. The golf club head CG yz-plane is a plane defined by the CGy and the CGz. The CG yx-plane is a plane defined by the CGy and the CGx.

Moreover, a moment of inertia about the golf club head CGz is calculated by the following equation:

$$I_{CG_z}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CGy and the CGz.

In certain implementations, the club head can have a moment of inertia about the CGz between about 450 $kg\cdot mm^2$ and about 650 $kg\cdot mm^2$, and a moment of inertia about the CGx between about 300 $kg\cdot mm^2$ and about 500 $kg\cdot mm^2$, and a moment of inertia about the CGy between about 300 $kg\cdot mm^2$ and about 500 $kg\cdot mm^2$.

For a variety of reasons, it may be advantageous to orient the center of gravity (CG) of the golf club head toward the toe. For example, users often strike the golf ball high (e.g., +3 to +4 mm on the z-axis) and toeward (e.g., −5 to −7 mm on the x-axis) on the striking face. Striking the ball off-center (i.e., in a location different from the projected CG location on the striking face) generally decreases ball-speed, and as a result, decreases the distance traveled by the golf ball.

Further, as discussed above, striking the face toeward also produces a gear effect, producing hook spin. Increasing the negative CGx orientation (i.e., from −2 to −10 mm on the x-axis) may alter the gear effect by decreasing the counter-clockwise spin (i.e., for a right-handed golfer) which ultimately results in the golf ball curving to the left.

Additionally, in order to maximize the moment of inertia (MOI) about a z-axis extending through the CGz, a negative CGx orientation may be provided. Working in conjunction with the weight of the hosel of the golf club, a negative CGx orientation allows for greater MOI about the z-axis by strategically distributing club head weight on the x-axis at corresponding positive and negative orientations.

Alternatively, it may be advantageous to orient the CG of the golf club head toward the heel. For example, by increasing positive CGx orientation (i.e., from +2 mm to 0 mm on the x-axis), the club head may close faster (i.e., at 400-500 rpm), increasing local club head speed and producing more ball-speed, and as a result, increasing the distance traveled by the golf ball.

In certain implementations, the golf club head can have a CGx between about +2 and about −10 mm. For example, the CGx for a golf club head with adjustable weights (discussed below) is between about −3 mm to about −4 mm. In certain implementations, the club head can have a low CGz of less than 0, such as between 0 and about −4 mm. In certain implementations, the club head can have a CGz positioned below a geometric center of the face. In certain implementations, the club head can have a moment of inertia about the CGz (also referred to as "Izz") above 400 kg·mm$^2$, above 460 kg·mm$^2$ or above 480 kg·mm$^2$. A moment of inertia about the CGx (also referred to as "Ixx") can be above 300 kg·mm$^2$. The moments of inertia of the golf club head can also be expressed as a ratio, such as a ratio of Ixx to Izz. For example, in some embodiments, a ratio of Ixx to Izz is at most 0.6, or 60%. In an example, the golf club head can have an Ixx above 300 kg·mm$^2$ and an Izz above 500 kg·mm$^2$, such that Ixx/Izz is less than or equal to 0.6. In another example, the Ixx is greater than 280 kg·mm$^2$ and the Izz is greater than 465 kg·mm$^2$.

In certain implementations, the golf club head can have a Zup less than 30 mm. For example, above ground, an alternative club head coordinate system places the head origin at the intersection of the z-axis and the ground plane, providing positive z-axis coordinates for every club head feature. As used herein, "Zup" means the CG z-axis location determined according to this above ground coordinate system. Zup generally refers to the height of the CG above the ground plane as measured along the z-axis.

In certain implementations, the golf club head can have a Delta 1 (i.e., measure of how far rearward in the golf club head body the CG is located) greater than 20, such as greater than 26 in certain implementations. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

The United States Golf Association (USGA) regulations constrain golf club head shapes, sizes, and moments of inertia. Due to these constraints, golf club manufacturers and designers struggle to produce golf club heads having maximum size and moment of inertia characteristics while maintaining all other golf club head characteristics. For example, one such constraint is a volume limitation of 460 cm$^3$. In general, volume is measured using the water displacement method. However, the USGA will fill any significant cavities in the sole or series of cavities which have a collective volume of greater than 15 cm$^3$.

In some embodiments, as in the case of a fairway wood, the golf club head may have a volume between about 100 cm$^3$ and about 300 cm$^3$, such as between about 150 cm$^3$ and about 250 cm$^3$, or between about 130 cm$^3$ and about 190 cm$^3$, or between about 125 cm$^3$ and about 240 cm$^3$, and a total mass between about 125 g and about 260 g, or between about 200 g and about 250 g. In the case of a utility or hybrid club, the golf club head may have a volume between about 60 cm$^3$ and about 150 cm$^3$, or between about 85 cm$^3$ and about 120 cm$^3$, and a total mass between about 125 g and about 280 g, or between about 200 g and about 250 g. In the case of a driver, the golf club head may have a volume between about 300 cm$^3$ and about 600 cm$^3$, between about 350 cm$^3$ and about 600 cm$^3$, and/or between about 350 cm$^3$ and about 500 cm$^3$, and can have a total mass between about 145 g and about 1060 g, such as between about 195 g and about 205 g.

Historically, $CG_x$ locations were heelward about 4-6 mm. More recently, $CG_x$ locations have been moved toeward to about −1 mm. $CG_x$ locations will likely continue to be toeward, such as in the example $CG_x$ locations described in U.S. patent application Ser. No. 16/171,237, filed Oct. 25, 2018, which is incorporated herein by reference. For example, club head has a center of gravity (CG), the location of which may be defined in terms of the coordinate system described above and shown in FIGS. 1A, 1B and 1D, and in some embodiments, the club head has a $CG_x$ toeward of center face as, for example, no more than −2 mm toeward. In some embodiments the club head has a $CG_x$ of 0 to −4 mm. In some embodiments the club head has a moment of inertia about the z-axis ($I_{zz}$) of 480 to 600 Kg·mm$^2$ or in some embodiments greater than 490 Kg·mm$^2$, a moment of inertia about the x-axis ($I_{xx}$) of about 280 to 420 Kg·mm$^2$ or in some embodiments greater than 280 Kg·mm$^2$.

There are a variety of ways to position the CG orientations of the golf club head. For example, in some embodiments, a composite crown and/or sole is provided to help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, having a density of less than 2 grams per cubic centimeter. In still further embodiments, the composite material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional weight can be strategically added to the hollow interior of the golf club head, or strategically located on the exterior of the golf club head, to shift the effective CG fore or aft, toeward or heelward or both (apart from any further CG adjustments made possible by adjustable weight features), and/or to improve desirable MOI characteristics, as described above.

In some embodiments, the crown and/or sole may be formed in whole or in part from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. Nos. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference.

Alternatively, the crown and/or sole may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 Mpa) as measured by ASTM D 638; a Flexural Strength of 50000 psi (345 Mpa) as measured by ASTM D 790; and a Flexural Modulus of $2.60\times10^6$ psi (17927 Mpa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 Mpa as measured by ISO 527; a Tensile Elongation of 1.4% as measured by ISO 527; a Tensile Modulus of 41500 Mpa as measured by ISO 527; a Flexural Strength of 580 Mpa as measured by ISO 178; and a Flexural Modulus of 34500 Mpa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 Mpa as measured by ISO 527; a Tensile Elongation of 1.3% as measured by ISO 527; a Tensile Modulus of 28500 Mpa as measured by ISO 527; a Flexural Strength of 385 Mpa as measured by ISO 178; and a Flexural Modulus of 23,000 Mpa as measured by ISO 178.

In other embodiments, the crown and/or sole is formed as a two layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

The laminates may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered composite crown may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming.

The inner layer may be injection molded using conventional techniques and secured to the outer crown layer by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer is secured to the outer layer, the outer surface of the inner layer and/or the inner of the outer layer may be pretreated by means of one or more of the following processes (disclosed in more detail in Ehrenstein, "Handbuch Kunststoff-Verbindungstechnik", Carl Hanser Verlag Munich 2004, pages 494-504):

Mechanical treatment, preferably by brushing or grinding,

Cleaning with liquids, preferably with aqueous solutions or organics solvents for removal of surface deposits Flame treatment, preferably with propane gas, natural gas, town gas or butane Corona treatment (potential-loaded atmospheric pressure plasma)

Potential-free atmospheric pressure plasma treatment

Low pressure plasma treatment (air and 02 atmosphere)

UV light treatment

Chemical pretreatment, e.g. by wet chemistry by gas phase pretreatment

Primers and coupling agents

In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the crown as a highly integrated part. Typically the injection molded inner layer is prepared from the same polymer family as the matrix material used in the formation of the composite laminate structures used to form the outer layer so as to ensure a good weld bond.

In addition to being formed in the desired shape for the aft body of the club head, a thermoplastic inner layer may also be formed with additional features including one or more stiffening ribs to impart strength and/or desirable acoustical properties as well as one or more weight ports to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer, is typically of from about 0.25 to about 2 mm, preferably of from about 0.5 to about 1.25 mm, even more preferably from 0.5 to 1 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell (or sole) may be made of a composite material, such as, for example, a carbon fiber reinforced epoxy, carbon fiber reinforced polymer, or a polymer. Furthermore, U.S. patent application Ser. No. 12/974,437 (now U.S. Pat. No. 8,608,591) describes golf club heads with lightweight crowns and soles.

Composite materials used to construct the crown and/or sole should exhibit high strength and rigidity over a broad temperature range as well as good wear and abrasion behavior and be resistant to stress cracking. Such properties include, a) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039);

b) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039);

c) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790);

d) a Flexural Modulus at room temperature of from about 0.4 Msi to about 21 Msi, from about 0.5 Msi to about 20 Msi, more preferably of from about 10 Msi to about 19 Msi (as measured by ASTM D 790);

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$, also abbreviated gsm). FAW values at or below 120 $g/m^2$, at or below 100 $g/m^2$, or at or below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Each of the golf club heads discussed throughout this application may include a separate crown, sole, and/or face that may be a composite, such as, for example, a carbon fiber reinforced epoxy, carbon fiber reinforced polymer, or a polymer crown, sole and/or face.

In some embodiments, the CGx, CGy and CGz orientations of the golf club head may be adjustable. For example, in an embodiment, the golf club head is provided with one or more adjustable weight features, such as weight ports, tracks, and/or slots in conjunction with one or more adjustable weights located in the weight port(s), track(s), and/or slot(s). For example, U.S. Pat. No. 9,868,036, which is incorporated herein by reference, describes weight tracks with slidable weights for adjusting the CG orientations of the golf club head. Other adjustable weight features may be used to adjust the CG orientations.

In some embodiments, the CGx, CGy and CGz orientations of the golf club head are positioned in conjunction with the aerodynamic properties of the golf club head. In some implementations, aerodynamic drag forces on the golf club head are reduced by the shape of the striking face. For example, aerodynamic drag forces can be reduced by providing a striking face that is shorter along the positive x-axis 208 projecting toward the heel side of the club head and taller on the negative x-axis 208 is projecting toward the toe side of the golf club head. In other words, the striking face may be provided with bulge oriented in the portion of the face in the negative x-axis. For example, as discussed below, the golf club head may have a crown height to face height ratio of at least 1.12. As a result of this configuration, more material and mass is provided along the negative x-axis of the striking face than along the positive x-axis, which may orient the CGx on the negative x-axis. This aerodynamic shape tends to move CGx toeward naturally.

In addition to the features described above, additional aerodynamic shapes are described in U.S. Pat. Nos. 8,858,359 and 9,861,864. For example, various properties may be modified to improve the aerodynamic aspects of the golf club head. In various embodiments, the volume of the golf club head may be 430 cc to 500 cc. In various embodiments, there may be no inversions, indentations, or concave shaping elements on the crown of the golf club head, and, as such, the crown remains convex over its body, although the curvature of the crown may be variable in various embodiments.

For example, in an embodiment, the golf club head a face height of about 59.1 mm and a crown height of about 69.4 mm. As can be seen, a ratio of the crown height to the face height is 69.4/59.1, or about 1.17. In other embodiments, the golf club head may have a crown height to face height ratio of at least 1.12. Other crown height to face height ratios may be used. For example, a face height of about 58.7 mm may be provided in an embodiment. The corresponding crown height is about 69.4 mm in the current embodiment. A ratio of the crown height to the face height is 69.4/58.7, or about 1.18. Alternatively, a face height of about 58.7 mm may be provided in another embodiment. The crown height is about 69.4 mm in the current embodiment. A ratio of the crown height to the face height is 69.4/58.7, or about 1.18. As such, the ratio of crown height to face height may be between about 1 and about 2, depending on the embodiment.

In another example, the golf club head may have a minimum and/or a maximum face area. For example, the larger the face area, the more drag is produced (i.e., lowers aerodynamic features of the golf club head. In addition to aerodynamic features, the minimum and/or maximum face areas may be dictated by other golf club head properties, such as mass savings and ball speed benefits. Accordingly, in one embodiment, the golf club head has a minimum face area of 3300 $mm^2$. In other embodiments, the golf club head has a face area between about 3700 $mm^2$ and about 4000 $mm^2$. In other embodiments, the golf club head has a face area between about 3500 $mm^2$ and about 4200 $mm^2$. In other embodiments, the golf club head has a face area between about 4100 $mm^2$ and about 4400 $mm^2$, preferably between 4200 $mm^2$ and 4300 $mm^2$. In yet another embodiment, the golf club head has a maximum face area of about 4500 $mm^2$. Other face areas may be used.

In some implementations, discretionary mass is strategically positioned at an angle with respect to the striking face 110, such as in the same plane as the golf club head as the club is designed to travel on the downswing. In some embodiments, the discretionary mass is strategically provided low (along the negative z-axis), rearward (along the positive y-axis 207), and toeward (along the negative x-axis 208), orienting the mass in the location where air is flowing, thereby reducing aerodynamic drag forces and orienting CGx on the negative x-axis.

Examples of strategically positioned discretionary masses are described in U.S. provisional patent application Ser. No. 62/755,319, which is incorporated herein by reference. For example, as illustrated in FIGS. 12, 13, 14A, 15-19, golf club head 300 comprises an inertia generator 360, which may comprise an elongate center sole portion 362 that extends in a generally Y-direction—though as illustrated, and as further described below, is also angled toewardly—from a position proximate the golf club head center of gravity 350 to the rear portion of the body.

In one or more embodiments, golf club head 300 includes a hollow body 310 defining a crown portion 312, a sole portion 314, a skirt portion 316, and a striking surface 318. The striking surface 318 can be integrally formed with the body 310 or attached to the body. The body 310 further includes a hosel 320, which defines a hosel bore 324 adapted to receive a golf club shaft. The body 310 further includes a heel portion 326, a toe portion 328, a front portion 330, and a rear portion 332. Included are a number of features that may improve playability, including at least an inertia generator 360, front channel 390, a slot or channel insert 395, one or more front channel support ribs 396, an additional rib 397 that connects to front channel support ribs 396, as well as composite panels on the sole 344, 348 and on the crown 335, along with discretionary mass elements and other additional features, as will be further described herein. The front channel 390 may have a certain length L (which may be measured as the distance between its toeward end and heelward end), width W (e.g., the measurement from a forward edge to a rearward edge of the front channel 390), and offset distance OS from the front end, or striking surface 318 (e.g., the distance between the face 318 and the forward edge of front channel 390. During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

Figure 12:
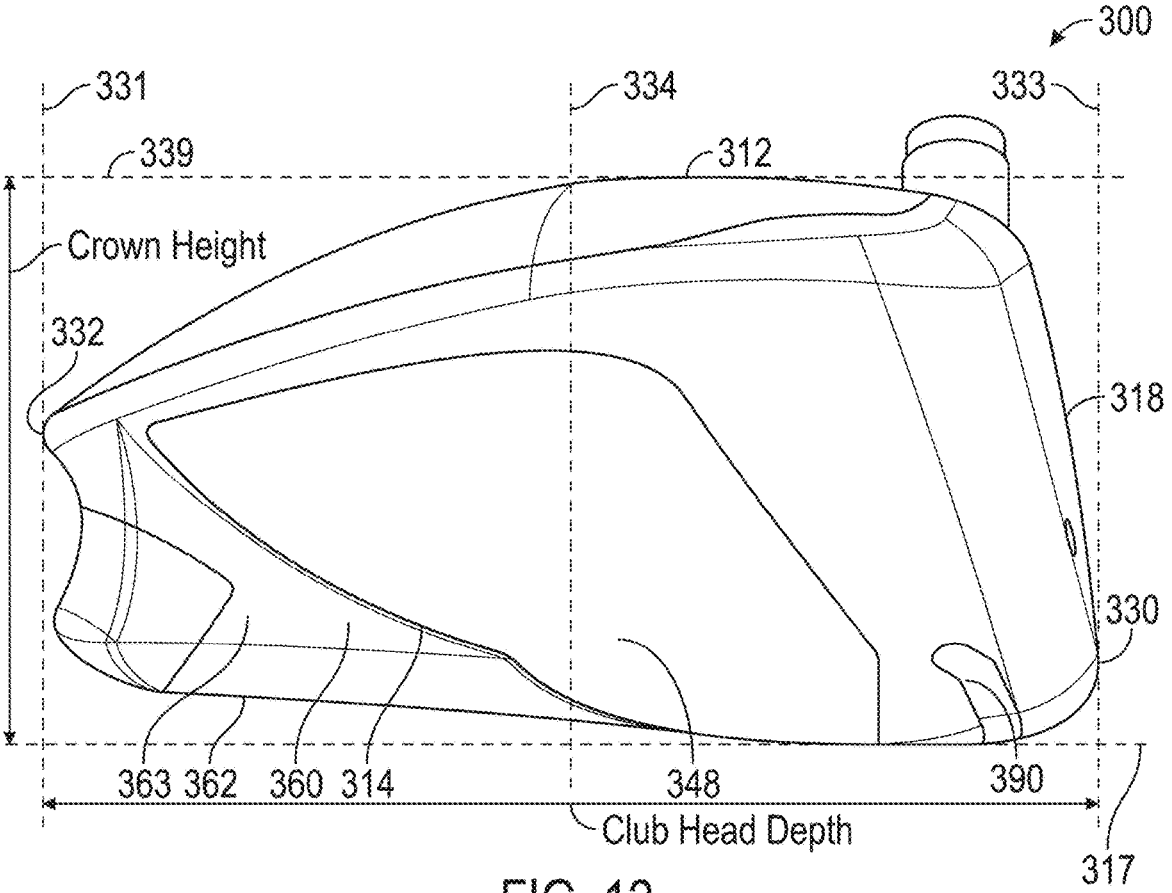
FIG. 12 is a side elevation view from a toe side of a golf club head in accord with one embodiment of the current disclosure.
Figure 13:
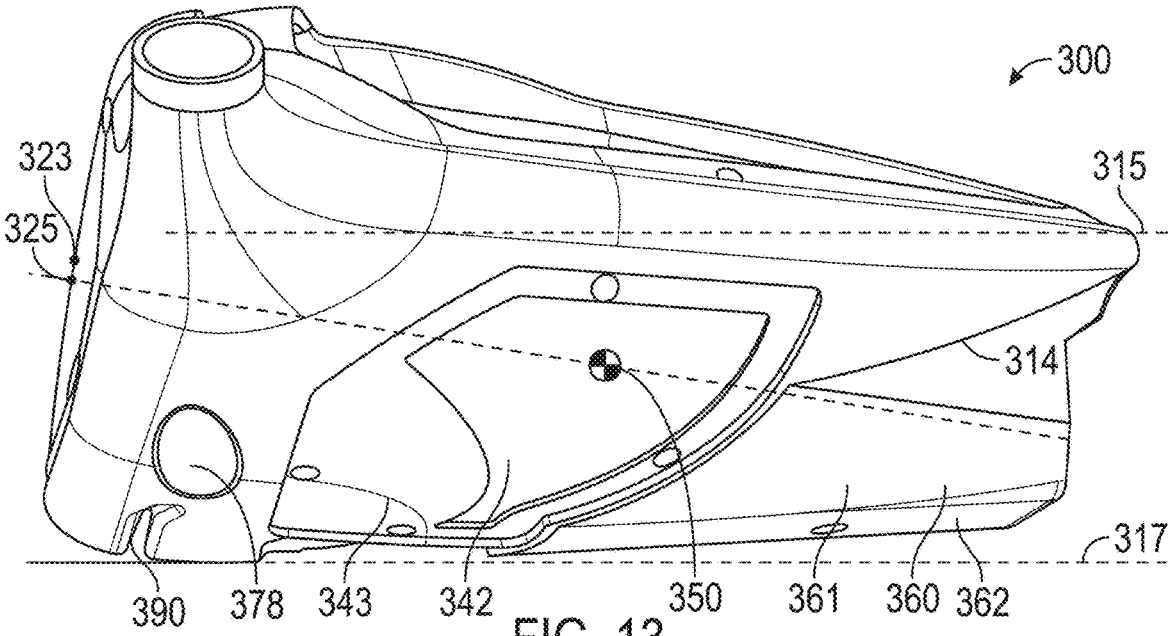
FIG. 13 is a side elevation view from a heel side of a golf club head in accord with one embodiment of the current disclosure, with sole and crown inserts removed.

A front plane 331 that extends from a forwardmost point of the golf club head, and a rear plane 333 that extends from a rearward most point of the golf club head. Each of these planes extends from its respective point and is perpendicular to the ground plane 317. Together, the planes may be used to measure the front to back depth of the golf club head ("club head depth"), as illustrated in FIG. 12. A midpoint plane 334 extends perpendicular to the ground plane 317 halfway between the front plane 331 and the rear plane 333. As illustrated in FIG. 13, a center 323 is disposed on the striking surface 318. Also shown on the face is the projected CG point 325. Golf club head 300 also has a skirt height 315, which may measure the lowest point above the ground plane at which the skirt meets the crown. In some embodiments, the skirt height 315 may be between 25 mm and 40 mm, such as between 30 mm and 40 mm, or between 30 mm and 35 mm.

Figure 14A:
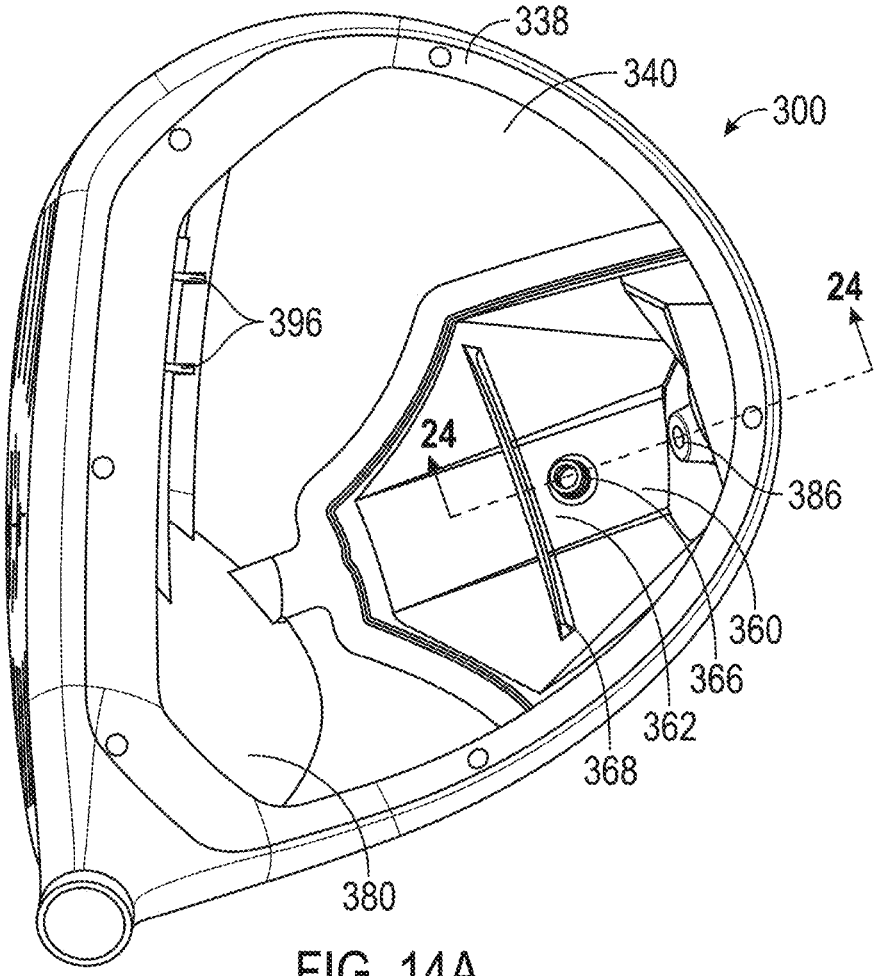
FIG. 14A is a top view of a golf club head in accord with one embodiment of the current disclosure, with a crown insert removed.
Figure 14B:
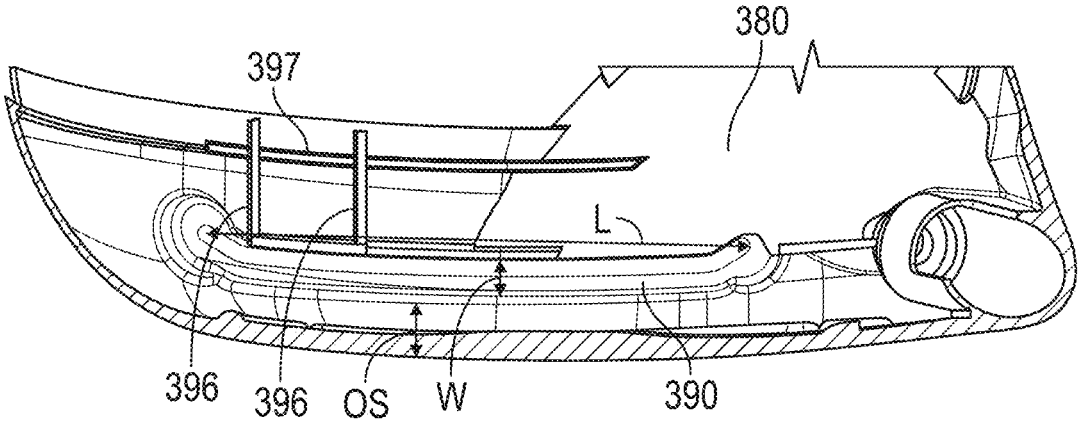
FIG. 14B is a top cross-sectional view of a front portion of a golf club head in accord with one embodiment of the current disclosure.
Figure 15:
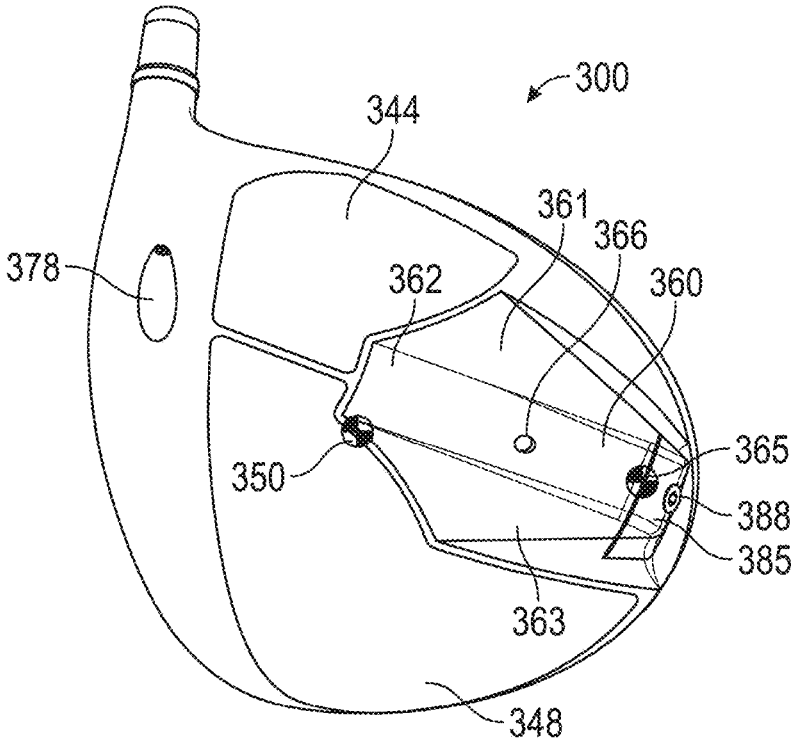
FIG. 15 is a bottom perspective view of a golf club head in accord with one embodiment of the current disclosure.
Figure 16:
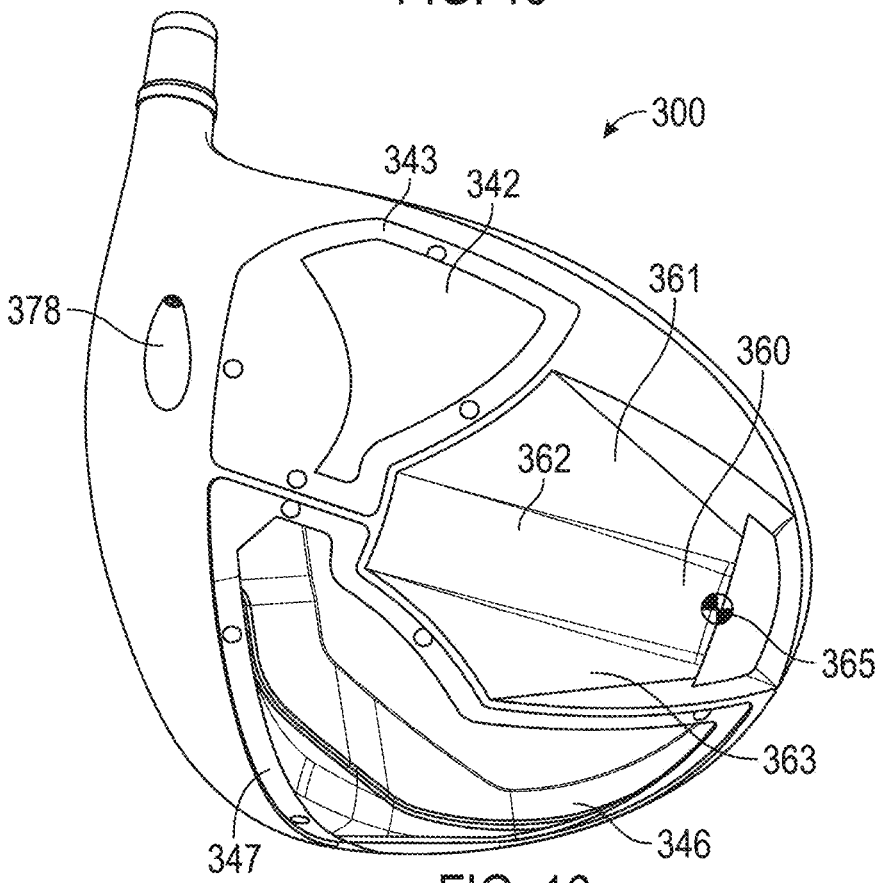
FIG. 16 is a bottom perspective view of a golf club head in accord with one embodiment of the current disclosure, with two sole inserts removed.

As best illustrated in FIGS. 12 and 13, the center sole portion 362 comprises an elongate and substantially planar surface that is closer to the ground plane 317 than the surrounding portions of the sole 314 that are toeward and heelward of the inertia generator 360. In certain embodiments, the inertia generator 360 is angled so that a rear end of the inertia generator is toeward of a front end. An angle of the inertia generator relative to the y-axis may be in the range of 10 to 25 degrees, such as between 15 and 25 degrees, such as between 17 and 22 degrees. As illustrated in FIGS. 14A and 15, an aperture 366 may be provided within the center sole portion 362, which aperture may be used for introducing hot melt into the inner cavity of the golf club head. Also provided is an inertia generator support rib 368, which may run along the inside of the golf club head under inertia generator 360. A cross-section of the inertia generator may be taken along line 24-24. Inertia generator support rib 368 may not only help provide structural support for the inertia generator, it may also help constrain any hot melt that is injected using aperture 366.

As best illustrated in FIGS. 12 and 15, the inertia generator further comprises a heelward sole surface 361 and a toeward sole surface 363 that slope upwardly from the center sole portion 362 to the sole 314 when viewed in the normal address position. The heelward sole surface 361 may have a generally triangular shape, with: a base that faces generally forward and heelward (and may be substantially parallel to the heel sole insert 344, a first edge adjacent the center sole portion 362 that extends rearwardly from the toeward end of the base generally parallel to the center sole portion, and a second edge that extends from the heelward end of the base at a position on the sole 314 to a position that is "raised up" from the sole at or proximate to the heelward side of the center sole portion 362 at the rear 332 of the golf club head. The toeward sole surface 363 may likewise have a generally triangular shape, with: a base that faces generally forward and toeward (and may be substantially parallel to the toe sole insert 348, a first edge adjacent the center sole portion 362 that extends rearwardly from the heelward end of the base generally parallel to the center sole portion, and a second edge that extends from the toeward end of the base at a position on the sole 314 to a position that is "raised up" from the sole at or proximate to the toeward side of the center sole portion 362 at the rear 332 of the golf club head. The inertia generator is configured so that a center of gravity 365 may in certain embodiments be positioned toeward of the x axis and lower (or closer to the ground plane 317) than the z-axis. In other words, the inertia generator may help to move the club's overall center of gravity 350 toeward, while also lowering its center of gravity, reducing Zup, as described above.

Example values for the inertia generator's center of gravity 365 are set forth below. In certain embodiments, the inertia generator may have a center of gravity 365 relative to the center 323 of the striking surface 318 as measured on the:

- x-axis ($CG_x$) of between −10 mm and −25 mm, such as between −15 mm and −20 mm;
- y-axis ($CG_y$) of between 80 and 110 mm, such as between 90 and 100 mm; and
- z-axis ($CG_z$) of between 0 and −20 mm, such as between −10 mm and −20 mm.

Additionally, due to its shape and orientation, the inertia generator is configured to generally align with a typical swing path, permitting increased inertia generated during a golf swing. Example moments of inertia for golf club head 300 are set forth below.

As best illustrated in FIG. 14A, the crown can be formed to have a recessed peripheral ledge or seat 338 to receive the crown insert 335, such that the crown insert is either flush with the adjacent surfaces of the body to provide a smooth seamless outer surface or, alternatively, slightly recessed below the body surfaces. The crown insert 335 may cover a large opening 340 (illustrated in FIG. 14A) at the top and rear of the body, forming part of the crown 312 of the golf club head. Heel sole insert 344 and toe sole insert 348 may be secured to the body 310 to cover heel sole opening 342 and toe sole opening 346, respectively, in the sole rearward of the hosel (illustrated in FIG. 16). Heel sole opening 342 has a heel sole ledge 343 for supporting heel sole insert 344. Similarly, toe sole opening 346 has a toe sole ledge 347 for supporting toe sole insert 348. The golf club head may comprise a forward mass pad 380 positioned heelward and forward on the sole 314.

As best illustrated in FIG. 15, a plurality of characteristic time ("CT") tuning screws 375 may be inserted through apertures 374 in the striking surface. Dampening material such as tuning foam 376 may be inserted through one or both of these apertures into the inner cavity 394 of the golf club head 300 to adjust the characteristic time. For example, a dampening material may be added that, upon hardening, may lower the CT time. Additional details about providing tuning of the characteristic time are provided in U.S. patent application Ser. No. 15/857,407, filed Dec. 28, 2017, the entire contents are hereby incorporated by reference herein.

Positioned on a rear side of the inertia generator 360 is inertia generator mass element 385, which may comprise a steel or tungsten weight member or other suitable material. Inertia generator mass element 385 may be removably affixed to the rear of the inertia generator 360 using a fastener port 386 that is positioned in the rear of the inertia generator 360 and configured to receive a fastener 388, which may be removably inserted through an aperture 387 in the inertia generator mass element 385 and into the fastener port 386. Fastener port 386 and aperture 387 may be threaded so that fastener 388 can be loosened or tightened either to allow movement of, or to secure in position, inertia generator mass element 385. The fastener may comprise a head with which a tool (not shown) may be used to tighten or loosen the fastener, and a body that may, e.g., be threaded to interact with corresponding threads on the fastener port 386 and aperture 387 to facilitate tightening or loosening the fastener 388.

The fastener port 386 can have any of a number of various configurations to receive and/or retain any of a number of fasteners, which may comprise simple threaded fasteners, such as described herein, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference herein.

Figure 17:
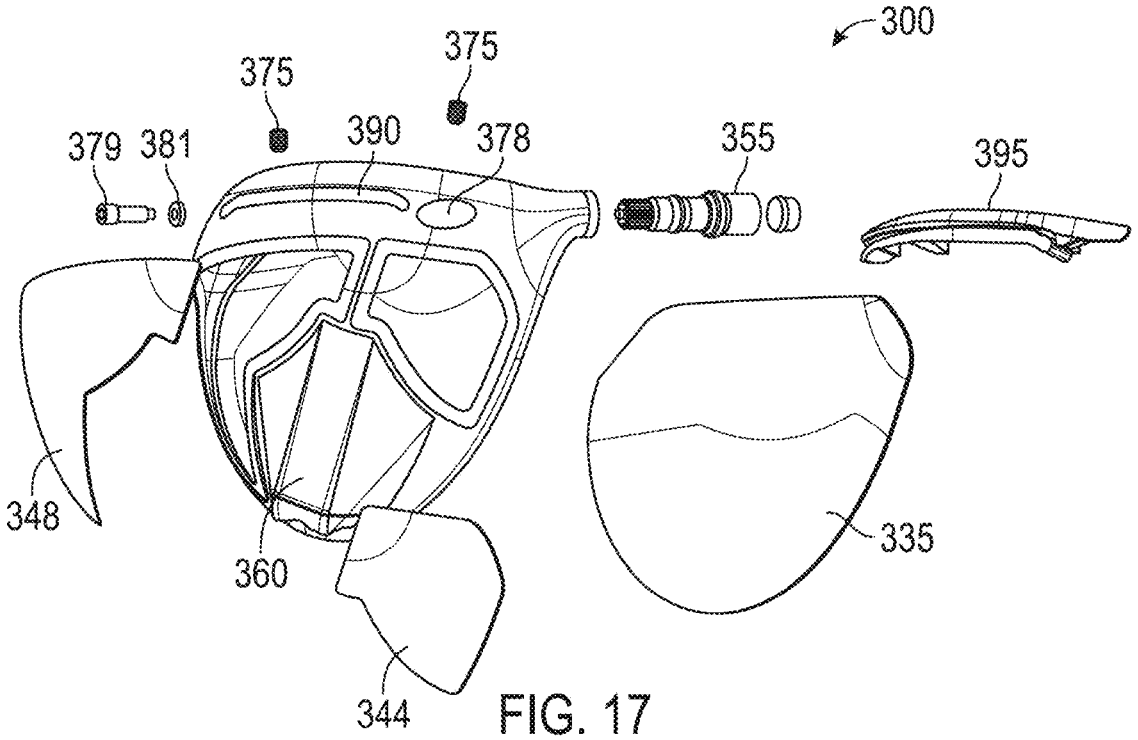
FIG. 17 is an exploded perspective view of a golf club head in accord with one embodiment of the current disclosure.
Figure 18:
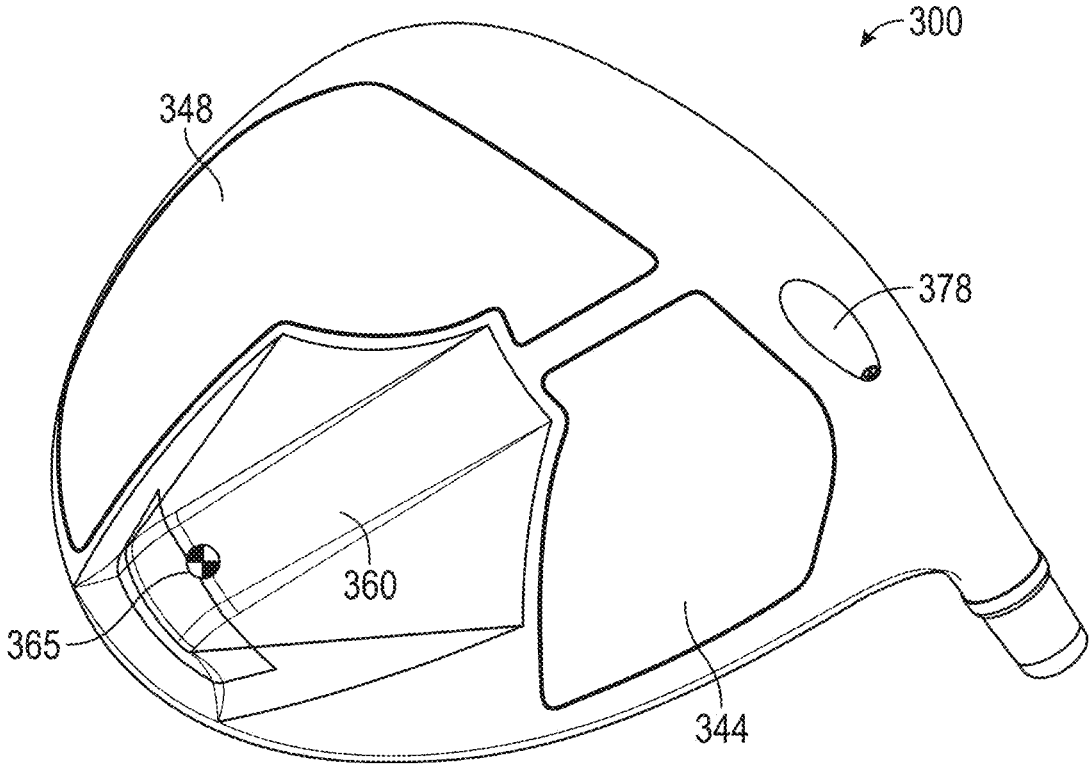
FIG. 18 is a bottom perspective view from a heel side of a golf club head in accord with one embodiment of the current disclosure.

As illustrated in FIG. 17, the golf club head's hosel 320 has a hosel bore 324 that may accommodate a shaft connection assembly 355 that allows the shaft to be easily disconnected from the golf club head, and that may provide the ability for the user to selectively adjust a and/or lie-angle of the golf club. The shaft connection assembly 355 may comprise a shaft sleeve that can be mounted on the lower end portion of a shaft (not pictured), as described in U.S. Pat. No. 8,303,431. A recessed port 378 is provided on the sole 314, and extends from the sole 314 toward the hosel 320, and in particular the hosel bore 324. The hosel bore 324 extends from the hosel 320 through the golf club head 310 and opens within the recessed port 378 at the sole 314 of the golf club head 300. The hosel bore may contain threads that are configured to interact with a fastener such as a screw. The golf club head is removably attached to the shaft by shaft connection assembly 355 (which is mounted to the lower end portion of a golf club shaft (not shown)) by inserting one end of the shaft connection assembly 355 into the hosel bore 324, and inserting a screw 379 (or other suitable fixation device) upwardly through the recessed port 378 in the sole 314 and, in the illustrated embodiment, tightening the screw 379 into a threaded opening of the shaft connection assembly 355, thereby securing the golf club head to the shaft sleeve 302. A screw capturing device, such as in the form of an O-ring or washer 381, can be placed on the shaft of the screw 379 to retain the screw in place within the golf club head when the screw is loosened to permit removal of the shaft from the golf club head. For embodiments having a shaft connection assembly 355 the club head mass and mass properties, including but not limited to the CG location, associated measurements utilizing the CG location, and moments of inertia are determined with all components of the shaft connection assembly 355 installed.

Figure 19:
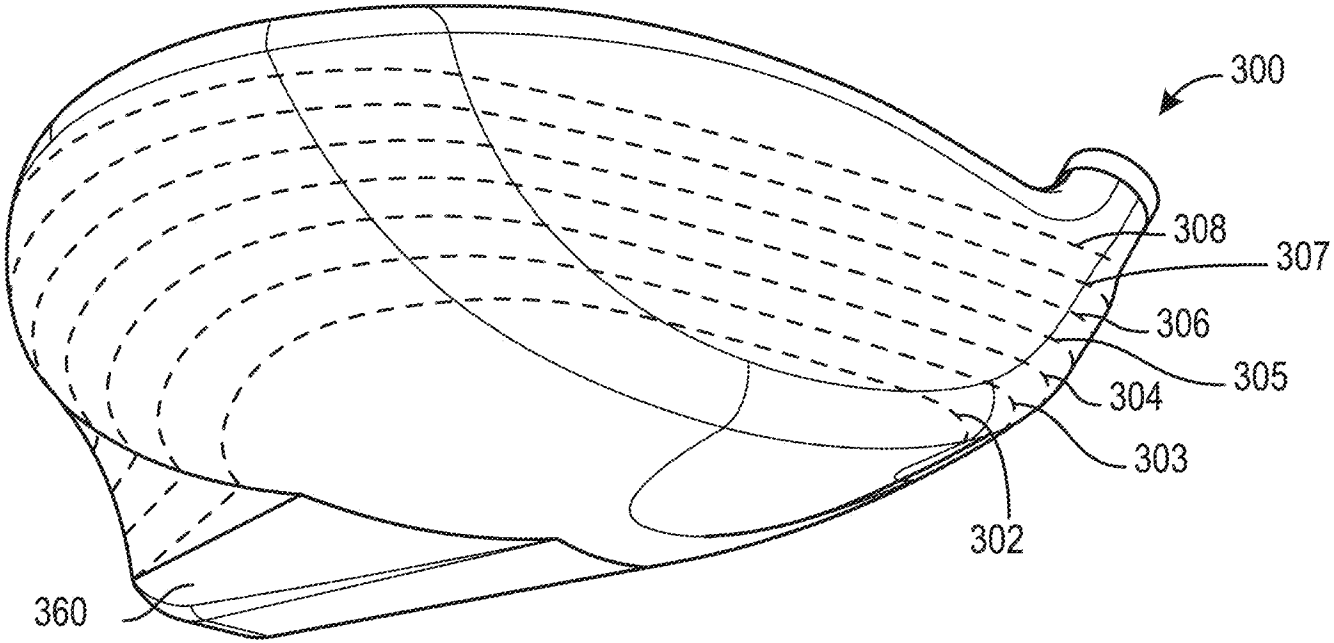
FIG. 19 is a perspective view from a toe side of a golf club head in accord with one embodiment of the current disclosure, providing elevation markers on the golf club head at various heights relative to a ground plane.

Illustrated in FIG. 19 are dashed lines surrounding golf club head 300. Each of these dashed lines represents a fixed distance above a ground plane when golf club head 300 is in normal address position, so that a cross-section of the golf club head taken at one of the respective lines would be positioned at a consistent height above the ground plane. For example, 10 mm cross-section line 302 represents the cross-section of golf club head 300 at a position 10 mm above the ground plane. In turn:

- 15 mm cross-section line 303 represents the cross-section of golf club head 300 at a position 15 mm above the ground plane;
- 20 mm cross-section line 304 represents the cross-section of golf club head 300 at a position 20 mm above the ground plane;
- 25 mm cross-section line 305 represents the cross-section of golf club head 300 at a position 25 mm above the ground plane;
- 30 mm cross-section line 306 represents the cross-section of golf club head 300 at a position 30 mm above the ground plane;
- 35 mm cross-section line 307 represents the cross-section of golf club head 300 at a position 35 mm above the ground plane; and
- 40 mm cross-section line 308 represents the cross-section of golf club head 300 at a position 40 mm above the ground plane.

As discussed above, the CGx orientation of the golf club head may be moved toeward (along the negative x-axis) or heelward (along the positive x-axis) to provide to generate specific properties of the golf club head, such as increasing MOI, increasing ball speed and reducing "gear effect." However, orientating the CGx toeward may result in the striking face of the golf club head remaining open at impact with the golf ball. In this example, when the CGx is oriented along the negative x-axis, it may be more difficult for the user to square (e.g., release) the club head in the downswing, resulting in users hitting the ball right (i.e., a "slice" or "blocked" shot). Conversely, when the orientating the CGx heelward may result in the striking face of the golf club head to be closed at impact with the golf ball. In this example, when the CGx is oriented along the positive x-axis, the club head may release early, making it more difficult for the user to keep the striking face from closing too quickly in the downswing, resulting in the user hitting the ball left (i.e., a "hook" or "pulled" shot). To overcome the missed shots resulting from the negative or positive CGx orientations, visual cues may be provided to offset the CGx orientation (i.e., altering the perceived angle of the face 110 for the user), allowing the user to hit the ball straighter with fewer misses.

As discussed above, in some embodiments, one or more features of the golf club head may be provided to alter the perceived angle of the face for the user. For example, referring back to FIG. 3, the golf club head 600 includes an alignment feature to alter the perceived angle of the face 110 for the user. In implementations with a negative CGx orientation, an alignment feature is provided to alter the perceived top line relative to striking face, with the perceived top line appearing to be square while the actual face angle is closed relative to the perceived top line. By closing the actual face angle relative to the perceived top line, the user counteracts the miss right by closing the club head in the downswing to square the striking face at impact with the golf ball. Conversely, in implementations with a positive CGx orientation, a different alignment feature is provided to alter the perceived top line relative to striking face, with the perceived top line appearing to be square while the actual face angle is open relative to the perceived top line. By opening the actual face angle relative to the perceived top line, the user counteracts the miss left by opening the club head in the downswing to square the striking face at impact with the golf ball.

For example, the alignment feature may be provided as a contrasting paint or shading of the crown 120 relative to the color or shading of the face 110. In this example, users tend to focus on the perceived top line produced by the contrasting paint, such as via white or another color paint contrasting with the metal striking face, even when the actual face angle is visible to the user. The user tends to ignore the actual face angle when contrasting paint of shading is provided. Further, the alignment feature may also provide for unconscious correction during the swing. Specifically, by perceiving the club to be square when the actual face angle is closed or open relative to the perceived top line, the user will naturally and unconsciously attempt to square the perceived top line at impact with the golf ball, correcting for the misses caused by the CGx orientation.

In some implementations, the alignment feature may alter the perceived top line from about 2 to about 4 degrees open or closed relative to the actual face angle. In some implementations, for each 5 percent change in negative or positive CGx orientation, the perceived top line is 1 degree open or closed, respectively, with respect to the actual face angle (i.e., opening or closing the perceived top line relative to the actual face angle), causing the user to close or open the actual face angle at the address position. Depending on the golf club, each degree of perceived top line change may affect lateral dispersion in a resultant shot by a set amount. For example, changing the perceived top line of a driver by one degree may reduce dispersion by approximately five yards. In another example, changing the perceived top line of a fairway wood by one degree may reduce dispersion by approximately three yards.

In some implementations, the alignment feature may be provided as a parabola defined relative to the striking face. For example, a point on parabola relative to the striking face is provided from about 2 to about 4 degrees open or closed relative to the angle of the striking face. Depending on the golf club, the radius of the alignment feature may affect lateral dispersion in a resultant shot by a set amount. For example, changing the radius of the parabola defining the topline of a driver by one degree may reduce dispersion by approximately five yards. In another example, changing the radius of the parabola defining the topline of a fairway wood by one degree may reduce dispersion by approximately three yards.

In some embodiments, grooves and/or score lines of the golf club head may be provided to alter the address position for the user, aligning the address position with the CG orientations. Referring back to FIG. 1B, grooves and/or score lines are located on the striking face 110, traditionally positioned at the center of face (CF) located at the origin 205 of the coordinate system 200. Orientating the CGx along the positive or negative x-axis, without moving scorelines from the CF, may cause the user to address the golf club head to the golf ball without aligning the CGx with the golf ball. If the user does not align the golf ball with the CGx, the user may strike the golf ball at a location on the striking face that does not correspond with the CGx location, decreasing ball speed and the accuracy of the golf shot. For example, for a positive CGx, striking the club at the CF does not correspond with the positive CGx orientation. Further, if the user strikes the ball at a location on the striking face corresponding to the positive CGx (i.e., toewardly of the score lines provided at CF), the user may believe that the shot was mishit, resulting in the user misaligning future shots. In some implementations, score lines and/or grooves are provided offset from CF at a location on the striking face corresponding the CGx, CGy and CGz orientations. The score lines and grooves also serve as an alignment aid at address. For example, in the example of a negative CGx, the score lines and/or grooves are positioned toewardly of CF to encourage the user to address and strike the ball more toewardly (i.e., aligned with the negative CGx). In this example, the score lines and/or grooves are positioned toeward of a geometric center of the face. Thus, the score lines and/or grooves are aligned for maximum performance (i.e., maximum ball speed, reducing gear effect, reducing dispersion, and the like).

Further, golf club designs are provided to counteract the left and right tendency that a player encounters when the ball impacts a high, low, heelward and/or toeward position on the club head striking face. One such golf club design incorporates a "twisted" bulge and roll contour, such as discussed in U.S. Pat. Nos. 9,814,944 and 10,265,586 and U.S. Patent Pub. No. 2019/0076705, which are incorporated herein by reference in their entireties.

Figure 20A:
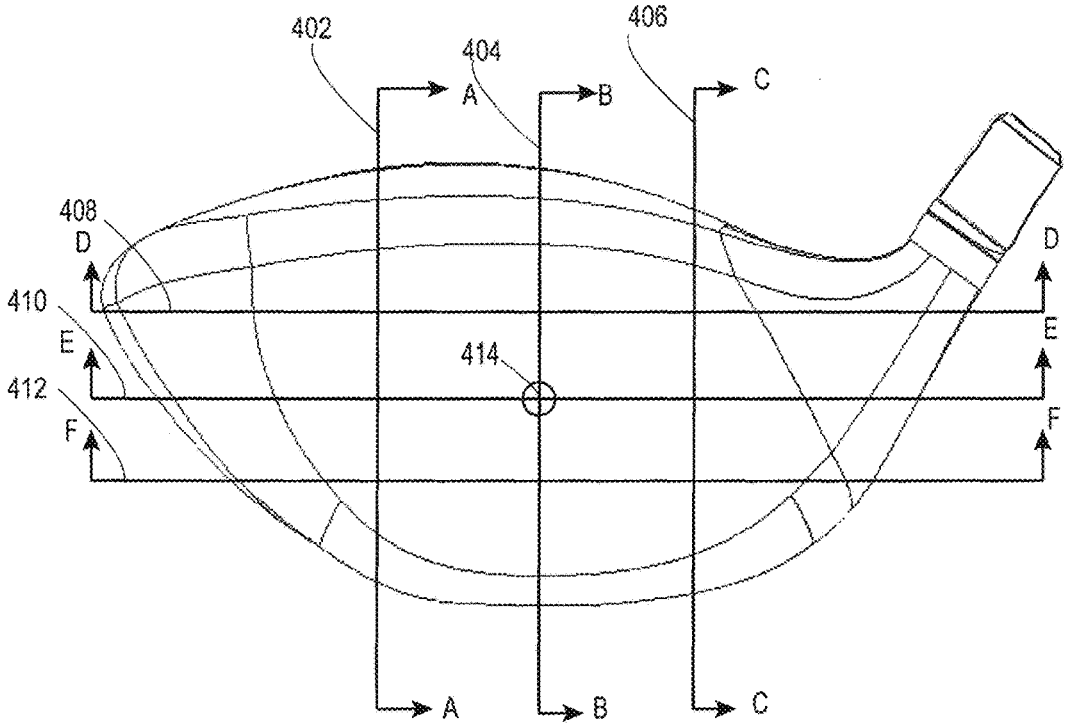
FIG. 20*a* is a front elevation view of a golf club according to an embodiment.

FIG. 20*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 20B:
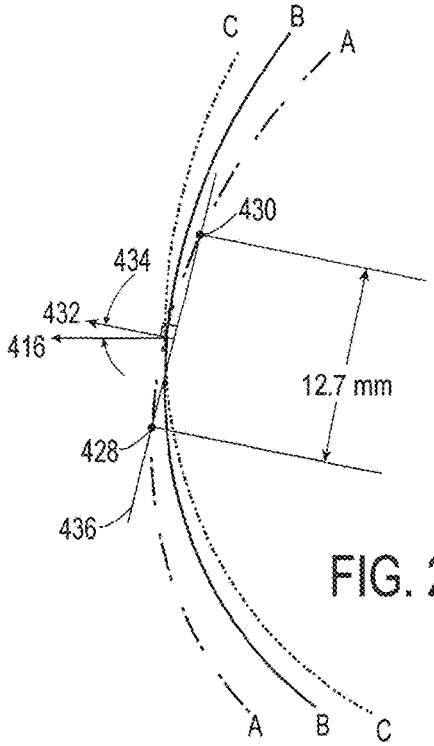
FIG. 20*b* is an exaggerated comparative view of face surface contours taken along section lines A-A, B-B, and C-C of FIG. 20*a*, as seen from a heel view.

FIG. 20*b* illustrates all three striking face surface roll contours A,B,C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A,B,C are considered three different roll contours across the striking face taken at three different locations to show the variability of roll across the face. The toe side vertical contour A is more lofted (having positive LA° Δ) relative to the center face vertical contour B. The heel side vertical contour C is less lofted (having a negative LA° Δ) relative to the center face vertical contour B.

FIG. 20*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA° Δ) is positive relative to the center face vector 416 and points above or higher relative to the center face vector 416 as is the case for the roll curvature A.

Figure 20C:
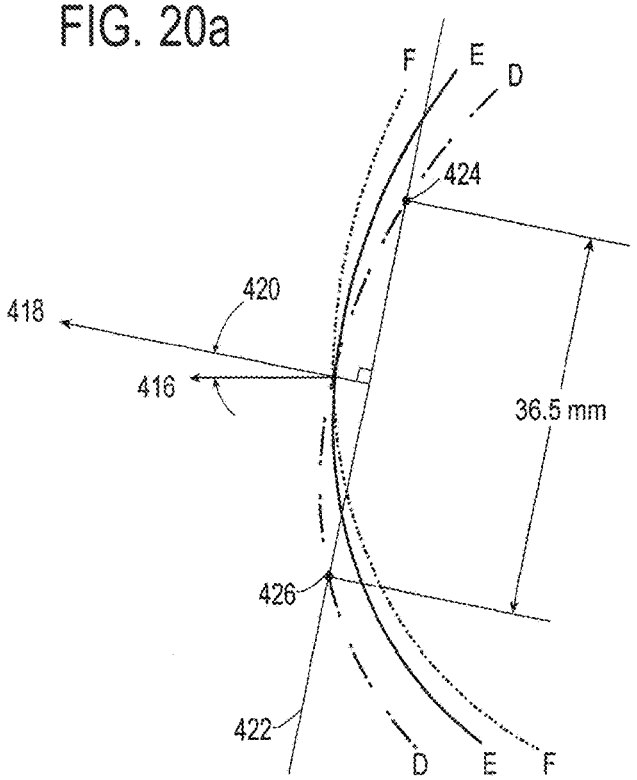
FIG. 20*c* is an exaggerated comparative view of face surface contours taken along section lines D-D, E-E, and F-F of FIG. 20*a*, as seen from a top view.

FIG. 20*c* further illustrates three striking face surface bulge contours D,E,F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D,E,F are considered three different bulge contours across the striking face taken at three different locations to show the variability of bulge across the face. The crown side bulge contour D is more open (having a positive FA° Δ, defined below) when compared to the center face bulge contour E. The sole side bulge contour F is more closed (having a negative FA° Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 20*b* and 20*c* are severely distorted in order for explanation purposes.

In order to determine whether a 2-D contour, such as A, B, C, D, E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, CA. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 20*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA° Δ) is positive relative to the center face vector 416 and points to the right as is the case for the bulge curvature D.

Figure 21:
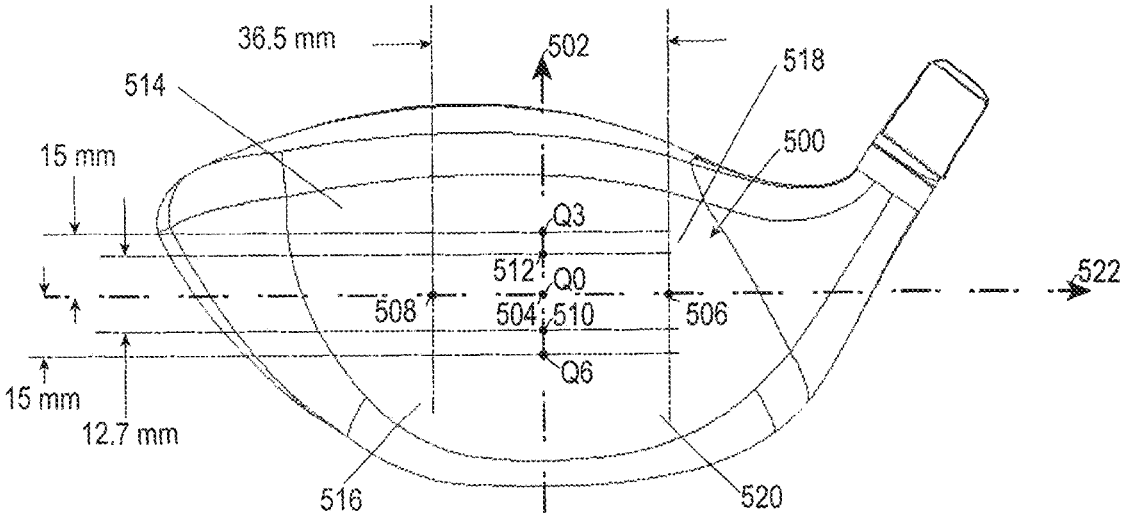
FIG. 21 is a front view of a golf club face with multiple measurement points and four quadrants.

FIG. 21 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 21, the face angle and loft are measured for a center face point Q0 when an easily measurable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive z-axis 502 for face point measurements extends from the center face toward the crown of the club head and is tangent to the center face. The x-z coordinate system at center face, without a loft component, is utilized to locate the plurality of points P0-P36 and Q0-Q8, as described below. The positive y-axis 504 extends from the face center and is perpendicular to the face center point and away from the internal volume of the club head. The positive y-axis 504 and positive z-axis 502 will be utilized as a reference axis when the face angle and loft angle are measured at another y-z coordinate location, other than center face.

FIG. 21 further shows two critical points Q3 and Q6 located at coordinates (0 mm, 15 mm) and (0 mm, −15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3,Q6 is 1°, hence the nomenclature "1° twist".

Figure 22A:
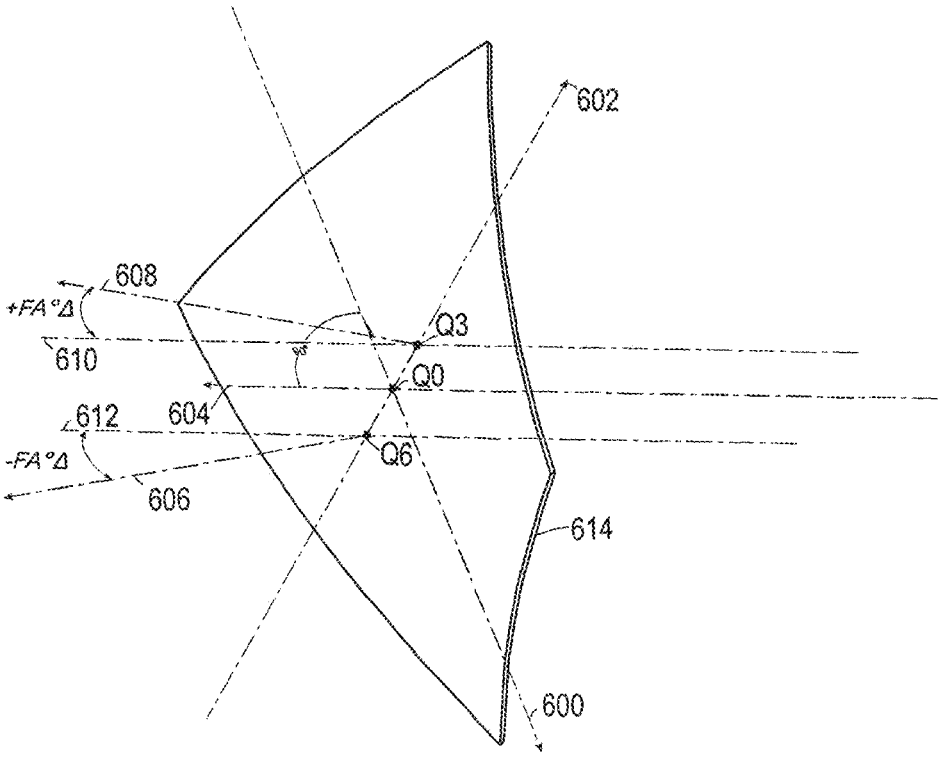
FIG. 22*a* is an isometric view of an exemplary twisted face surface plane.

To further the understanding of what is meant by a "twisted face", FIG. 22*a* provides an isometric view of an over-exaggerated twisted striking surface plane 614 of "10° twist" to illustrate the concept as applied to a golf club striking face. Each point located on the golf club face has an associated loft angle change (defined as "LA° Δ") and face angle change (defined as "FA° Δ"). Each point has an associated loft angle change (defined as "LA° Δ") and face angle change (defined as "FA° Δ").

FIG. 22*a* shows the center face point, Q0, and the two critical points Q3,Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614. Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 22B:
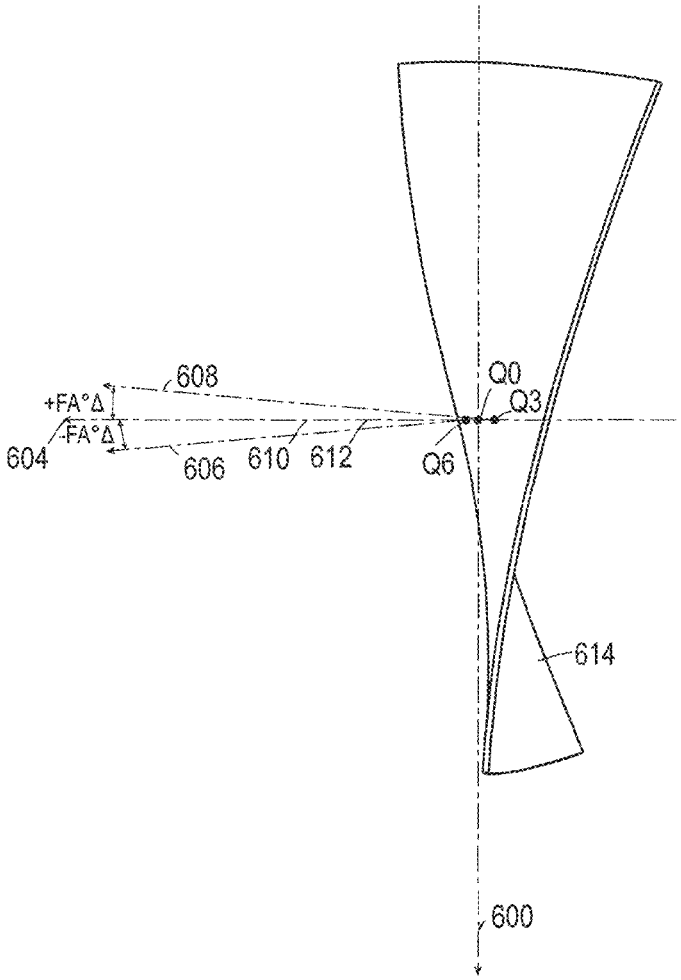
FIG. 22*b* is a top view of an exemplary twisted face surface plane.

FIG. 22*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA° Δ indicates a perpendicular axis at a measured point that points to the right of the relative reference axis. A negative face angle change −FA° Δ indicates a perpendicular axis that points to the left of the relative reference axis. The face angle change is measured within the plane created by the positive x-axis 600 and positive z-axis 604.

Figure 22C:
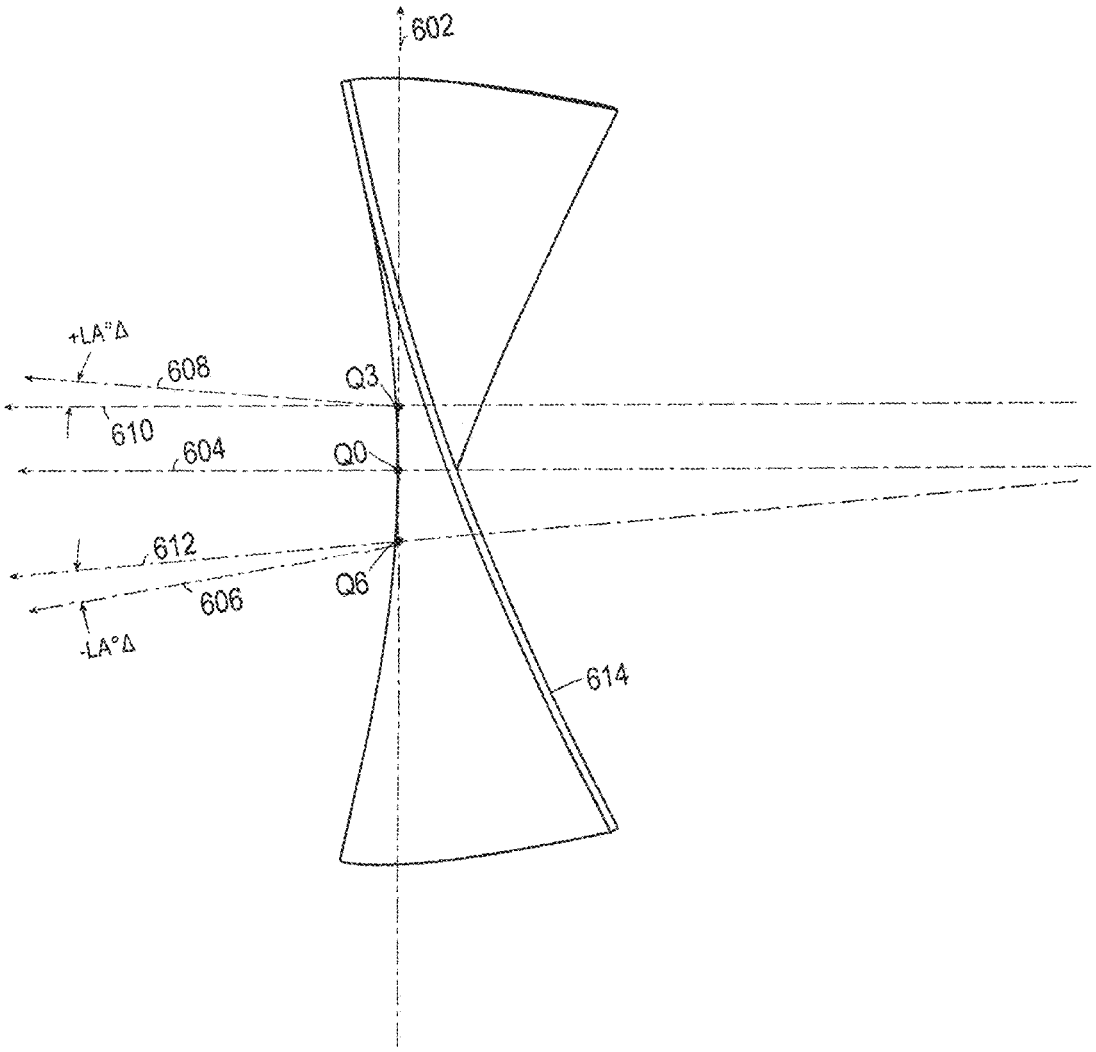
FIG. 22*c* is an elevated heel view of an exemplary twisted face surface plane.

FIG. 22*c* shows a heel side view of a twisted plane 614 and the loft angle change between the perpendicular axes 608,606 and the reference axes 610,612 at the critical point locations. A positive loft angle change +LA° Δ indicates a perpendicular axis at a measured point that points above the relative reference axis. A negative loft angle change −LA° Δ indicates a perpendicular axis that points below the relative reference axis. The loft angle is measured within the plane created by the positive z-axis 604 and positive y-axis 602 for a given measured point.

Figure 23:
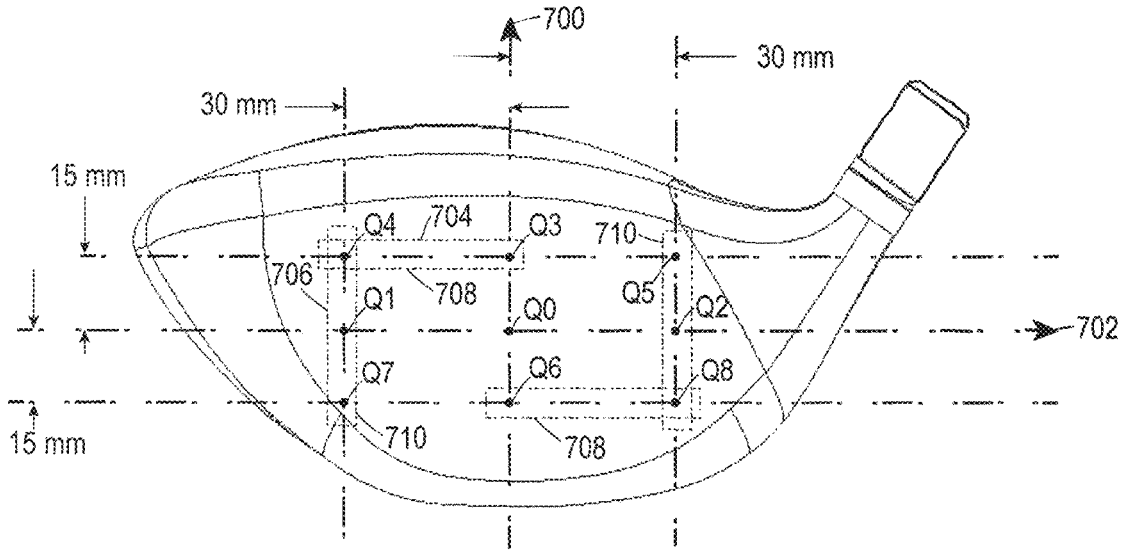
FIG. 23 illustrates a front view of a golf club with a predetermined set of measurement points.
Figure 24:
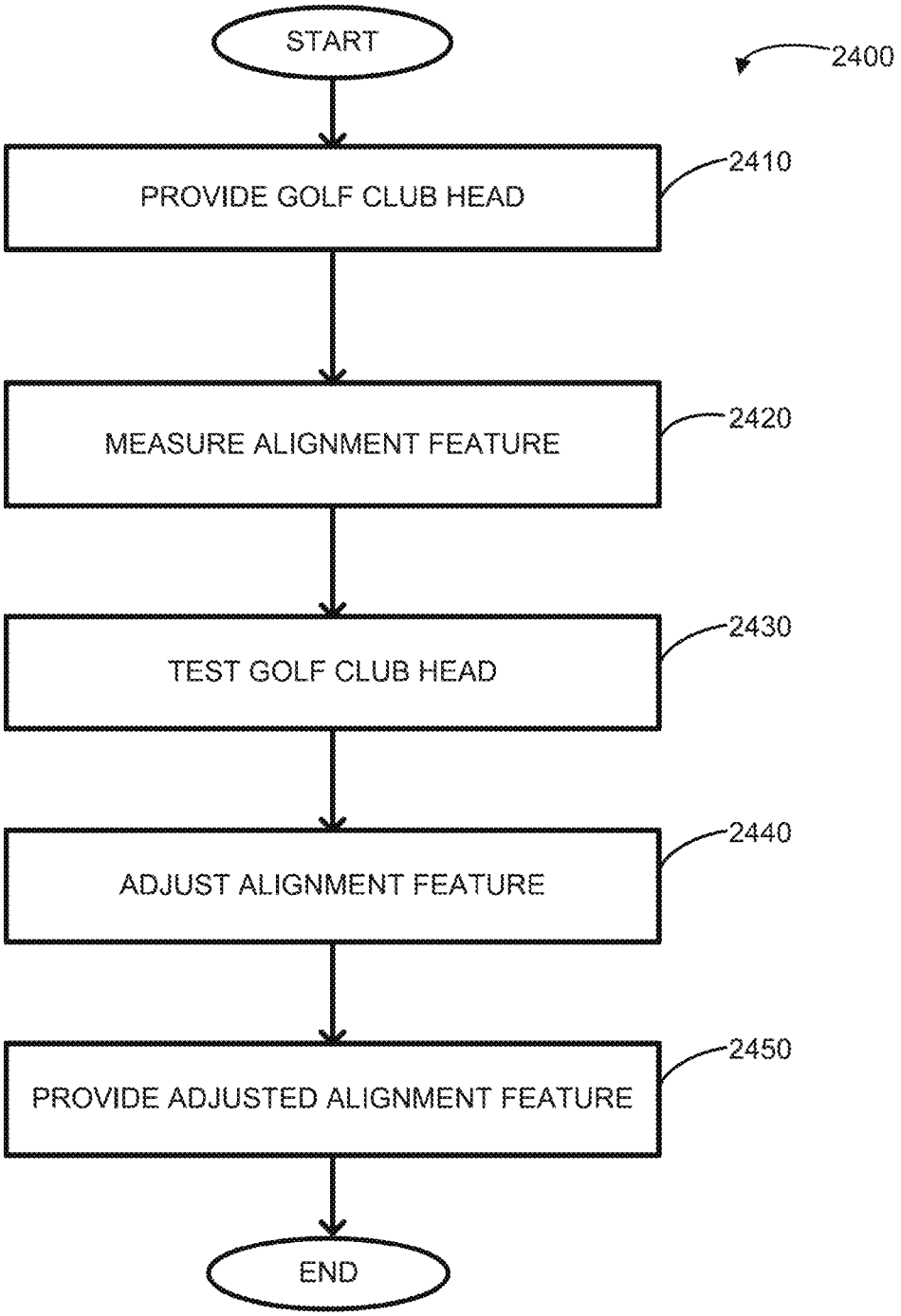
FIG. 24 is a flowchart of a method in accordance with one or more of the present embodiments.

FIG. 23 shows an additional plurality of points Q0-Q8 that are spaced apart across the striking face in a grid pattern. In addition to the critical points Q3,Q6 described above, heel side points Q5,Q2,Q8 are spaced 30 mm away from a vertical axis 700 passing through the center face. Toe side points Q4,Q1,Q7 are spaced 30 mm away from the vertical axis 700 passing through the center face. Crown side points Q3,Q4,Q5 are spaced 15 mm away from a horizontal axis 702 passing through the center face. Sole side points Q6,Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist", 1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 23, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

For example, if a head has a bulge radius (Bulge), and roll radius (Roll), it is possible to define two bounding surfaces for the desired twisted face surface by specifying two different twist amounts (DEG). In an embodiment, the striking face has a bulge radius between 228.6 mm and 355.6 mm. In another embodiment, the striking face has a bulge radius between 228.6 mm and 330.2 mm. Additional and different bulge radii may be used.

Table 1 shows the LA° Δ and FA° Δ relative to center face for points located along the vertical axis 700 and horizontal axis 702 (for example points Q1,Q2,Q3, and Q6). With regard to points located away from the vertical axis 700 and horizontal axis 702, the LA° Δ and FA° Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA° Δ is measured relative to point Q3 having the same vertical axis 700 coordinate at (0 mm, 15 mm). In other words, both Q3 and Q4 have the same y-coordinate location of 15 mm. Referring to Table 1, the LA° Δ of point Q4 is 0.4° with respect to the loft angle at point Q3. The LA° Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA° Δ is measured relative to point Q1 having the same horizontal axis 702 coordinate at (−30 mm, 0 mm). In other words, both Q1 and Q4 have the same x-coordinate location of −30 mm. Referring to Table 1, the FA° Δ of point Q4 is 0.2° with respect to the face angle at point Q1. The FA°

Δ of point Q4 is measured with respect to point Q1 which is located in a corresponding upper toe vertical band 706.

To further illustrate how LA° Δ and FA° Δ are calculated for points located within a quadrant that are away from a vertical or horizontal axis, the LA° Δ of point Q8 is measured relative to a loft angle located at point Q6 within a lower heel quadrant horizontal band 708. Likewise, the FA° Δ of point Q8 is measured relative to a face angle located at point Q2 within a lower heel quadrant vertical band 710.

In summary, the LA° Δ and FA° Δ for all points that are located along either a horizontal 702 or vertical axis 700 are measured relative to center face Q0. For points located within a quadrant (such as points Q4, Q5, Q7, and Q8) the LA° Δ is measured with respect to a corresponding point located in a corresponding horizontal band, and the FA° Δ of a given point is measured with respect to a corresponding point located in a corresponding vertical band. In FIG. 23, not all bands are shown in the drawing for the improved clarity of the drawing.

The reason that points located within a quadrant have a different procedure for measuring LA° Δ and FA° Δ is that this method eliminates any influence of the bulge and roll curvature on the LA° Δ and FA° Δ numbers within a quadrant. Otherwise, if a point located within a quadrant is measured with respect to center face, the LA° Δ and FA° Δ numbers will be dependent on the bulge and roll curvature. Therefore utilizing the horizontal and vertical band method of measuring LA° Δ and FA° Δ within a quadrant eliminates any undue influence of a specific bulge and roll curvature. Thus the LA° Δ and FA° Δ numbers within a quadrant should be applicable across any range of bulge and roll curvatures in any given head. The above described method of measuring LA° Δ and FA° Δ within a quadrant has been applied to all examples herein.

The relative LA° Δ and FA° Δ can be applied to any lofted driver, such as a 9.5°, 10.5°, 12° lofted clubs or other commonly used loft angles such as for drivers, fairway woods, hybrids, irons, or putters.

TABLE 1

| Relative to Center Face and Bands | | | | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA°Δ | FA°Δ | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

In some implementations, a "twisted" bulge and roll contour of the striking face of the golf club head may alter the perceived angle of the face for the user. For example, referring back to FIG. 21, the upper toe quadrant 514 is more "open" than all the other quadrants of the striking face, resulting in the perceived angle of the face to appear open to the user at address. The perceived angle of the face resulting from the "twisted" bulge and roll contour of the striking face may cause misalignment by the user at addresses, such as setting up the actual face angle of the club closed with respect to the intended target line, resulting in the user hitting the ball left (i.e., a "hook" or "pulled" shot). Further, the perceived angle of the face resulting from the "twisted" bulge and roll contour may be aesthetically unpleasing to the user, with a square striking face appearing open at address. To correct for the perceived angle of the face resulting from the "twisted" bulge and roll contour, an alignment feature is provided to alter the perceived top line relative to striking face.

In some embodiments, an alignment feature is provided to alter the perceived angle of the face for the user to appear closed with respect to the upper toe quadrant 514 of the striking face. In other embodiments, an alignment feature is provided to alter the perceived angle of the face for the user to appear closed with respect to the actual face angle. In the aforementioned embodiments, the alignment feature counteracts the open appearance of "twisted" bulge and roll contour. In some embodiments, the alignment feature may be provided as a contrasting color or shading of the crown 120 relative to the color or shading of the face 110, which may further be implemented through the use of a decal attached to either the crown 120 or the face 110, or even via material removal processes removing, or texturing, a coating, such as paint, PVD, CPVD, or the like, from either the crown 120 or the face 110, which may further include the use of a laser to remove, or texture, said coating. In some embodiments, the contrasting paint or shading extends from the crown 120 onto the face 110. In some implementations, a negative CGx is provided along with a "twisted" bulge and roll contour on the striking face. In some implementations, the negative CGx counteracts some of the alignment issues caused by the "twisted" bulge contour, and vice versa. For example, the "twisted" bulge and roll contour on the striking face may be combined with one or more adjustable weights and/or a discretionary mass strategically positioned at an angle with respect to the striking face. Other combinations of the present embodiments may be provided.

In an embodiment, an alignment feature is provided to alter the perceived angle of the face of a golf club head with a "twisted" bulge and roll contour on the striking face. In this embodiment, the performance of the golf club had can be improved by decreasing lateral dispersion of the golf club head. For example, in the case of a right-handed golfer, lateral dispersion is measured indicating that the golf club has a dispersion tendency for a right miss. The right miss may be the result of the "twisted" bulge and roll contour causing the perceived angle of the face of the golf club head to appear open. The alignment feature may be altered to counteract for the right miss, such as by altering the perceived face angle to appear closed with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a left miss, the alignment feature may be altered to counteract for the left miss by altering the perceived face angle to appear closed with respect to the closed with respect to the actual face angle.

In another embodiment, a different alignment feature is provided to alter the perceived angle of the face of a golf club head with a "twisted" bulge and roll contour on the striking face. In this embodiment, the performance of the golf club had can also be improved by decreasing lateral dispersion of the golf club head. For example, in the case of a right-handed golfer, lateral dispersion is measured indicating that the golf club has a dispersion tendency for a left miss. The left miss may be the result of the "twisted" bulge and roll contour causing the perceived angle of the face of the golf club head to appear closed. The alignment feature may be altered to counteract for the left miss, such as by altering the perceived face angle to appear open with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a right miss, the alignment feature may be altered to counteract for the right miss by altering the perceived face angle to appear closed with respect to the closed with respect to the actual face angle.

In an embodiment, a method 2400 is provided for determining an alignment feature for a golf club head, such as in a head with a negative CGx, a "twisted" bulge and roll, or another design. This method may be performed using one or more of the golf club head embodiments discussed above.

At 2410, a golf club head is provided with an alignment feature. In an embodiment, the golf club head is a new design to be tested prior to large scale manufacturing. In this embodiment, the golf club head may have one or more alignment features. The one or more alignment features may be based on previous designs, such as retained topline properties from a previous design, or may a new alignment feature, such as based on a computer aided design (CAD) model or another club head design. For example, the golf club head may have undergone a complete remodel, such as incorporating a substantial golf club head shape change, or may have been slightly redesigned based on a previous golf club head design. In another embodiment, The golf club head may have only minor differences from another golf club head design, such as a different loft that may result in differences between golf club head designs.

At 2420, the alignment feature is measured. For example, in an embodiment using a top line as an alignment feature, a top line radius is measured. Other alignment features may be measured. Additionally or alternatively, a Sight Adjusted Perceived Face Angle (SAPFA) or other metric of the golf club head may also be measured.

At 2430, the golf club head is tested. For example, a prototype of the new golf club head design are provided for player testing. In this example, one or more players may test the golf club head. Based on the testing, a lateral dispersion of the golf club head may be measured. Other performance metrics may also be measured. Lateral dispersion may be indicative that a different alignment feature may provide better performance, such as less lateral dispersion. In another example, an impression of the alignment feature on the user may also be measured. In this example, if the golf club head face appears too open or too closed during the test, a different alignment feature may improve appeal or confidence in the golf club head to the testers.

At 2440, the alignment feature is adjusted. For example, based on the testing, the one or more alignment features may be adjusted to increase performance and/or appeal of the golf club head. In this example, a top line radius may be adjusted. Based on the lateral dispersion measured during testing, a top line radius may be adjusted one degree for every five yards of lateral dispersion with a driver and adjusted one degree for every three yards of lateral dispersion with a fairway wood. Other adjustment amounts may be provided. Further, additional and different adjustments to the one or more alignment features may be provided.

After the alignment feature is adjusted, one or more of acts 2430 and 2440 may be repeated for additional testing and/or adjustment. In some embodiments, individual player testing may also be performed, such as for individual tour players. At 2450, the adjusted alignment feature is provided for manufacturing. For example, after testing and adjusting one or more alignment features, the golf club head design is manufactured.

Discretionary mass generally refers to the mass of material that can be removed from various structures providing mass that can be distributed elsewhere for tuning one or more mass moments of inertia and/or locating the golf club head center-of-gravity. Golf club head walls provide one source of discretionary mass. In other words, a reduction in wall thickness reduces the wall mass and provides mass that can be distributed elsewhere. Thin walls, particularly a thin crown, provide significant discretionary mass compared to conventional golf club heads.

For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on a golf club head body, such as a thin crown, a golf club head body can be formed from an alloy of steel or an alloy of titanium.

Some examples of titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or club head bodies can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

For further details concerning titanium casting, please refer to U.S. Pat. No. 7,513,296, incorporated herein by reference.

Additionally, the thickness of a club hosel may be varied to provide for additional discretionary mass, as described in U.S. Pat. No. 9,731,176, the entire contents of which are hereby incorporated by reference.

As discussed above, the location and characteristics of golf club head alignment features, such as a golf club head topline, may be important to the golf club's performance and aesthetics. For example, a 1-degree change in perceived face angle of the golf club head may cause a lateral dispersion of up to about 5 yards. Likewise, providing an alignment feature changing the perceived face angle of the golf club head may correct for lateral dispersion caused by other characteristics of the golf club.

One or more of the present embodiments provide for hard tooling the location and characteristics of one or more alignment features into the golf club head. For example, instead of masking and painting a topline onto the golf club head, a topline is hard tooled at the intersection between the casted club head body and a face insert. The club head body, such as a casted club head body, may be painted separately from the face insert, requiring no special masking to provide for an alignment feature. In some embodiments, a transition zone between the face and the crown may be painted the same color as other portions of the casted club head body, eliminating the need to use a masking line between the transition zone and other portions of the casted club head body. After painting the casted club head body, the face may be bonded or otherwise attached to the casting. A contrast in color, difference in finishes, and/or difference in texture between the casted club head body and the face defines the necessary visual cue. For example, the face insert may be a single color, or multicolored. Likewise, the club head body and/or the crown may also be a single color, or multicolored, providing for one or more alignment features by contrasting with the one or more color of the face insert. In another example, the club head body and/or the crown may have one finish, such as gloss, and the face insert may be a different finish, such as matte. In yet another example, the club head body and/or the crown may have one texture, such a visible composite weave, and the face insert may be a different texture, such as a texture that appears uniform or smooth. Additionally or alternatively, a crown insert may be bonded or otherwise attached to the casted club head body to provide for a visual cue. Accordingly, the topline may not be subject to the manufacturing variability resulting from user error and the manufactured golf club heads may be more consistent from part to part.

In some embodiments, the face insert is made of a composite that includes multiple plies or layers of a fibrous material (e.g., graphite, or carbon, fiber) embedded in a cured resin (e.g., epoxy), such as those described in U.S. Pat. No. 10,016,662, the entire contents of which are hereby incorporated by reference. Composite face plates for use in the metalwood golf clubs may be fabricated using the procedures described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are all incorporated herein by reference in their entirety. The composite material can be manufactured according to the methods described at least in U.S. patent application Ser. No. 11/825,138, the entire contents of which is herein incorporated by reference in its entirety. In some embodiments, the face insert has a variable thickness, such as those described in U.S. Pat. No. 7,874,938, the entire contents of which are hereby incorporated by reference.

In some embodiments, the face is tunable (e.g., for CT, COR, or another characteristic), such as described in U.S. patent application Ser. No. 15/857,407, filed Dec. 28, 2017, the entire contents of which are hereby incorporated by reference.

Figure 25:
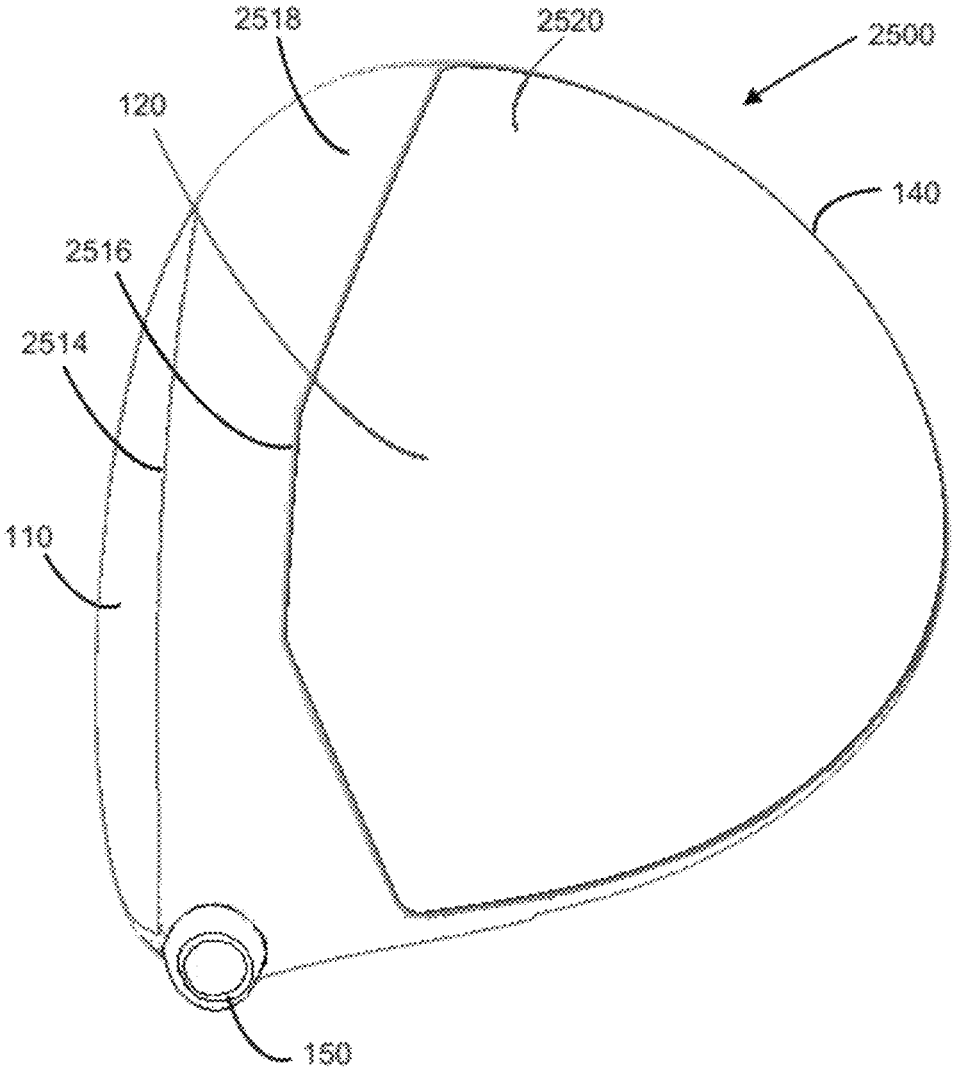
FIG. 25 is a top view of a golf club head in accord with one embodiment of the current disclosure having tooled alignment feature.

FIG. 25 is a top view of a golf club head having at least one tooled alignment feature. The golf club head 2500 includes a face 110, a crown 120, a sole 130 (not depicted), a skirt 140, and a hosel 150. As depicted in FIG. 25, a primary alignment feature 2514 is provided on the golf club head. The primary alignment feature 2514 may be provided as a topline that is hard tooled at the intersection of the face 110 and the casting of the golf club head 2500. The topline may delineate the transition between at least a portion of the crown 120 having a shade, color, finish, and/or texture that contrasts and/or is different from the shade, color, finish, and/or texture of the face 110. The topline may also delineate a transition between the face 110 with another portion of the golf club body. In some embodiments, the casting of the golf club head 2500, including a portion of the crown 120, are painted in a shade or color prior to attaching the face 110. The face 110 may define the characteristics of the primary alignment feature 2514. For example, the size and shape of the face 110 may change the location of the topline, curvature of the topline, Sight Adjusted Perceived Face Angle (SAPFA) of the golf club head 2500, and other characteristics of the golf club head 2500 and/or primary alignment feature 2514.

In some embodiments, the face 110 is provided at least in part as a composite material. Other materials may also be used. The face 110 may be bonded to the golf club head 2500. Any bonding methods known in the art may be utilized, including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions. Alternatively, the face 110 may be attached to the golf club head in another manner, such as with screws, fasteners, epoxy, welding, or with another attaching or bonding means. In some embodiments, the face may be welded from the back of the face (i.e., from inside the cavity of a golf club head). The welding may not fully penetrate the face (e.g., less than 100% weld penetration). Past club head designs have provided for an intersection location of the face 110 and golf club body casting at a location that is undesirable for a primary alignment feature 2514. For example, past intersection locations do not provide for aesthetic and visual cue performance due to durability constraints. One or more of the present embodiments provide for a bonded face design allowing for a tooled topline location with aesthetic and performance characteristics while maintaining durability of the golf club head. For example, the tooled topline location may follow the shape of the face insert. If testing the club head shows a lateral dispersion that goes right and/or appears closed, the shape of the face insert may be changed to minimize the lateral dispersion and to make the club head appear more open. Likewise, if testing the club head shows a lateral dispersion that goes left and/or appears open, the shape of the face insert may be changed to minimize the lateral dispersion and to make the club head appear more closed. To maximize performance, the face insert may not be a uniform shape (e.g., not an elliptical face insert). For example, in some embodiments, a portion of the face insert extends upward and heelward toward the hosel. A portion of the face insert may also extend upward and toeward.

In some embodiments, the golf club head includes a secondary alignment feature. Referring back to FIG. 25, the secondary alignment feature 2516 may delineate a transition between the first portion of the crown 2518 and a second portion of the crown 2520. In an example, the first portion of the crown 2518 may have a contrasting shade or color with the shade or color of the face 110 and the second portion of the crown 2520 may have a contrasting shade or color with the shade or color of the first portion of the crown 2520. Secondary alignment 2516 feature may also be hard tooled into the club head, such as with a crown insert. In some embodiments, the crown insert may be as a composite material. Examples of some of these composite materials for use in the metalwood golf clubs and their fabrication procedures are discussed herein and described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference.

Figure 26:
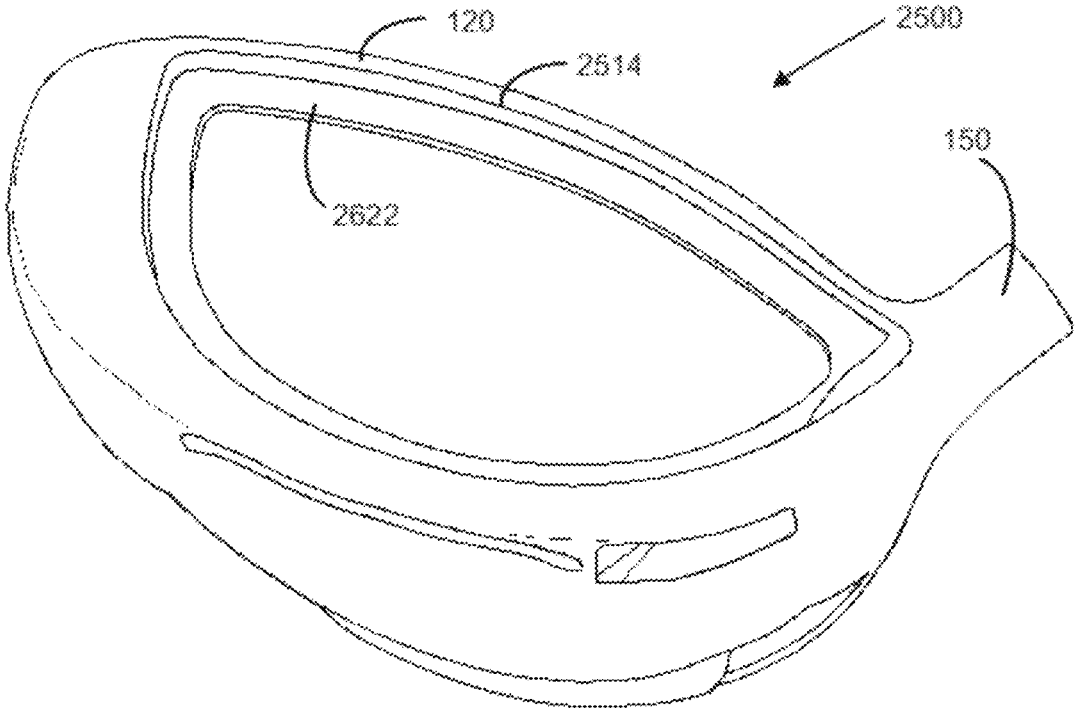
FIG. 26 is a perspective view of a golf club head in accord with one embodiment of the current disclosure, without a face insert installed.

FIG. 26 is a perspective view of a golf club head having at least one tooled alignment feature, without a face insert installed. In this embodiment, the golf club head 2500, or any of the disclosed components, may be cast, milled, or formed in any other fashion included metal injection molded and additive manufacturing techniques, to create a ledge 2622 for receiving a face insert 110 (not depicted). The face insert 110 may be provided as a composite material or as another material. For example, the face insert 110 may be a molded composite to be bonded to the ledge 2622 of golf club head. By bonding the face insert 110 to the ledge 2622, the transition between the face 110 and the crown 120 provide for a noticeable topline as the primary alignment feature 2514. In some embodiments, the face 110 is bonded to the ledge 2622 with a seamless transition between the face 110 and crown 120, such to promote desired aerodynamic and aesthetic characteristics.

The characteristics of the primary alignment feature 2514 may be defined by the face insert 110. For example, a larger face insert 110 may position the alignment feature 2514 higher on the golf club head 2500. Likewise, a smaller face insert 110 may position the alignment feature 2514 lower on the golf club head 2500. The shape of the face insert 110 may also provide for a desired curvature and/or radius of the topline. Once the desired characteristics of the primary alignment feature 2514 are established, the alignment feature 2514 is hard tooled into the golf club head 2500. Hard tooling the alignment feature allows for the alignment feature to be permanent, non-deformable, and not prone to manufacturing errors associated with painted alignment features that use stickers or other maskings during manufacturing. As such, the primary alignment feature may be determined by the club head casting, or a feature milled, stamped, molded, or forged into the club head, and integrated in the golf club head using the face insert.

Figure 27:
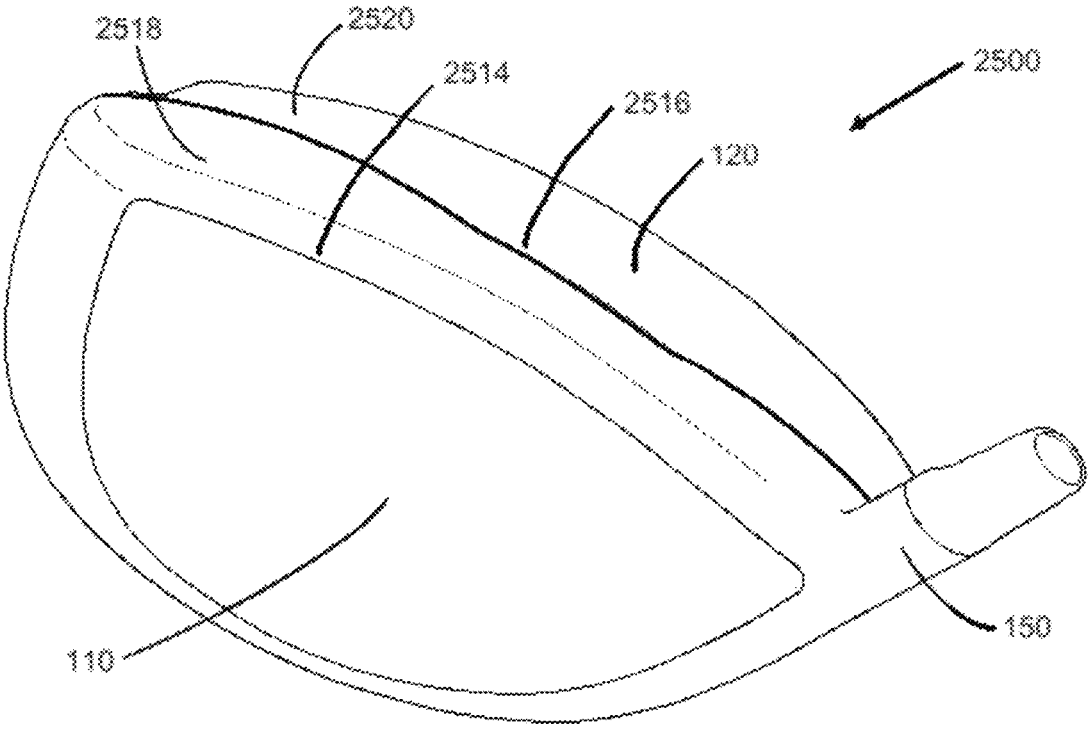
FIG. 27 is a perspective view of a golf club head in accord with one embodiment of the current disclosure, with a face insert installed.

FIG. 27 is a perspective view of a golf club head having at least one tooled alignment feature, with a face insert installed. In this embodiment, the golf club head 2500 is provided with the face insert 110 bonded to the ledge 2622 (not depicted). As depicted in FIG. 27, the primary alignment feature 2514 is a hard tooled topline at the intersection of the face 110 with the casting body, such as a first portion of the crown 2518. In the case of a bonded face, the joint between the face 110 and the crown 120 determines the topline 2514. Other ways of installing the face insert may be used, such as with screws, fasteners, or another method of installation.

Additional features of the golf club head 2500 may be facilitated by using a face insert 110. For example, including a notch in the back of the face insert 110 allows for the golf club head 2500 to utilize flight control technology (FCT) in the hosel 150 to include a loft and lie connection sleeve to adjust, inter alia, face angle. Other characteristics of the face insert may provide for performance benefits. In an embodiment, the face insert 110 may provide for more accurate and uniform face thicknesses between manufactured golf club heads and provide for the precise face thickness variabilities incorporated in the golf club head design. In an embodiment, a molded composite face insert allows for variable thickness across locations of the face. In an embodiment, the center of gravity about the x-axis (CGx) may be more accurately positioned using the face insert, such as by using a variable thickness face. Further, characteristic time (CT) and coefficient of restitution (COR) requirements may be attained precisely by molding the composite face and bonding the face to the golf club head. The composite face may also be tunable after installation. In an embodiment, the face insert may provide for a CT above about 255 and a COR of about 0.835. In an embodiment, different bulge and roll characteristics may be prescribed for a user and provided using the face insert. For example, the different bulge and roll characteristics, including twisted bulge and roll characteristics, may be provided by selecting from different face inserts. One of the different face inserts may be selected prior to bonding the face to the golf club head, or alternatively the face inserts may be interchangeable by a user or club fitter. In yet another embodiment, changing the face characteristics requires the club head casting to change to accommodate the new face insert.

In some embodiments, the face insert may be provided as a dark face insert surface area having a CIELab brightness (L) of less than about 40 and a bright surface area of the casted club head body and/or the crown of the club head has a CIELab brightness of between about 50 and about 100. In some embodiments, the difference in brightness (ΔL) between the face insert and the club head body and/or the crown is at least 20, at least 30, at least 40, at least 50, at least 60, at least 70, or another difference greater than about 20.

In some embodiments, the face insert may be provided with a dark face insert surface area having a CIELab brightness (L) of less than about 40 and the club head body and/or the crown of the club head is provided with a dark surface area having a CIELab brightness of less than about 40. For example, the difference in brightness (ΔL) between the face insert and the club head body and/or the crown is at least 5, at least 10, at least 15, at least 20, or in another series of embodiments the difference less than about 20, or less than about 15, or less than about 10, or less than about 5.

In some embodiments, the face insert may be provided as a matte, semigloss, or low gloss face insert surface area having a gloss value of less than about 60, about 50, or about 40 gloss units and a semigloss surface area of the club head body and/or the crown of the club head has a CIELab gloss value of greater than about 40, about 50, about 60, and about 70 gloss units. For example, a matte or low gloss face insert may have gloss values of less than 10, 8, 5, 4, or 2 gloss units.

Any difference in appearance between the face insert and the club head body and/or the crown may be used as an alignment feature. The club head body and/or the crown may be different in appearance with the face insert by color, brightness, texture, finish, or another visual difference. For example, different finishes may be used, such gloss, semigloss, low gloss, matte, or another finish. Different textures may also be used, such textures manufactured into the club head components, ridges, valleys, patterns of material, composite weaves, and other textures.

Figure 28:
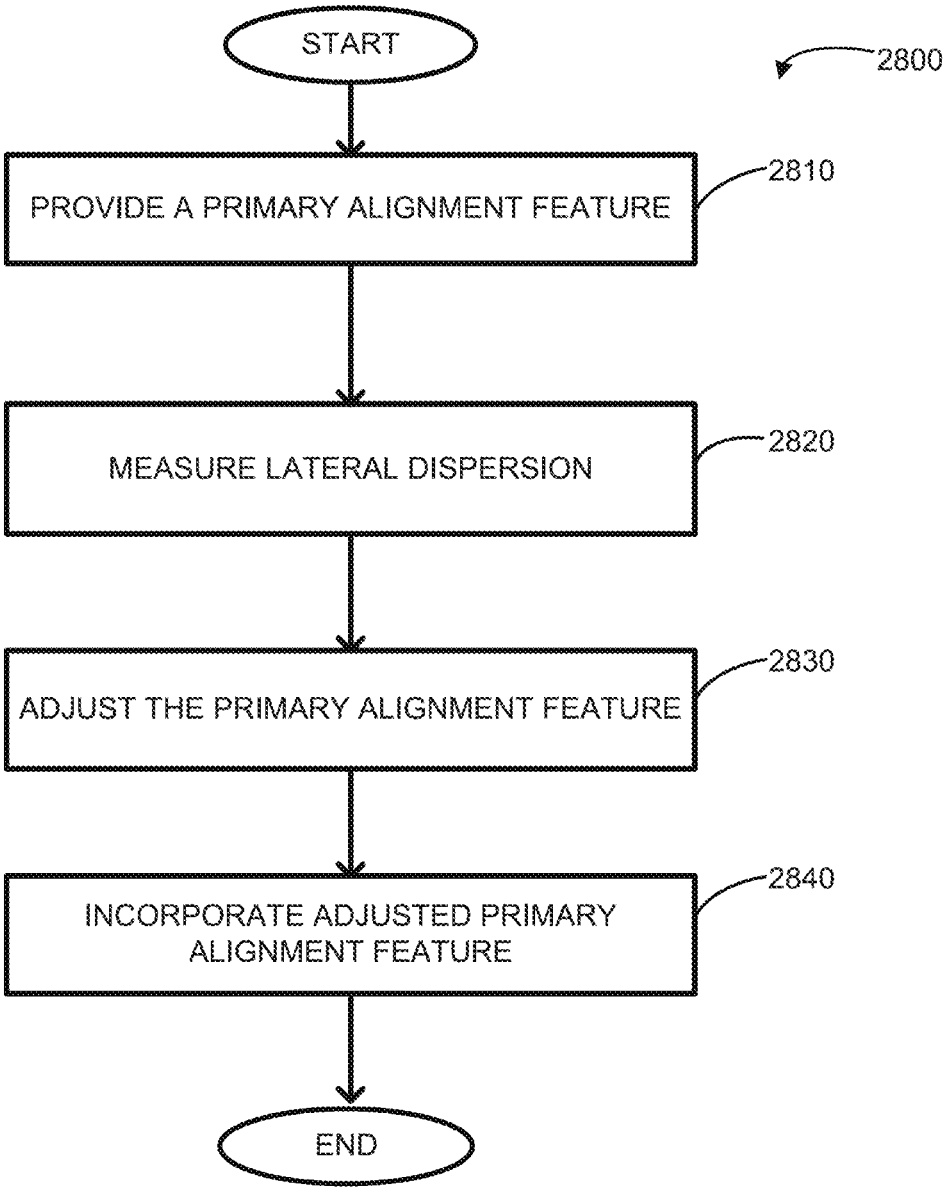
FIG. 28 is a flowchart of a method in accordance with one or more of the present embodiments.

FIG. 28 is a flowchart of a method 2800 for counteracting a lateral dispersion tendency of a golf club head. For example, the method may be used to determine an alignment feature for a golf club head. This method may be performed using one or more of the golf club head embodiments discussed herein or with another golf club head having a face, a crown and a sole.

At 2810, a primary alignment feature is provided. For example, the primary alignment feature may include a line delineating a transition between a portion of the crown and the face. The portion of the crown may have an area with a shade or color that contrasts the shade or color of the face. The primary alignment feature may be hard tooled into the golf club head using the face of the golf club body. For example, the face may be bonded or otherwise attached to a painted golf club body. The face may be painted or provided with a different shade or color from the crown, or may be unpainted. In an embodiment, the face is provided in a composite material of a shade or color that contrasts with the crown.

At 2820, the lateral dispersion tendency of the golf club head is measured. The lateral dispersion tendency indicates an average dispersion from a center target line. For example, a positive lateral dispersion tendency is the average dispersion right of the center target line and a negative lateral dispersion tendency is the average dispersion left of the center target line. For example, a prototype of the new golf club head design is provided for player testing. In this example, one or more players may test the golf club head. Based on the testing, a lateral dispersion of the golf club head may be measured. Other performance metrics may also be measured. Lateral dispersion may be indicative that a different alignment feature may provide better performance, such as less lateral dispersion. In another example, an impression of the alignment feature on the user may also be measured. In this example, if the golf club head face appears too open or too closed during the test, a different alignment feature may improve appeal or confidence in the golf club head to the testers.

At 2830, the primary alignment feature is adjusted to provide an adjusted primary alignment feature, such as to counteract the lateral dispersion tendency of the golf club head. The primary alignment feature may also be adjusted in conjunction with changing face characteristics of the golf club head, such as when providing for different bulge and roll characteristics, tuning CT, and prescribing other face characteristics. In an embodiment, based on the testing, the primary alignment feature may be adjusted to increase performance and/or appeal of the golf club head. In this example, a top line radius may be adjusted. Based on the lateral dispersion measured during testing, a top line radius may be adjusted one degree for every five yards of lateral dispersion with a driver and adjusted one degree for every three yards of lateral dispersion with a fairway wood. Other adjustment amounts may be provided. Furthermore, additional and different adjustments to the one or more alignment features may be provided.

After the alignment feature is adjusted, one or more of acts 2820 and 2830 may be repeated for additional testing and/or adjustment. In some embodiments, individual player testing may also be performed, such as for individual tour players. In some embodiments, a secondary alignment feature is tested and adjusted.

At 2840, the adjusted primary alignment feature is incorporated into the golf club head. In an embodiment, the adjusted primary alignment feature is incorporated into the golf club head by retooling the golf club head. The adjusted alignment feature may also be provided for manufacturing the golf club heads. For example, after testing and adjusting one or more alignment features, the golf club head design is manufactured. Therefore, as-cast with the golf club head, the one or more alignment features are integrally formed into the golf club head, such as with an integrally formed topline alignment feature.

Figure 29:
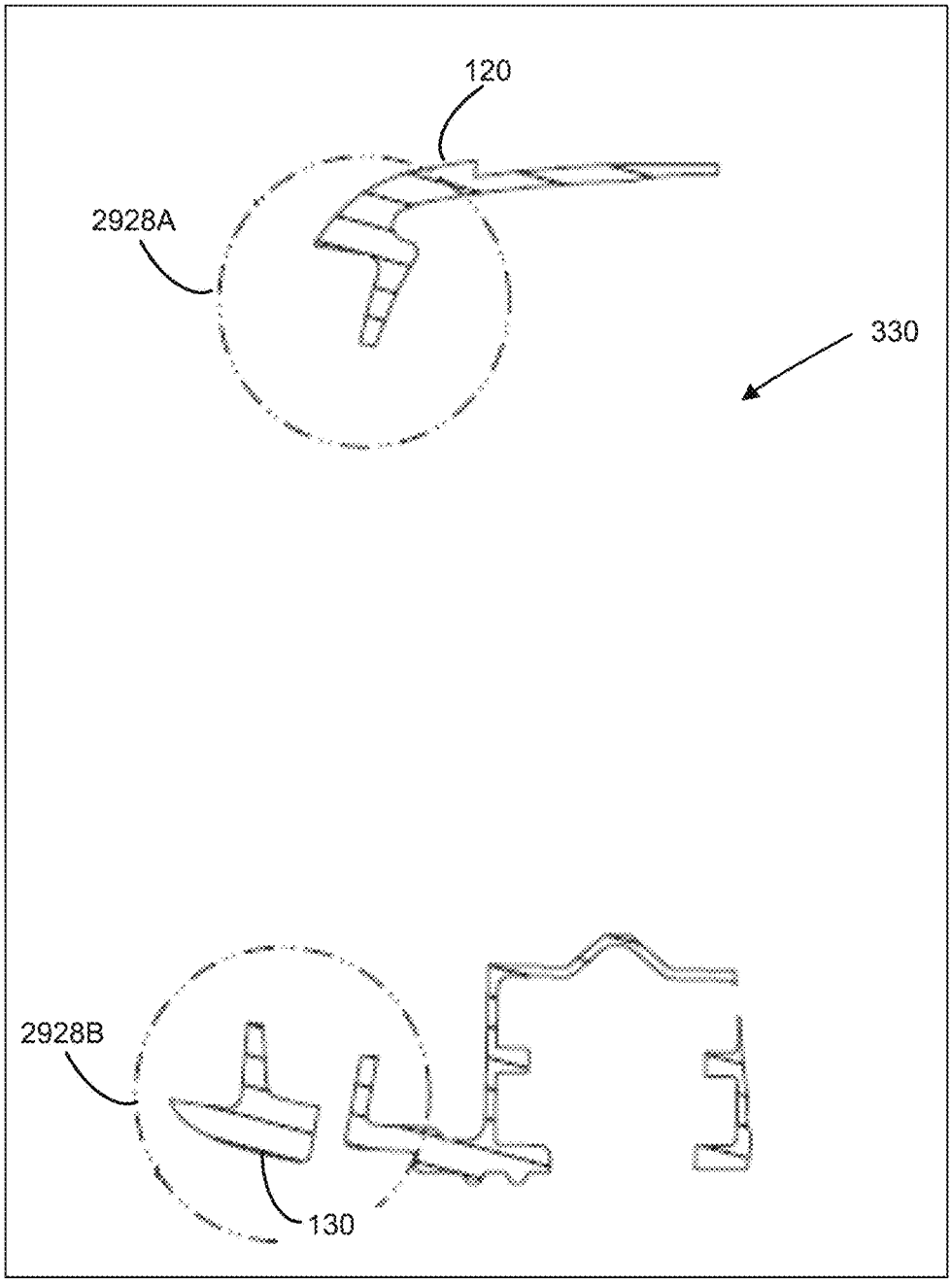
FIG. 29 is a section view of a golf club head in accord with one embodiment of the current disclosure, without a face insert installed.

FIG. 29 is a section view of a golf club head in accord with one embodiment of the current disclosure, without a face insert installed. In some embodiments, the transition from a portion of the crown 120 to the face insert (not depicted in FIG. 29) provides for a primary alignment feature. For example, FIG. 29 shows a front portion 330 of a golf club head, such as golf club head 2500 or another golf club head. The front portion 330 is configured to receive a face insert (not depicted in FIG. 29), such as face insert 110 or another face insert. The front portion 330 includes a face insert support structures 2928A, 2928B. An upper face insert support structure 2928A is adjacent or immediately next to the crown 120. A lower face insert support structure 2928B is adjacent or immediately next to the sole 130.

In some embodiments, when installed to the face insert support structures 2928A, 2928B, the face insert forms a part of the transition region from the face to the crown 120 and/or the sole 130. For example, at least a portion of the transition region may be painted the same color or shade as at least a portion of the crown prior to installing the face insert, which when installed provides a contrasting color or shade of the face insert with respect to the painted portion of the transition region and/or crown. In other embodiments, the face insert eliminates the need for a transition region from the face to the crown 120 and/or the sole 130. In some embodiments, the face insert includes at least a portion of the radius of the transition from the face insert to the crown. By forming part of the radius of the transition from the face to the crown, aerodynamics of the club head may be improved by decreasing turbulence of the air passing from the face to the crown and increasing annular flow.

Figure 30A:
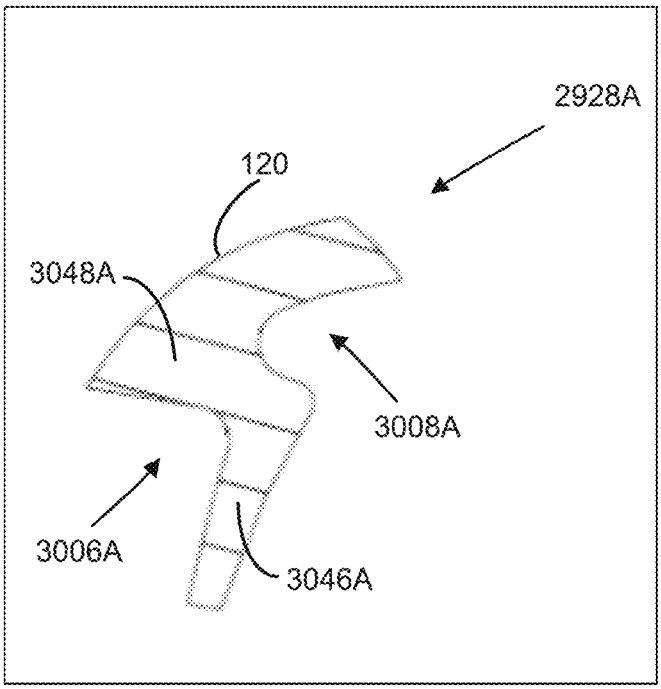
FIG. 30A is a section view of an upper lip of a golf club head in accord with one embodiment of the current disclosure, without a face insert installed.

FIG. 30A is a section view of an upper lip of a golf club head in accord with one embodiment of the current disclosure, without a face insert installed. FIG. 30A depicts an upper face insert support structure 2928A that is adjacent or immediately next to the crown 120. The upper face insert support structure 2928A includes an upper rear support member 3046A and an upper peripheral member 3048A. The upper rear support member 3046A and the upper peripheral member 3048A create an upper undercut recess 3006A forming a lip for receiving the face insert and connecting a portion of the crown 120 to the upper face insert support structure 2928A.

In some embodiments, the upper face insert support structure 2928A is provided in a shape that flexes in a similar manner as the face insert when the golf club head strikes a golf ball. For example, in some golf club head designs, the face insert material, such as a composite material, is more flexible or compliant than the golf club body material, such as an aluminum or titanium alloy. In this example, a slot or recess 3008A may be provided within the upper peripheral member 3048A to increase flexibility or compliance of the upper face insert support structure 2928A, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

Figure 30B:
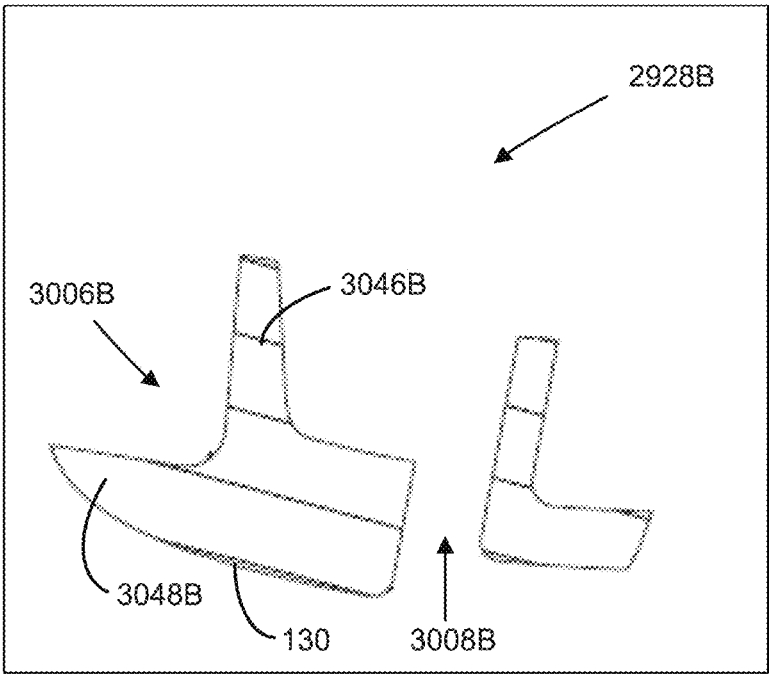
FIG. 30B is a section view of a lower lip of a golf club head in accord with one embodiment of the current disclosure, without a face insert installed.

FIG. 30B is a section view of a lower lip of a golf club head in accord with one embodiment of the current disclosure, without a face insert installed. FIG. 30B depicts a lower face insert support structure 2928B that is adjacent or immediately next to the sole 130. The lower face insert support structure 2928B includes a lower rear support member 3046B and a lower peripheral member 3048B. The lower rear support member 3046B and the lower peripheral member 3048B create a lower undercut recess 3006B forming a lip for receiving the face insert and connecting a portion of the sole 130 to the lower face insert support structure 2928B.

In some embodiments, the lower face insert support structure 2928B is provided in a shape that flexes in a similar manner as the face insert when the golf club head strikes a golf ball. In the example discussed above, the face insert material is more flexible or compliant than the golf club body material. In this example, a slot or recess 3008B may be provided within the lower peripheral member 3048B to increase flexibility or compliance of the upper face insert support structure 2928B, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

FIG. 31 is a top view of a golf club head in accord with one embodiment of the current disclosure. FIG. 31 depicts club head 3100 with hosel 150, face 110 and a center-face location 3110. A center-face y-axis location (CFY) is defined using the center-face location 3110 of face 110 and a center point location 3150 of the hosel 150. A positive CFY produces onset of the golf club head and extends from center point location 3150 of hosel 150 toward the front portion of the golf club head to the center-face location 3110. For example, onset may cause lateral dispersion and the face to appear too far forward of the hosel. A negative CFY produces offset of the golf club head and extends from center point location 3150 of hosel 150 toward the rear portion of the golf club head to the center-face location 3110. A face progression (FP) is defined using the leading-edge location 3120 of face 110 and a center point location 3150 of the hosel 150. Face progression is related to face location, loft and face height. CFY, face progression, and alignment features all influence performance of a golf club head, such as lateral dispersion. For example, if the CFY and/or face progression of the golf club head is changed, one or more alignment features may be provided to counteract the lateral dispersion created or reduced by the CFY and/or face progression.

In some embodiments, a high CFY (e.g., greater than about 15 mm, 14 mm, 13 mm, or another CFY) may produce lateral dispersion right of the intended target line. In other embodiments, a low CFY (e.g., less than about 15 mm, 14 mm, 13 mm, or another CFY) may produce lateral dispersion left of the intended target line. In some embodiments, CFY is between about 13 mm and about 15 mm.

In some embodiments, a high face progression (e.g., greater than about 20 mm, 19 mm, 18 mm, or another face progression) may produce lateral dispersion right of the intended target line. In other embodiments, a low face progression (e.g., less than about 19 mm, 18 mm, 17 mm, or another face progression) may produce lateral dispersion left of the intended target line. In some embodiments, face progression is between about 15 mm and about 20 mm.

In some embodiments, a golf club head is provided with at least one of: CFY no more than 15.5 mm; CFY no more than 15 mm; CFY no more than 14.5 mm; CFY no more than 14 mm; CFY no more than 13.5; CFY no more than 13 mm; face progression no more than 20 mm; face progression no more than 19 mm; face progression no more than 18 mm;

face progression no more than 17 mm; and face progression no more than 16 mm. In some embodiments, a golf club head is provided with a CFY no more than 17.5 mm. In another series of embodiments CFY is at least 8 mm, 9 mm, 10 mm, 11 mm, or 12 mm. Likewise, in another series of embodiments face progression is at least 10 mm, 11 mm, 12 mm, 13 mm, or 14 mm.

Figure 32:
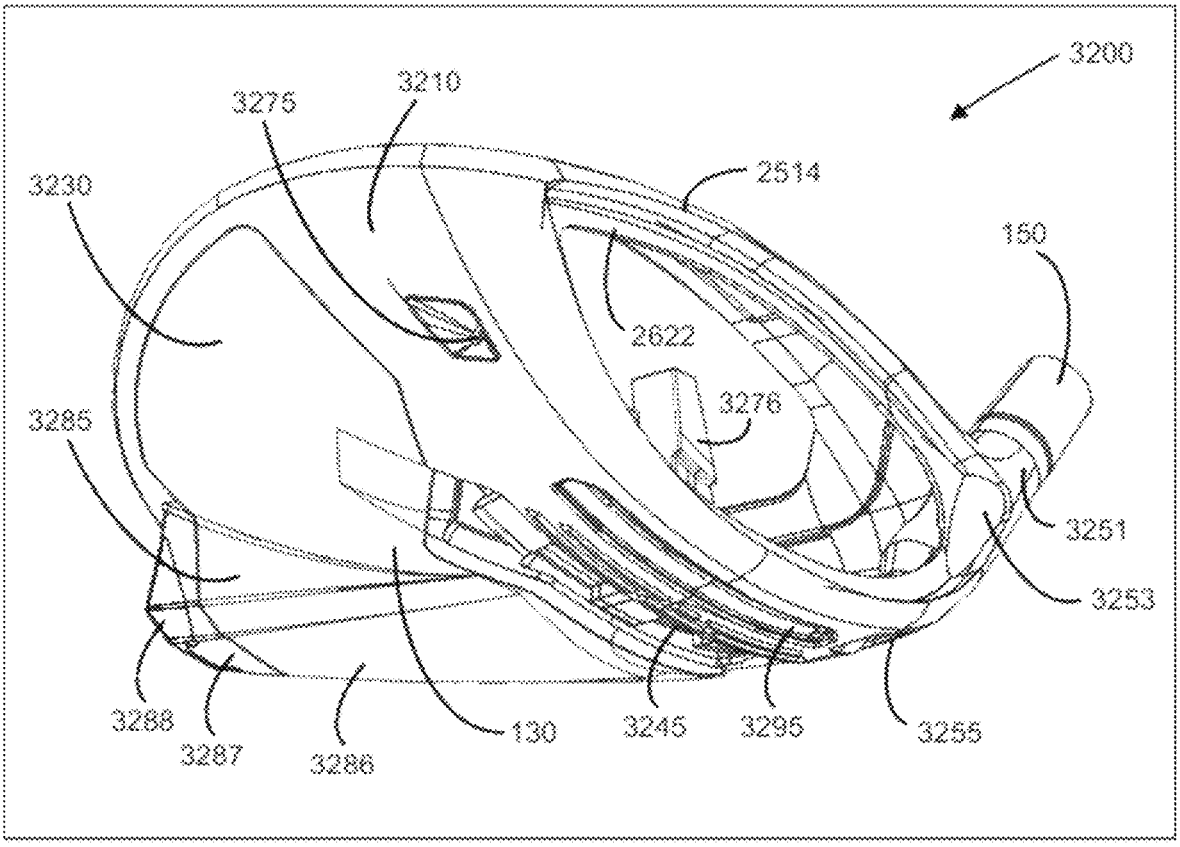
FIG. 32 is a perspective view from a toe side of a golf club head in accord with one embodiment of the current disclosure, without a face insert installed.

FIG. 32 is a perspective view from a toe side of a golf club head 3200. In this embodiment, the golf club head 3200 includes a hollow body 3210. The hollow body 3210 includes a hosel 150, a crown 120 (not depicted), and a sole 130. In some embodiments, the hollow body 3210 has openings to receive the face insert 110 (not depicted), a crown insert 3220, and/or a sole insert 3230. In some embodiments, the hollow body is a metal or composite material frame, and the face insert 110 (not depicted), a crown insert 3220, and/or a sole insert 3230 are at least in part composite materials. The hollow body 3210 is cast with a ledge 2622 for receiving a face insert 110 (not depicted). By bonding the face insert 110 to the ledge 2622, the transition between the face 110 and the crown 120 provide for a primary alignment feature 2514, such as a topline or another alignment feature. For example, the hollow body 3210 may be cast from a titanium alloy, an aluminum alloy, another alloy, or a combination thereof. The hollow body 3210 is painted prior to bonding a face insert 110 (not depicted), a crown insert 3220 (not depicted), and/or a sole insert 3230. By bonding the face insert and/or the crown insert, one or more alignment features are hard tooled into the golf club head 3200. The face insert 110, a crown insert 3220, and/or a sole insert 3230 may be bonded to the hollow body 3210 after the hollow body 3210 is painted, such as by bonding the face insert 110 first, then boding the crown insert 3220. Alternatively, the crown insert 3220 is bonded first, followed by the face insert 110. By bonding the inserts after the hollow body 3210 is painted, the one or more alignment features are hard tooled into the golf club head during casting and bonding. In some embodiments, at least a portion of the crown and sole inserts 3220, 3230 are manufactured from a composite material.

In other embodiments, one or more alignment features are hard tooled into the golf club head by casting one or more witness lines into the golf club head. For example, one or more positive witness lines may be cast into the hollow body 3210, such as by casting a protrusion, ridge, or other raised feature in the hollow body 3210. In another example, one or more negative witness lines may be cast into the hollow body 3210, such as an indentation, valley, or other depressed feature into the hollow body 3210. In some embodiments, a combination of positive and negative witness lines may be provided. The one or more witness line may be painted with the hollow body 3210 to provide one or more alignment features. Alternatively or additionally, the witness lines may be used as a guide for painting one or more alignment features on the golf club head. By casting the witness lines in the golf club head during manufacturing, the subsequent painting of the one or more alignment features may be more accurate from part to part.

Referring back to FIG. 32, in some embodiments, the hosel 150 may be adjustable, such as using flight control technology (FCT) in the hosel 150. For example, FCT may include a loft and lie connection sleeve to adjust, inter alia, face angle. The FCT may be adjustable with a screw 3255 or another connector. The hosel 150 also includes an external hosel surface 3251 and an internal hosel surface 3253. The internal hosel surface 3253 may occupy at least a portion of the face opening or region for receiving the face insert 110 (not depicted). To accommodate the internal hosel surface 3253, a notch or other feature is provided in face insert 110 for accepting at least a portion of the hosel within the face insert 110. As discussed herein, the notch may reduce CFY and accommodates at least a portion of the hosel within the face insert. Further, by accommodating for a portion of the hosel within the face insert, a portion of the face insert may extend high on the heel and follow the natural shape of the crown and/or other features of the club head. In some embodiments, the face insert 110 ties directly into the hosel 150. By accommodating at least a portion of the internal hosel surface 3253 within the face insert 110, a center-face location 3110 (not depicted) of the face insert 110 may be located closer to a center point location 3150 (not depicted) of the hosel 150, reducing CFY and increasing performance of the golf club head.

In some embodiments, the golf club head 3200 includes a slot 3295 and a weight track 3245. For example, the slot 3295 and/or the weight track 3245 may be cast into the hollow body 3210. As will be discussed below, the slot 3295 may increase the durability of the golf club head by allowing at least a portion of the hollow body 3210 to flex similarly to the face insert 110, increasing performance of the golf club head and increasing the durability of the golf club head by preventing the face insert 110 from decoupling from the hollow body 3210. In some embodiments, the golf club head 3200 includes one or more characteristic time (CT) tuning ports. Referring to FIG. 32, a CT tuning port 3275 is provided in the toe portion of the hollow body 3210. Another CT tuning port (not depicted) may be provided in the heel portion of the hollow body 3210. The one or more CT tuning ports may be provided in additional and different locations on the golf club head 3200, such in the face insert 110 or in another location. Using the CT tuning port(s), an adhesive or another material may be injected into the golf club head 3200 to reduce or increase the CT of the golf club head. For example, the golf club head 3200 may be manufactured with a CT that does not conform to the United States Golf Association (USGA) regulations that constrain CT of golf club heads. By injecting an adhesive into the CT tuning port 3275, the CT of the golf club head is detuned to conform to the USGA regulations.

In some embodiments, the golf club head includes one or more foam inserts. For example, a foam insert 3276 is positioned within the hollow body 3210. An additional foam insert is also provided proximate to the toe portion (not depicted). The one or more foam inserts aid in CT tuning the golf club head by restraining the adhesive or other material to locations within the golf club head while the material solidifies. Additionally, a rear wall may also be provided to further restrain the material while it solidifies. Accordingly, the foam inserts and the rear wall prevent the adhesive injected into the tuning port 3275 from moving too far toeward, heelward, and backward, allowing the golf club head to be CT tuned more precisely. Additional and different structures may be provided to restrain the injected materials during CT tuning.

In some embodiments, the golf club head includes a multi-material inertia generator. An inertia generator, as discussed herein, may also be referred to as an aft winglet and a center of gravity (CG) lowering platform. The inertia generator 3285 moves discretionary mass rearward to increase inertia and to move the CG projection lower on the face of the golf club head. For example, the golf club head 3200 includes an inertia generator 3285 extending rearwardly and angled toewardly from the front portion of the golf club head 3200 to the rear portion of the golf club head 3200. A multi-material inertia generator may include two or more materials of different densities. For example, the inertia generator 3285 includes one or more of a low density portion 3286, a medium density portion 3287, and a high density portion 3288.

The low density portion 3286 may be a composite or another material, such as a portion of the composite sole panel 3230 or as another component. The low density portion 3286 has a density of less than about 2 g/cc, such as between about 1 g/cc and about 2 g/cc. The medium density portion 3287 may be an aluminum alloy, a titanium alloy, another alloy, another material, or a combination of multiple alloys or materials, such as a portion of the hollow body 3210 or as another component. The medium density portion 3287 has a density greater than about 2.7 g/cc, such as between about 1 g/cc and about 5 g/cc, between about 2.0 g/cc and about 5.0 g/cc, and between about 2.5 g/cc and about 4.5 g/cc. The high density portion 3288 may be a steel alloy, a tungsten alloy, another alloy, another material, or a combination of multiple alloys or materials, such as a rear weight affixed to the inertia generator 3285 or as another component. The high density portion 3288 has a density greater than about 7 g/cc. For example, an aluminum alloy is often about 2.7 g/cc, a titanium alloy is often about 4.5 g/cc, a steel alloy is often about 7.8 g/cc, and tungsten alloy a tungsten alloy is often about 19 g/cc.

Figure 33:
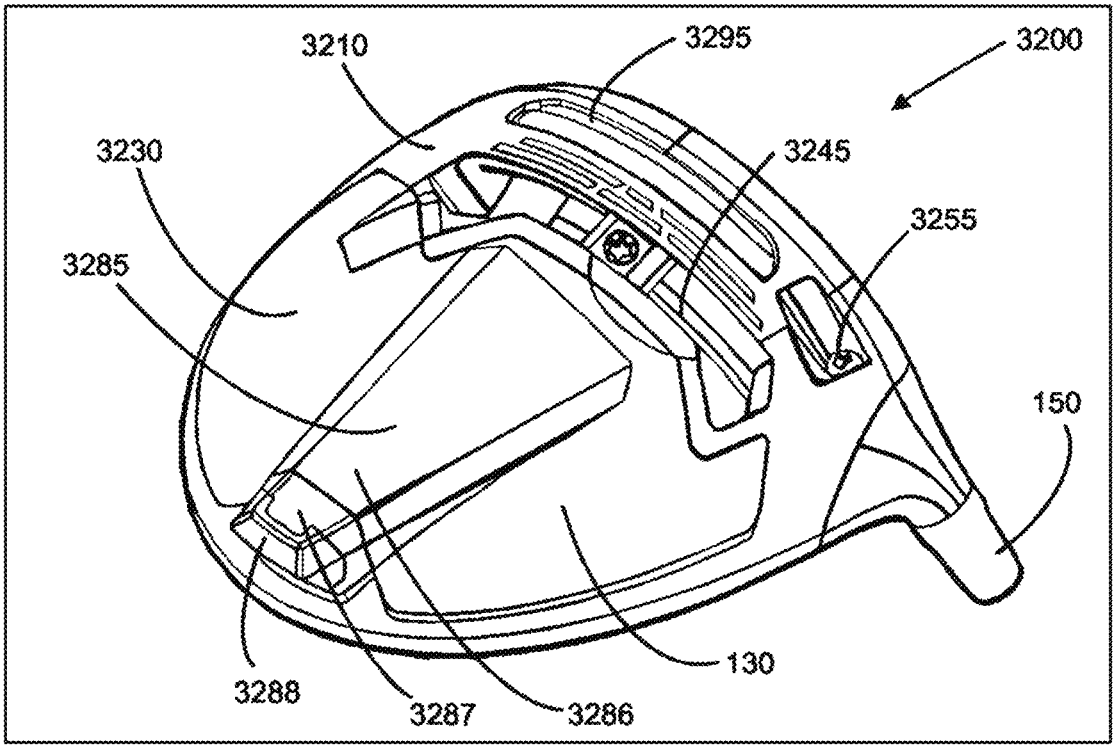
FIG. 33 is a perspective view from heel side of a golf club head in accord with one embodiment of the current disclosure.

FIG. 33 is a perspective view from a toe side of a golf club head 3200. FIG. 33 provides another view of the sole 130 with the insert 3230, the inertia generator 3285, the slot 3295, the weight track 3245 and the screw 3255. The inertia generator 3285 is provided as a multi-material inertia generator, with a low density portion 3286, medium density portion 3287, and high density portion 3288.

Figure 34:
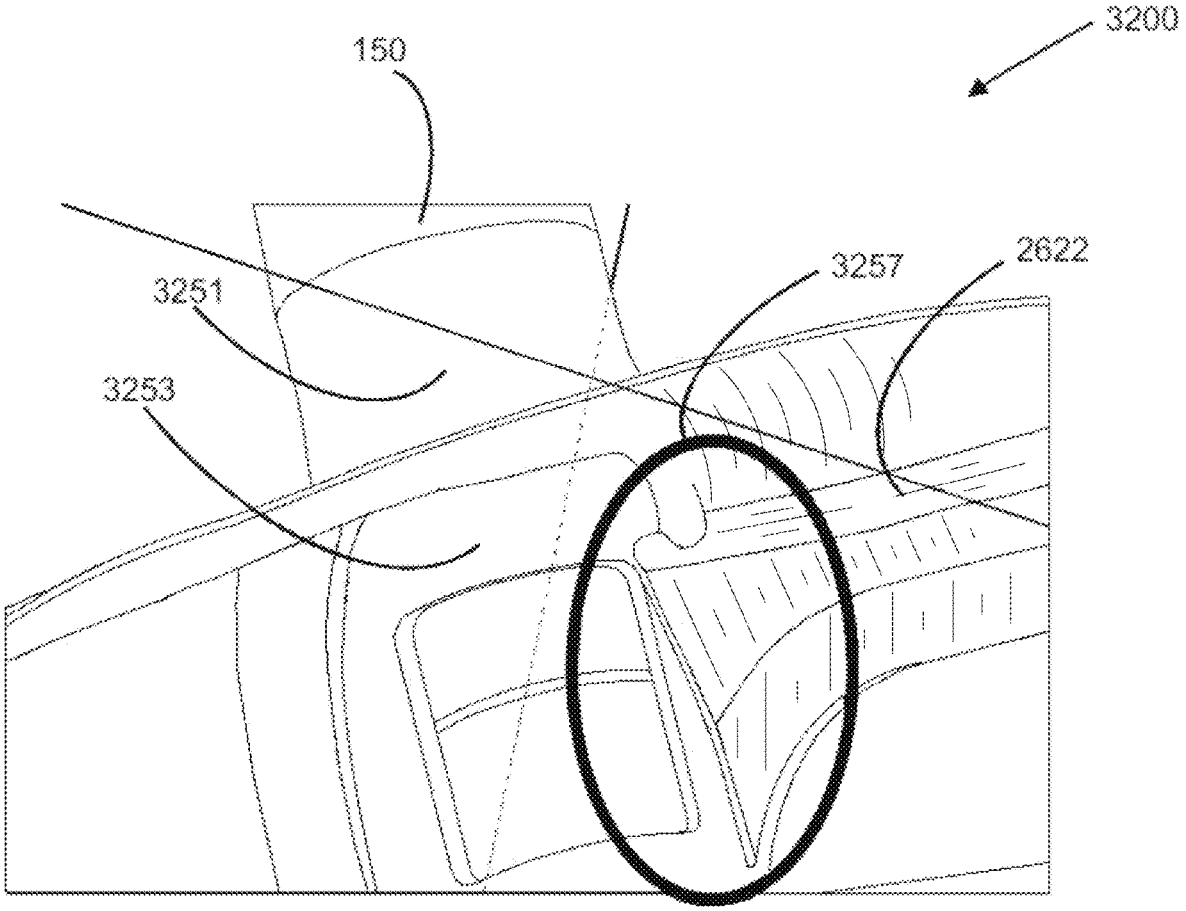
FIG. 34 is a perspective view of a portion of a golf club head in accord with one embodiment of the current disclosure.

FIG. 34 is a perspective view of a portion of a golf club head 3200. FIG. 34 shows the hosel 150 with the external hosel surface 3251 and the internal hosel surface 3253. As depicted in FIG. 34, the ledge 2622 for receiving a face insert 110 (not depicted) is joined to the internal hosel surface 3253 within an intersection region 3257. The face support, such as including ledge 2622, intersects and joins with the internal hosel surface 3253 allowing the internal hosel surface 3253 to interact with and/or be at least partially within the face insert 110. The face support may intersect and/or join the internal hosel surface 3253 proximate to the crown, proximate to the sole, or proximate to the crown and the sole.

Figure 35:
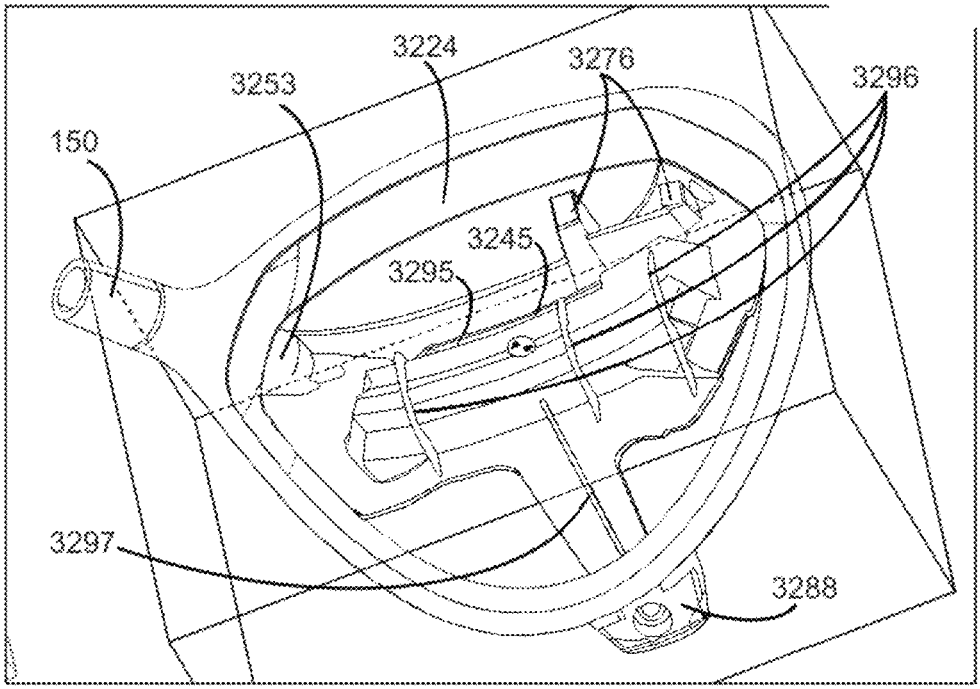
FIG. 35 is a perspective view from the rear portion of a golf club head in accord with one embodiment of the current disclosure, without a crown insert installed.

FIG. 35 is a perspective view from the rear portion of a golf club head 3200, without a crown insert 3220 installed. FIG. 35 shows a club head 3200 with hosel 150, internal hosel surface 3253, foam inserts 3276, and high density portion 3288. A ledge 3224 is provided for bonding a crown insert 3220 (not depicted). The ledge 3224 is wider proximate to the front portion and the face of the club head to provide for additional CT tuning. For example, in addition to supporting the crown insert 3220, a width of the ledge 3224 is increased to decrease the CT of the club head. In an embodiment, the ledge 3224 width is increased from about 10 mm to about 15 mm proximate the face. During or after manufacture, material can be removed from the ledge 3224 to increase the CT of the club head, such as increasing the CT by about 8 to about 10 points. As discussed above, CT tuning is typically used to reduce CT of a club head to meet the USGA constraints. If the CT of a club head is determined to be too far under the USGA constraints, the club head can tuned using the ledge 3224 to increase CT to approach or exceed the USGA constraints.

In some embodiments, the golf club head 3200 includes support ribs 3296, 3297. For example, support ribs 3296 provide for additional support for the hollow body 3210, the weight track 3245 and/or slot 3295. The support ribs 3296 may be provided over the weight track 3245 and in other areas within the hollow body 3210. Support rib 3297 may be provided to support supports the hollow body 3210 and inertia generator 3285. As depicted in FIG. 35, the hollow body 3210 includes a platform of material extending in the direction of the inertia generator 3285 that includes the support rib 3297. Additional and different support ribs may be provided.

Figure 36:
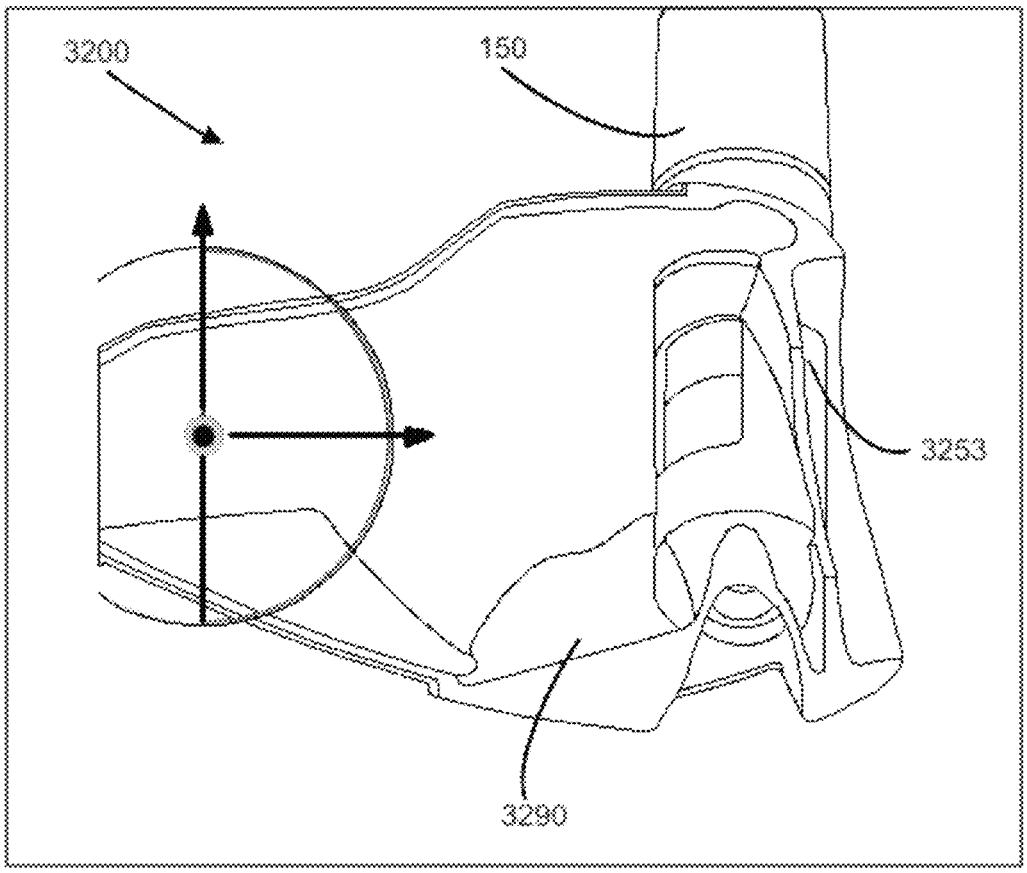
FIG. 36 is a view of a portion of a golf club head in accord with one embodiment of the current disclosure.
Figure 37:
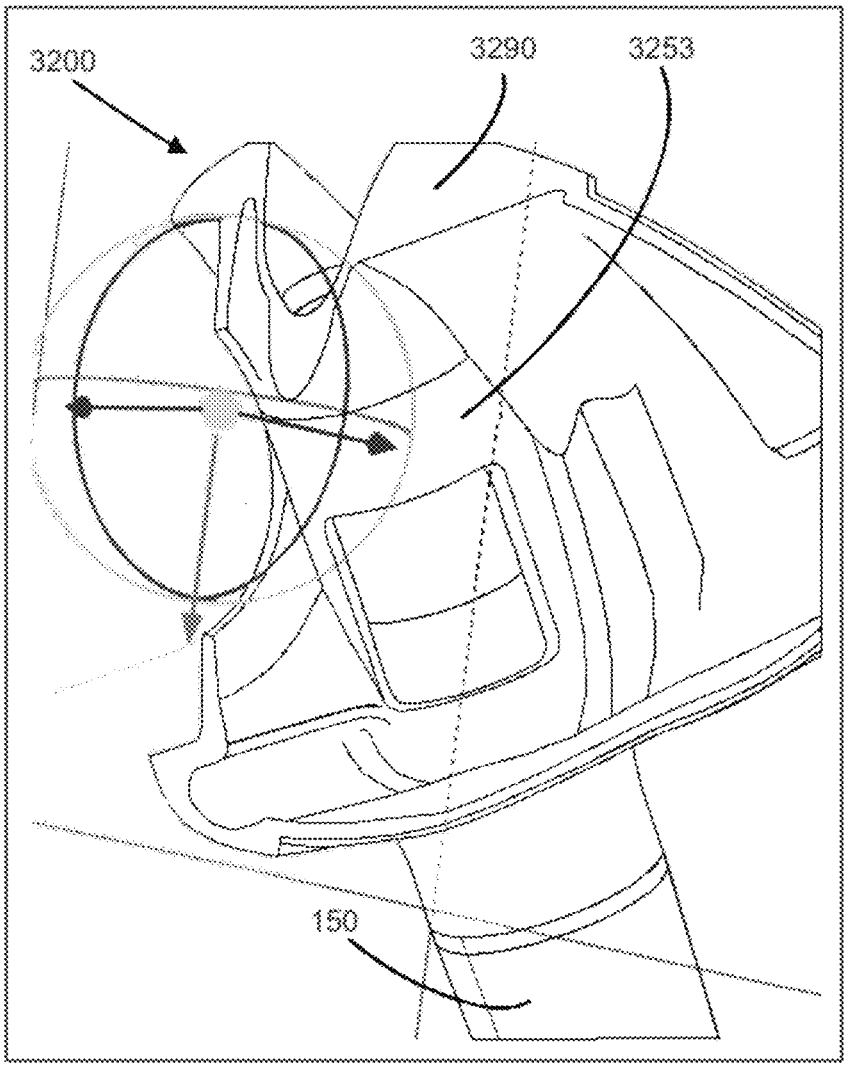
FIG. 37 is a view of a portion of a golf club head in accord with one embodiment of the current disclosure.

FIGS. 36-37 are views of portions of a golf club head 3200. FIG. 36 shows internal hosel surface 3253 occupying at least a portion of the face opening or region for receiving the face insert 110 (not depicted). By occupying at least a portion of the face opening or region for receiving the face insert 110, face progression and onset may be reduced, increasing performance of the golf club head 3200.

In some embodiments, the golf club head 3200 includes a mass pad 3290 in the heel portion of the golf club head. Mass pad 3290 positions discretionary mass of the golf club head 3200 heelward, and may lower the CG and move CG forward to modify the CG projection onto the face. In some embodiments, a removable and/or adjustable weight may be provided in the heel portion in lieu of or in addition to the mass pad 3290.

Figure 38:
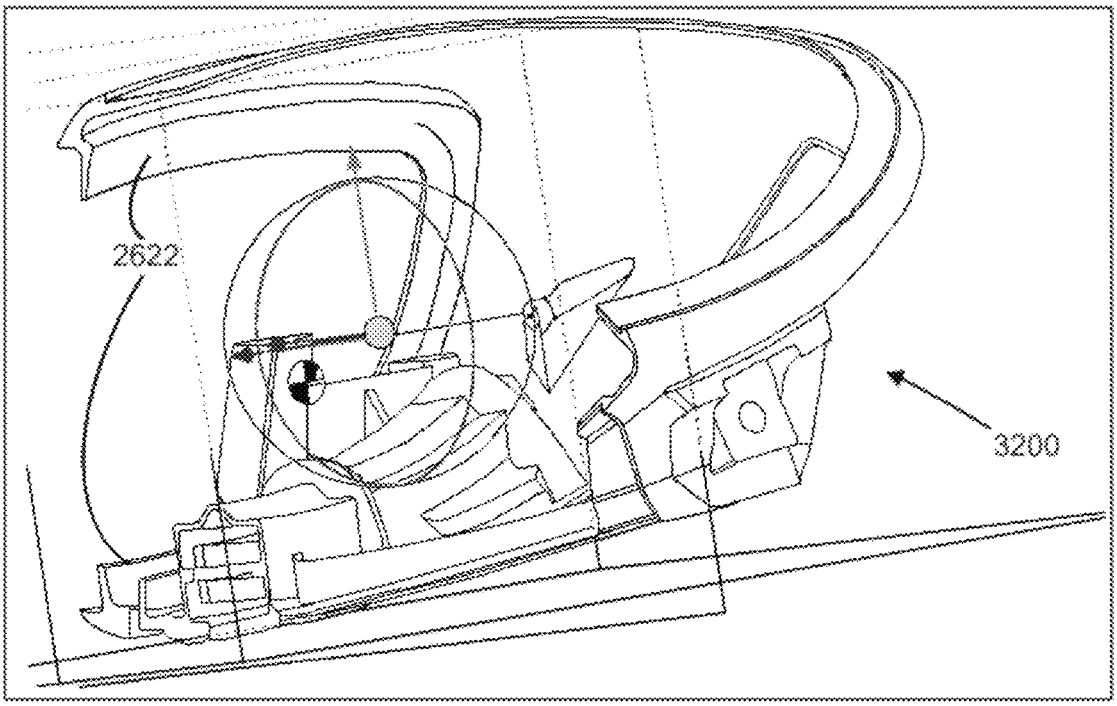
FIG. 38 is a view of a portion of a golf club head in accord with one embodiment of the current disclosure.
Figure 39:
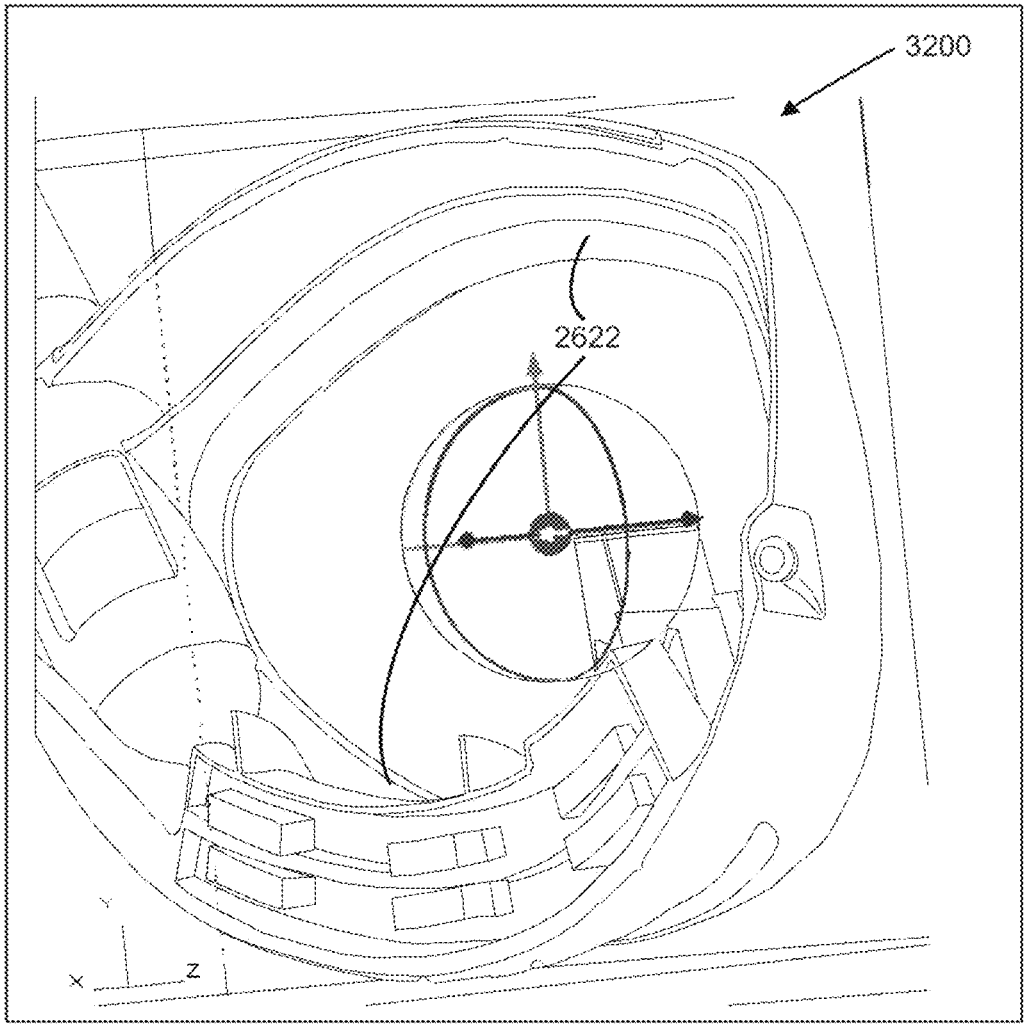
FIG. 39 is a view of a portion of a golf club head in accord with one embodiment of the current disclosure.

FIGS. 38-39 are views of portions of a golf club head 3200. As depicted in FIGS. 38-39, the ledge 2622 extends around the entire periphery of the face opening to support the face insert 110 (not depicted). By extending around the entire periphery, the ledge 2622 supports the entire face insert 110. In other embodiments, the ledge 3224 supports the face insert 110 in the heel portion, toe portion, crown portion and sole portion. For example, the ledge 2622 supports the face insert 110 in a region defined by about a 10 mm band about the geometric center of the face insert 110. Other bands about the geometric center of the face insert may be used, such as about 15 mm and about 20 mm. (prior art only had support in the heel and toe regions). Additional and different structures may be used to support the face around the entire periphery of the face or in regions about the geometric center of the face.

Figure 40:
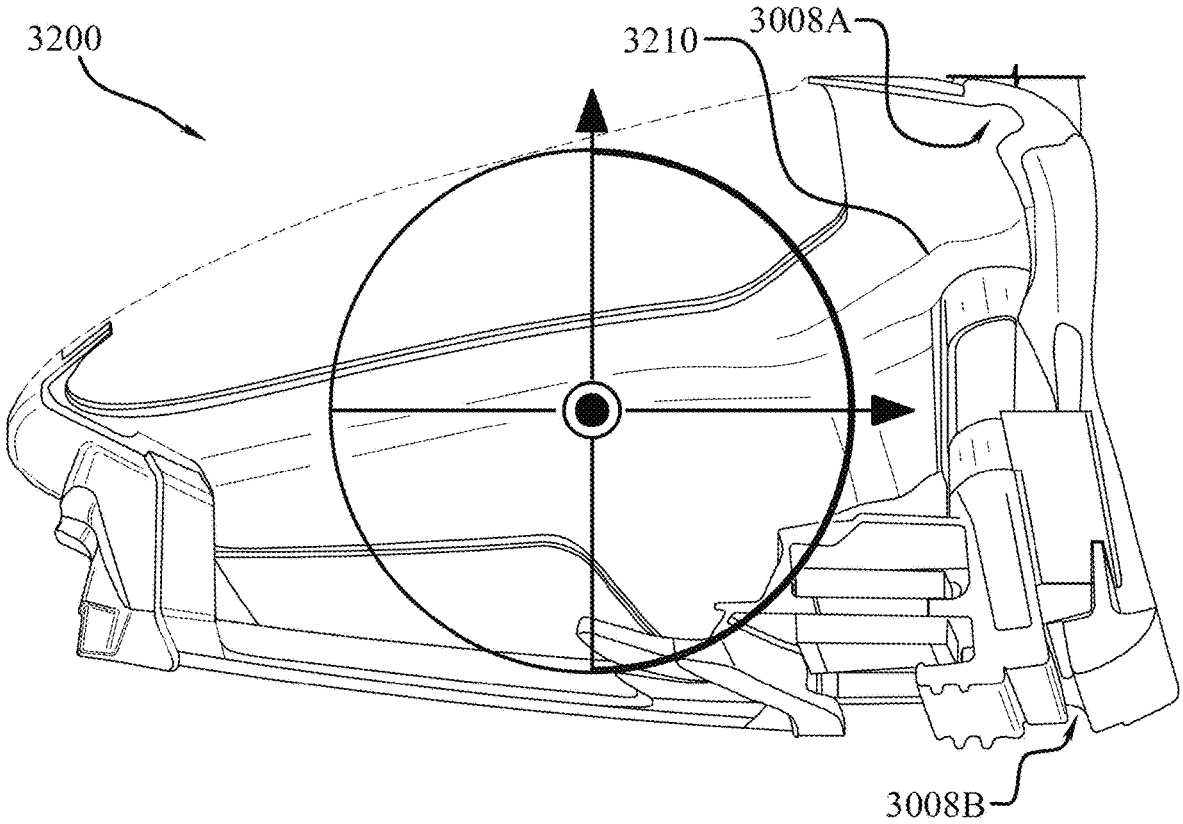
FIG. 40 is a view of a portion of a golf club head in accord with one embodiment of the current disclosure.

FIG. 40 is a view of a portion of a golf club head 3200. FIG. 40 shows the upper face insert support structure 2928A and the lower face insert support structure 2928B provided so that at least a portion of the hollow body 3210 flexes in a similar manner as the face insert 110 (not depicted) when the golf club head strikes a golf ball. Different materials (e.g., metal alloys and composites) have different flex characteristics and typically flex differently from each other. For example, the slot or recess 3008A and the slot or recess 3008B allow a composite face to flex more uniformly with the cast hollow body 3210. Additional and different geometries within the hollow body 3210 may be provided. By flexing in a similar manner, the golf club head may be more durable, substantially preventing the face insert from decoupling, or de-bonding, from the golf club body.

Figure 41:
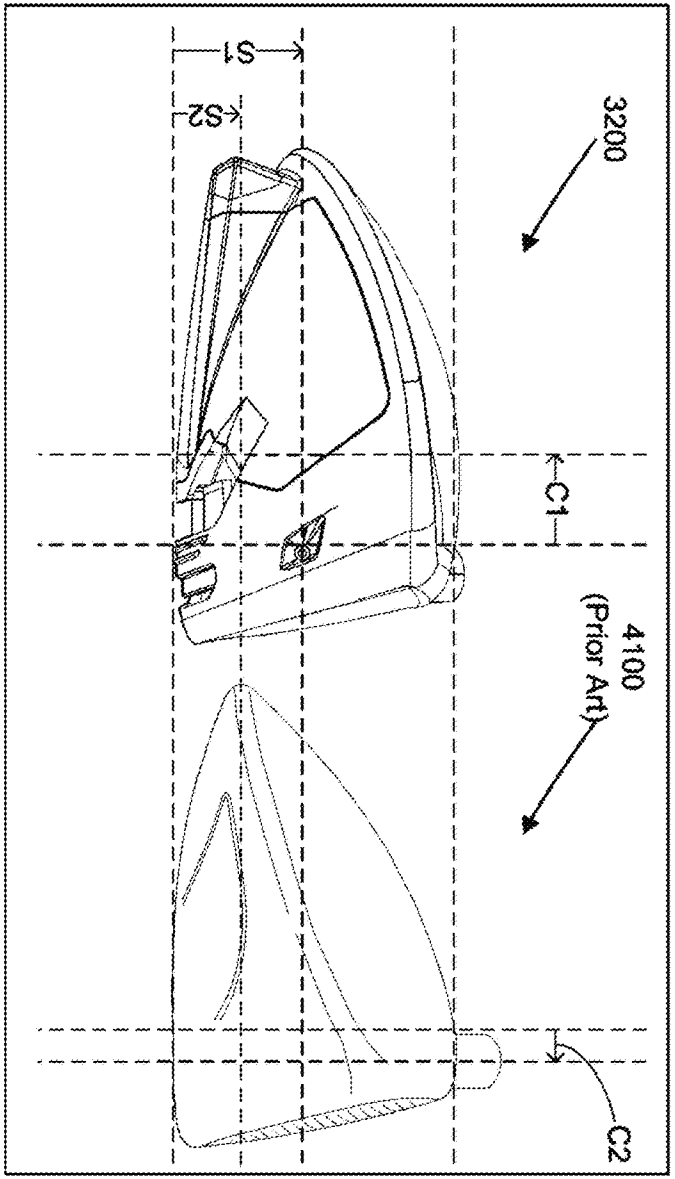
FIG. 41 is a perspective view from a toe side of two golf club heads, one golf club head in accord with one embodiment of the current disclosure and one golf club head in accord with a prior art club head.

FIG. 41 is a perspective view from a toe side of two golf club heads 3200, 4100. The golf club head 3200 is an embodiment of the present disclosures and golf club head 4100 is an embodiment of a prior art club head design. The golf club head 3200 includes features that improve the aerodynamic features of the club head. For example, the prior art club head 4100 has a peak crown height that is located approximately in line with a center shaft axis of the hosel, referred to as an acute crown. To promote better aerodynamic properties of the golf club head 3200, the peak crown height is located rearward of the hosel, referred to as an obtuse crown. Referring to FIG. 41, the peak crown height of the golf club head 4100 is located a distance C2 forward of the rear-most edge of the hosel. To promote better aerodynamics, the peak crown height of the golf club head 3200 is located a distance C1 rearward of the rear-most edge of the hosel. In an embodiment, the peak crown height of the golf club head 3200 is located at least about 15 mm rearward of the rear-most edge of the hosel. Moving the peak crown height rearward allows aero flow to be attached to the club head longer, promoting better aerodynamic properties.

The skirt height of golf club 3200 may also improve aerodynamic features of the golf club head. Golf club head 3200 has a skirt height S1, which may measure the lowest point above the ground plane at which the skirt meets the crown. Golf club head 4100 has a skirt height S2. In some embodiments, the skirt height S1 is at least 20 mm, and in some embodiments may be between about 25 mm and about 40 mm, such as between 30 mm and 40 mm, or between 30 mm and 35 mm. Increasing the skirt height S1 of golf club head 3200 likewise improves the aerodynamic properties of the golf club head. The golf club body has a total body height from defined from a bottom most portion of the golf club body, or the ground plane, to a top most portion of the crown, or the peak crown height, such as vertically or along a z-axis. In some embodiments, the total body height is no less than 48 mm, no less than 52 mm, no less than 53 mm, no less than 54 mm, no less than 55 mm, no less than 56 mm, no less than 57 mm, no less than 58 mm, no less than 59 mm, or no less than 60 mm. In further embodiments the total body height is no more than 72 mm, no more than 70 mm, no more than 68 mm, no more than 66 mm, or no more than 64 mm. The golf club body also has a body length defined from a leading edge of the golf club body, or the leading-edge location, to a rearward most portion of golf club head, or the rearward most portion of the skirt, such as horizontally or along a y-axis. In some embodiments, the body length is no less than 98 mm, no less than 102 mm, no less than 106 mm, no less than 109 mm, no less than 112 mm, no less than 115 mm, or no less than 118 mm. In further embodiments the body length is no more than 133 mm, no more than 130 mm, no more than 127 mm, no more than 126 mm, no more than 125 mm, no more than 124 mm, no more than 123 mm, or no more than 122 mm.

Figure 42:
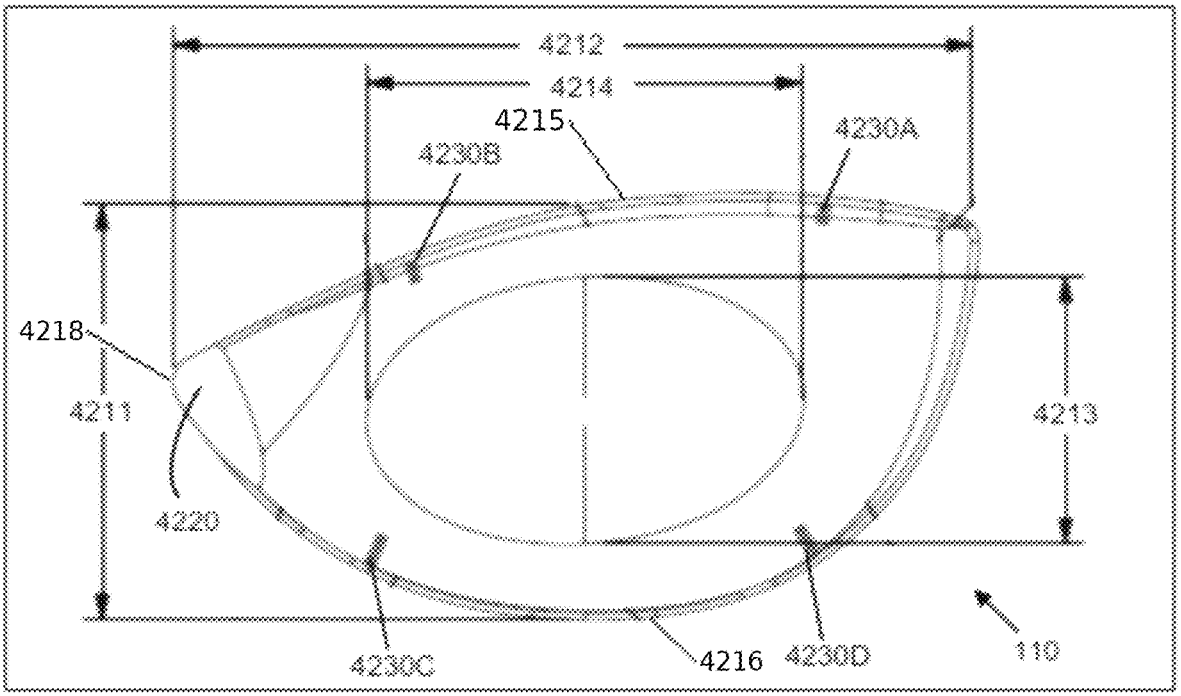
FIG. 42 is a is a front elevation view of a face insert.

FIG. 42 is a front elevation view of a face insert 110. Further details concerning the construction and manufacturing processes for the composite face plate are described in U.S. Pat. No. 7,871,340 and U.S. Published Patent Application Nos. 2011/0275451, 2012/0083361, and 2012/0199282. The composite face plate is attached to an insert support structure located at the opening at the front portion of the club head. Further details concerning the insert support structure are described in U.S. Pat. No. RE43,801.

In some embodiments, the face insert 110 can be machined from a composite plaque, and it should be noted that face insert and face plate are used interchangeably throughout, however the face insert 110 may be formed of metal alloy In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm±1.0 mm plaque size and dimensions. The face insert 110 is then trimmed from the plaque to create a desired face profile. For example, the face profile length 4212 can be between about 80 mm and about 120 mm, or between about 90 mm and about 110 mm, or between about 94 mm and about 106 mm, or between about 98 mm and about 104 mm, preferably about 102 mm. The face profile width 4211 can be between about 40 mm and about 65 mm, or between about 42 mm and about 63 mm, or between about 44 mm and about 61 mm, or between about 46 mm and about 59 mm, or between about 48 mm and about 57 mm, or between about 50 mm and about 55 mm, preferably about 53 mm. The ideal striking location width 4213 can be between about 25 mm and about 50 mm or between about 30 mm and about 40 mm, preferably about 34 mm. The ideal striking location length 4214 can be between about 40 mm and about 70 mm or between about 45 mm and about 65 mm, preferably about 55.5 mm. With continued reference to FIG. 42, the face insert 110 has a face topline perimeter edge 4215, a face lower portion perimeter edge 4216, a face toe transition region 4217, and a face heel transition region 4218. In one embodiment the face toe transition region 4217 is defined by that portion of the perimeter at the toe having a radius of curvature of less than 10 mm, and in further embodiments less than 9 mm, 8 mm, 7 mm, or 6 mm. Similarly, in one embodiment the face heel transition region 4218 is defined by that portion of the perimeter at the heel having a radius of curvature of less than 10 mm, and in further embodiments less than 9 mm, 8 mm, 7 mm, or 6 mm. Alternatively, the face insert 110 can be molded to provide the desired face dimensions and profile.

In embodiments where the face insert 110 is machined from a composite plaque, the face insert 110 can be machined in one or more operations, such as computer numerical control (CNC) or other operations. For example, starting with the composite plaque, a notch 4220 can be first machined from the plaque. Next, a perimeter chamfer can be machined around the perimeter of the face insert 110. Finally, a face profile can be machined from the plaque. In some embodiments, each of the notch 4220, perimeter chamfer, and face profile can be machined in a single operation, such as a single CNC operation without removing the plaque from the CNC fixture. In other embodiments, multiple operations can be performed, such as machining one or more of the notch 4220, perimeter chamfer, or face profile being machined separately from the other features of the face. Other orders of machining features can be provided, such as machining the notch after the face profile and chamfer, as well as machining additional features into the face insert 110, such as bond gap bumps and other features. The notch 4220 is not limited to nonmetallic face plates, or inserts, and all associated disclosure applies equally to metallic face plates, or inserts.

Additional features can be machined, molded, or cast into face the insert 110 to create the desired face profile. For example, a notch 4220 can be machined or molded into the backside of a heel portion of the face insert 110. For example, the notch 4220 in the back of the face insert 110 allows for the golf club head 2500 to utilize flight control technology (FCT) in the hosel 150. The notch 4220 can be configured to accept at least a portion of the hosel within the face insert 110. Alternatively or additionally, the notch 4220 can be configured to accept at least a portion of the club head body within the face insert 110.

In some embodiments, the notch 4220, or another relief portion, defines a transition region on the face insert. For example, the notch 4220 or relief portion is proximate to a heel portion of the face and can have an area of at least about 50 $mm^2$ and no more than about 300 $mm^2$, preferably less than about 200 $mm^2$, more preferably between about 75

$mm^2$ and about 150 $mm^2$. Preferably, the notch area is about 1.5% to about 6% of the external area of the face insert (e.g., the outward facing portion of the face configured for striking the golf ball), more preferably the notch area is about 2% to about 3% of the external face insert.

The notch may allow for the reduction of CFY by accommodating at least a portion of the hosel and/or at least a portion of the club body within the face insert, allowing the ideal striking location of the face insert to be closer to a plane passing through a center point location of the hosel. The face insert 110 can be configured to provide a CFY no more than about 18 mm and no less than about 9 mm, preferably between about 11.0 mm and about 16.0 mm, and more preferably no more than about 15.5 mm and no less than about 11.5 mm. The face insert 110 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 2 mm and no more than 12 mm, preferably between at least 3 mm and 8 mm. In other embodiments, a difference between CFY and face progression is at least 2 mm and no more than 4 mm.

In another example, backside bumps 4230A, 4230B, 4230C, 4230D may be machined or molded into the backside of the face insert. The backside bumps 4230A, 4230B, 4230C, 4230D can be configured to provide for a bond gap. A bond gap is an empty space between the club head body and the face insert that is filled with adhesive during manufacturing. The backside bumps 4230A, 4230B, 4230C, 4230D protrude to separate the face from the club head body when bonding the face insert to the club head body during manufacturing. In some instances, too large or too small of a bond gap may lead to durability issues of the club head, the face insert, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the face insert 110 can be machined or molded with a chamfer. In an example, the face insert 110 includes a chamfer substantially around the inside perimeter edge of the face insert, such as a chamfer between about 0.5 mm and about 1.1 mm, preferably 0.8 mm. In some embodiments, the perimeter chamfer is provided to avoid the face insert 110 bottoming out on an internal radius of the recessed face opening of the golf club head configured to receive the face insert 110. By providing the perimeter chamfer, the face insert 110 can fit properly within recessed face opening despite manufacturing variances and other characteristics of the golf club head created during the casting process.

Figure 43:
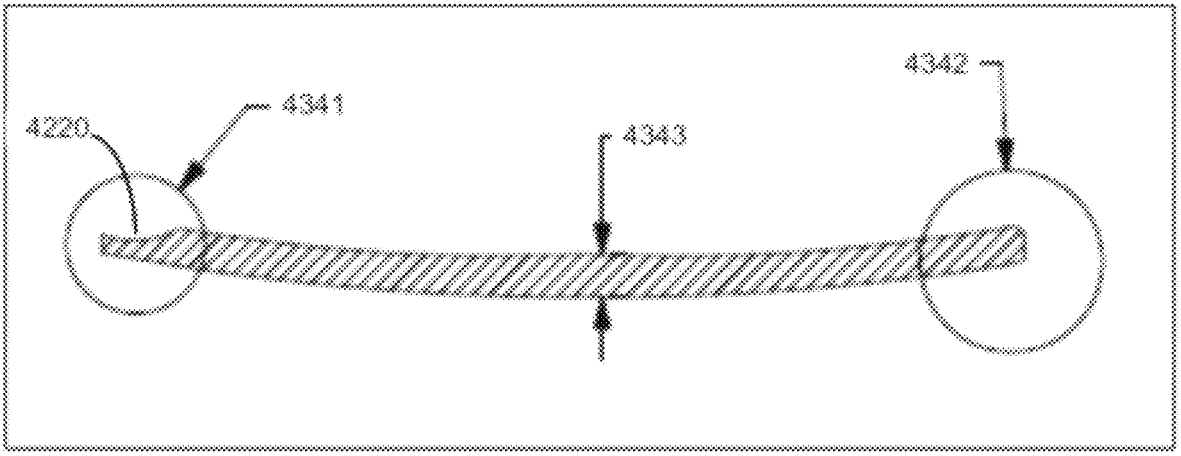
FIG. 43 is a is a bottom perspective view of a face insert.

FIG. 43 is a is a bottom perspective view of a face insert 110. The face insert has a heel portion 4341 and a toe portion 4342. The notch 4220 is machined or molded into the heel portion 4341. In this example, the face insert 110 has a variable thickness, such as with a peak thickness 4343. The peak thickness 4343 can be between about 2 mm and about 7.5 mm or between about 3.8 mm and about 4.8 mm, preferably 4.1 mm±0.1 mm, 4.25 mm±0.1 mm, or 4.5 mm±0.1 mm.

In some embodiments, the face insert 110 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the face insert 110 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the face insert 110 in a localized area, such as in the center face at the ideal striking location. Some Q's and C's can have additional or fewer plies (e.g., three-ply rather than four-ply), such as to fine tune the thickness, mass, localized thickness, and provide for other properties of the face insert 110, such as to increase or decrease COR of the face insert 110.

Additional composite materials and methods for making the same are described in U.S. Pat. Nos. 8,163,119 and 10,046,212, which is incorporated by reference. For example, the usual number of layers for a striking plate is substantial, e.g., fifty or more. However, improvements have been made in the art such that the layers may be decreased to between 30 and 50 layers.

The tables below provide examples of possible layups. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm (grams per square meter) with about 36% to about 40% resin content. The thickness of each individual ply may be altered by adjusting either the FAW or the resin content, and therefore the thickness of the entire layup may be altered by adjusting these parameters.

In addition to the unidirectional composite panels oriented at 90°, −45°, 0°, and 45°, additional Q panels can be provided according to table 2.

TABLE 2

| ply 1 | ply 2 | ply 3 | ply 4 | ply 5 | ply 6 | ply 7 | ply 8 | AW g/m² |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |

TABLE 2-continued

| ply 1 | ply 2 | ply 3 | ply 4 | ply 5 | ply 6 | ply 7 | ply 8 | AW g/m$^2$ |
|---|---|---|---|---|---|---|---|---|
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$.

In an example, a first face insert can have a peak thickness of 4.1 mm and an edge thickness of 3.65 mm, including 12 Q's and 2 C's, resulting in a mass of 24.7 g. In another example, a second face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third face insert can have a peak thickness of 4.5 mm and an edge thickness of 3.9 mm, including 12 Q's and 3 C's, resulting in a mass of 26.2 g. Additional and different combinations of Q's and C's can be provided for a face insert 110 with a mass between about 20 g and about 30 g, or between about 15 g and about 35 g. In one series of embodiments the mass of the face insert 110 is no more than 30 g, while in further embodiments it is no more than 28 g, 26 g, 25 g, and 24 g. In a further series of embodiments the mass of the face insert 110 is at least 16 g, while in further embodiments it is at least 18 g, 19 g, 20 g, 21 g, 22 g, and 23 g.

Figure 44A:
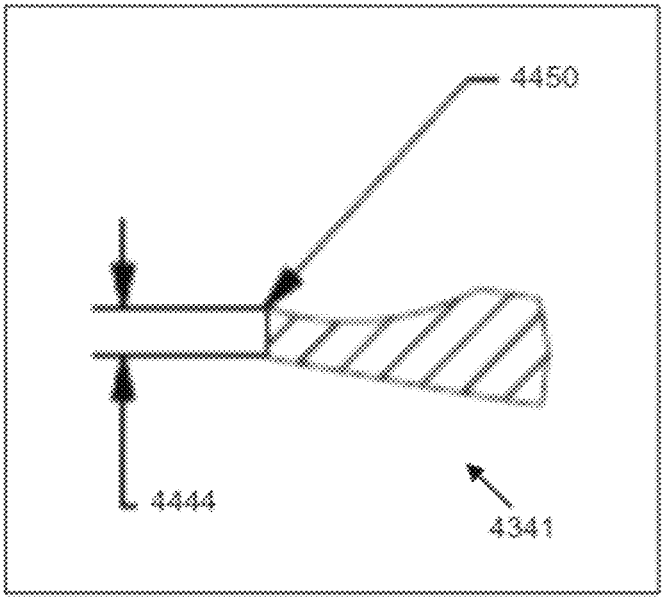
FIG. 44A is a section view of a heel portion of a face insert.

FIG. 44A is a section view of a heel portion 4341 of a face insert 110. The heel portion 4341 can include a notch 4220. In embodiments with a chamfer on an inside edge of the face insert 110, no chamfer 4450 can be provided on the notch 4220. The notch 4420 can have a notch edge thickness 4444 less than the non-notch edge thickness 4445 of the face insert 110. Thus, the face plate perimeter has a face perimeter thickness that may vary from the non-notch edge thickness 4445, to the notch edge thickness 4444. In one embodiment the notch edge thickness 4444 is at least 10% less than the non-notch edge thickness 4445, and in further embodiments at least 15%, 20%, 25%, 30%, or 35% less. In another embodiment the notch edge thickness 4444 is at least 25% of the non-notch edge thickness 4445, and at least 30%, 35%, 40%, 45%, 50%, or 55% in further embodiments. For example, in one embodiment the notch edge thickness 4444 can be between 1.5 mm and 2.1 mm, while in further embodiments the notch edge thickness 4444 is no more than 3.0 mm, no more than 2.8 mm, no more than 2.6 mm, no more than 2.4 mm, no more than 2.2 mm, no more than 2.0 mm, and in one embodiment is preferably 1.8 mm. In a further series of embodiments the notch edge thickness 4444 is at least 0.9 mm, and at least 1.0 mm, 1.1 mm, 1.2 mm, 1.3 mm, 1.4 mm, 1.5 mm, and 1.6 mm in further embodiments. In one embodiment the reduced notch edge thickness 4444 extends over at least 5 mm of the perimeter of the face insert 110, while in further embodiments it extends over at least 7.5 mm, 10 mm, 12.5 mm, 15 mm, and 17.5 mm. In another embodiment the reduced notch edge thickness 4444 extends over no more than 70 mm of the perimeter of the face insert 110, while in further embodiments it extends over no more than 60 mm, 50 mm, 45 mm, 40 mm, and 35 mm. In one embodiment the non-notch edge thickness 4445 is constant throughout at least 90 mm of the perimeter of the face insert 110, while in further embodiments it constant throughout at least 110 mm, 130 mm, 150 mm, or 170 mm. In another embodiment, with reference to the front elevation view coordinate system of FIG. 61, the non-notch edge thickness 4445 is constant throughout at least 90 degrees of the perimeter of the face insert 110, and in further embodiments at least 135 degrees, 180 degrees, 225 degrees, 270 degrees, or 315 degrees. The non-notch edge thickness 4445 is at least 3.1 mm in an embodiment, and is at least 3.2 mm, 3.3 mm, 3.4 mm, 3.5 mm, 3.6 mm, 3.7 mm, or 3.8 mm in further embodiments. In a still further series of embodiments the non-notch edge thickness 4445 is no more than 4.9 mm in an embodiment, and no more than 4.8 mm, 4.7 mm, 4.6 mm, 4.5 mm, 4.4 mm, 4.3 mm, 4.2 mm, or 4.1 mm in further embodiments. The peak thickness 4343 is greater than the non-notch edge thickness 4445 in one embodiment, while in further embodiments the peak thickness 4343 is at least 5%, 10%, or 15% greater than the non-notch edge thickness 4445. The peak thickness 4343 is 100% greater than the reduced notch edge thickness 4444 in one embodiment, while in further embodiments the peak thickness 4343 is at least 110%, 120%, or 130% greater than the reduced notch edge thickness 4444. The peak thickness 4343 is less than 200% of the non-notch edge thickness 4445 in one embodiment, while in further embodiments the peak thickness 4343 is less than 190%, 180%, 170%, 160%, 150%, 140%, or 130% of the non-notch edge thickness 4445. The peak thickness 4343 is less than 310% of the reduced notch edge thickness 4444 in one embodiment, while in further embodiments the peak thickness 4343 is less than 300%, 290%, 280%, or 270% of the reduced notch edge thickness 4444. The peak thickness 4343 is at least 3.9 mm in an embodiment, and is at least 4.0 mm, 4.1 mm, 4.2 mm, 4.3 mm, 4.4 mm, 4.5 mm, 4.6 mm, 4.7 mm, or 4.8 mm in further embodiments. In a still further series of embodiments the peak thickness 4343 is no more than 6.0 mm in an embodiment, and no more than 5.9 mm, 5.8 mm, 5.7 mm, 5.6 mm, 5.5 mm, 5.4 mm, 5.3 mm, 5.2 mm, 5.1 mm, or 5.0 mm in further embodiments.

Figure 44B:
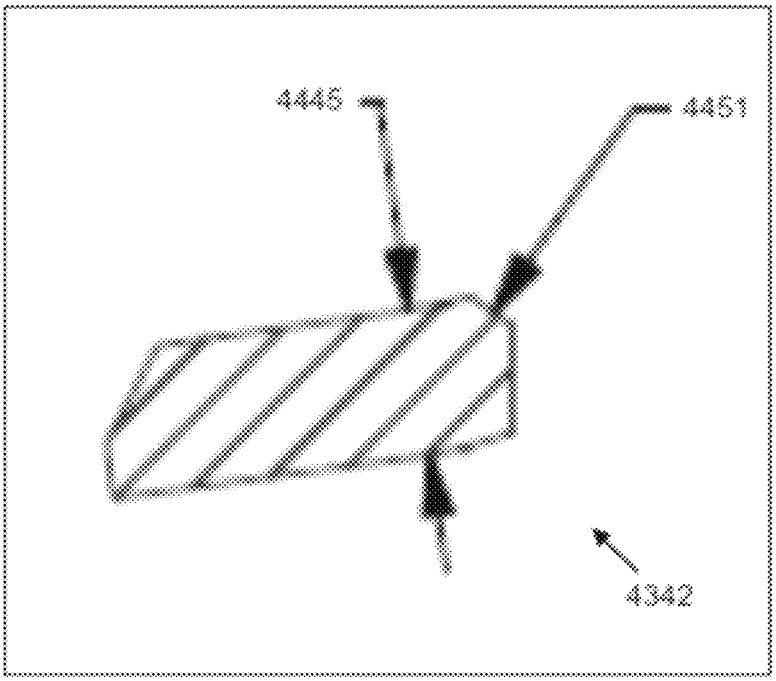
FIG. 44B is a section view of a toe portion of a face insert.

FIG. 44B is a section view of a toe portion 4342 of a face insert 110. The toe portion 4342 includes a chamfer 4451 on the inside edge of the face insert 110. The chamfer 4451 has an internal angle from the chamfer surface to the face insert sidewall surface that is at least 110 degrees in one embodiment, and at least 120 degrees, 130 degrees, or 140 degrees in further embodiments. Further, the chamfer 4451 has a chamfer length of at least 0.5 mm in one embodiment, and at least 0.6 mm, 0.7 mm, 0.8 mm, or 0.9 mm in further embodiments. In a further embodiment the chamfer length is no more than 60% of the non-notch edge thickness 4445, and no more than 50%, 40%, 35%, 30%, or 25% in additional embodiments. In one embodiment the chamfer 4452 is present throughout at least 90 mm of the perimeter of the face insert 110, while in further embodiments it present throughout at least 110 mm, 130 mm, 150 mm, or 170 mm. In another embodiment, with reference to the front elevation view coordinate system of FIG. 61, the chamfer 4452 is present throughout at least 90 degrees of the perimeter of the face insert 110, and in further embodiments at least 135 degrees, 180 degrees, 225 degrees, 270 degrees, or 315 degrees. In a further embodiment the face insert perimeter adjacent the reduced notch edge thickness 4444 does not have the chamfer 4452. In still a further embodiment the notch 4220 has a radius of curvature of no more than 25 mm, and no more than 22 mm, 19 mm, and 16 mm in additional embodiments. At least a portion of the notch 4220 has an acute angle between the notch surface and the face insert sidewall surface, in one embodiment. In some embodiments, the edge thickness 4445 can be between about 3.35 mm and about 4.2 mm, preferably 3.65 mm±0.1 mm, 3.8 mm±0.1 mm, or 3.9 mm±0.1 mm.

Figure 45:
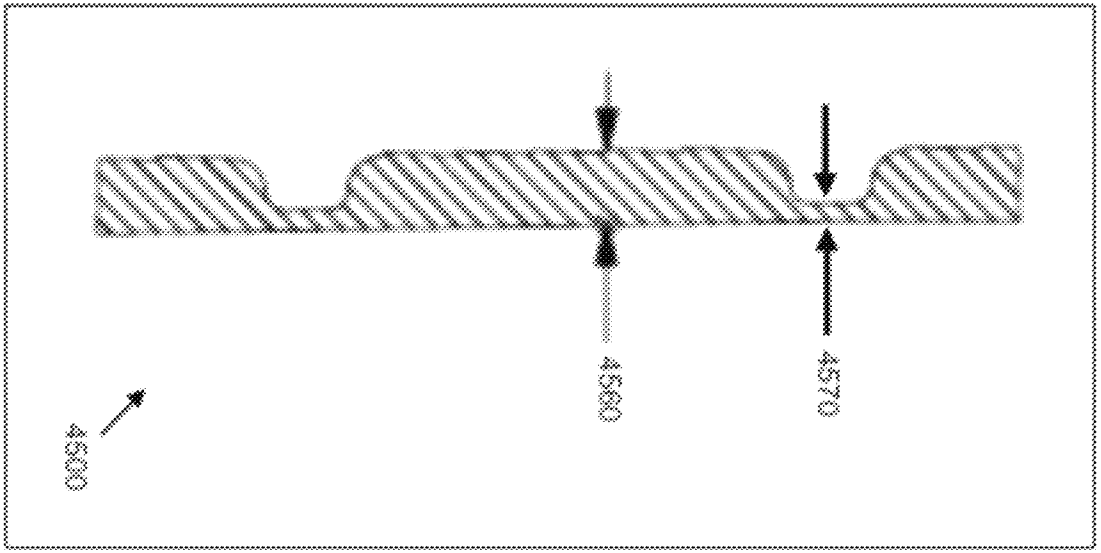
FIG. 45 is a section view of a polymer layer of a face insert.
Figure 46:
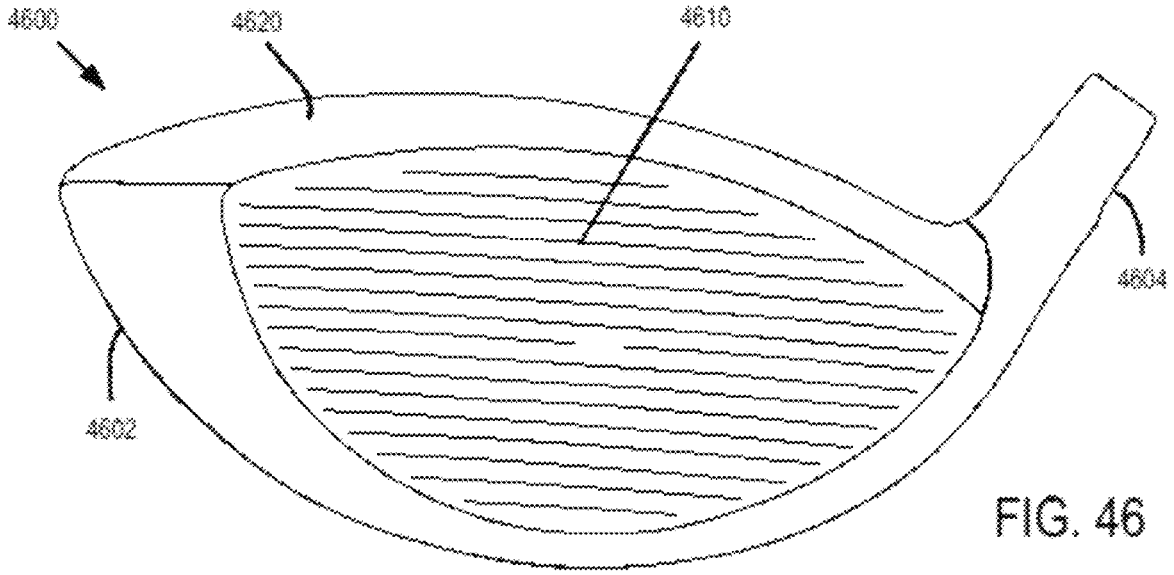
FIGS. 46-67 illustrate another exemplary golf club head, as follows.
Figure 47:
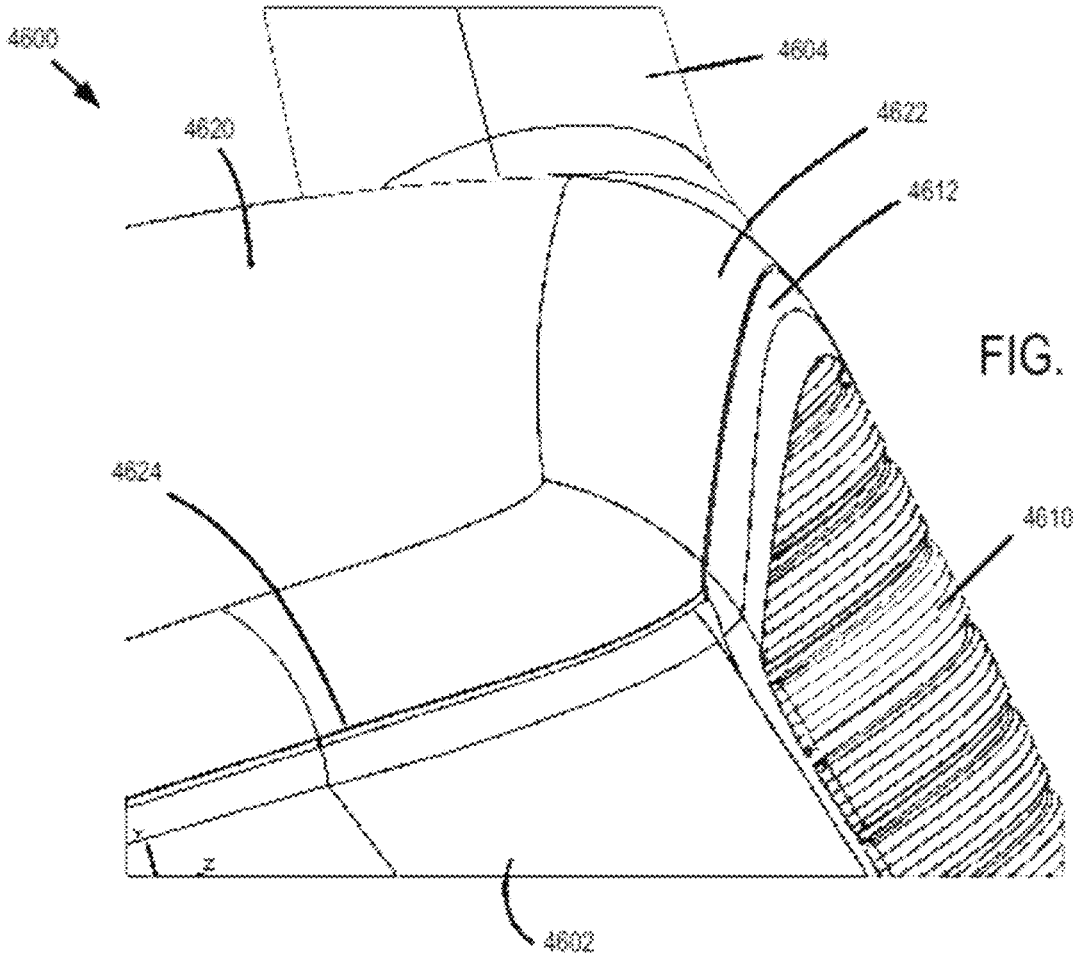
Figure 48:
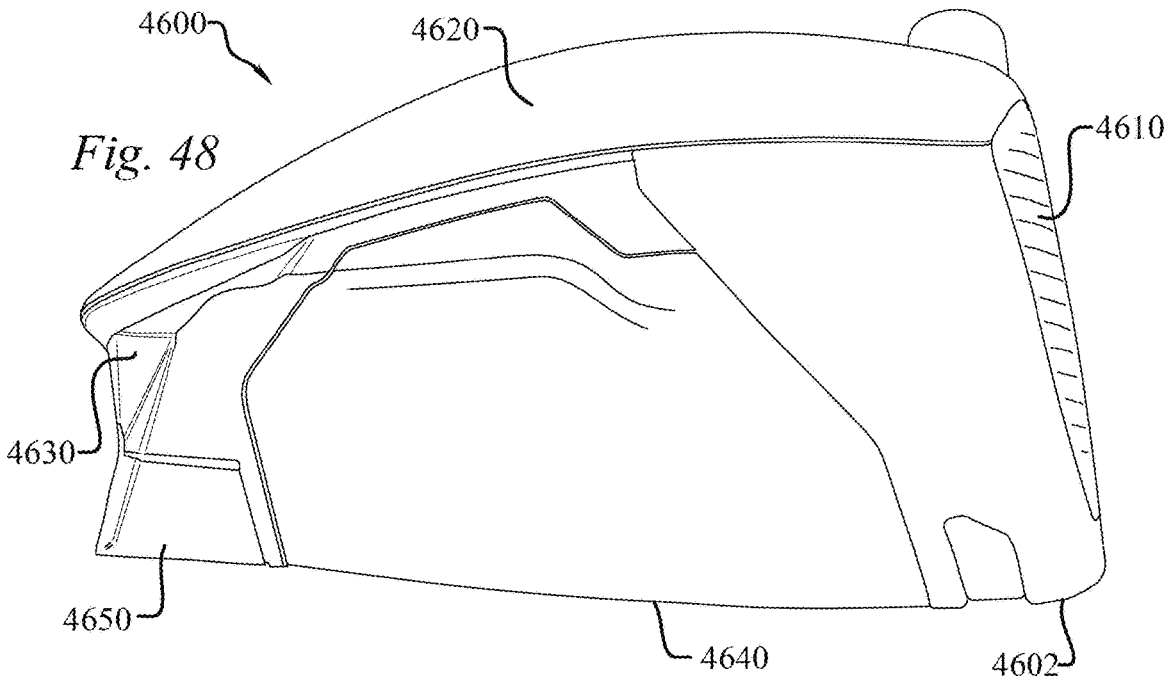

FIG. 45 is a section view of a polymer layer 4500 of a face insert 110. The polymer layer 4500 can be provided on the outer surface of the face insert 110 to provide for better performance of the face insert 110, such as in wet conditions. Exemplary polymer layers are described in U.S. patent application Ser. No. 13/330,486 (patented as U.S. Pat. No. 8,979,669), which is incorporated by reference. The polymer layer 4500 may include polyurethane and/or other polymer materials. The polymer layer may have a polymer maximum thickness 4560 between about 0.2 mm and 0.7 mm or about 0.3 mm and about 0.5 mm, preferably 0.40 mm±0.05 mm. The polymer layer may have a polymer minimum thickness 4570 between about 0.05 mm and 0.15 mm, preferably 0.09 mm±0.02 mm. The polymer layer can be configured with alternating maximum thicknesses 4560 and minimum thicknesses 4570 to create score lines on the face insert 100. Further, in some embodiments, teeth and/or another texture may be provided on the thicker areas of the polymer layer 4500 between the score lines.

In some embodiments, a method of assembling a golf club is provided. For example, the method includes providing a golf club head having a face opening with an internal hosel surface intruding into the face opening (e.g., forming a portion of the face opening) The golf club head can also include at least one of a crown opening and/or a sole opening. The method also includes attaching a composite face insert to the golf club body, where the face insert is machined from a composite plaque with a larger area than the finished face insert. For example, the composite face insert includes a machined perimeter chamfer and a machined in notch. The method further includes enclosing the face opening with the face insert, such as by attaching the face insert to the club head. In some embodiments, the internal hosel surface is received by the notch in the face insert. The method also includes enclosing one or more of the crown opening and/or sole opening with a crown insert and/or a sole insert. The method may further include attaching a golf club shaft having a shaft sleeve, and tightening a screw to attach the golf club shaft to the golf club head to form a golf club assembly. In some examples, the golf club head has a face progression less between 10 and 20 mm and a CFY between 9 and 18 mm, preferably less than 16 mm.

In some embodiments, the x-axis of the golf club head is tangential to the face and parallel to a ground plane, negative locations on the x-axis extend from the center face to the toe portion, and positive locations on the x-axis extend from the center face to the heel portion. In these embodiments, a center of gravity of the golf club body with respect to the x-axis ($CG_x$) can be oriented from about 0 mm to about −10 mm.

In some embodiments, a method of counteracting a lateral dispersion tendency of a golf club head is provided. For example, the golf club head can have a face, a crown and a sole together defining an interior cavity, a body of the golf club head including a heel and a toe portion and having x, y and z axes which are orthogonal to each other and have their origin at USGA center face. The method can include providing a primary alignment feature comprising a line delineating a transition between at least a first portion of the crown having an area of contrasting shade or color with a shade or color of the face. The primary alignment feature can be hard tooled into the golf club head with the face of the golf club body, and the golf club head can have a first Sight Adjusted Perceived Face Angle (SAPFA) with respect to the primary alignment feature. The method also includes measuring the lateral dispersion tendency of the golf club head. The lateral dispersion tendency indicates an average dispersion from a center target line, where a positive lateral dispersion tendency is the average dispersion right of the center target line and a negative lateral dispersion tendency is the average dispersion left of the center target line. The method further includes adjusting the primary alignment feature to provide an adjusted primary alignment feature to counteract the lateral dispersion tendency of the golf club head and incorporating the adjusted primary alignment feature into the golf club head. The adjusted primary alignment feature can have a second Sight Adjusted Perceived Face Angle (SAPFA) of from about −2 to about 10 degrees and a second Radius of Curvature (circle fit) of from about 300 to about 1000 mm.

In some embodiments, the method can also include incorporating the adjusted primary alignment feature into the golf club head comprises retooling the golf club head. In some embodiments, adjusting the primary alignment feature counteracts the lateral dispersion tendency of the golf club head by providing for a positive lateral dispersion tendency for the golf club head. In some embodiments, adjusting the primary alignment feature counteracts the lateral dispersion tendency of the golf club head by providing for a negative lateral dispersion tendency for the golf club head. In some embodiments, adjusting the primary alignment feature counteracts the lateral dispersion tendency of the golf club head by reducing average dispersion from the center target line. In some embodiments, the primary alignment feature is hard tooled into the golf club head by bonding the face to the golf club body. In some embodiments, the golf club body is painted prior to bonding the face to the golf club body. In some embodiments, the adjusted primary alignment feature includes: a second Sight Adjusted Perceived Face Angle 25 mm Heelward ($SAPFA_{25H}$) of from about −5 to about 2 degrees; a second Sight Adjusted Perceived Face Angle 25 mm Toeward ($SAPFA_{25T}$) of from 0 to about 9 degrees; and a second Sight Adjusted Perceived Face Angle 50 mm Toeward ($SAPFA_{50T}$) of from about 2 to about 9 degrees.

Additional Exemplary Golf Club Heads

Figure 76:
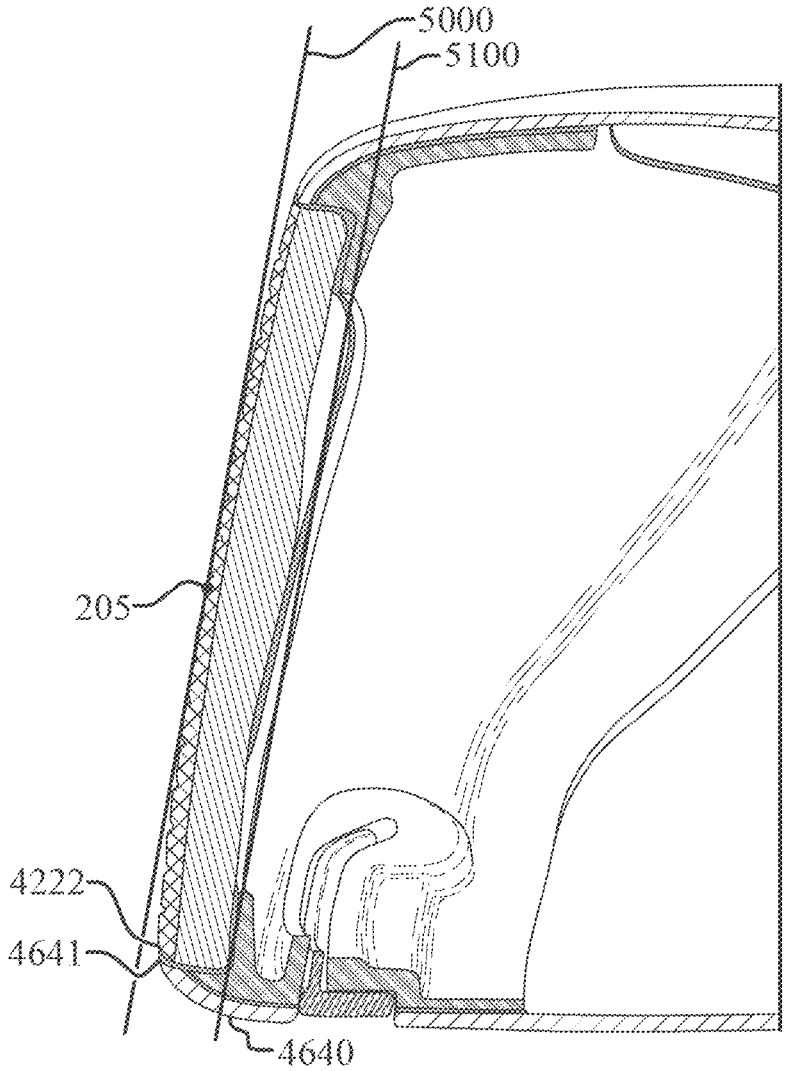
FIG. 76 is a cross-sectional view of the club head.
Figure 77:
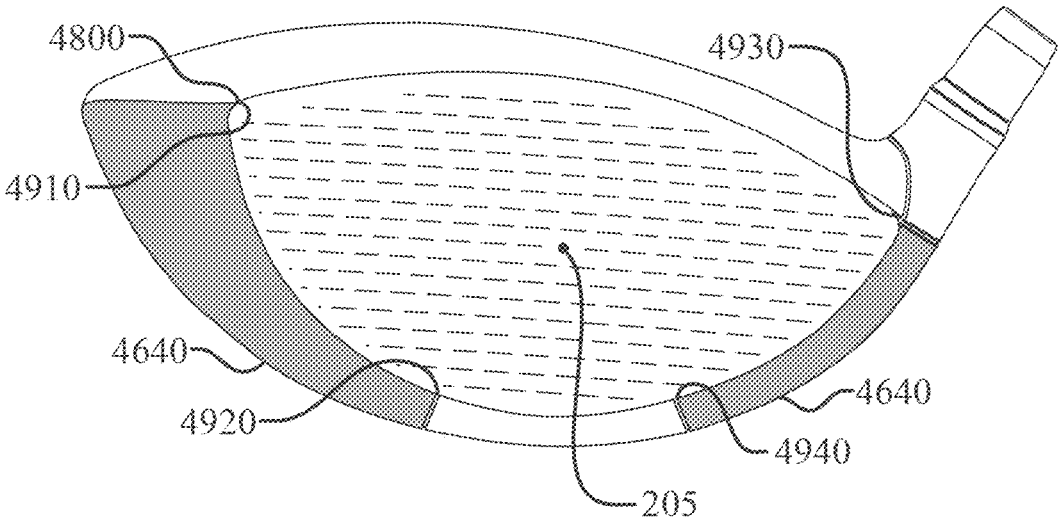
FIG. 77 is a front view of the club head.
Figure 78:
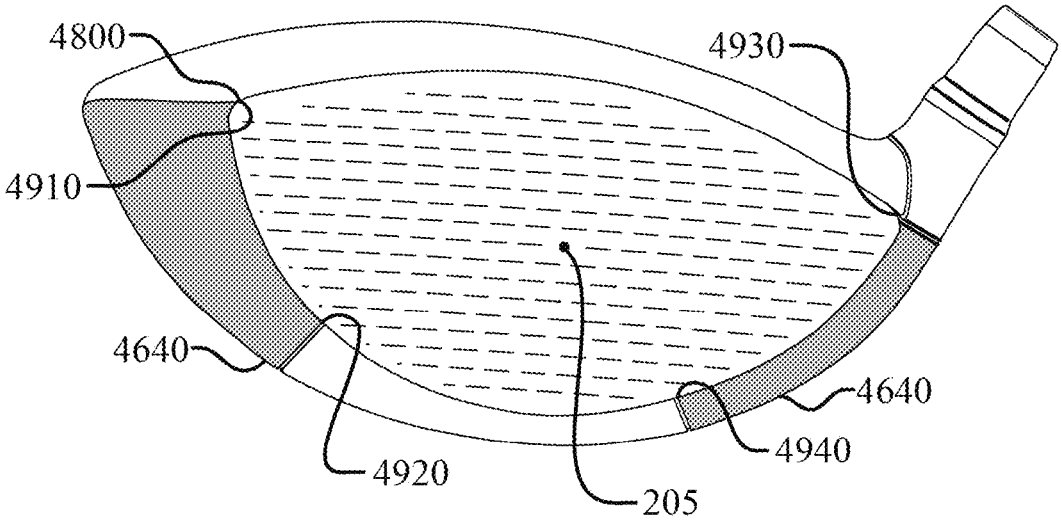
FIG. 78 is a front view of the club head.
Figure 79:
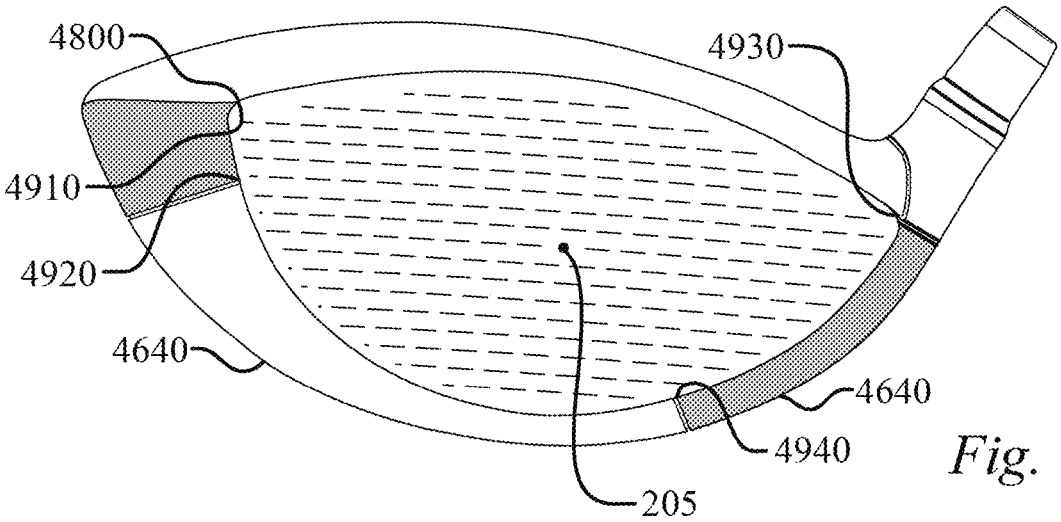
FIG. 79 is a front view of the club head.
Figure 80:
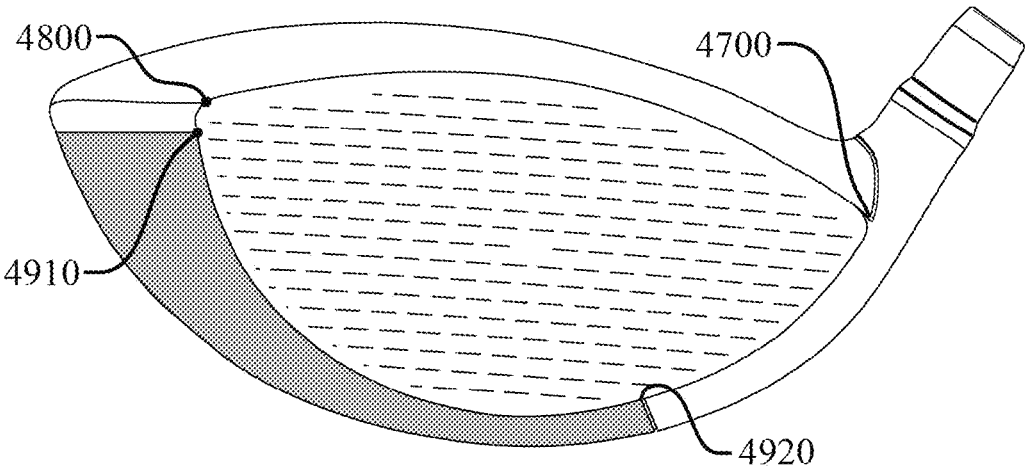
FIG. 80 is a front view of the club head.

FIGS. 46-94 illustrate an exemplary golf club head 4600 that includes a face plate 4610 and an oversized crown 4620, also referred to as a crown panel, that extends to the front of the club head adjacent to the upper side of the face plate 4610, and in some embodiments forms a topline and/or rear perimeter portion of the club head. The crown 4620 and face plate 4610 can comprise nonmetallic composite materials, in some embodiments, such that the topline is formed where a portion of the composite material of the crown extends to be adjacent to a portion of the face plate. While much of this disclosure is related to relationships of the crown 4620, the face plate 4610, and the associated support structure, it is important to appreciate at the outset that the disclosure and relationships also apply to a sole plate 4640 having a portion wrapping around the front of the club head to be adjacent the face plate 4610, which may occur at the toe of the face plate 4610, as seen in FIGS. 77-81, at the heel of the face plate 4610, as seen in FIGS. 77-79, at the lower portion of the face plate 4610, as seen in FIGS. 76 and 80, and any combinations thereof. Similarly, the disclosure and relationships also apply to individual plates that may form only a portion of the skirt, and may be located at the toe or heel, and may not constitute a portion of the sole.

The club head include a body 4602 that includes a hosel portion 4604 and provides a primary structural support for the club head, and various other components are coupled to the body, which may include the face plate 4610 and the crown 4620, and in some embodiments a sole plate 4640, one or more weights (e.g., weights 4650, 4640), and/or other features. In some embodiments, the body includes a front body portion (labeled as 4602) and a rear ring portion 4630 attached together (e.g., welded, bonded, or mechanically attached) at the heel and toe ends, or integrally formed. Whether attached together or integrally formed, the front body portion 4602 and the rear ring portion 4630 compose a frame that serves as the supporting structure for the attachment of other components, which may include the crown 4620, the face plate 4610, and/or the sole plate 4640. Further, as disclosed later in detail, the face plate 4610 may be attached to, or integrally formed with the frame and/or front body portion 4602 and therefore the use of the term plate is not to imply a separate component, although it may be a separate component as disclosed in more detail later. Similarly, the sole plate 4640 may be attached to, or integrally formed with the frame, front body portion 4602, and/or rear ring portion 4630, and therefore the use of the term plate is not to imply a separate component, although it may be as disclosed in more detail later. Thus, in one simple embodiment the frame is created by the front body portion 4602 and the rear ring portion 4630, whether joined together or formed together, and form an upper crown opening 340 in the frame. The front body portion 4602 includes a hosel portion 4604 having a hosel bore, the center of which defines a shaft axis (SA).

The rear ring portion 4630 can in some embodiments comprise a different material than the front body portion 4602. In other embodiments, the front body portion and the rear ring portion are a unitary component of a common material. In one embodiment the front body portion 4602 and/or the rear ring portion 4630 is formed of a metal alloy, while in a further embodiment the front body portion 4602 and/or the rear ring portion 4630 is formed of nonmetallic material, including any of those disclosed herein.

Figure 62:
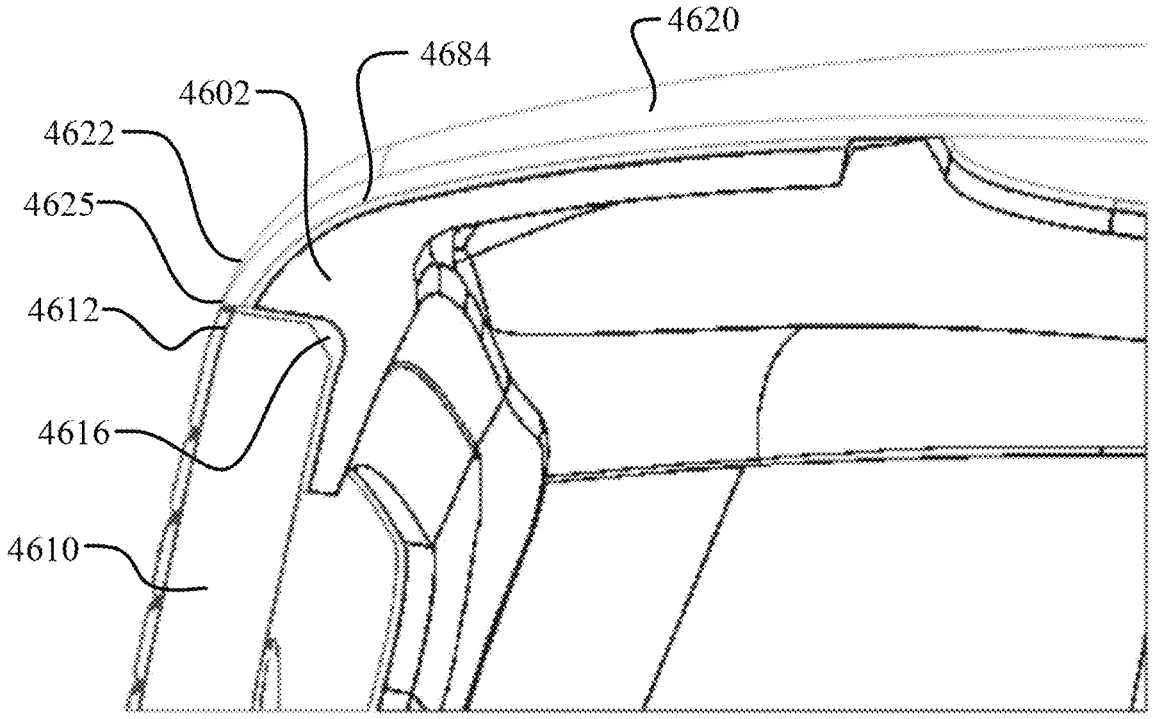
Figure 63:
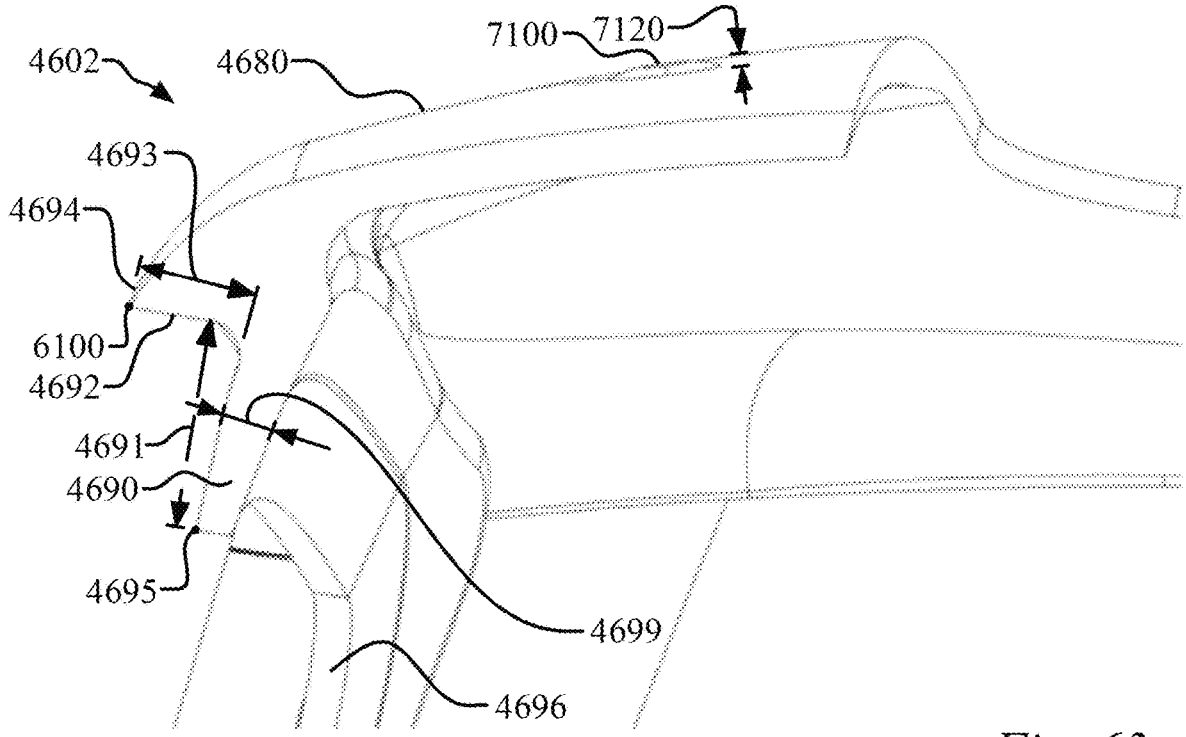
Figure 67:
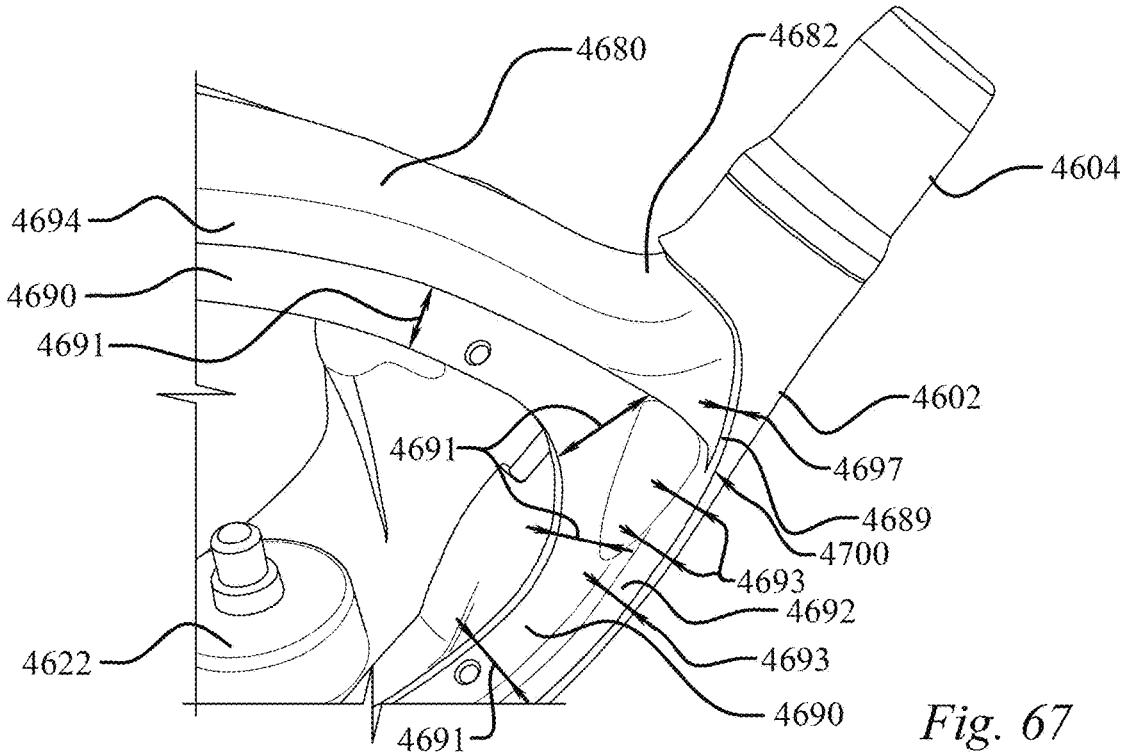

The crown 4620 can have a large external surface area that extends greater extents compared to conventional crowns. The perimeter of the crown 4620 can be bonded to recessed ledges of the body such that the crown 4620 covers an upper opening in the body. For example, as shown in FIGS. 62 and 63, the crown 4620 can comprise a front portion 4622 that is bonded to a front, or forward, ledge 4680 of the body via body panel adhesive 4684. The front portion 4622 extends over and around an upper front portion of the body 4694 and is adjacent to an upper portion 4612 of the face plate 4610. The body can also include a front opening 4696 that is covered by the face plate, with perimeter portions of the face plate 4610 being bonded to perimeter walls 4690, also referred to as the ledge wall 4690 or face support ledge wall 4690, and/or 4692, also referred to as the insert recess wall 4692, as seen in FIG. 63, of the body via face insert adhesive 4616. As seen in FIG. 63, the face support ledge wall 4690 has a ledge wall length 4691, measured from a ledge wall interior perimeter edge 4695 to the insert recess wall 4692. Similarly, the insert recess wall 4692 has an insert recess wall length 4693, which along the upper portion is measured from a recess wall leading edge 6100 to the face support ledge wall 4690, while in other portions, such as the illustrated lower portion, as seen in FIG. 67, is measured from forwardmost point of the insert recess wall 4692 to the face support ledge wall 4690. Referring again to FIG. 63, the face support ledge wall 4690 also has a ledge wall thickness 4699, which may vary slightly along the ledge wall length 4691, however unless noted otherwise references herein to the ledge wall thickness 4699 are the average ledge wall thickness 4699 from the ledge wall interior perimeter edge 4695 to the beginning of the fillet transitioning to the insert recess wall 4692. While the face support ledge wall 4690 is illustrated as continuous around the perimeter of the face plate 4610, in one embodiment it is discontinuous with at least X ledge gaps between adjacent and distinct ledge wall segments, wherein X represents a number from one to ten. Further, the face support ledge wall 4690 may be formed of a single material around the perimeter of the face plate 4610, however in one embodiment the face support ledge wall 4690 is constructed of at least 2 distinct portions formed of different material.

In one embodiment, the upper front portion of the body 4694, namely the front body portion 4602, is completely covered and not visible between the crown 4620 and the face plate 4610. This allows the topline of the club head to formed by the juncture of the crown 4620 and the face plate 4610, which can allow for a very precisely defined topline (the benefits of which are described in detail elsewhere herein). By contrast, in conventional club heads, the topline of the club head is often painted by hand and susceptible to variance due to human error. The exact orientation and position of the topline can be defined by precisely manufacturing the mating shapes of the front portion of the crown and the top portion of the face plate. This also allows for the intentional creation of custom topline orientations that are slightly different in different club heads, such as to influence a draw bias for instance.

Another advantage is that there is not a need to paint a visible upper front portion of the body, as in a conventional club head, which eliminates the problem of the painted surfaces chipping or otherwise being damaged from ball strikes or other impacts. Unexpectedly, it was discovered that the composite material of the crown is more durable and resistant to chipping and cracking than a conventional painted surface on a metallic body. This may be because the composite material of the crown 4620 is adhered to itself, which is a stronger bond than a paint layer adhered to a metallic body. In addition, the composite crown material overlapping a forward surface of the body appears to provide a very robust and damage resistant surface at the upper front region of the club head.

Figure 64:
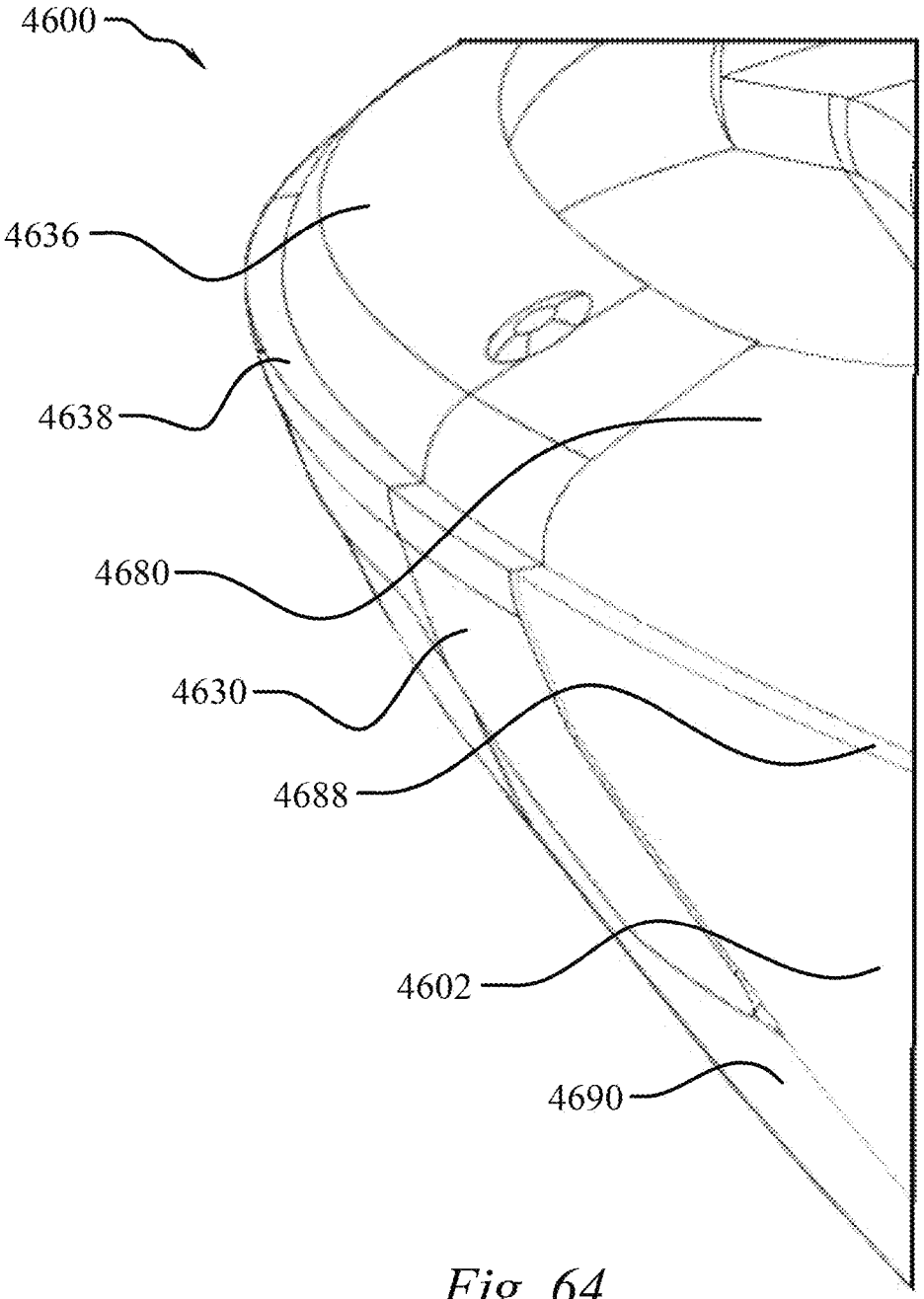
Figure 65:
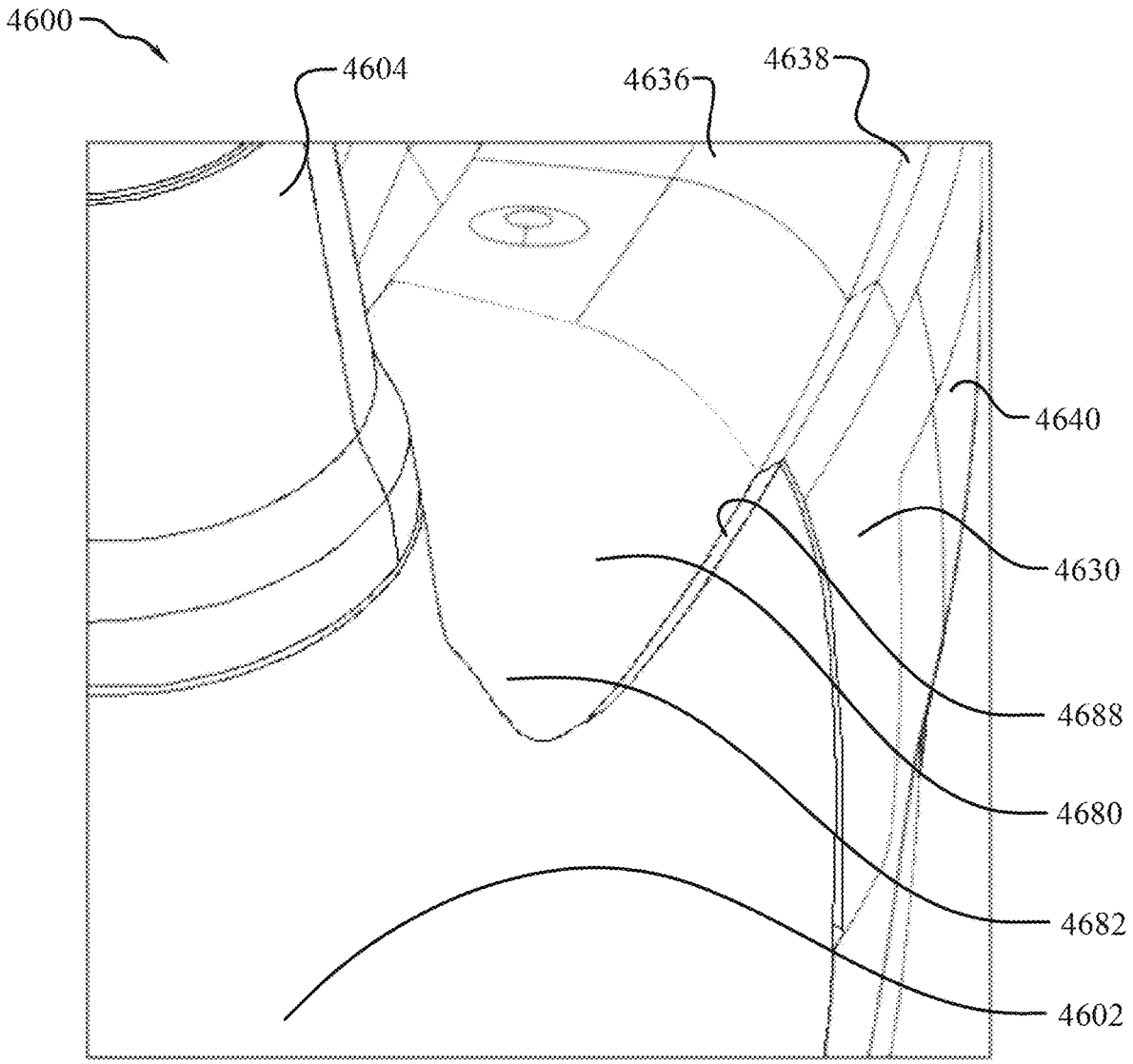

At the toe side of the club head, a toe portion 4624 of the crown 4620 can extend all the way to a toeward-most extent of the club head, or further, and be bonded to the ledge 4680 of the body. As shown in FIG. 64, some embodiments include the rear ring portion 4630 of the body, which may have a complementary ledge 4636 that is continuous with the ledge 4680, and the toe portion 4624 of the crown 4620 can be bonded to one, or both. A toe end of the crown 4620 can contact and/or be bonded to a wall 4688, 4638 where the body steps down to the recessed ledge. The wall 4688 of FIG. 64 is also known as the toe-side stepped down wall 4688 shown in FIG. 66. As seen in FIGS. 64 and 65, wall 4638, also referred to as the intermediary stepped down wall 4638, joins a heel-side stepped down wall 4689, seen in FIG. 67, to the toe-side stepped down wall 4688. In one embodiment the dimensions associated with the stepped down walls 4688, 4689, 4638 are identical.

Figure 50:
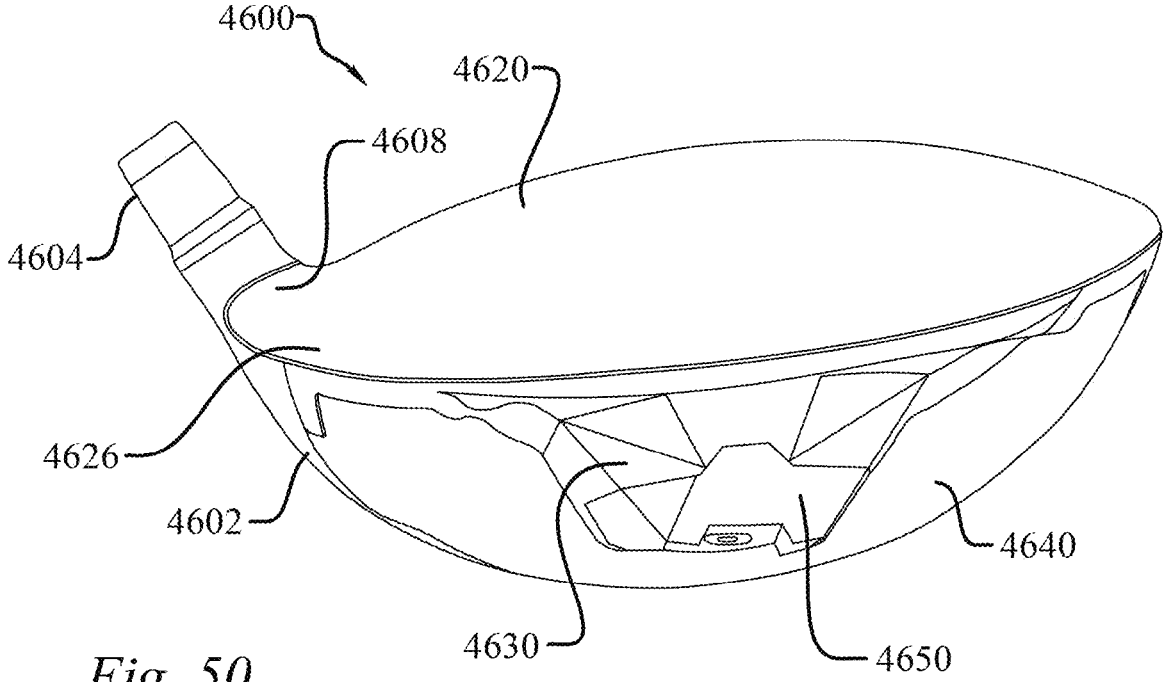

Similarly, at the heel side of the club head, a heel portion 4626 of the crown can extend all the way to a heelward-most extent of the club head, or further, and be bonded to the body ledge 4680 of the body. As shown in FIG. 65, the rear ring portion 4630 of the body can have a complementary ring ledge 4636 that is continuous with the body ledge 4680, and the heel portion 4626 of the crown 4620 can be bonded to one, or both. A heel end of the crown 4620 can contact and/or be bonded to heel-side stepped down wall 4689 and/or the intermediary stepped down wall 4638 where the body steps down to the recessed ledge 4680, 4636. The ring ledge 4636 and the intermediary stepped down wall 4638 can extend around the rear of the club head such that a rear portion of the crown 4620 can extend broadly to a maximum rearward extent of the club head as well, as shown in FIGS. 50 and 56.

Figure 56:
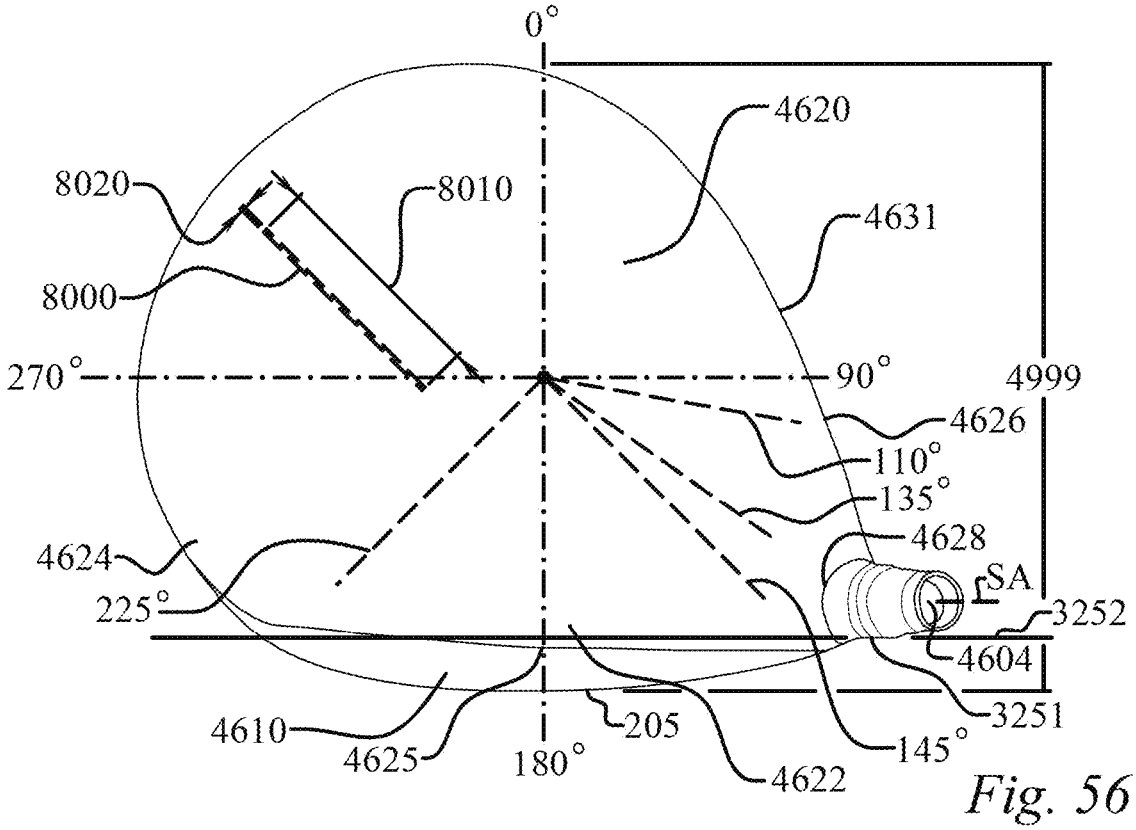
Figure 57:
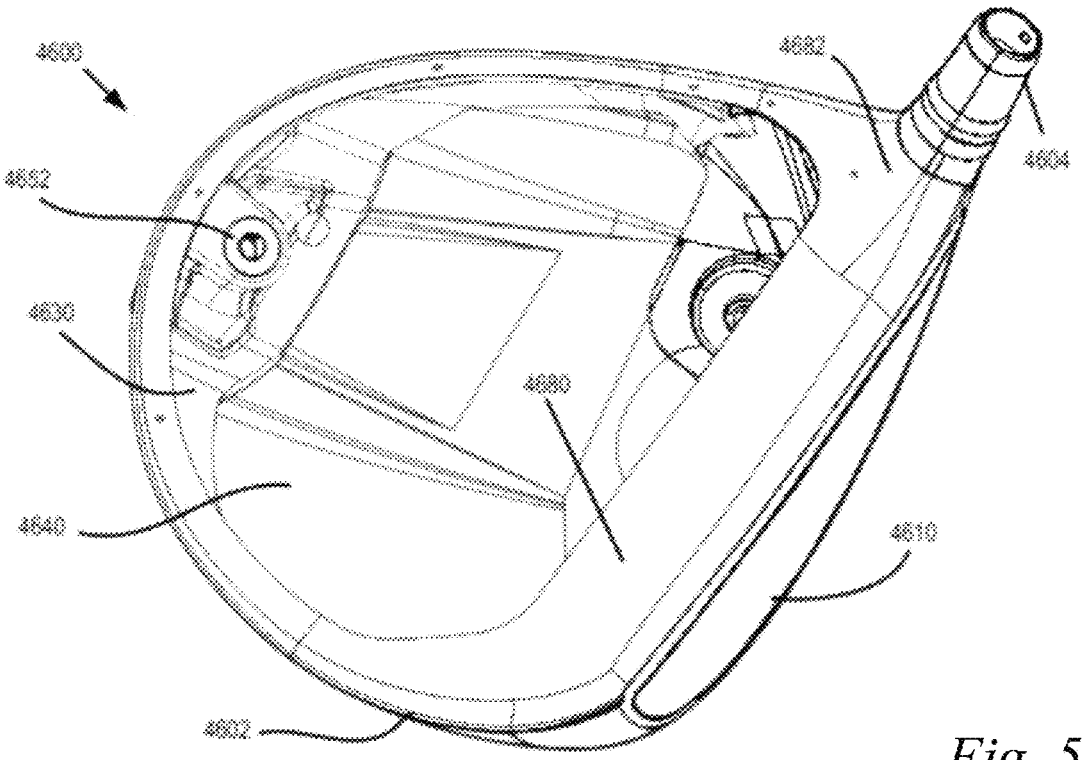
Figure 58:
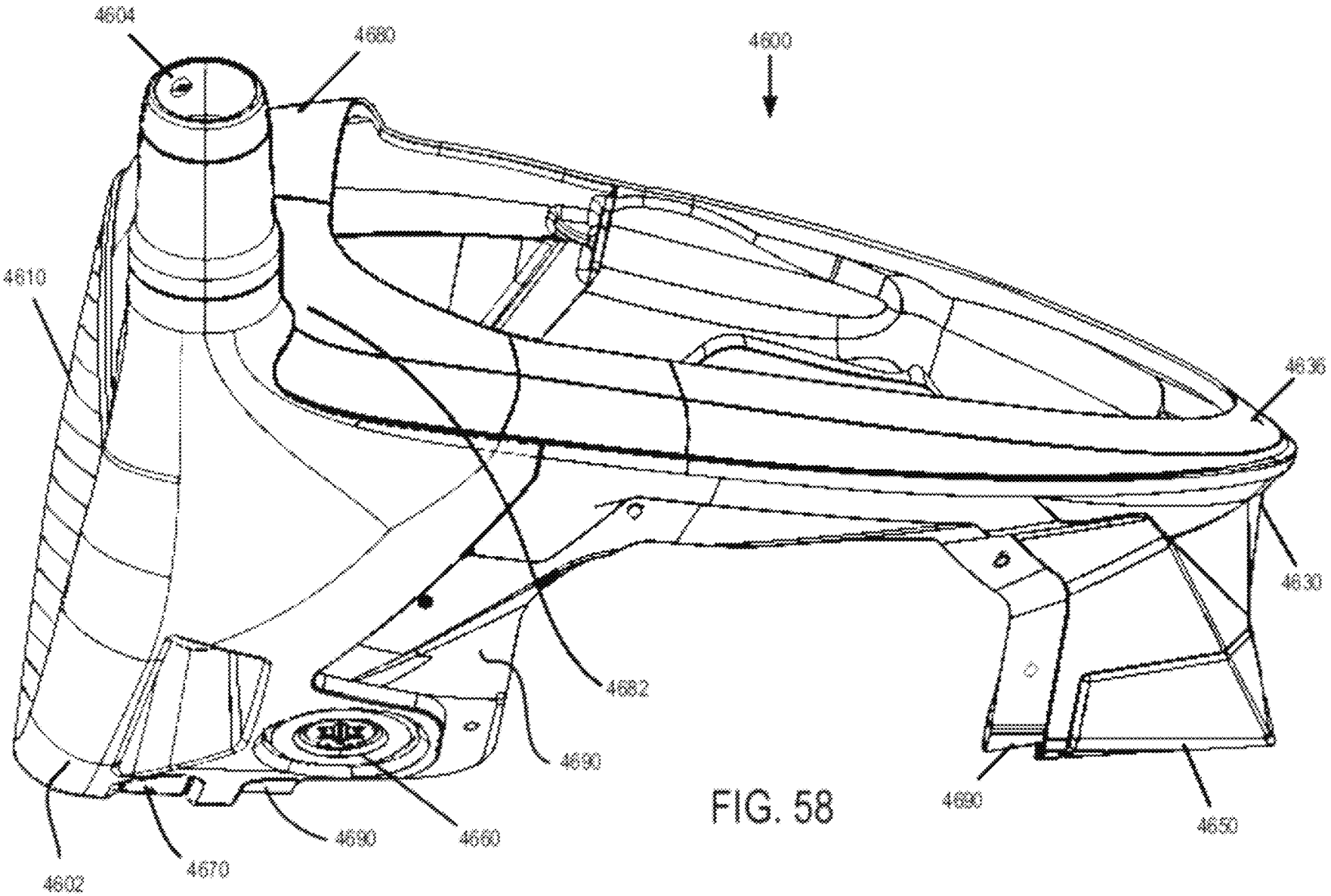
Figure 59:
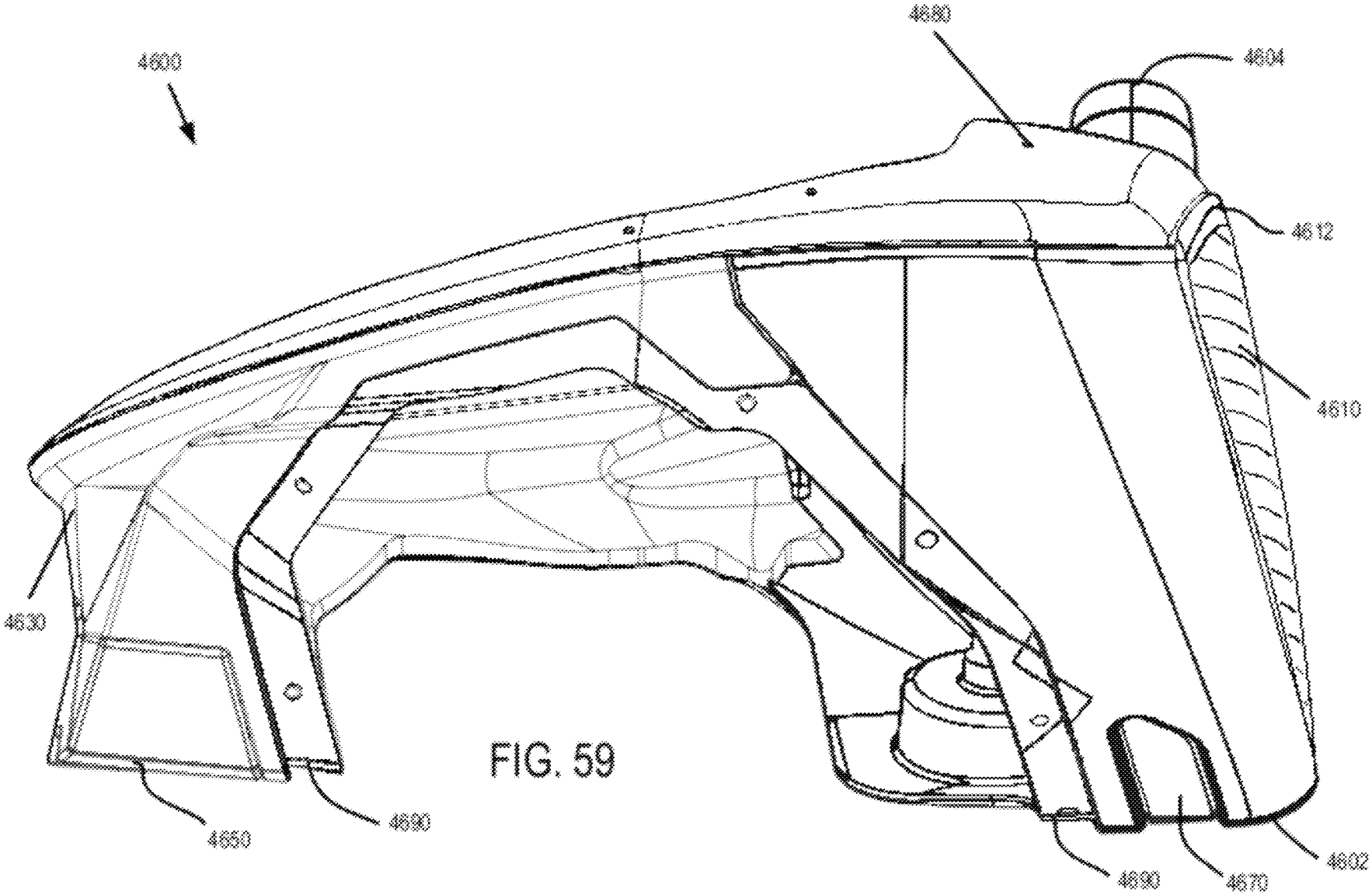

As seen in FIG. 56 a top plan view coordinate system is defined with the top plan origin inline with the center face 205 and at a midpoint of a center face depth dimension 4999, measured along a vertical center face plane VCFP, which contains the y-axis 207 seen in FIGS. 1A-1D, from the forwardmost point of the club head in the vertical center face plane to a rearward most point of the club head in the vertical center face plane, with the club head at the address position. A zero degree line extends between the top plan origin and the rear of the club head along the vertical center face plane, a 90 degree line extends perpendicular to the zero degree line from the top plan origin toward the heel, a 180 degree line extends perpendicular to the 90 degree line from the top plan origin and passes through center face 205, and a 270 degree line extends perpendicular to the 180 degree line from the top plan origin toward the toe. In one embodiment the crown 4620 curves downward to create the topline throughout the region between 170-190 degrees, while in further embodiments it creates the topline throughout the regions between 160-200 degrees, 155-205 degrees, 150-210 degrees, 145-215 degrees, 140-215 degrees, and 135-215 degrees. However, in a further embodiment the crown 4620 curves downward to create the topline through any continuous 10 degree range, and in further embodiments any 20 degree range, any 30 degree range, any 40 degree range, any 50 degree range, any 60 degree range, any 70 degree range, and any 80 degree range. In one embodiment the crown 4620 curves downward to create the entire topline. In another embodiment the crown 4620 curves downward to be adjacent the perimeter of the face plate 4610 throughout the region between 170-190 degrees, while in further embodiments this is true throughout the regions between 160-200 degrees, 155-205 degrees, 150-210 degrees, 145-215 degrees, 140-215 degrees, and 135-215 degrees. However, in a further embodiment the crown 4620 curves downward to be adjacent the perimeter of the face plate 4610 through any continuous 10 degree range, and in further embodiments any 20 degree range, any 30 degree range, any 40 degree range, any 50 degree range, any 60 degree range, any 70 degree range, and any 80 degree range.

Figure 61:
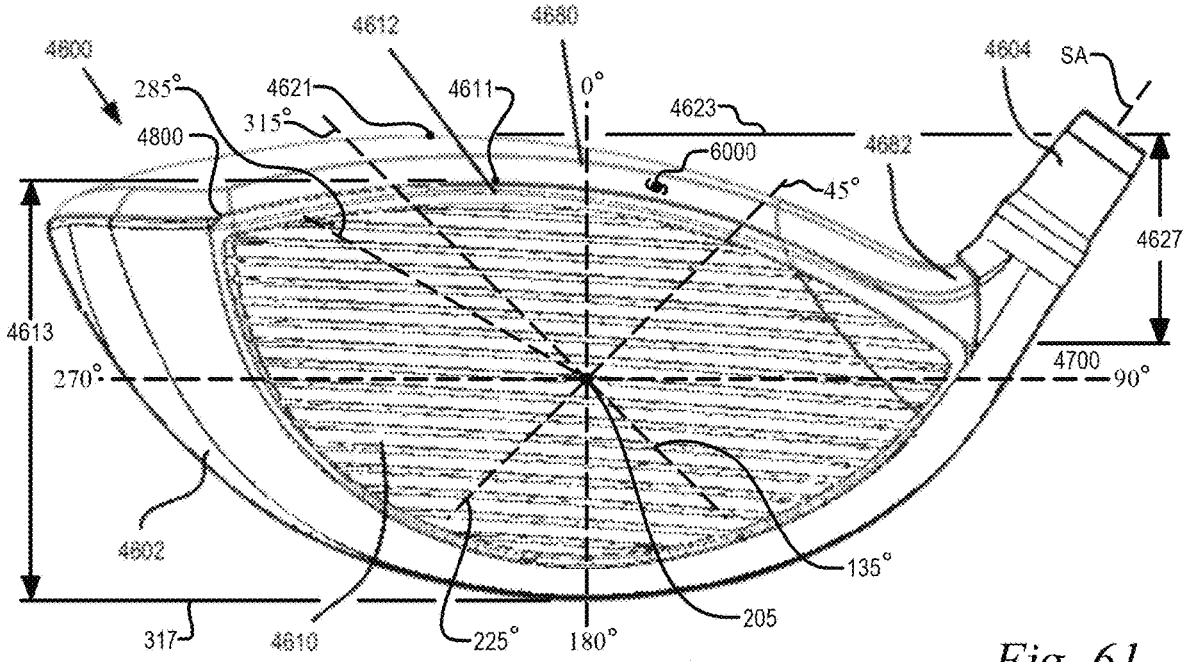

Another way to describe these relationships is with a front elevation view coordinate system illustrated in FIG. 61 and centered at center face 205 with the club head in the address position, with zero degrees vertically upward, 90 degrees horizontally to the heel, 180 degrees vertically downward, and 270 degrees horizontally to the toe. In another embodiment the crown 4620 curves downward to be adjacent the perimeter of the face plate 4610 throughout the region between 350-10 degrees, while in further embodiments this is true throughout the regions between 340-20 degrees, 335-25 degrees, 330-30 degrees, 325-35 degrees, 320-40 degrees, 315-45 degrees, 310-50 degrees, 305-55 degrees, or 300-60 degrees. However, in a further embodiment the crown 4620 curves downward to be adjacent the perimeter of the face plate 4610 through any continuous 10 degree range, and in further embodiments any 20 degree range, any 30 degree range, any 40 degree range, any 50 degree range, any 60 degree range, any 70 degree range, any 80 degree range, any 90 degree range, any 100 degree range, or any 110 degree range. In one embodiment the crown 4620 curves downward to be adjacent the perimeter of the face plate 4610 through any continuous 10 degree range located between the 45 degree line and the 90 degree line, while in further embodiments this 10 degree range is expanded to 15 degrees, 20 degrees, 25 degrees, or 30 degrees. Similarly, in another embodiment the crown 4620 curves downward to be adjacent the perimeter of the face plate 4610 through any continuous 5 degree range located between a 285 degree line and a 315 degree line, while in further embodiments this 5 degree range is expanded to 10 degrees, 15 degrees, 20 degrees, or 25 degrees. [stopped here]

Referring again to the top plan view of FIG. 56, in another embodiment the crown 4620 curves downward along a perimeter of the club head so that the crown 4620 creates the outermost perimeter, when viewed in a straight down top plan view with the club head in the design address position as seen in FIG. 56, through any continuous 10 degree range located at the rear of the club head from the 90 degree line to the 270 degree line. While in further embodiments the 10 degree range is expanded to 20 degrees, 30 degrees, 40 degrees, 50 degrees, 60 degrees, 70 degrees, 80 degrees, 90 degrees, 100 degrees, 110 degrees, 120 degrees, 120 degrees, 130 degrees, 140 degrees, 150 degrees, 160 degrees, 170 degrees, or the full 180 degrees. Additionally, in a further embodiment the crown 4620 creates the outermost perimeter through any continuous 10 degree range located between the 90 degree line and a 135 degree line; while in further embodiments the 10 degree range is expanded to 15 degrees, 20 degrees, 25 degrees, or 30 degrees. Similarly, in a further embodiment the crown 4620 creates the outer most perimeter through any continuous 10 degree range located between the 270 degree line and a 225 degree line; while in further embodiments the 10 degree range is expanded to 15 degrees, 20 degrees, 25 degrees, or 30 degrees. Further, in another embodiment the crown 4620 creates the outermost perimeter through any continuous 10 degree range located between the 300 degree line and a 60 degree line; while in further embodiments the 10 degree range is expanded to 15 degrees, 20 degrees, 25 degrees, or 30 degrees. However, in a further embodiment the crown 4620 does not curve downward along a perimeter of the club head through any continuous exposed 10 degree range located at the rear of the club head from the 90 degree line to the 270 degree line, and thereby leaving a portion of the rear ring portion 4630 exposed when viewed in a straight down top plan view with the club head in the design address position as seen in FIG. 56. In further embodiments the continuous exposed 10 degree range is broadened to at least 15 degrees, 20 degrees, 25 degrees, or 30 degrees. Another series of embodiments caps the continuous exposed 10 degree range to no more than 135 degrees, and in further embodiments no more than 125 degrees, 115 degrees, 105 degrees, 95 degrees, 85 degrees, 75 degrees, 65 degrees, 55 degrees, 45 degrees, or 35 degrees.

The extent that the crown 4620 curves downward to create the outermost perimeter may vary. However in one embodiment no portion of the crown 4620 extends downward to an elevation below that of club head center of gravity 350, referred to as Zup, seen in FIG. 13, throughout a predetermined range. In one such embodiment, again with reference to FIG. 56, the predetermined range is at least a 5 degree range located in the rear of the club head between the 90 degree line and the 270 degree line; while in further embodiments the 5 degree range is expanded to 10 degrees, 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 160 degrees, 170 degrees, or the full 180 degrees. In another embodiment the predetermined range is at least a 5 degree range located in the rear of the club head between the 0 degree line and the 270 degree line; while in further embodiments the 5 degree range is expanded to 10 degrees, 20 degrees, 30 degrees, 40 degrees, 50 degrees, 60 degrees, 70 degrees, 80 degrees, or the full 90 degrees. In still a further embodiment the predetermined range is at least a 5 degree range located in the rear of the club head between the 0 degree line and the 90 degree line; while in further embodiments the 5 degree range is expanded to 10 degrees, 20 degrees, 30 degrees, 40 degrees, 50 degrees, 60 degrees, 70 degrees, 80 degrees, or the full 90 degrees.

In another embodiment no portion of the crown 4620 extends downward to an elevation below 125% of Zup, throughout a predetermined range. In one such embodiment, again with reference to FIG. 56, the predetermined range is at least a 5 degree range located in the rear of the club head between the 90 degree line and the 270 degree line; while in further embodiments the 5 degree range is expanded to 10 degrees, 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 160 degrees, 170 degrees, or the full 180 degrees.

In still a further embodiment no portion of the crown 4620 extends downward to an elevation below 150% of Zup, throughout a predetermined range. In one such embodiment, again with reference to FIG. 56, the predetermined range is at least a 5 degree range located in the rear of the club head between the 90 degree line and the 270 degree line; while in further embodiments the 5 degree range is expanded to 10 degrees, 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 160 degrees, 170 degrees, or the full 180 degrees.

Now looking at the forward portion of the club head between the 90 degree line and the 270 degree line of FIG. 56, in one embodiment at least a portion of the crown 4620 extends to an elevation below 200% of Zup, while in another embodiment at least a portion of the crown 4620 extends to an elevation below 175% of Zup, and in still a further embodiment at least a portion of the crown 4620 extends to an elevation below 150% of Zup. Now looking at the forward portion of the club head between the 110 degree line and the 145 degree line of FIG. 56, in one embodiment at least a portion of the crown 4620 extends to an elevation below 200% of Zup, while in another embodiment at least a portion of the crown 4620 extends to an elevation below 175% of Zup, and in still a further embodiment at least a portion of the crown 4620 extends to an elevation below 150% of Zup.

Now looking at the forward portion of the club head between the 270 degree line and the 225 degree line of FIG. 56, in an embodiment no portion of the crown 4620 extends downward to an elevation below Zup, throughout a predetermined range. In one such embodiment, again with reference to FIG. 56, the predetermined range is at least a 5 degree range located between the 270 degree line and the 225 degree line of FIG. 56; while in further embodiments the 5 degree range is expanded to 10 degrees, 15 degrees, 20 degrees, 25 degrees, 30 degrees, 35 degrees, 40 degrees, or the full 45 degrees.

In another embodiment, again looking at the forward portion of the club head between the 270 degree line and the 225 degree line of FIG. 56, no portion of the crown 4620 extends downward to an elevation below 175% of Zup, throughout a predetermined range. In one such embodiment, again with reference to FIG. 56, the predetermined range is at least a 5 degree range located between the 270 degree line and the 225 degree line of FIG. 56; while in further embodiments the 5 degree range is expanded to 10 degrees, 15 degrees, 20 degrees, 25 degrees, 30 degrees, 35 degrees, 40 degrees, or the full 45 degrees.

In still a further, again looking at the forward portion of the club head between the 270 degree line and the 225 degree line of FIG. 56, no portion of the crown 4620 extends downward to an elevation below 150% of Zup, throughout a predetermined range. In one such embodiment, again with reference to FIG. 56, the predetermined range is at least a 5 degree range located between the 270 degree line and the 225 degree line of FIG. 56; while in further embodiments the 5 degree range is expanded to 10 degrees, 15 degrees, 20 degrees, 25 degrees, 30 degrees, 35 degrees, 40 degrees, or the full 45 degrees.

Figure 53:
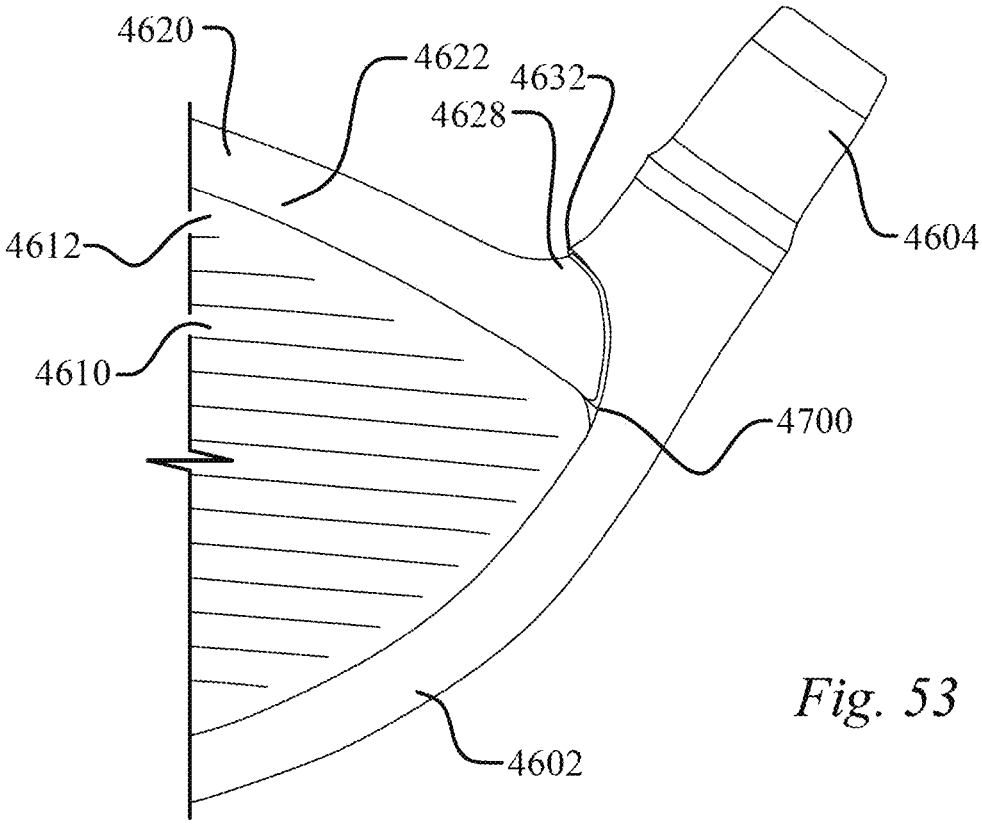
Figure 93:
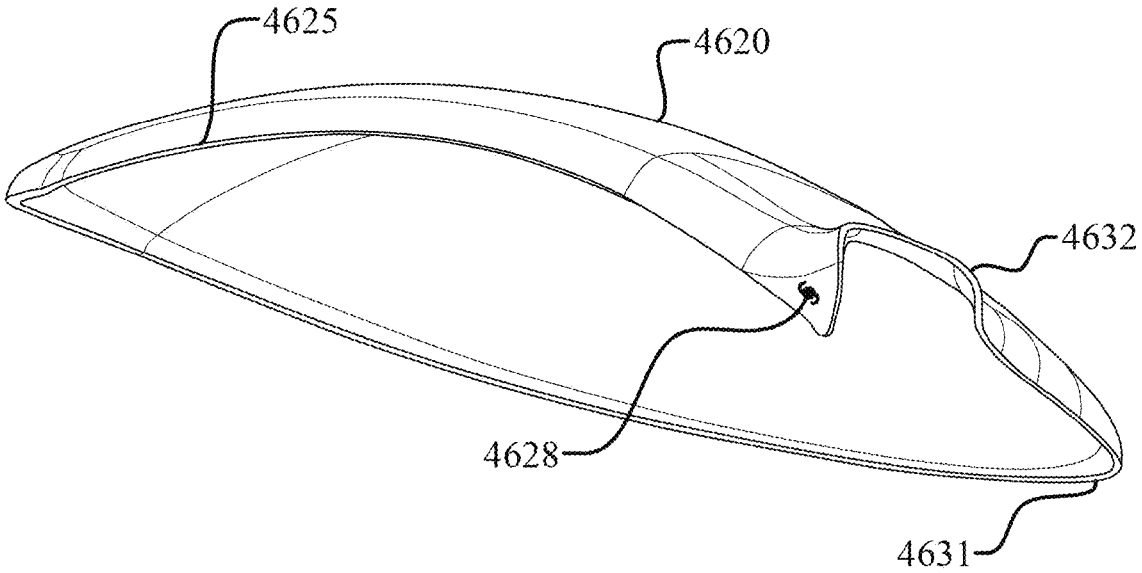
FIG. 93 is a perspective view of the crown.

In still a further, again looking at the forward portion of the club head between the 270 degree line and the 90 degree line of FIG. 56, the crown 4620 has particular aerodynamic curvatures including any of the relationships disclosed in U.S. patent application Ser. No. 17/360,179, which is incorporated by reference herein in its entirety. Often such relationships involve the location of a crown apex 4621, or the point of highest elevation on the crown 4620 above the ground plane 317, thereby establishing an apex plane 4623, seen in FIG. 61, including the crown apex 4621 and parallel to the ground plane 317, referred as the apex height and illustrated as the crown height in FIG. 12. The crown 4620 has a crown leading edge 4625, seen in FIGS. 62 and 93, and each point along the crown leading edge 4625 has a crown leading edge apex-offset distance 4627, seen in FIG. 61, which is the vertical distance of any point on the crown leading edge 4625 below the apex plane 4623, and will vary from a maximum crown leading edge apex-offset distance 4627 to a minimum crown leading edge apex-offset distance 4627, with the minimum crown leading edge apex-offset distance 4627 located on the crown leading edge 4625 adjacent a highest face point 4611, which is located at a top face elevation 4613 above the ground plane 317. The crown 4620 also has a crown perimeter edge 4631, seen in FIGS. 54, 56, and 93, which are the perimeter portions of the crown 4620 that do not encompass the crown leading edge 4625. The crown perimeter edge 4631 may include a crown-hosel perimeter edge portion 4632, seen in FIG. 93. As seen in FIGS. 53 and 93, in one embodiment a portion of the crown 4620 adjacent the crown-hosel perimeter edge portion 4632 is concave upward.

In one embodiment, with reference again to FIGS. 63 and 70B, the insert recess wall 4692 has a recess wall leading edge 6100. Similarly the face topline perimeter edge 4215, of FIG. 42, has a face topline leading edge 4221, seen in FIGS. 70B and 75, and the face lower portion perimeter edge 4216 has a face lower portion leading edge 4222, seen in FIG. 76. In one embodiment the crown leading edge 4625 is within 3 mm of the recess wall leading edge 6100, the recess wall leading edge 6100 is within 3 mm of the face topline leading edge 4221, and the crown leading edge 4625 is within 3 mm of the face topline leading edge 4221, when analyzing these relationships within a single vertical section parallel to the vertical center face plane VCFP; while in further embodiments the 3 mm relationship is reduced to 2.5 mm, 2.0 mm, 1.5 mm, or 1.0 mm. In a further embodiment the crown leading edge 4625 is proud of the face topline leading edge 4221 by a proud distance 4223, seen in FIG. 70B, meaning, within a vertical section parallel to the vertical center face plane VCFP, the crown leading edge 4625 is further forward, in the direction of the y-axis 207, than the adjacent face topline leading edge 4221; and in a further embodiment the proud distance 4223 is no more than 0.15 mm, while in another embodiment the proud distance is at least 0.02 mm, 0.04 mm, 0.06 mm, or 0.08 mm. While the discussion has been focused on the relationship within a single vertical section, the front elevation view coordinate system of FIG. 61 may be used to define regions in which the disclosed relationships may be true. For instance in one embodiment any of the proud relationships may be true through any continuous 15 degree range, while in further embodiments the range is expanded to 25, 35, 45, 55, 65, 75, 85, 95, 105, or 115 degrees, and in still another embodiment it is true for all sections along the face topline perimeter edge 4215. These relationships apply in general to a portion of the face that is adjacent to the crown leading edge 4625 and vertically aligned within any vertical section.

Figure 55:
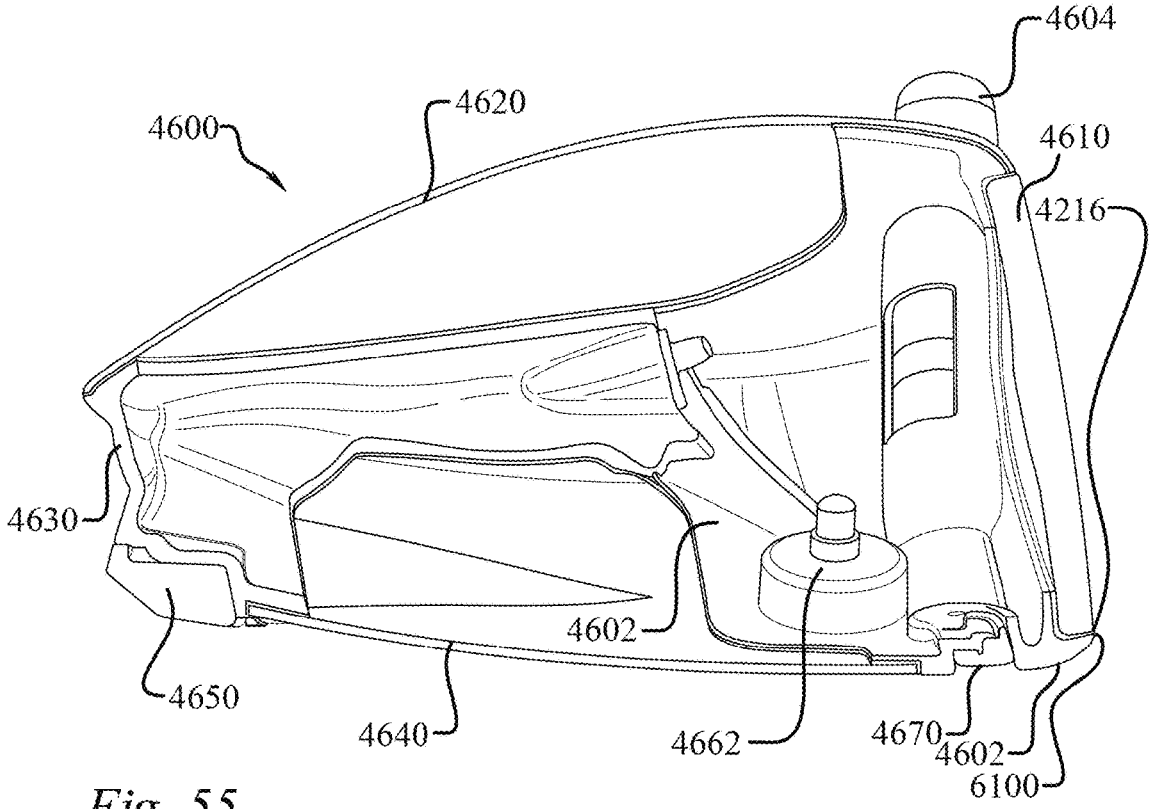

Now looking at FIG. 55 and the bottom perimeter of the face insert 4610, namely the relationship of the face lower portion perimeter edge 4216 and the face lower portion leading edge, here the front body portion 4602 creates the leading edge of the club head. Whereas in the embodiment of FIG. 76 the sole plate 4640 wraps upward to be adjacent to the face plate 4610, and has a sole plate leading edge 4641. In either case the proud relationship just described with respect to the crown leading edge 4625 may also apply to recess wall leading edge 6100, in FIG. 55, and/or sole plate leading edge 4641, in FIG. 76.

However, in a further embodiment the opposite may be true. Thus, just as the crown leading edge 4625 is proud to obscure a golfer from seeing a face topline leading edge, a portion of the face lower portion leading edge 4222 may be proud of the adjacent recess wall leading edge 6100, in FIG. 55, and/or sole plate leading edge 4641, in FIG. 76, so that now the lower portion of the face lower portion leading edge 4222 prevents a golfer in the address position from noticing a distinct joint around the lower portion of the face plate 4610. Thus, in this embodiment the components are precisely located so the face topline leading edge 4221 is slightly recessed in relation to the crown leading edge 4625, and transitions so that at least a portion of the face lower portion leading edge 4222 may be proud of the adjacent recess wall leading edge 6100, in FIG. 55, and/or sole plate leading edge 4641, in FIG. 76. In another embodiment it is proud by no more than 0.15 mm, measured in the same manner as the proud distance 4223 of FIG. 70B, while in another embodiment it is proud by at least 0.02 mm, 0.04 mm, 0.06 mm, or 0.08 mm. While the discussion has been focused on the relationship within a single vertical section, the front elevation view coordinate system of FIG. 61 may be used to define regions in which the disclosed relationships may be true. For instance in one embodiment any of the proud relationships may be true through any continuous 15 degree range, while in further embodiments the range is expanded to 25, 35, 45, 55, 65, 75, 85, or 95 degrees. In such embodiments the transition of the face plate 4610 being recessed with respect to an adjacent component to being proud with respect to an adjacent component is delicate to that it is not apparent along the toe side and/or heel side perimeter of the face plate 4610. In such embodiments the perimeter of the face plate 4610 is flush with the adjacent component, i.e. neither recessed or proud, at a flush-transition point, which may include a toe-side flush-transition point and a heel-side flush-transition point. In one embodiment an elevation of the toe-side flush-transition point and/or the heel-side flush-transition point is above the elevation of center face 205, while in an alternative embodiment the elevation of the toe-side flush-transition point and/or the heel-side flush-transition point is below the elevation of center face 205. In still a further embodiment the elevation of the heel-side flush-transition point is less than the elevation of the toe-side flush-transition point.

Figure 70A:
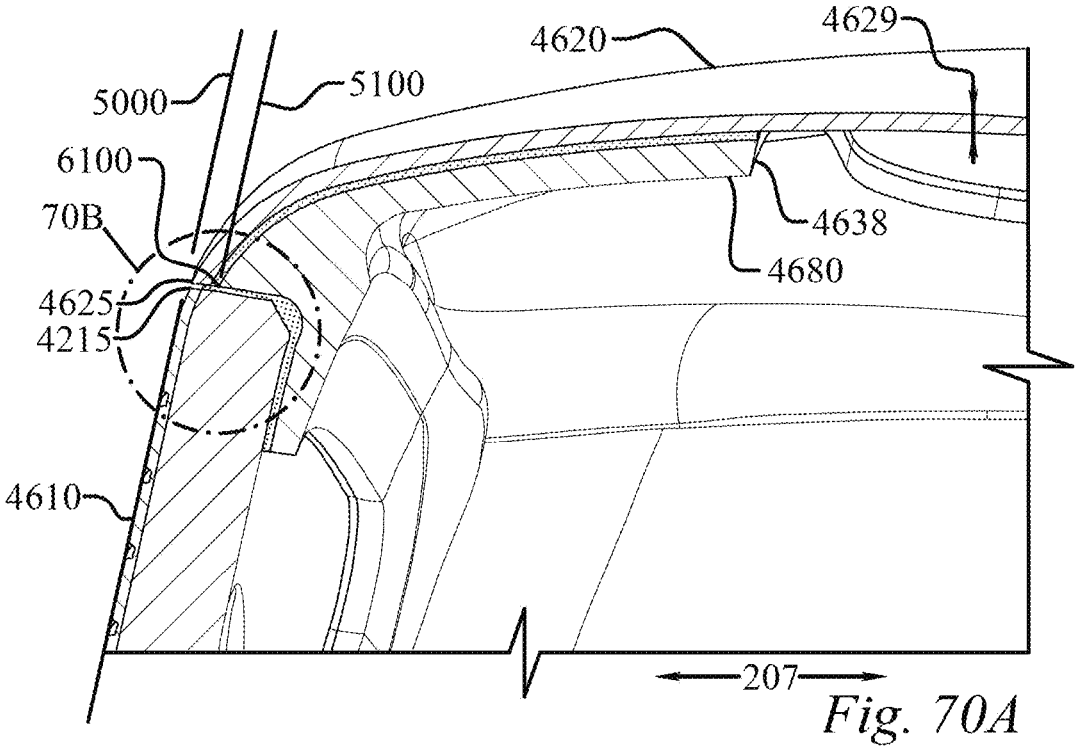
FIG. 70A is a cross-sectional view of an upper-front portion of the club head.
Figure 70B:
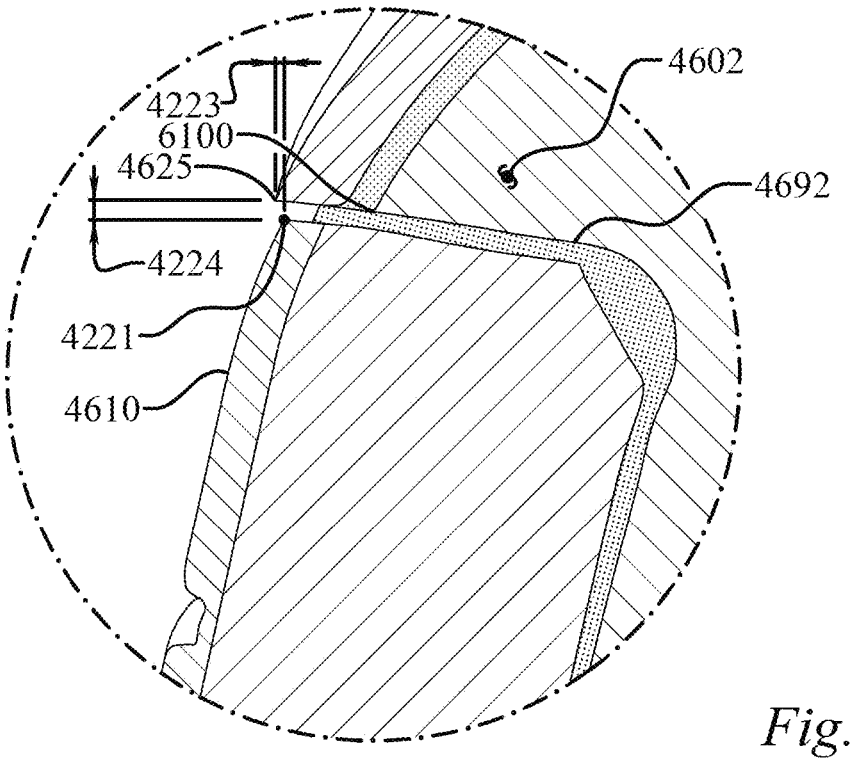
FIG. 70B is an enlarged cross-sectional view of an upper-front portion of the club head.

As seen in FIG. 70B, one embodiment has a face gap 4224 between the crown leading edge 4625 and the face topline leading edge 4221. Further, the face gap 4224 is present at any point along the face plate perimeter between it and an adjacent body component, whether located on the front body portion 4602 or the sole plate 4640. The face gap 4224 is measured parallel to the loft plane 5000. In one embodiment the face gap 4224 is no more than 75% of the maximum crown thickness 4629 of the portion of the crown 4620 located between the offset loft plane 5100 and the crown leading edge 4625, while in further embodiments is it no more than 65%, 55%, 45%, or 35%. In a further embodiment the face gap 4224 is at least 5% of the maximum crown thickness 4629 of the portion of the crown 4620 located between the offset loft plane 5100 and the crown leading edge 4625, while in further embodiments is it at least 10%, 15%, 20%, or 25%. In one embodiment, consistent with the illustrated embodiments, no portion of the front body portion 4602 extends into the face gap 4224; meaning no portion of the front body portion 4602 extends beyond the recess wall leading edge 6100 into the face gap 4224 to be adjacent the crown leading edge sidewall surface. In one embodiment the face gap 4224 is no more than 2 mm, and in further embodiments no more than 1.5 mm, 1.4 mm, 1.3 mm, 1.2 mm, 1.1 mm, 1.0 mm, 0.9 mm, 0.8 mm, 0.7 mm, 0.6 mm, or 0.5 mm. As with all such relationships, the face gap 4224 is evaluated in any vertical section and the disclosed relationships may apply at any or all of the disclosed vertical sections. In another embodiment the face gap 4224 is greater than the proud distance 4223, and in further embodiments the face gap 4224 is at least 10%, 20%, or 30% greater than the proud distance 4223. In further embodiments the face gap 4224 is less than 250% of the proud distance 4223, and less than 225%, 200%, 175%, or 150% in further embodiments.

In one embodiment the maximum crown leading edge apex-offset distance 4627, seen in FIG. 61, is at least 40% of Zup, while in further embodiments it is at least 50%, 55%, 60%, 65%, or 70%. However, unlike past unitary composite club heads, in another embodiment the maximum crown leading edge apex-offset distance 4627 is no more than 120% of Zup, while in further embodiments it is no more than 110%, 100%, 90%, 85%, 80%, or 75%. In another embodiment the minimum crown leading edge apex-offset distance 4627 is at least 10% of Zup, while in further embodiments it is at least 12%, 14%, 16%, 18%, 20%, 22%, 24%, 26%, 28%, 30%, 32%, or 34%. However, in another embodiment the minimum crown leading edge apex-offset distance 4627 is no more than 35% of Zup, while in further embodiments it is no more than 32.5%, 30%, 29%, 28%, 27%, 26%, 25%, 24%, 23%, or 22%. In a further embodiment the maximum crown leading edge apex-offset distance 4627 is at least 100% greater than the minimum crown leading edge apex-offset distance 4627, and in further embodiments at least 125%, 150%, 175%, or 200%. In one embodiment the maximum crown leading edge apex-offset distance 4627 occurs at a point on the crown leading edge 4625 located between the vertical center face plane and hosel portion 4604, and the minimum crown leading edge apex-offset distance 4627 occurs at a point on the crown leading edge 4625 located between the vertical center face plane and the toe 185. In still a further embodiment the minimum crown leading edge apex-offset distance 4627 occurs at a point on the crown leading edge 4625 located between the vertical center face plane and a parallel plane containing the crown apex 4621. In another embodiment dividing the head along the vertical center face plane passing through center face 205 to compare a heel-side maximum crown leading edge apex-offset distance with a toe-side maximum crown leading edge apex-offset distance, the heel-side maximum crown leading edge apex-offset distance is at least 10% greater than the toe-side maximum crown leading edge apex-offset distance, and in further embodiments at least 15%, 20%, or 25% greater. Additionally, the minimum crown leading edge apex-offset distance 4627 is greater than the effective face position height 164, shown in FIG. 1A, in another embodiment.

With reference again to FIGS. 42 and 61, in the installed position the face toe transition region 4217 has a highest face toe transition region elevation, measured vertically from the ground plane 317, and a lowest face toe transition region elevation, also measured vertically from the ground plane 317. In one embodiment the toe-side crown-to-face junction point 4800 is adjacent to a face perimeter point in the face toe transition region 4217 having the highest face toe transition region elevation, such as the embodiment of FIG. 61. However, in another embodiment the toe-side crown-to-face junction point 4800 is adjacent to a face perimeter point in the face toe transition region 4217 having a face toe transition region elevation that is less than the highest face toe transition region elevation, such as the embodiment of FIG. 84. In still a further embodiment the toe-side crown-to-face junction point 4800 is adjacent to a face perimeter point in the face toe transition region 4217 having the lowest face toe transition region elevation.

Similarly, with reference again to FIGS. 42 and 61, in the installed position the face heel transition region 4218 has a highest face heel transition region elevation, measured vertically from the ground plane 317, and a lowest face heel transition region elevation, also measured vertically from the ground plane 317. In one embodiment the heel-side crown-to-face junction point 4700 is adjacent to a face perimeter point in the face heel transition region 4218 having the highest face heel transition region elevation, such as the embodiment of FIG. 61. However, in another embodiment the heel-side crown-to-face junction point 4700 has a heel-side junction point elevation and the toe-side crown-to-face junction point 4800 has a toe-side junction point elevation, measured vertically from the ground plane 317. In one embodiment the toe-side junction point elevation is at least 10% greater than the heel-side junction point elevation, and at least 15%, 20%, 25%, or 30% in further embodiments. However, in another embodiment the toe-side junction point elevation is less than 120% greater than the heel-side junction point elevation, and less than 110%, 100%, 90%, 80%, or 70% in further embodiments.

Figure 84:
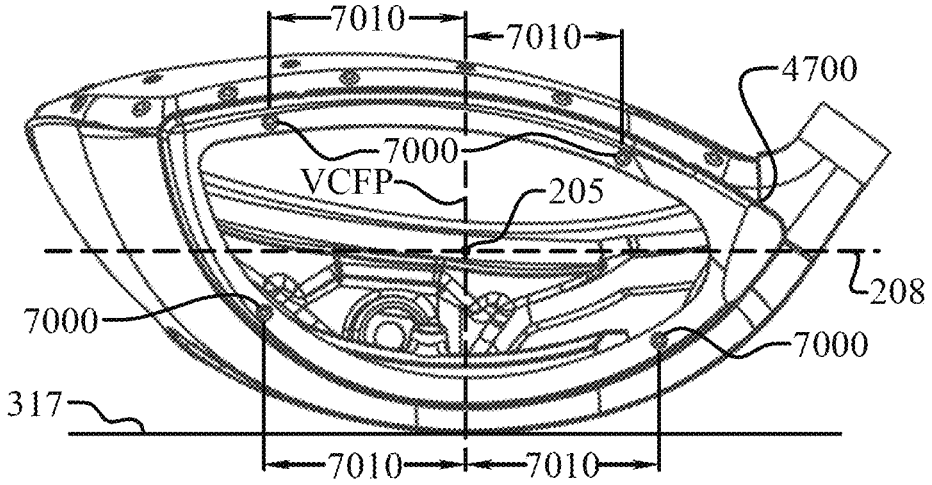
FIG. 84 is a front view of the club head with the crown and face plate removed.
Figure 85:
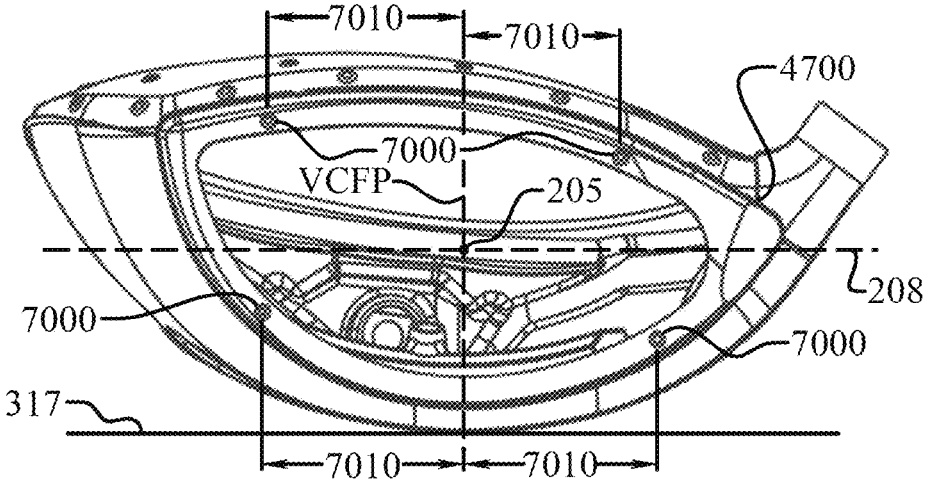
FIG. 85 is a front view of the club head with the crown and face plate removed.
Figure 86:
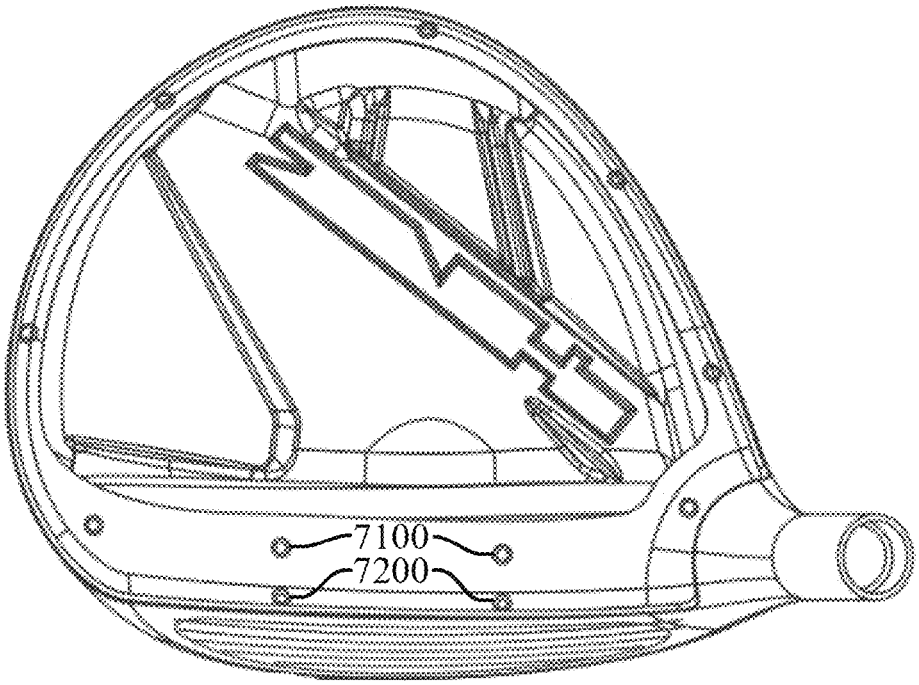
FIG. 86 is a front view of the club head with the crown removed.

In one embodiment the heel-side crown-to-face junction point 4700 has a heel-side junction point elevation is greater than the highest face heel transition region elevation, as seen in FIGS. 84 and 85; and in a further embodiment the elevation differential between the two elevations is no more than 12 mm, and no more than 10 mm, 8 mm, 6 mm, or 4 mm in additional embodiments. However, in another embodiment the heel-side crown-to-face junction point 4700 is adjacent to a face perimeter point in the face heel transition region 4218 having a face heel transition region elevation that is less than the highest face heel transition region elevation. In still a further embodiment the heel-side crown-to-face junction point 4700 is adjacent to a face perimeter point in the face heel transition region 4218 having the lowest face heel transition region elevation. As seen in FIG. 84, the location of the heel-side crown-to-face junction point 4700 can be defined by a heel-side crown-to-face junction horizontal offset distance measured from the vertical center face plane VCFP, which in one embodiment is at least 40 mm, and is at least 42 mm, 44 mm, or 46 mm in further embodiments. In another embodiment the heel-side crown-to-face junction horizontal offset distance is no more than 70 mm, and no more than 66 mm, 62 mm, 60 mm, 58 mm, 56 mm, or 54 mm in additional embodiments. Similarly, as seen in FIG. 84, the vertical location of the heel-side crown-to-face junction point 4700 can be defined by a heel-side crown-to-face junction vertical offset distance measured from vertically from the elevation of center face 205. In one embodiment the heel-side crown-to-face junction vertical offset distance is less than 16 mm above center face 205, and less than 14 mm, 12 mm, 10 mm, 8 mm, or 6 mm in further embodiments. In one embodiment, as is apparent from FIG. 84, an edge of the crown 4620, namely a portion of the crown-hosel perimeter edge portion 4632, extends vertically, plus or minus 5 degrees, from the heel-side crown-to-face junction point 4700 to an intersection with the vertical forward hosel plane 3252 seen in FIG. 56. However in another embodiment, as is apparent from FIG. 72, an edge of the crown 4620, namely a portion of the crown-hosel perimeter edge portion 4632, extends upward from the heel-side crown-to-face junction point 4700 to the vertical forward hosel plane 3252 with a curved edge, which in the illustrated embodiment is concave toward center face 205; and in one embodiment the curved edge has a radius of curvature less than 25 mm, and in further embodiments less than 20 mm, 17.5 mm, 15 mm, or 12.5 mm.

Figure 94:
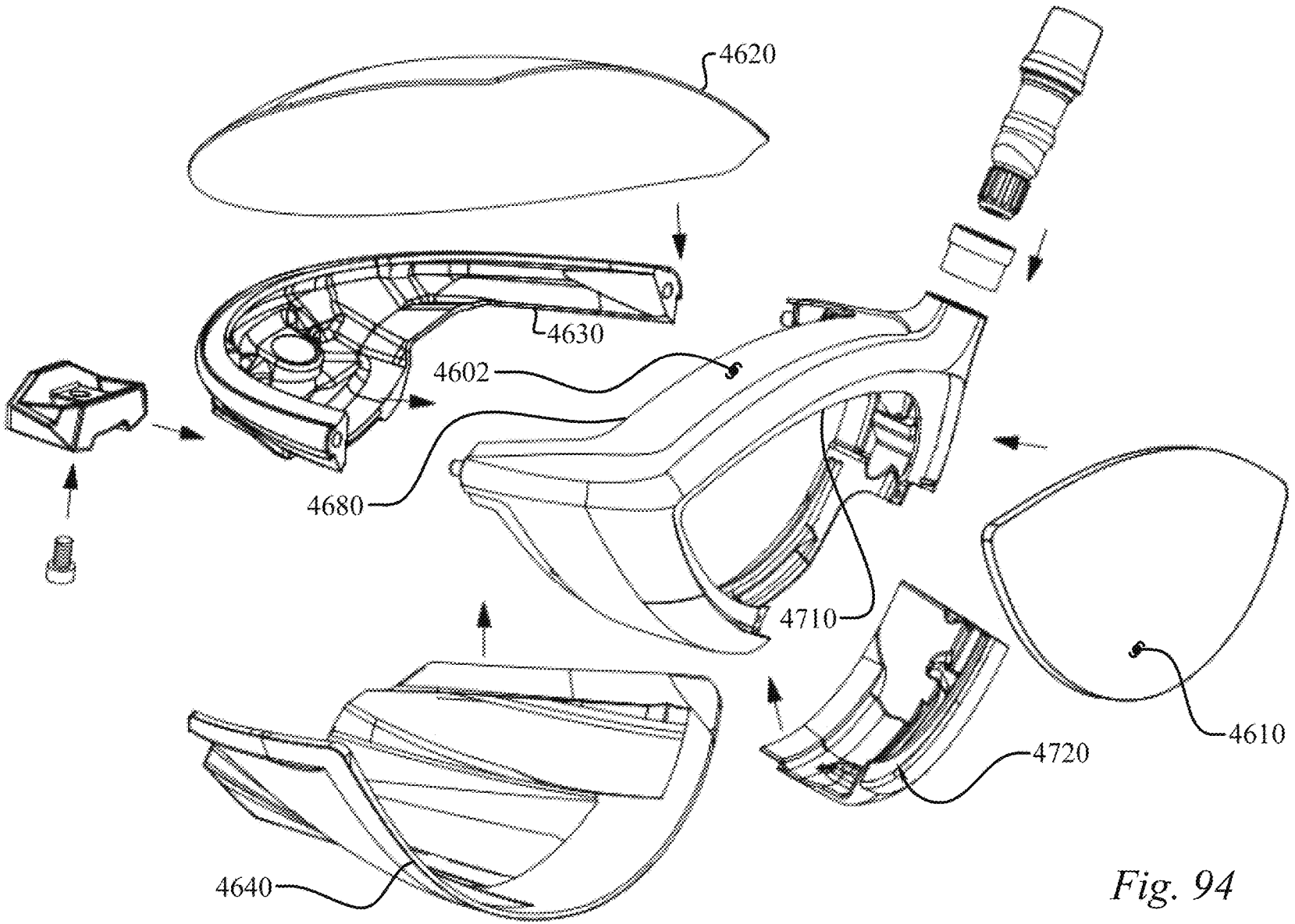
FIG. 94 is an exploded perspective view of an embodiment of the club head.

Now again referring to the front elevation coordinate system illustrated in FIG. 61, and the prior disclosure that the face support ledge wall 4690 may be formed of multiple materials around the perimeter of the face plate 4610. One such embodiment has a first ledge wall region formed of a first ledge wall material having a first ledge wall material density, and a second ledge wall region formed of a second ledge wall material having a second ledge wall material density greater than the first ledge wall material density. FIG. 94 illustrates one such embodiment having a first ledge wall region 4710 and a second ledge wall region 4720. In a further embodiment the second ledge wall material density is at least 25% greater than the first ledge wall material density, and in further embodiments is at least 50%, 75%, 100%, 125%, 150%, 175%, 200%, 225%, 250%, or 275% greater. In a further embodiment the first ledge wall material density is less than 5 g/cc, while in another embodiment it is less than 3 g/cc, and in an even further embodiment it is less than 2 g/cc. The second ledge wall material density is at least 4 g/cc in one embodiment, at least 7 g/cc in another embodiment, and at least 10 g/cc in still a further embodiment.

As seen in FIG. 63 the following disclosure is applicable to all face support ledge wall 4690 embodiments, whether a single continuous face support ledge wall 4690, a face support ledge wall 4690 composed of multiple distinct sections separated from one another but formed of the same material, or a face support ledge wall 4690 with multiple distinct sections, whether separated or not, and formed of different materials. A ledge wall 4690 has a ledge wall average thickness 4699 from the ledge wall interior perimeter edge 4695 to the beginning of the fillet transitioning to the insert recess wall 4692. One embodiment has a first ledge wall having a first ledge wall average thickness 4699 from the ledge wall interior perimeter edge 4695 to the beginning of the fillet transitioning to the insert recess wall 4692, and similarly a second ledge wall having a second ledge wall average thickness 4699 from the ledge wall interior perimeter edge 4695 to the beginning of the fillet transitioning to the insert recess wall 4692. In one embodiment the second ledge wall average thickness is less than the first ledge wall average thickness; while in another embodiment the second ledge wall average thickness is at least 10% less than the first ledge wall average thickness; and in further embodiments it is at least 15% less, 20% less, 25% less, 30% less, or 35% less. In another series of embodiments the second ledge wall average thickness is 40-80% of the first ledge wall average thickness, and is 45-75%, 50-70%, or 55-65% in further embodiments. In one specific embodiment the ledge wall average thickness and/or the first ledge wall average thickness is at least 1.1 mm and the second ledge wall average thickness is no more than 1.0 mm; in another embodiment the ledge wall average thickness and/or the first ledge wall average thickness is at least 1.15 mm and the second ledge wall average thickness is no more than 0.95 mm; in another embodiment the ledge wall average thickness and/or the first ledge wall average thickness is at least 1.20 mm and the second ledge wall average thickness is no more than 0.90 mm; in another embodiment the ledge wall average thickness and/or the first ledge wall average thickness is at least 1.25 mm and the second ledge wall average thickness is no more than 0.85 mm. In one specific embodiment the ledge wall average thickness and/or the first ledge wall average thickness is at least 0.875 mm and the second ledge wall average thickness is no more than 0.86 mm; in another embodiment the ledge wall average thickness and/or the first ledge wall average thickness is at least 0.90 mm and the second ledge wall average thickness is no more than 0.85 mm; in another embodiment the ledge wall average thickness and/or the first ledge wall average thickness is at least 0.925 mm and the second ledge wall average thickness is no more than 0.84 mm; in another embodiment the ledge wall average thickness and/or the first ledge wall average thickness is at least 0.95 mm and the second ledge wall average thickness is no more than 0.83 mm.

With reference again to the front elevation view coordinate system illustrated in FIG. 61, in one embodiment the first ledge wall region 4710 of FIG. 94 encompasses at least 90 degrees around the perimeter of the face plate 4610; while in further embodiments it encompasses at least 145 degrees, 180 degrees, 190 degrees, 200 degrees, 210 degrees, 220 degrees, 230 degrees, 240 degrees, 250 degrees, 260 degrees, 270 degrees, or 280 degrees. In one embodiment the first ledge wall region 4710 encompasses the entire top perimeter located from the 90 degree line to the 270 degree line. In a further embodiment the first ledge wall region 4710 encompasses at least 10 degrees around the perimeter of the face plate 4610 in the region between the 225 degree line and the 270 degree line, while in further embodiments the 10 degree range is expanded to 15 degrees, 20 degrees, 25 degrees, 30 degrees, or 35 degrees. In yet another embodiment the first ledge wall region 4710 encompasses at least 10 degrees around the perimeter of the face plate 4610 in the region between the 135 degree line and the 90 degree line, while in further embodiments the 10 degree range is expanded to 15 degrees, 20 degrees, 25 degrees, 30 degrees, or 35 degrees. In still another embodiment the first ledge wall region 4710 encompasses no more than 350 degrees around the perimeter of the face plate 4610; while in further embodiments it encompasses no more than 340 degrees, 330 degrees, 320 degrees, 310 degrees, 300 degrees, 290 degrees, 280 degrees, 270 degrees, or 260 degrees. While in the illustrated embodiment the first ledge wall region 4710 is continuous, in some embodiments it is discontinuous and formed of distinct sections with together total the ranges mentioned above. In fact one such embodiment includes at least 2 distinct sections of the first ledge wall region 4710, while further embodiments include at least 3 distinct sections, at least 4 distinct sections, or at least 5 distinct sections.

Similarly, with continued reference to the front elevation view coordinate system illustrated in FIG. 61, in one embodiment the second ledge wall region 4720 of FIG. 94 encompasses at least 10 degrees around the perimeter of the face plate 4610; while in further embodiments it encompasses at least 20 degrees, 30 degrees, 40 degrees, 50 degrees, 60 degrees, 70 degrees, 80 degrees, 90 degrees, or 100 degrees. In one embodiment the second ledge wall region 4720 encompasses at least 10 degrees around the perimeter of the face plate 4610 in the region between the 180 degree line and the 90 degree line, while in further embodiments the 10 degree range is expanded to 15 degrees, 20 degrees, 25 degrees, 30 degrees, 35 degrees, 40 degrees, 45 degrees, or 50 degrees. In yet another embodiment the second ledge wall region 4720 encompasses at least 10 degrees around the perimeter of the face plate 4610 in the region between the 180 degree line and the 270 degree line, while in further embodiments the 10 degree range is expanded to 15 degrees, 20 degrees, 25 degrees, 30 degrees, or 35 degrees. In still another embodiment at least a portion of the second ledge wall region 4720 is located above Zup, while in a further embodiment at least a portion of the second ledge wall region 4720 is located above center face 205. In one embodiment the second ledge wall region 4720 encompasses at least 5 degrees around the perimeter of the face plate 4610 in the region between the 270 degree line and the 0 degree line, while in further embodiments the 5 degree range is expanded to 10 degrees, 15 degrees, 20 degrees, 25 degrees, 30 degrees, 35 degrees, 40 degrees, or 45 degrees. In another embodiment the second ledge wall region 4720 encompasses at least 5 degrees around the perimeter of the face plate 4610 in the region between the 0 degree line and the 90 degree line, while in further embodiments the 5 degree range is expanded to 10 degrees, 15 degrees, 20 degrees, 25 degrees, 30 degrees, 35 degrees, 40 degrees, or 45 degrees. In still another embodiment the second ledge wall region 4720 encompasses no more than 180 degrees around the perimeter of the face plate 4610; while in further embodiments it encompasses no more than 170 degrees, 160 degrees, 150 degrees, 140 degrees, 130 degrees, 120 degrees, 110 degrees, 100 degrees, 90 degrees, or 80 degrees. While in the illustrated embodiment of FIG. 94 the second ledge wall region 4720 is continuous, in some embodiments it is discontinuous and formed of distinct sections with together total the ranges mentioned above. In fact one such embodiment includes at least 2 distinct sections of the second ledge wall region 4720, while further embodiments include at least 3 distinct sections, at least 4 distinct sections, or at least 5 distinct sections. The second ledge wall region 4720 may be formed as a portion of a forward insert that also forms a portion of the sole, as described in detail in U.S. patent application Ser. No. 17/560,054, which is incorporated by reference herein in its entirety.

The crown can also extend close to and/or into the hosel portion of the body 4602 as well. As shown in FIGS. 50 and 53, a front-heel portion of the crown 4628 can extend into and around the hosel portion of the body 4602, with a forward edge wrapping over the front side of the hosel adjacent to a heel end of the face plate 4610. As shown in FIG. 67, the body can include a recessed surface 4682 that cuts into the hosel portion to receive the front-heel portion of the crown 4628.

Figure 66:
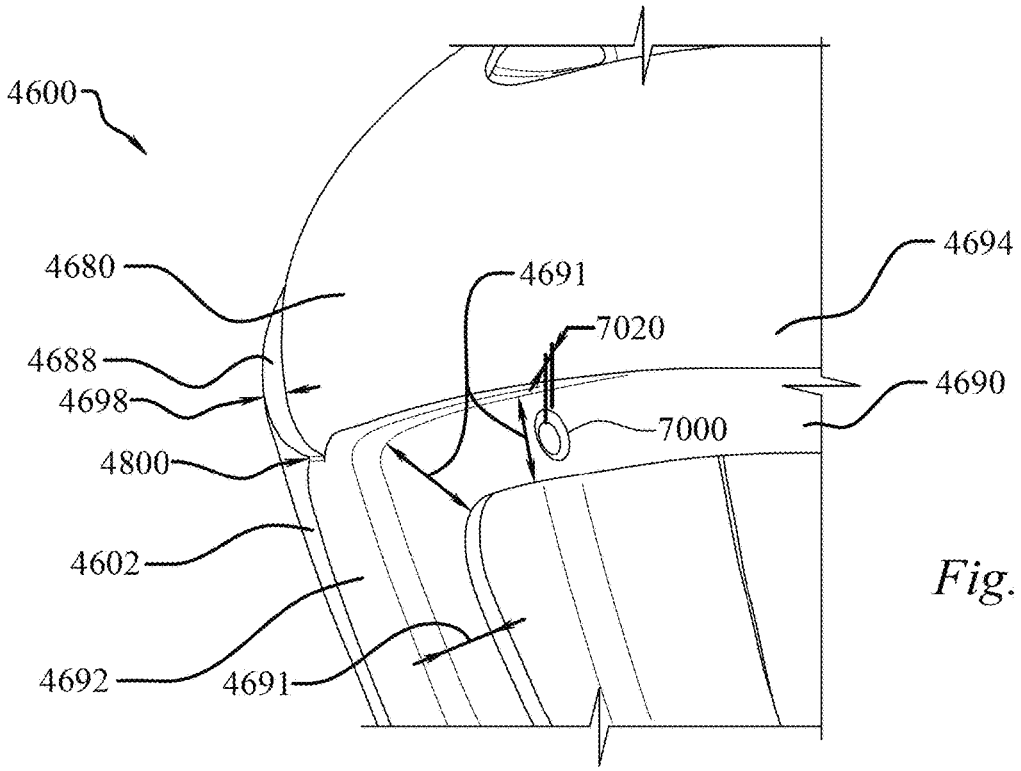

With reference now to FIG. 67, the recessed surface 4682 can include a heel-side stepped down wall 4689 that extends around a portion of the hosel portion 4604 and down around the heel side of the face receiving portions of the forward body portion 4602, where the heel-side stepped down wall 4689 transitions into the insert recess wall 4692, that may be bonded to the side surfaces of the face plate 4610. The heel-side stepped down wall 4689 has a heel-side stepped down wall length 4697, as seen in FIG. 67. As seen in FIG. 66, the front-toe side of the body, the ledge 4688, also referred to as the toe-side stepped down wall 4688, can similarly wrap around all the way to the insert wall recess 4692 such that the front-toe part of the crown wraps down to the toe end of the face plate. The toe-side stepped down wall 4688 has a toe-side stepped down wall length 4698, as seen in FIG. 66. Referring again to FIG. 67, the point at which the heel-side stepped down wall 4689 intersects the insert recess wall 4692 is the heel-side crown-to-face junction point 4700. Referring again to FIG. 66, the point at which the toe-side stepped down wall 4688 intersects the insert recess wall 4692 is the toe-side crown-to-face junction point 4800. The location of the heel-side crown-to-face junction point 4700 and the toe-side crown-to-face junction point 4800, as well as all the associated relationships with the stepped down walls, their lengths, and those of the insert recess wall 4692, significantly influence the performance and durability of the club head.

Figure 54:
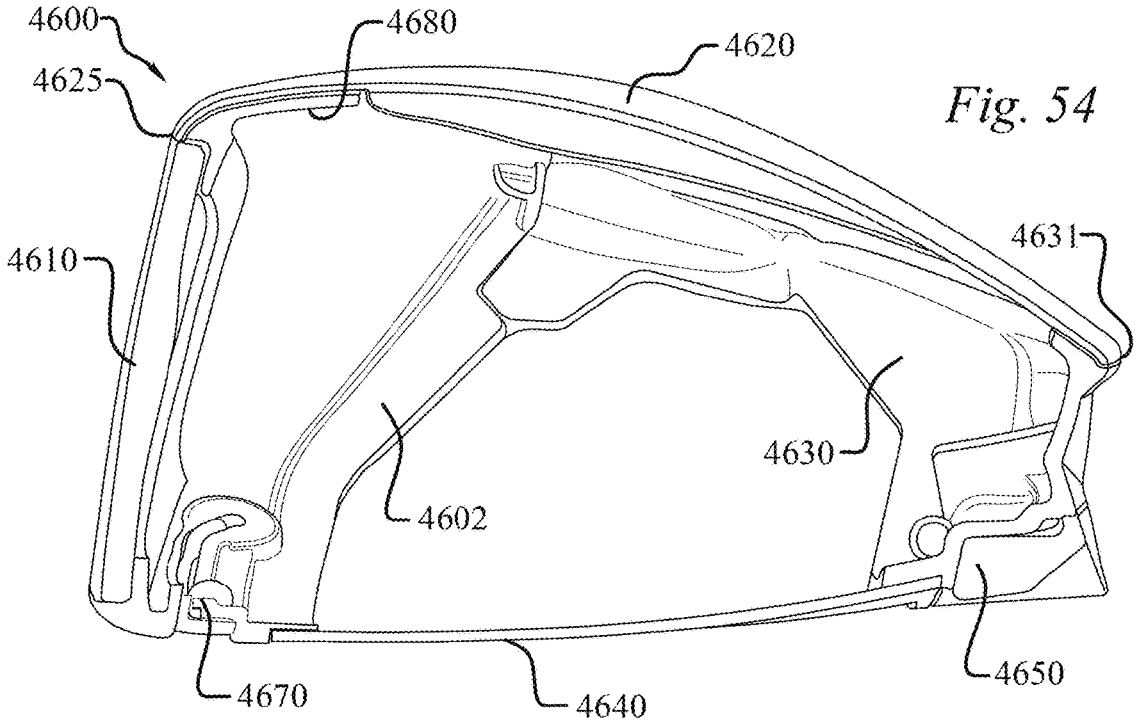

The topline can therefore extend along the entire top edge of the face plate 4610 from adjacent the heel-side stepped down wall 4689 at the heel end to adjacent the toe-side stepped down wall 4688 at the toe end. As seen in FIG. 65, wall 4638, also referred to as intermediary stepped down wall 4638, joins the heel-side stepped down wall 4689 to the toe-side stepped down wall 4688. The illustrated embodiment demonstrates the importance of the bond gap promoting features, or BGPFs, to ensure the crown leading edge 4625 is not only proud of the adjacent portion of the face plate 4610 at the toe-side crown-to-face junction point 4800 of FIG. 66, but also to ensure the crown perimeter edge 4631, seen in FIGS. 54, 56, and 93, is also proud of the adjacent portion of the forward body portion 4602 at the toe-side crown-to-face junction point 4800 of FIG. 66. Thus, all the proud relationships associated with the crown leading edge 4625 also apply to the crown perimeter edge 4631 with respect to the adjacent portions of the forward body portion 4602 and/or rear ring portion 4630, including the intermediary stepped down wall 4638, which includes the curvature of the crown 4620 adjacent to the crown perimeter edge 4631. However, analysis of the curvature of the crown 4620 adjacent to the crown perimeter edge 4631 is performed with respect to a vertical head perimeter edge plane 4998 and an offset vertical head perimeter edge plane 4997, seen in FIGS. 49 and 92, wherein the offset vertical head perimeter edge plane 4997 is parallel to the vertical head perimeter edge plane 4998 but offset a vertical head perimeter offset plane distance toward the center of gravity of the club head. With reference not to FIG. 56, the vertical head perimeter edge plane 4998 is tangent to any analysis point located on the perimeter of the club head. For example, if the analysis point is located where the 270 degree line intersects the club head perimeter, then the vertical head perimeter edge plane 4998 would be approximately parallel to the y-axis, and thus the 0 degree line; whereas if the analysis point is located at the intersection of a 315 degree line and the club head perimeter, then the vertical head perimeter edge plane 4998 would be approximately parallel to 225 degree line. Then, for any analysis point the evaluation section is cut along a vertical evaluation plane that is perpendicular to the vertical head perimeter edge plane 4998, and the crown curvature is evaluated in the vertical evaluation plane between the analysis point and the offset vertical head perimeter edge plane 4997. Now, with this defined, one skilled in the art will appreciate that all embodiments regarding the crown curvature adjacent the face plate 4610 are applicable to the crown curvature between the vertical head perimeter edge plane 4998 and the offset vertical head perimeter edge plane 4997, including the disclosed 3-point method, the 5-point method, and the associated radius of curvatures.

Figure 72:
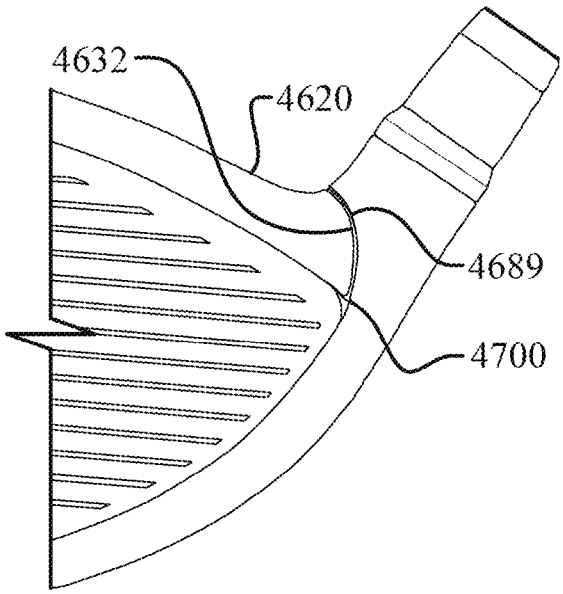
FIG. 72 is a partial front view of the club head with the crown panel.
Figure 73:
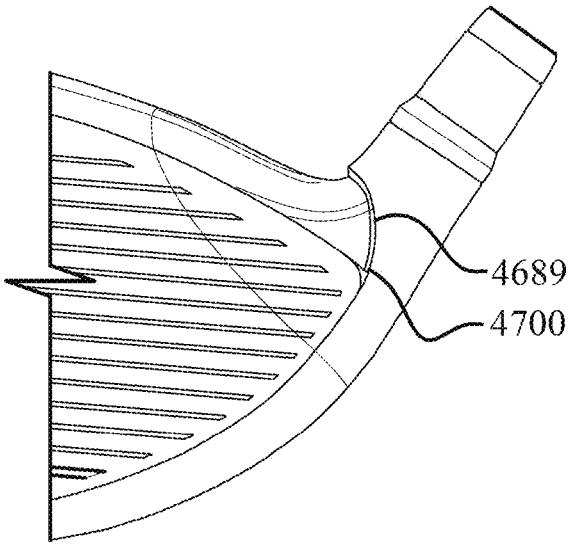
FIG. 73 is a partial front view of the club head with the crown panel removed.
Figure 90:
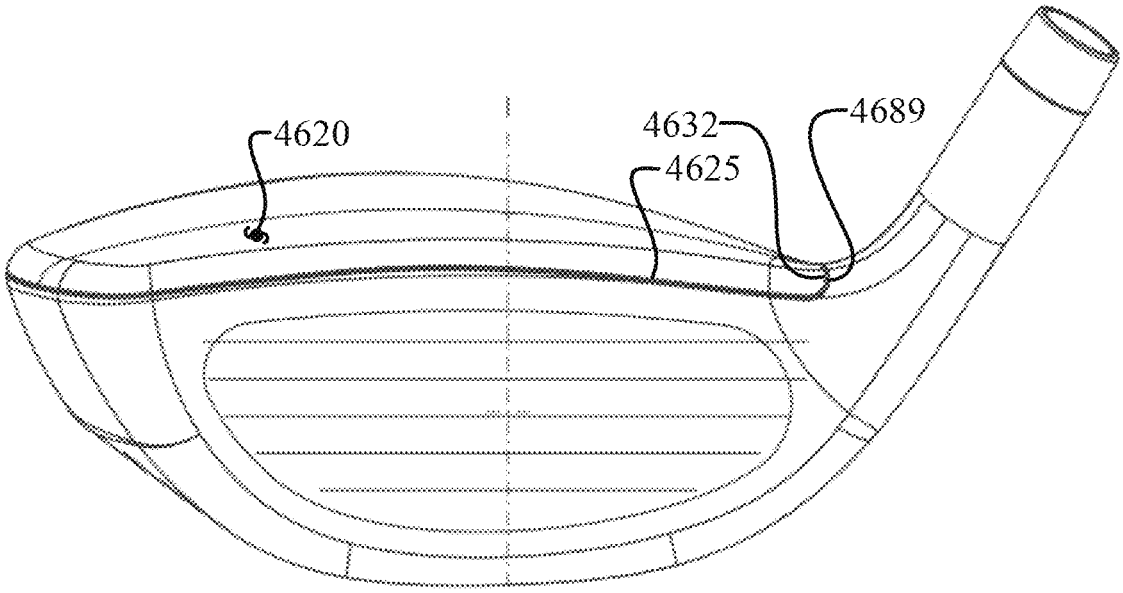
FIG. 90 is a front view of the club head.
Figure 91:
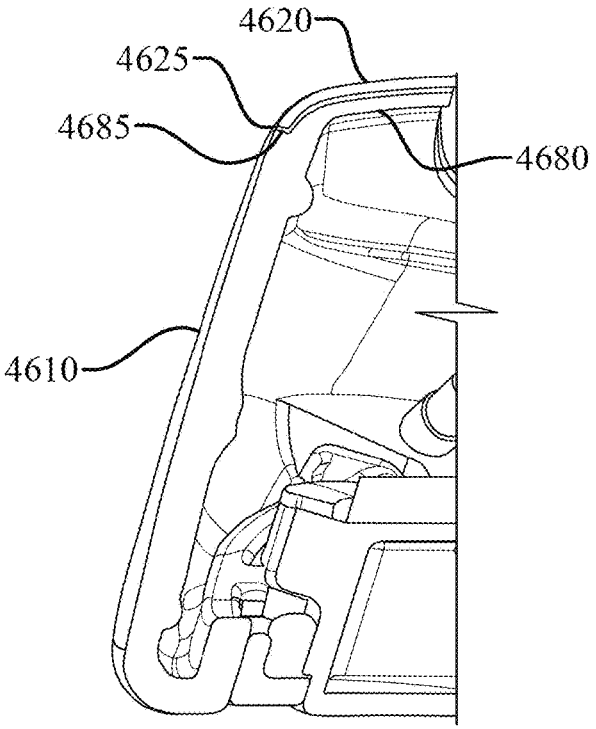
FIG. 91 is a partial cross-sectional view of the club head.
Figure 92:
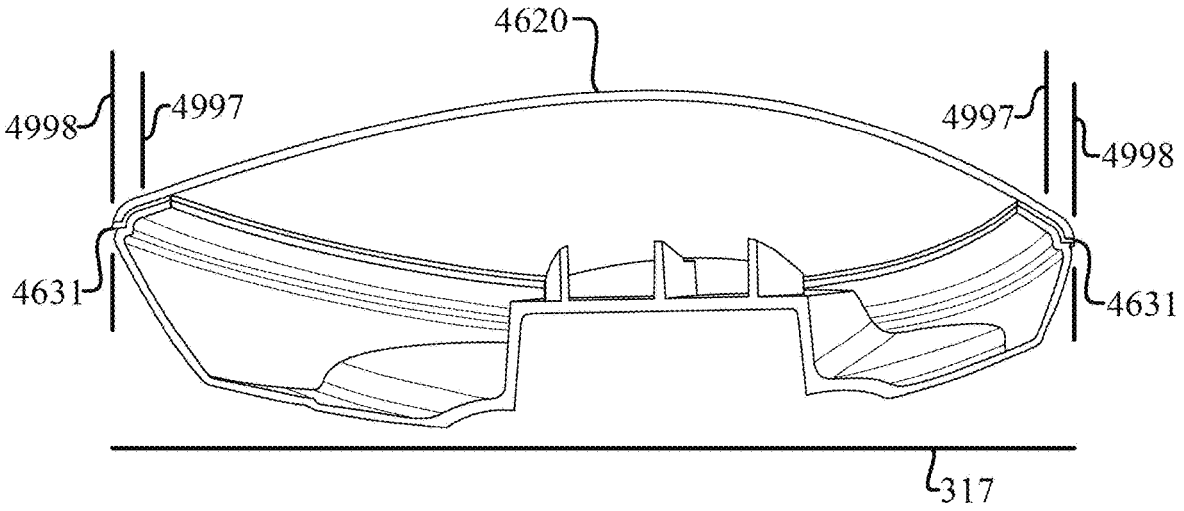
FIG. 92 is a partial cross-sectional view of the club head.

This is particularly delicate at the heel-side crown-to-face junction point 4700, seen in FIG. 67, whereby in one embodiment the crown-hosel perimeter edge portion 4632, seen in FIGS. 72, 90, and 93, is flush with the adjacent forward body portion 4602 at the heel-side stepped down wall 4689, yet the crown leading edge 4625 is still proud of the face plate 4610, thereby ensuring the top edge of the face plate 4610 is obscured from a golfer's view at address while also ensuring the crown-hosel perimeter edge portion 4632 is not clearly projecting from the adjacent forward body portion 4602 as it extends upward from the heel-side crown-to-face junction point 4700, illustrating the importance of the heel-side stepped down wall length 4697 and its relationship with the bond gap promoting features, the insert recess wall length 4693, and the thickness of the crown 4620 and face plate 4610, as well as the curvature of the front body portion 4602. In fact this is further complicated in embodiments in which the crown perimeter edge 4631 is also proud of the toe-side stepped down wall 4688 and/or the intermediary stepped down wall 4638. In one embodiment the heel-side stepped down wall length 4697 is greater than the toe-side stepped down wall length 4698.

Figure 68:
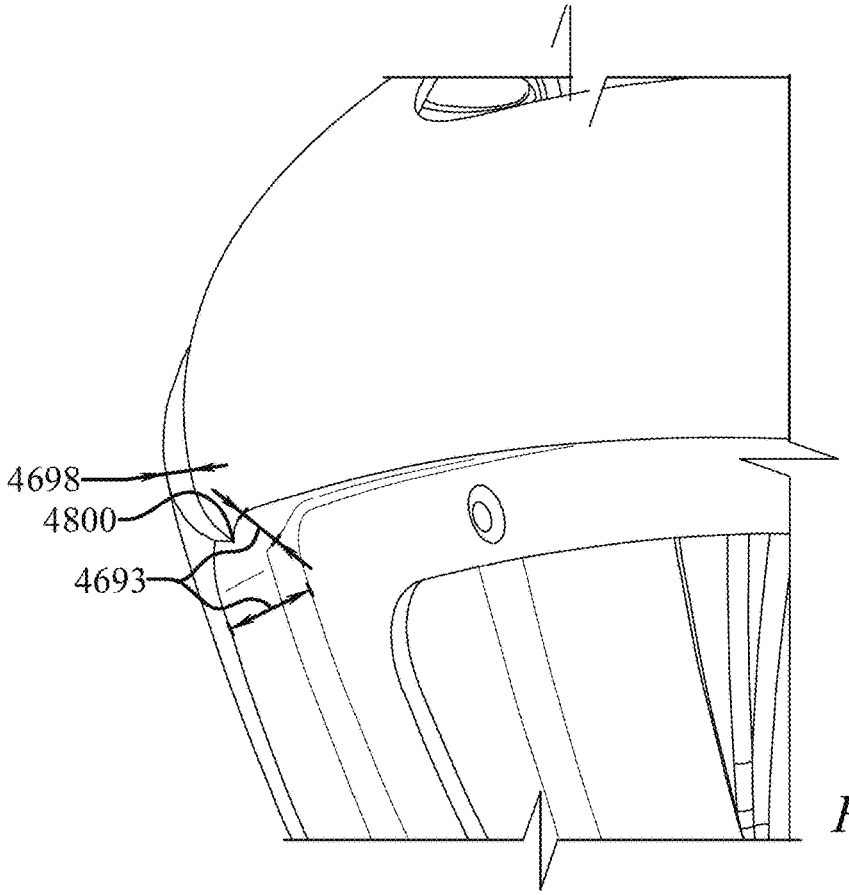
FIG. 68 shows an upper-front-toe portion of the body of the club head.
Figure 69:
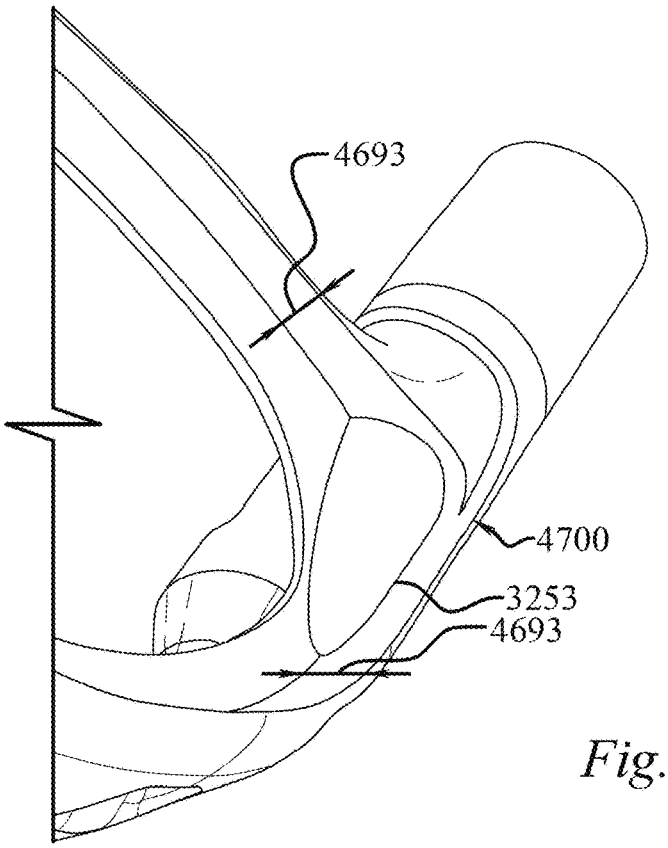
FIG. 69 shows a front-heel portion of the body of the club head.

In one embodiment seen in FIGS. 68 and 69, the insert recess wall length 4693 is not constant throughout the entire perimeter of the face insert 110. As seen in the embodiment of FIGS. 61, 66, and 68, at the toe-side crown-to-face junction point 4800 the insert recess wall length 4693 changes by an amount equal to the toe-side stepped down wall length 4698. Thus, utilizing the front elevation coordinate system illustrated in FIG. 61 and centered at center face 205, with zero degrees vertically upward, 90 degrees horizontally to the heel, 180 degrees vertically downward, and 270 degrees horizontally to the toe, in one embodiment a change in the insert recess wall length 4693 occurs in the quadrant between 270 degrees and zero degrees, while in a further embodiment the change occurs a location in the region of 280-315 degrees, and in additional embodiments the change occurs a location in the region of 285-305 degrees, or 290-300 degrees. In a further embodiment, seen in FIGS. 67 and 69, and ignoring the internal hosel surface 3253 for the moment, at the heel-side crown-to-face junction point 4700 the insert recess wall length 4693 changes by an amount equal to the heel-side stepped down wall length 4697, and thus, with reference again to the front elevation coordinate system illustrated in FIG. 61, a change in the insert recess wall length 4693 occurs in the quadrant between zero degrees and 90 degrees, and in a further embodiment between 45 degrees and 90 degrees, while in another embodiment between 60 degrees and 85 degrees, and between 70 degrees and 85 degrees in still another embodiment.

While in a further embodiment, seen in FIGS. 67 and 69, a portion of the internal hosel surface 3253 extends beyond a portion of the face support ledge wall 4690, but does not extend beyond the recess wall leading edge 6100 and/or the forwardmost point of the insert recess wall 4692 adjacent the internal hosel surface 3253 extending beyond a portion of the face support ledge wall 4690. In one embodiment the curved nature of this portion of the internal hosel surface 3253 creates a varying insert recess wall length 4693, as seen best in FIGS. 67 and 69. Thus, in one embodiment, and again referring to the front elevation coordinate system illustrated in FIG. 61, the insert recess wall length 4693 is not constant at a location in the region of 45-135 degrees, while in a further embodiment it is not constant at a location in the region of 60-120 degrees, and in a still further embodiment it is not constant at a location in the region of 70-110 degrees. In another embodiment the insert recess wall length 4693 within any of the disclosed regions varies from a maximum insert recess wall length to a minimum insert recess wall length, and the maximum insert recess wall length is at least 10% greater than the minimum insert recess wall length; while in further embodiments the maximum insert recess wall length is at least 20%, 30%, 40%, or 50% greater than the minimum insert recess wall length. In still further embodiments the maximum insert recess wall length is no more than 150% greater than the minimum insert recess wall length; and in additional embodiments is no more than 140%, 130%, 120%, 110%, 100%, and 90% greater than the minimum insert recess wall length.

While the above paragraph discloses a portion of the internal hosel surface 3253 extending beyond a portion of the face support ledge wall 4690, but not extending beyond the recess wall leading edge 6100, one skilled in the art will appreciate how this applies equally to embodiments in which the face plate 4610 is joined to the front body portion 4602 without the use of a face support ledge wall 4690, for example via a butt weld, or other butt joining methodology, along the insert recess wall 4692. In such embodiments the front body portion 4602 adjacent the face opening has an internal surface adjacent to the insert recess wall 4692, and the internal hosel surface 3253 extends beyond the adjacent internal surface (i.e. between an internal edge of the insert recess wall 4692 and an external edge of the insert recess wall 4692), but obviously does not extend beyond the forwardmost edge of the insert recess wall 4692. Thus all the notch disclosure is equally applicable to metallic face plates 4610 and their perimeter to accommodate the internal hosel surface 3253 extending into the region between the internal edge of the insert recess wall 4692 and the external edge of the insert recess wall 4692, and achieve all the disclosed benefits.

Now looking specifically at the change in the insert recess wall length 4693 occurring at the toe-side crown-to-face junction point 4800 of FIGS. 61, 66, and 68, in one embodiment the minimum insert recess wall length is at least 5% less than the maximum insert recess wall length, and in further embodiments the minimum insert recess wall length is at least 10%, 15%, 20%, or 25% less than the maximum insert recess wall length. While in a further series of embodiments the minimum insert recess wall length is 5-75% less than the maximum insert recess wall length, and in further embodiments the minimum insert recess wall length is 10-65%, 15-60%, or 20-55% less than the maximum insert recess wall length. In one embodiment the insert recess wall length 4693 is at least 2 mm, while in further embodiments it is at least 2.5 mm or 3.0 mm; and in a further embodiment the insert recess wall length 4693 is no more than 5.0 mm, and no more than 4.75 mm, 4.5 mm, 4.25 mm, or 4.0 mm in further embodiments.

Figure 60:
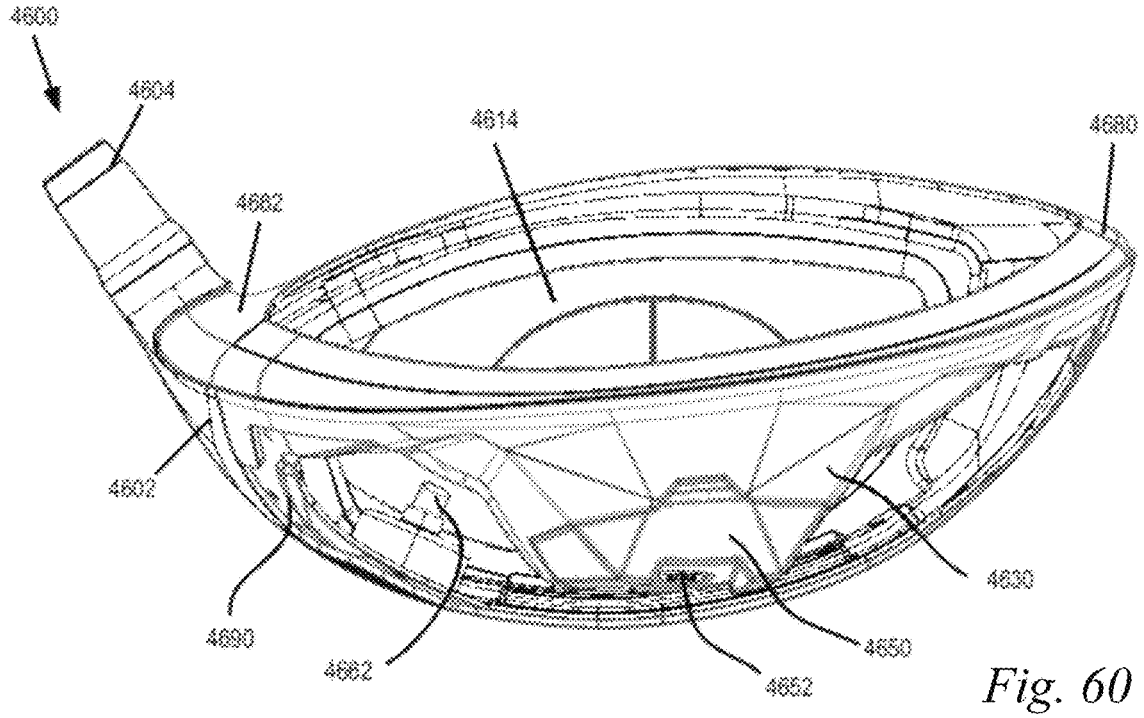

At the bottom of the club head 4600, in some embodiments a sole insert 4640 is bonded to a sole support ledge 4690, seen in FIG. 60, of the body, with forward aspects of the sole support ledge 4690 being part of the front body portion 4602 and rear and lateral aspects of the sole support ledge 4690 being part of the rear ring portion 4630. The sole insert 4640 can comprise any of the nonmetallic low density composite materials disclosed herein, like the crown, to reduce mass.

Figure 81:
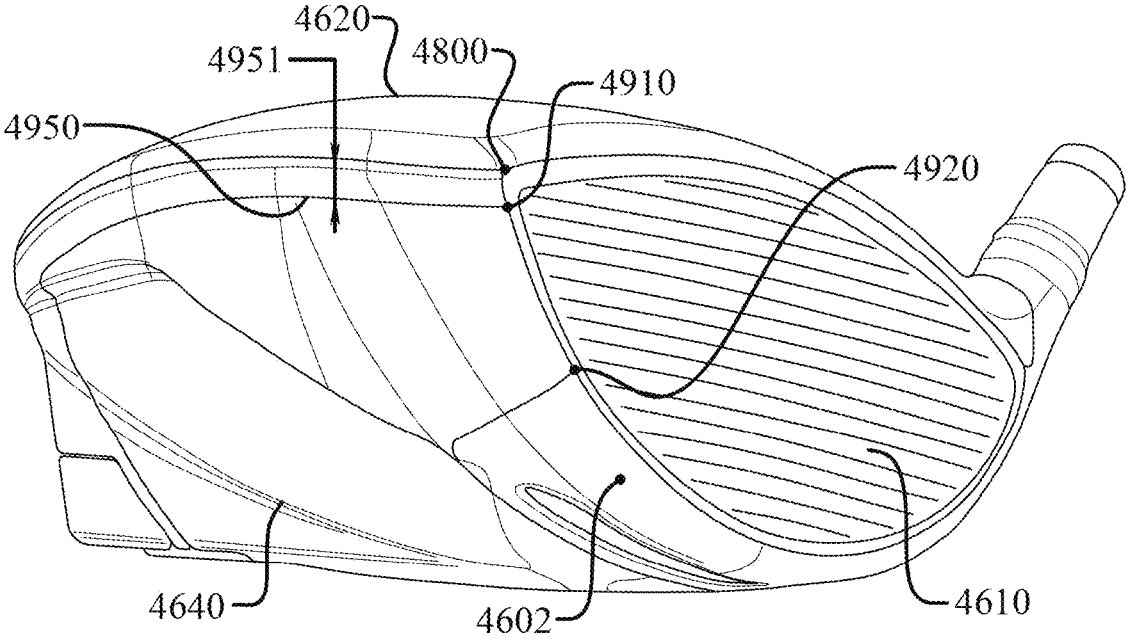
FIG. 81 is a perspective view of the club head.

While many of the disclosed embodiments relate to interfaces associated with a crown 4620 bonded to the frame and wrapping toward the face plate 4610, all of the disclosed relationships apply equally to one, or more, sole panels 4640 wrapping toward the face plate 4610, skirt panels wrapping toward the face plate 4610 at the heel and/or toe, and/or the rear ring portion 4630 wrapping toward the face plate 4610. For instance, FIG. 81 illustrates a sole insert 4640 that wraps around the front body portion 4602 to terminate adjacent the face plate 4610 at the toe side of the club head. In this embodiment the previously discussed the toe-side crown-to-face junction point 4800 is illustrated, but now there is also a first sole-to-face junction point 4910 and a second sole-to-face junction point 4920. In this embodiment the first sole-to-face junction point 4910 occurs where the sole insert 4640 is adjacent to the face plate 4610 and the front body portion 4602. Similarly, in this embodiment the second sole-to-face junction point 4920 occurs where the sole insert 4640 is adjacent to the face plate 4610 and the front body portion 4602. While in FIGS. 81 and 82 the sole insert 4640 only wraps around to be adjacent the face plate 4610 in the region between about 285 degrees and 260 degrees, referencing the front elevation coordinate system illustrated in FIG. 61, the region may be much greater, as seen in FIG. 80 where the second sole-to-face junction point 4920 is located between 180 degrees and 90 degrees. Further, in one embodiment the second sole-to-face junction point 4920 may be adjacent the heel-side crown-to-face junction point 4700. Likewise, while the embodiment of FIGS. 81 and 82 has a portion of the front body portion 4602 exposed between the crown 4620 and the sole insert 4640, and more specifically between the toe-side crown-to-face junction point 4800 and the first sole-to-face junction point 4910, this is not required and in one embodiment the first sole-to-face junction point 4910 is adjacent to the toe-side crown-to-face junction point 4800 without any exposed portion of the front body portion 4602, as seen in FIG. 77. Additionally, the sole insert 4640 may wrap around to be adjacent the face plate 4610 in multiple distinct regions, as seen in the shaded regions of FIGS. 77, 78, and 79. Thus, as seen in FIG. 77, the sole insert 4640 may additionally have a third sole-to-face junction point 4930 and a fourth sole-to-face junction point 4940.

A portion of sole insert 4640 is adjacent to the face plate 4610 at an elevation above center face 205, in one embodiment, while in another embodiment a portion of sole insert 4640 is adjacent to the face plate 4610 at an elevation both above center face 205 and below center face 205. Further, in another embodiment a portion of sole insert 4640 is adjacent to the face plate 4610 at an elevation above Zup, while in another embodiment a portion of sole insert 4640 is adjacent to the face plate 4610 at an elevation both above Zup and below Zup.

Further, using the front elevation view coordinate system illustrated in FIG. 61, in one embodiment the sole insert 4640 curves around the front body portion 4602 to be adjacent the perimeter of the face plate 4610 throughout any continuous 10 degree range, and in further embodiments any 20 degree range, 30 degree range, 40 degree range, 50 degree range, 60 degree range, 70 degree range, 80 degree range, 90 degree range, 100 degree range, or 110 degree range. In one embodiment the sole insert 4640 curves around the front body portion 4602 to be adjacent the perimeter of the face plate 4610 through any continuous 10 degree range located between the 285 degree line and the 180 degree line, while in further embodiments this 10 degree range is expanded to 15 degrees, 20 degrees, 25 degrees, or 30 degrees, while in further embodiments the range is located between the 285 degree line and the 225 degree line. In another embodiment the sole insert 4640 curves around the front body portion 4602 to be adjacent the perimeter of the face plate 4610 through any continuous 10 degree range located between the 90 degree line and the 180 degree line, while in further embodiments this 10 degree range is expanded to 15 degrees, 20 degrees, 25 degrees, or 30 degrees, while in further embodiments the range is located between the 90 degree line and the 135 degree line. In a further embodiment the sole insert 4640 curves around the front body portion 4602 to be adjacent the perimeter of the face plate 4610 throughout a continuous range of no more than 145 degrees, and in further embodiments no more than 135 degrees, 125 degrees, 115 degrees, 105 degrees, 95 degrees, 85 degrees, 75 degrees, 65 degrees, 55 degrees, 45 degrees, 35 degrees, or 25 degrees.

One skilled in the art will recognize that all the disclosed relationships associated with the crown 4620 apply equally to the sole insert 4640, as well as individual toe skirt inserts and/or heel skirt inserts, including, but not limited to, the interface with the toe-side stepped down wall 4688, the heel-side stepped down wall 4689, the intermediary stepped down wall 4638, the rear ring portion 4630, the face plate 4610, the insert recess wall length 4693, the heel-side stepped down wall length 4697, and the toe-side stepped down wall length 4698.

Figure 87:
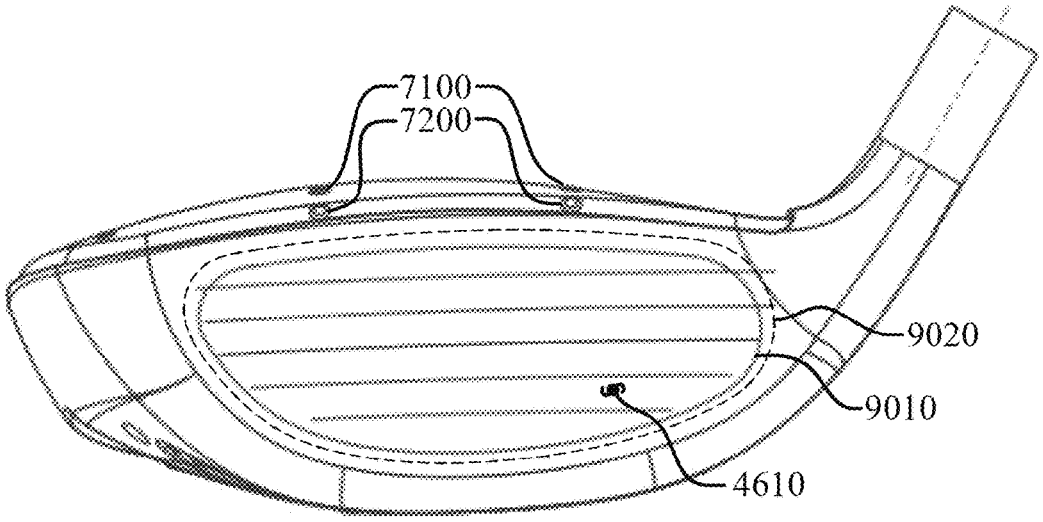
FIG. 87 is a front view of the club head with the crown removed.
Figure 88:
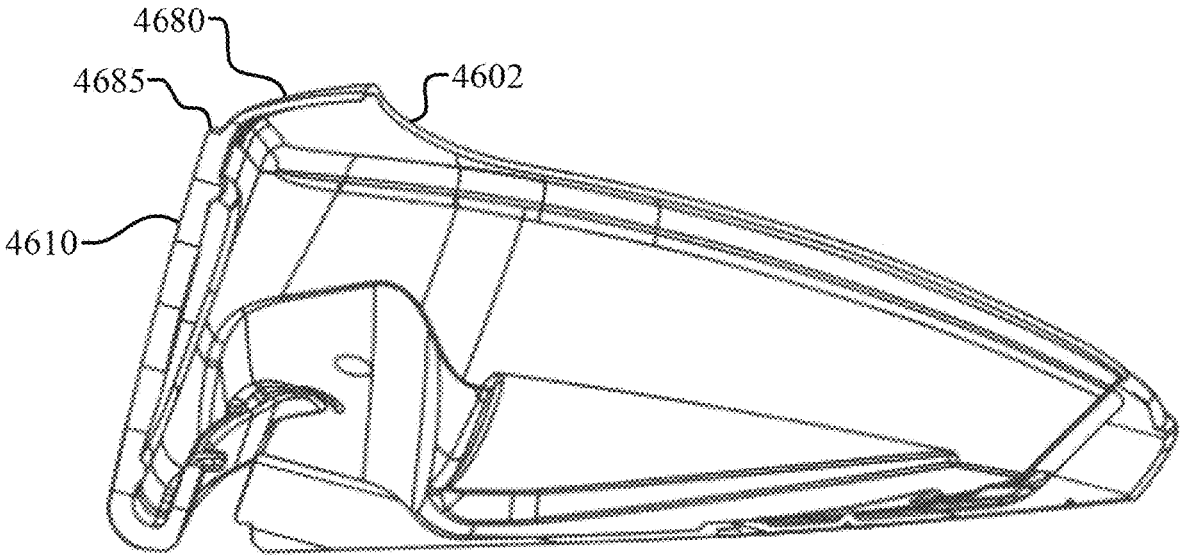
FIG. 88 is a cross-sectional view of the club head.
Figure 89:
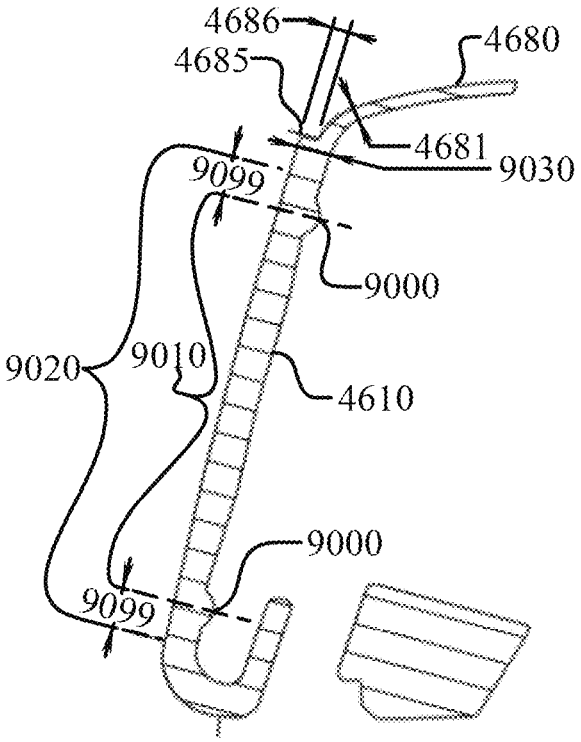
FIG. 89 is a partial cross-sectional view of the club head.

The phrase "adjacent to" or "adjacent the" is used throughout with reference to the proximity of certain components in relation to the perimeter of the face plate 4610, namely an edge of the crown 4620, an edge of the sole insert 4640, and/or the edge of skirt panels. Further, unless stated otherwise, the use of the term face plate is not to be inferred as being limited to a separate face component, or insert, joined to the club head; rather the perimeter of a face plate is applicable to (a) a separate face component joined to the club head and having a distinct perimeter edge after joining as seen in most of the illustrated embodiments, as well as (b) a separate face component bonded flush to the club head and not having a distinct perimeter edge after joining, as well as (c) a separate face component joined to the club head and not having a distinct perimeter edge after joining (such as by welding and brazing) as seen in FIGS. 87-89, as well as (d) unitarily cast or molded forward portions of the club head that include the striking surface. Regardless of these situations, a perimeter edge of the face plate 4610 may be easily identified. For situation (a) the perimeter of the face plate is the distinct perimeter edge left upon joining the face plate to the club head. However, for situation (b) careful sectioning of the club head, or analysis of the design drawings of the individual components, will allow one skilled in the art to identify the perimeter edge of the face plate 4610. For situation (c) when fusion of the face plate 4610 and club head has occurred such as by welding, one skilled in the art will be able to identify a center of the fusion zone 9000, seen in FIG. 89, by sectioning the club head and then the perimeter of the face plate 9020 is established by offsetting the center of fusion perimeter 9010, seen in FIGS. 87 and 89, outward by an offset distance 9099 of 3 mm, or via analysis of the design drawings of the individual components to establish a design component perimeter and offsetting the design component perimeter by an offset distance 9099 of 3 mm; when fusion of the face component and club head does not occur such as by brazing the face inserts are often still of a size similar to those used in fusion joining, and likewise one skilled in the art will be able to identify the center of the joint by sectioning the club head and then the perimeter of the face plate established by offsetting the center of joint perimeter outward by an offset distance 9099 of 3 mm, or via analysis of the design drawings of the individual components to establish a design component perimeter and offsetting the design component perimeter by an offset distance 9099 of 3 mm. For situation (d) involving unitarily cast or molded forward portions of the club head that include the striking surface, the perimeter of the face plate is defined as a series of points at which the striking surface radius becomes less than 127 mm; if the radius is not easily computed within a computer modeling program, three points that are 0.1 mm apart along a line passing through center face 205 can be used as the three points used for determining the striking surface radius, or a 127 mm curvature gauge aligned with face center 205 and rotated through the 360 degrees of FIG. 61 can be used to detect the locations of the edge of the face where the curvature drops to 127 mm and the joining of these locations establishes the perimeter of the face plate.

Now with the perimeter of the face plate established, regardless of the construction, multiple different methods may be used to determine whether another component is "adjacent to" or "adjacent the" perimeter of the face plate 4610. A first method is referred to as the simple proximity method whereby a predefined proximity distance is used, which may be thought of as a string having a length, separating a first end and a second end, equal to the predefined proximity distance whereby the first end of the string is placed at a point on the perimeter of the face plate and the string is in contact with the external surface of the club head. Then if the other component or feature (i.e. an edge of the crown 4620, the sole insert 4640, face secondary alignment feature 1404, and/or a skirt insert) is contacted by the second end of the string, the other component is "adjacent to" or "adjacent the" perimeter of the face plate 4610. In one embodiment the predefined proximity distance is 4 mm, while in further embodiments it is 3 mm, 2 mm, 1 mm, or 0.75 mm.

A second method is referred to as the offset plane method. In the offset plane method a loft plane 5000 is established first at a vertical plane passing through face center 205 and perpendicular to the shaft axis plane, referred to as the vertical center face plane, sometimes abbreviated VCFP, and the loft plane 5000 is defined as a plane that is tangent to the face center 205 of the club head, as seen in FIG. 70A. The point at which the loft plane 5000 contacts the face center 205 is referred to as the loft plane origin.

Now, with the loft plane 5000 established and explanation with respect to the vertical center face plane completed, analysis of other vertical sections passing through the face plate 4610 will be explained. Again, this procedure is applicable for any vertical section passing through the face plate 4610 that is perpendicular to a shaft axis plane, which is a vertical plane perpendicular to the ground plane 317 and including the shaft axis SA. For instance, with reference to FIG. 61, the 0-180 degree line is within the center face plane, and corresponds to the z-axis 206. However, to analyze relationships associated with an offset vertical section located −5 mm toeward from the vertical center face plane, the curvature of the face plate 4610 must be accounted for. Thus the loft plane 5000 is shifted −5 mm toeward along the 90-270 degree line of FIG. 61, which is also the x-axis 208, and then it is translated toward the rear of the club head, along the y-axis 207 seen in FIGS. 1A-1D, until the loft plane origin contacts the face plate 4610 thereby establishing a −5 mm toeward localized loft plane 5000. This is the location of a −5 mm toeward vertical plane, whereby attributes of a −5 mm toeward vertical section through the club head are determined with respect to the −5 mm toeward localized loft plane 5000, which is then offset by the predetermined offset plane distance to established a −5 mm toeward localized offset loft plane 5100, which is used to evaluate the characteristics of the club head in the −5 mm toeward vertical section. Here the negative sign is used to represent that the location is 5 mm along the x-axis 208 in the toeward direction, which is the negative direction, while the heelward direction is the positive x-axis 208 direction. This process of translating the loft plane origin first along the x-axis 208 to an analysis location, and then rearward along the y-axis 207 until the loft plane origin contacts the face plate 4610, may be repeated to establish a localized loft plane 5000 and a localized offset loft plane 5100 for any analysis location.

For instance, one embodiment evaluates club head characteristics at the following analysis locations: (a) a vertical center face plane including the y-axis and the z-axis and creating a vertical center face section through the club head and having a center face offset loft plane that is parallel to the loft plane and offset an offset plane distance from the loft plane; (b) at least a first heelward offset vertical plane parallel to the vertical center face plane and offset along the x-axis a distance of 5 millimeters toward the hosel portion, and creating a 5 mm offset vertical section having a 5 millimeter heelward localized loft plane and a 5 millimeter heelward localized offset loft plane offset the offset plane distance from the 5 millimeter heelward localized loft plane; and (c) at least a first toeward offset vertical plane parallel to the vertical center face plane and offset along the x-axis a distance of 5 millimeters away from the hosel portion, and creating a −5 millimeter offset vertical section having a −5 millimeter toeward localized loft plane and a −5 millimeter toeward localized offset loft plane offset the offset plane distance from the −5 millimeter toeward localized loft plane; wherein within the vertical center face section a portion of the crown leading edge is forward of the center face offset loft plane, within the 5 millimeter offset vertical section a portion of the crown leading edge is forward of the 5 millimeter heelward localized offset loft plane, and within the −5 millimeter offset vertical section a portion of the crown leading edge is forward of the −5 millimeter toeward localized offset loft plane. While in a further embodiment the vertical center face section a portion of the crown in front of the center face offset loft plane has a center face crown radius of curvature of less than 15 mm, within the 5 millimeter offset vertical section a portion of the crown in front of the 5 millimeter heelward localized offset loft plane has a 5 millimeter heelward crown radius of curvature of less than 15 mm, and within the −5 millimeter offset vertical section a portion of the crown in front of the −5 millimeter toeward localized offset loft plane has a −5 millimeter toeward crown radius of curvature of less than 15 mm. Another embodiment also evaluates club head characteristics at (a) a second heelward offset vertical plane parallel to the vertical center face plane and offset along the x-axis a distance of 10 millimeters toward the hosel portion, and creating a 10 mm offset vertical section having a 10 millimeter heelward localized loft plane and a 10 millimeter heelward localized offset loft plane offset the offset plane distance from the 10 millimeter heelward localized loft plane; and (b) a second toeward offset vertical plane parallel to the vertical center face plane and offset along the x-axis a distance of 10 millimeters away from the hosel portion, and creating a −10 millimeter offset vertical section having a −10 millimeter toeward localized loft plane and a −10 millimeter toeward localized offset loft plane offset the offset plane distance from the −10 millimeter toeward localized loft plane; wherein within the 10 millimeter offset vertical section a portion of the crown leading edge is forward of the 10 millimeter heelward localized offset loft plane, and within the −10 millimeter offset vertical section a portion of the crown leading edge is forward of the −10 millimeter toeward localized offset loft plane. In a further embodiment within the 10 millimeter offset vertical section a portion of the crown in front of the 10 millimeter heelward localized offset loft plane has a 10 millimeter heelward crown radius of curvature of less than 15 mm, and within the −10 millimeter offset vertical section a portion of the crown in front of the −10 millimeter toeward localized offset loft plane has a −10 millimeter toeward crown radius of curvature of less than 15 mm. Another embodiment also evaluates club head characteristics at (a) a third heelward offset vertical plane parallel to the vertical center face plane and offset along the x-axis a distance of 20 millimeters toward the hosel portion, and creating a 20 mm offset vertical section having a 20 millimeter heelward localized loft plane and a 20 millimeter heelward localized offset loft plane offset the offset plane distance from the 20 millimeter heelward localized loft plane; and (b) a third toeward offset vertical plane parallel to the vertical center face plane and offset along the x-axis a distance of 20 millimeters away from the hosel portion, and creating a −20 millimeter offset vertical section having a −20 millimeter toeward localized loft plane and a −20 millimeter toeward localized offset loft plane offset the offset plane distance from the −20 millimeter toeward localized loft plane; within the 20 millimeter offset vertical section a portion of the crown leading edge is forward of the 20 millimeter heelward localized offset loft plane, and within the −20 millimeter offset vertical section a portion of the crown leading edge is forward of the −20 millimeter toeward localized offset loft plane. In a further embodiment within the 20 millimeter offset vertical section a portion of the crown in front of the 20 millimeter heelward localized offset loft plane has a 20 millimeter heelward crown radius of curvature of less than 15 mm, and within the −20 millimeter offset vertical section a portion of the crown in front of the −20 millimeter toeward localized offset loft plane has a −20 millimeter toeward crown radius of curvature of less than 15 mm. Another embodiment also evaluates club head characteristics at (a) a fourth heelward offset vertical plane parallel to the vertical center face plane and offset along the x-axis a distance of 30 millimeters toward the hosel portion, and creating a 30 mm offset vertical section having a 30 millimeter heelward localized loft plane and a 30 millimeter heelward localized offset loft plane offset the offset plane distance from the 30 millimeter heelward localized loft plane; and (b) a fourth toeward offset vertical plane parallel to the vertical center face plane and offset along the x-axis a distance of 30 millimeters away from the hosel portion, and creating a −30 millimeter offset vertical section having a −30 millimeter toeward localized loft plane and a −30 millimeter toeward localized offset loft plane offset the offset plane distance from the −30 millimeter toeward localized loft plane; within the 30 millimeter offset vertical section a portion of the crown leading edge is forward of the 30 millimeter heelward localized offset loft plane, and within the −30 millimeter offset vertical section a portion of the crown leading edge is forward of the −30 millimeter toeward localized offset loft plane. While in a further embodiment within the 30 millimeter offset vertical section a portion of the crown in front of the 30 millimeter heelward localized offset loft plane has a 30 millimeter heelward crown radius of curvature of less than 15 mm, and within the −30 millimeter offset vertical section a portion of the crown in front of the −30 millimeter toeward localized offset loft plane has a −30 millimeter toeward crown radius of curvature of less than 15 mm. One skilled in the art will appreciate that this methodology may be applied at any analysis location, and the disclosed relationships are applicable at any one or more of the analysis locations. Therefore, to be explicit the above procedure includes analysis of a −X mm toeward vertical plane, whereby attributes of a −X mm toeward vertical section through the club head are determined with respect to a −X mm toeward localized loft plane 5000, which is then offset by the predetermined offset plane distance to established a −X mm toeward localized offset loft plane 5100, which is used to evaluate the characteristics of the club head in the −X mm toeward vertical section, whereby −X represents any integer number from −1 to −70. Further, the above procedure includes analysis of a +X mm heelward vertical plane, whereby attributes of a +X mm heelward vertical section through the club head are determined with respect to a +X mm heelward localized loft plane 5000, which is then offset by the predetermined offset plane distance to established a +X mm heelward localized offset loft plane 5100, which is used to evaluate the characteristics of the club head in the +X mm heelward vertical section, whereby +X represents any integer number from 1 to 70.

This same procedure may be repeated anywhere along the along the 90-270 degree line of FIG. 61, which is also the x-axis 208, to analyze specific vertical sections to determine if a component (i.e. an edge of the crown, sole, and/or skit) is "adjacent to" or "adjacent the" perimeter of the face plate 4610 through the use of an offset loft plane 5100, seen in FIG. 70 with respect to the vertical center face plane but applicable for any vertical section. Using the vertical center face section as an example, the offset loft plane 5100 is parallel to the loft plane 5000 but offset by a predetermined offset plane distance. For any other vertical sections the offset loft plane 5100 is parallel to the localized loft plane 5000 but offset by the predetermined offset plane distance. Then, when analyzing any vertical section, if a portion of a component (i.e. an edge of the crown 4620, the sole insert 4640, and/or a skirt insert) is located between the offset loft plane 5100 and either the loft plane 5000 or the localized loft plane 5000, then the component, at this particular analysis location, is "adjacent to" or "adjacent the" perimeter of the face plate 4610; further one skilled in the art will recognize that this applies to edges that are vertically above or below the point being analyzed and may include edges that are horizontally adjacent the perimeter of the face plate 4610, as is the case along the toe and/or heel portion of the perimeter. In one embodiment the predetermined offset plane distance is 6 mm, while in further embodiments it is 5 mm, 4 mm, 3 mm, or 2 mm. In another embodiment the predetermined offset plane distance is less than 150% of the peak thickness 4343, and less than 140%, 130%, 120%, 110%, 100%, 90%, 80%, 70%, 60%, or 50% in further embodiments. Unless specifically identified otherwise in the claims, the offset plane method with a predetermined offset plane distance of 6 mm is to be inferred.

Figure 82:
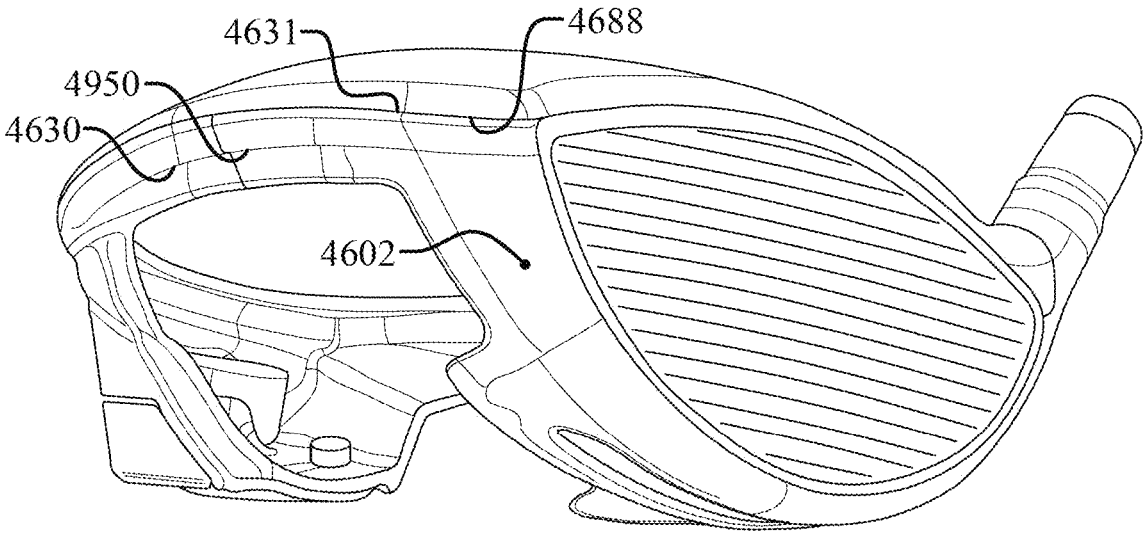
FIG. 82 is a perspective view of the club head with the sole insert removed.

As seen in FIGS. 81 and 82, the front body portion 4602 may include a forward ring portion 4950 extending rearward of the forward ledge 4680 and connecting to the rear ring portion 4630. In one embodiment the forward ring portion 4950 extends at least 15 mm behind the loft plane 5000 located at center face 205, while in further embodiment at least 20 mm, 25 mm, or 30 mm. Further, a portion of the forward ring portion 4950 may be exposed and visible after attachment of the crown 4620 and/or sole insert 4640. In the embodiment of FIG. 81, the exposed forward ring portion 4950 has an exposed ring width 4951 that is less than 50% of Zup, and in further embodiments less than 40%, 30%, or 20%. In one embodiment the exposed ring width 4951 is constant and the front body portion 4602 also has an exposed portion having an exposed front body width that matches the exposed ring width 4951 and extends all the way to the perimeter of the face plate 4610. In a further embodiment, also seen in FIG. 81, the rear ring portion 4630 is exposed at the connection to the forward ring portion 4950 and has an exposed rear ring width that is the same as the exposed ring width 4951.

Figure 51:
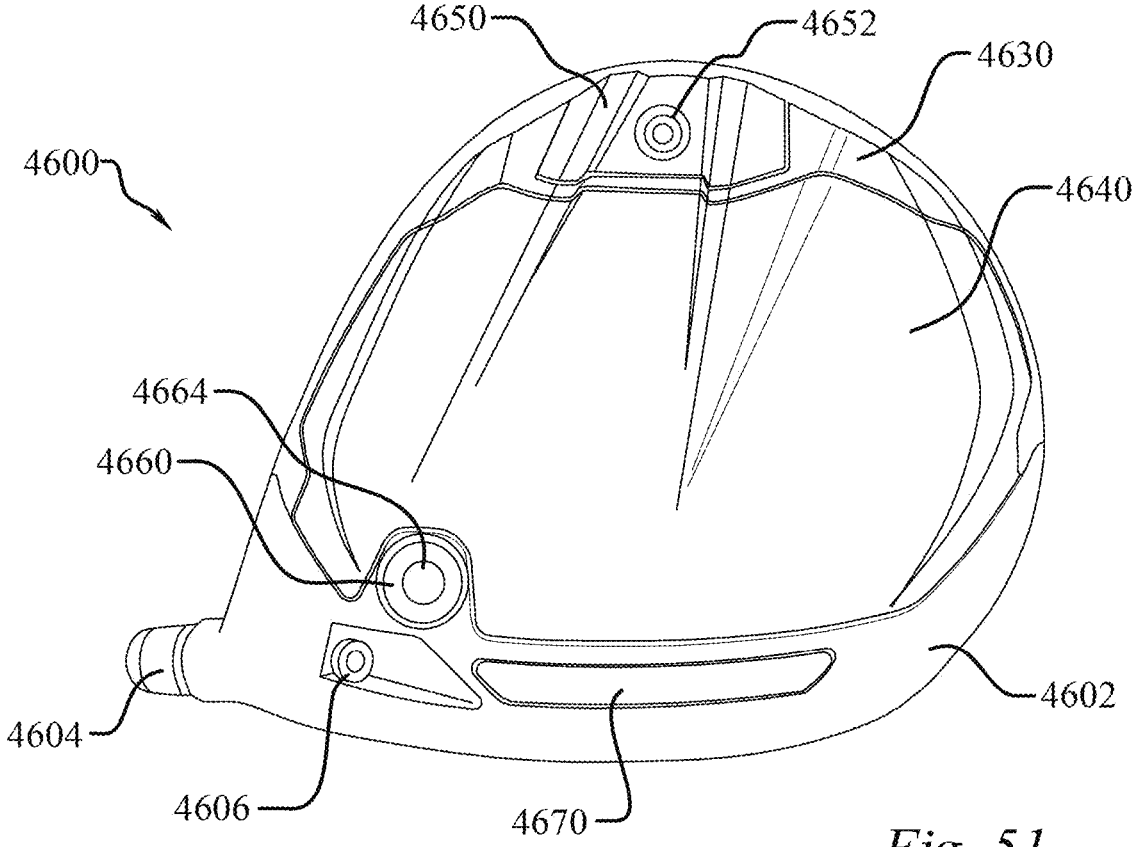

As previously disclosed, in some embodiments the rear ring portion 4630 may be integrally formed with a portion of the front body portion 4602. For example FIG. 94 illustrates an embodiment in which the front body portion 4602 includes a distinct first ledge wall region 4710 and a second ledge wall region 4720. In one embodiment the first ledge wall region 4710 is integrally formed with a portion of the front body portion 4602, including the forward ledge 4680, and may be integrally formed with the rear ring portion 4630, while the second ledge wall region 4720 is part of a separate denser component. However, in another embodiment the rear ring portion 4630 is a separate component but extends all the way to the face plate 4610, on the toe side and/or heel side, and creates a third ledge wall region located between a distinct first ledge wall region 4710 and a second ledge wall region 4720. Thus, in this embodiment the ledge wall region includes at least three components, one forming a ledge wall region to support a portion of the face topline perimeter edge 4215, a second to support a portion of the face lower portion perimeter edge 4216, and a third to support a portion of the face plate 4610 at the toe side and/or heel side of the face plate 4610. As shown in FIG. 51, the sole of the body 4602 can also include a forward channel 4670 that extends into an interior of the body and a recess for inserting a head-shaft fastener 4606. The club head 4600 can also include a front sole weight 4660 that is secured to a receptacle 4662 located on a heelward side of the sole of the body 4602 via a fastener 4664. At the rear of the club head, a rear weight 4650 can be secured to the rear ring portion 4630 via a fastener 4652. The weights 4660 and 4650 can be used to allocated discretionary mass to lower aspects of the club head to adjust the center of gravity, moments of inertia, and other mass properties of the club head.

In the club head 4600, the amount of discretionary mass that can be allocated to the weights 4660, 4650 can be substantially greater than in convention wood-type club heads mainly due to the reduced volume of dense metallic material in the body 4602 and the correspondingly increased size of the crown, and the presence of lower-density components such as the sole portion 4640 and crown 4620, face plate 4610, and/or the rear ring portion 4630. In particular, the mass of the top-front portion of the club head 4600 can be reduced by replacing some of the denser metallic material of the body (e.g., titanium or steel) with lower-density material of the crown (e.g., carbon fiber reinforced polymer composite) in the areas around the topline, the hosel, and the toe and heel skirt areas. The construction of the club head 4600 can provide for a maximized volume of lower density material (e.g., composite material) and/or a minimized volume of higher density material (e.g., metallic material). The club head 4600 can also feature a maximized surface area of lower density material and/or a minimum surface area of higher density material, with the entire visible topline region being composite material and the forward body portion 4602 hidden from view in that area. For example, in a top down view, almost none of the forward body portion 4602 is visible except for a small area around the hosel.

The club head 4600 can be assembled with the face plate 4610 being coupled to the front face opening of the body 4602 prior to the crown 4620, sole panel 4640, and/or skirt panel(s) being coupled to the frame. After the face plate 4610 is seated and bonded to the frame as desired, the crown 4620, sole panel 4640, and/or skirt panel(s) can then be manipulated to create the desired positioning and gapping between a crown leading edge 4625 and the perimeter of the face plate 4610, a front edge of the sole panel 4640 and the perimeter of the face plate 4610, and/or a front edge of a skirt panel(s) and the perimeter of the face plate 4610. The sole panel 4640 and/or skirt panel(s) can be coupled to the body either before or after the face plate 4610 and the crown 4620.

Among the several novel features of the club head 4600, a large nonmetallic crown 4620 that extends to be adjacent to the face plate 4610, and creates at least a portion of the overall club head perimeter, in a top plan view, is one of the most interesting, as well as one of the most challenging to make and incorporate into a real world club head that is durable and performs to the highest standards. Just manufacturing the crown 4620 can be challenging due to its three-dimensional shape that wraps down around the front and side aspects of the club head, and in some embodiments hugs tightly around the hosel portion. This makes tooling for fabricating the crown 4620 difficult. Some even said it cannot be done due to draft issues which are needed to release the crown insert from the tool. For an initial embodiment, careful attention was paid during the design to avoid any undercuts in the crown 4620 design and have zero to positive draft angle to allow for release from the mold (e.g., draft range 0 degrees to 4 degrees). Undercuts were not an issue for the older crown designs that did not wrap at all and certainly did not wrap onto multiple surfaces.

Figure 49:
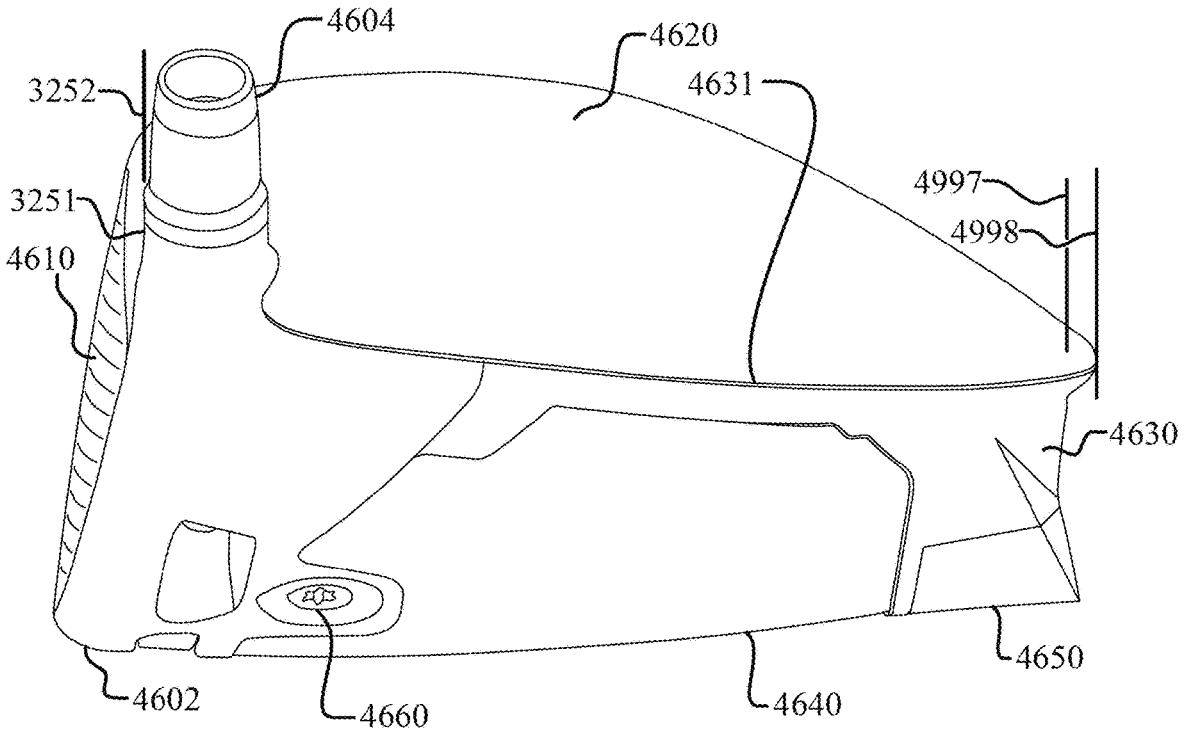
Figure 52:
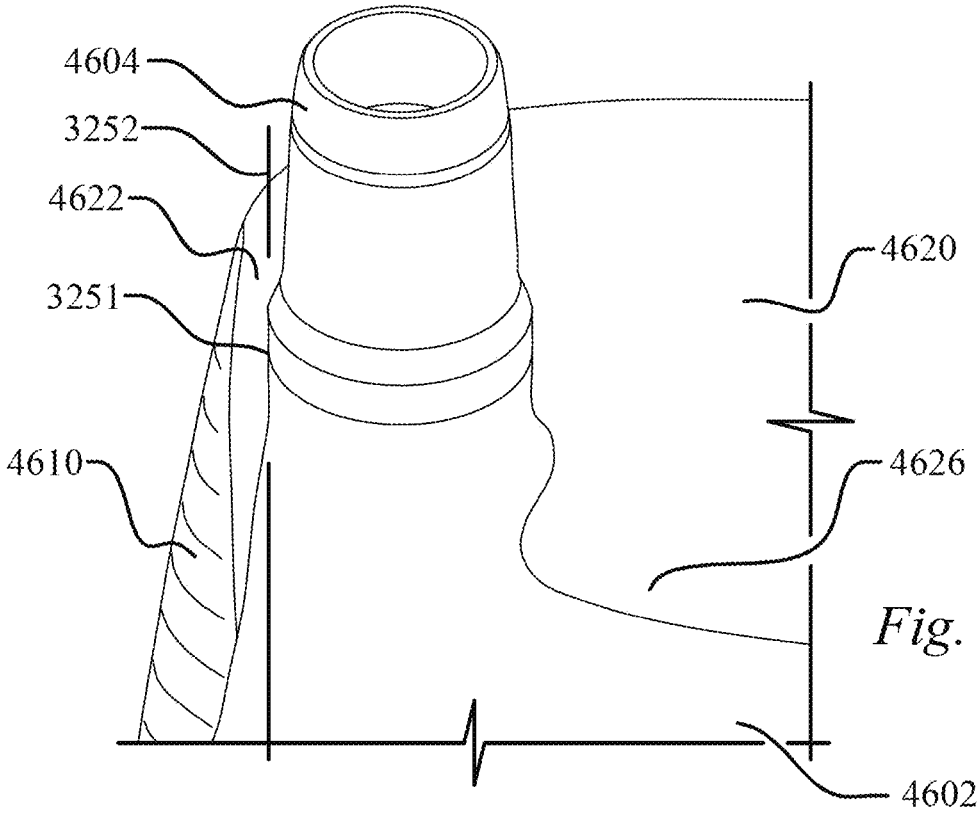

Once the crown 4620, sole panel 4640, and/or skirt panel(s) are fabricated with care, they can be bonded to the rest of the club head. Bonding agents can include epoxy or other adhesives (e.g., DP420 or DP460), as adhesives performs best in shear. During a collision with a ball, the crown 4620 experiences both lateral and vertical forces that overtime can cause the crown 4620 to pop off or become detached from the club head. With a typical crown insert and club head design, the bonding surfaces are situated such that the adhesive is put in shear for lateral forces, but not in shear for any of the vertical forces. Initially, it was feared that extending the crown 4620 and its bonding region closer to the face would negatively impact durability due to crown 4620 pop-off or cracking of the nonmetallic material. Unexpectedly, however, it was found that by extending the bond region and the crown 4620 past a forward portion of the external hosel surface 3251, as seen in FIGS. 49, 52, and 56, and wrapping the bond region and the crown 4620 onto the front of the body adjacent the face plate 4610 produced better-to-similar durability compared to a more typical construction. The additional bond surfaces forward of the external hosel surface 3251 in the crown-to-face transition region provide bond surfaces that are more normal to the impact, which puts the adhesive in shear in a direction that is more normal to the impact, and which better supports or counteracts the extreme vertical forces experienced during impact. The disclosed club head 4600 was found to be more robust in durability than prior designs where the crown does not extend onto the front of the body adjacent the face plate 4610, or even past the external hosel surface 3251.

In the embodiment seen in FIGS. 49, 52, and 56 the forwardmost point on the constant diameter portion of the external hosel surface 3251 defines a vertical forward hosel plane 3252, which is parallel to the shaft axis plane. If a constant diameter portion cannot be identified, then the location at which the shaft, or a shaft sleeve, enters the club head is used, which will have a bore for receiving the shaft, or shaft sleeve, and a bearing surface that abuts an edge of the shaft sleeve, and the forwardmost point on the bearing surface is the external hosel surface 3251, seen in FIG. 52, and establishes the vertical forward hosel plane 3252.

As seen in FIG. 56, in one embodiment a portion of the crown leading edge 4625, adjacent the face plate 4610 and/or face topline perimeter edge 4215 of FIG. 42, is in front of the vertical forward hosel plane 3252, while in a further embodiment a portion of the crown leading edge 4625, adjacent the face plate 4610 and/or face topline perimeter edge 4215, is also behind the vertical forward hosel plane 3252. Now with reference to the front elevation view coordinate system of FIG. 61, in one embodiment the crown leading edge 4625 adjacent the face plate 4610, and/or face topline perimeter edge 4215, between the 45 degree line and the 90 degree line is in front of the vertical forward hosel plane 3252, while a portion of the crown leading edge 4625 adjacent the face plate 4610, and/or face topline perimeter edge 4215, between the 315 degree line and the 270 degree line is behind the vertical forward hosel plane 3252. In another embodiment the crown leading edge 4625 adjacent the face plate 4610, and/or face topline perimeter edge 4215, between the 0 degree line and the 90 degree line is in front of the vertical forward hosel plane 3252, while a portion of the crown leading edge 4625 adjacent the face plate 4610, and/or face topline perimeter edge 4215, between the 315 degree line and the 270 degree line is behind the vertical forward hosel plane 3252. Referring again to FIG. 56, in a further embodiment at least 4 mm of the crown leading edge 4625 adjacent the face plate 4610, and/or face topline perimeter edge 4215, is behind the vertical forward hosel plane 3252, and at least 5 mm, 6 mm, or 7 mm in additional embodiments. In yet another embodiment no more than 20 mm of the crown leading edge 4625 adjacent the face plate 4610, and/or face topline perimeter edge 4215, is behind the vertical forward hosel plane 3252, and no more than 15 mm, 12.5 mm, 10 mm, or 7.5 mm in additional embodiments. In another embodiment a portion of the crown leading edge 4625, and/or face topline perimeter edge 4215, between the 0 degree line and the 90 degree line is at least 1 mm in front of the vertical forward hosel plane 3252, and at least 1.5 mm, 2.0 mm, 2.5 mm, or 3 mm in further embodiments. Further, in another embodiment no portion of the crown leading edge 4625, and/or face topline perimeter edge 4215, between the 0 degree line and the 90 degree line is more than 20 mm in front of the vertical forward hosel plane 3252, and no more than 18 mm, 16 mm, 14 mm, or 13 mm in additional embodiments.

Referring again to FIG. 70, the offset plane method is also useful in analyzing the curvature of a portion of an adjacent component (i.e. the crown 4620, the sole insert 4640, and/or a skirt insert) located in front of any of the offset loft planes 5100, meaning between an offset loft plane 5100 and a loft plane 5000. For simplicity of explanation the curvature of the crown 4620 in front of the center face offset loft plane 5100 of FIG. 70 will be examined first. The curvature of the crown 4620 in front of the offset loft plane 5100 is determined in vertical sections, such as the vertical center face plane, or any vertical plane offset heelward or toeward therefrom. In the region in front of the offset loft plane 5100 the curvature is determined based upon 3 points located on the exterior surface of the crown 4620, spaced 0.5 mm apart, and joined by a constant curvature arc, whereby the radius of curvature of the arc is the radius of curvature of the crown 4620; with this being referred to as the 3-point method. In one embodiment the first of the 3 points is located at the crown leading edge 4625, while in a further embodiment the first of the 3 points is located at an intersection of the offset loft plane 5100 and the exterior surface of the crown 4620. In yet another embodiment the 3-point method is expanded to encompass additional points with one point at the crown leading edge 4625, one point at the intersection of the offset loft plane 5100 and the exterior surface of the crown 4620, and at least 3 additional points evenly spaced on the exterior surface of the crown 4620 between the point at the crown leading edge 4625 and the point at the intersection of the offset loft plane 5100 and the exterior surface of the crown 4620; with this being the 5-point method whereby the 5 points are joined by a best-fit arc, and the radius of curvature of the arc is the radius of curvature of the crown 4620.

In one embodiment the radius of curvature of the crown 4620 in front of the offset loft plane 5100 determined by the 3-point method beginning at the crown leading edge 4625, and has a crown radius of curvature of less than 25 mm, and less than 23 mm, 21 mm, 19 mm, 17 mm, 15 mm, 13 mm, 11 mm, 9 mm, or 7 mm in further embodiments. In another embodiment the radius of curvature of the crown 4620 in front of the offset loft plane 5100 determined by the 3-point method beginning at the intersection of the offset loft plane 5100 and the exterior surface of the crown 4620, and has a crown radius of curvature of less than 25 mm, and less than 23 mm, 21 mm, 19 mm, 17 mm, 15 mm, 13 mm, 11 mm, 9 mm, or 7 mm in further embodiments. In yet a further embodiment the radius of curvature of the crown 4620 in front of the offset loft plane 5100 determined by the 5-point method, and has a crown radius of curvature of less than 25 mm, and less than 23 mm, 21 mm, 19 mm, 17 mm, 15 mm, 13 mm, 11 mm, 9 mm, or 7 mm in further embodiments. Again, all of the embodiments disclosed in the prior three sentences reflect the curvature of the crown 4620 in a single vertical section either at the vertical center face plane or an offset plane parallel to the vertical center face plane. Nonetheless, any of these embodiments may further apply to any vertical section passing through the face plate 4610, which is why it is convenient to refer to the front elevation view coordinate system of FIG. 61 to define regions in which any of these embodiments occur. For example in one embodiment any of these relationships is present throughout all vertical sections in a predetermined angle range. In an embodiment the predetermined angle range is at least 5 degrees, while in further embodiments it is at least 10, 15, 20, 25, 30, 35, 40, 45, 50, 55, 60, 65, 70, 75, 80, 85, 90, 95, or 100 degrees. In a further embodiment any of these relationships is present throughout all vertical sections passing through the face topline perimeter edge 4215 of FIG. 42. In the illustrated embodiments the curvature of the forward ledge 4680, seen best in FIG. 71, mimics the forward curvature of the crown 4620 and therefore all of the disclosed relationships also apply to the forward ledge 4680 adjacent to the face plate 4610.

As mentioned above, this curvature analysis is not limited to the crown 4620 and in fact applies equally, as do all of the disclosed relationships, to any component adjacent to the face plate 4610, which includes the sole plate 4640, as well as independent skirt panels and the forward ledge 4680, which will not be repeated entirely for the sake of brevity but is easily understood by one skilled in the art. For example, FIG. 76 illustrates an embodiment having the sole plate 4640 wrapping upward to be adjacent to the face plate 4610, whereby in the illustrated embodiment a sole plate leading edge 4641 becomes the leading edge of the club head. In one embodiment the radius of curvature of the sole plate 4640 in front of the offset loft plane 5100 is determined by the 3-point method beginning at the sole plate leading edge 4641, and has a sole plate radius of curvature of less than 25 mm, and less than 23 mm, 21 mm, 19 mm, 17 mm, or 15 mm in further embodiments. In another embodiment the radius of curvature of the sole plate 4640 in front of the offset loft plane 5100 is determined by the 3-point method beginning at the intersection of the offset loft plane 5100 and the exterior surface of the sole plate 4640, and has a sole plate radius of curvature of less than 25 mm, and less than 23 mm, 21 mm, 19 mm, 17 mm, or 15 mm in further embodiments. In yet a further embodiment the radius of curvature of the sole plate 4640 in front of the offset loft plane 5100 is determined by the 5-point method and has a sole plate radius of curvature of less than 25 mm, and less than 23 mm, 21 mm, 19 mm, 17 mm, or 15 mm in further embodiments. Again, all of the embodiments disclosed in the prior three sentences reflect the curvature of the sole plate 4640 in a single vertical section. Nonetheless, any of these embodiments may further apply to any vertical section passing through the face plate 4610 as disclosed herein with respect to the crown 4620 and various analysis points or locations, which is why it is convenient to refer to the front elevation view coordinate system of FIG. 61 to define regions in which any of these embodiments occur. For example in one embodiment any of these relationships is present throughout all vertical sections in a predetermined angle range. In an embodiment the predetermined angle range is at least 5 degrees, while in further embodiments it is at least 10, 20, 30, 40, 50, 60, 70, 80, 90, 100, 110, 120, 130, 140, 150, 160, 170, 180, 190, or 200 degrees. In a further embodiment any of these relationships is present throughout all vertical sections passing through the face lower portion perimeter edge 4216 of FIG. 42. As previously disclosed, the sole insert 4640 may wrap around to be adjacent the face plate 4610 in multiple distinct regions, as seen in the shaded regions of FIGS. 77, 78, and 79. One such embodiment includes at least two separate and distinct regions, Performance of the bonding agents is critical to ensure the face plate 4610, the crown 4620, the sole insert 4640, and/or skirt inserts remain in place and do not pop off during the club head's repeated impacts with a golf ball, which is more difficult than one would think and requires unique relationships to account for different stiffnesses and deflections of the these components, as well as the other components of the club head including the associated support structures and frame, as well as tight curvatures of the components adjacent the face plate 4610. This difficulty is further compounded by the use of multiple materials both in the exposed outer shell components of the crown 4620, the sole insert 4640, and/or the skirt inserts, as well as the underlying support components of the frame. Even further complicating this is the fact that in some embodiments the outer shell components such as the crown 4620, the sole insert 4640, and/or skirt inserts are extremely thin, while the face plate 4610 can be relatively thick; as well as having very different material properties. Additionally, controlling the placement of outer shell components to achieve desirable relationships with respect to the face plate 4610 is not only essential to performance but also to the finished look of the club head. For example, with reference to FIG. 70A, the placement of the crown leading edge 4625 is essential to ensuring the perimeter edge of the face plate 4610 is not visible when a golfer is addressing the ball. Thus, the location of the crown leading edge 4625, along the y-axis 207 seen in FIGS. 1A-1D, relative to the adjacent edge of the face plate 4610 is important, as is the joint spacing along the x-axis 208 and z-axis 206. In an embodiment the face plate 4610 is adhered with a face bonding agent, the crown 4620 is adhered with a crown bonding agent, and the sole insert 4640 is adhered with a sole bonding agent. In one embodiment the face bonding agent is different than the crown bonding agent and/or sole bonding agent. In a further embodiment the face bonding agent has an ASTM D3167 floating roller peel test average peeling load and/or maximum peeling load greater than that of the crown bonding agent and/or sole bonding agent, at 24 degrees Celsius. In a further embodiment the face bonding agent average peeling load and/or maximum peeling load is at least 3 N/cm greater than the average peeling load and/or maximum peeling load of the crown bonding agent and/or sole bonding agent; while in a further embodiment it is 4 N/cm greater or 5 N/cm greater, at 24 degrees Celsius.

Bond gap promoting features, abbreviated BGPF for simplicity, as well as their locations, sizes, and relationships to one another are essential to precise positioning of components with respect to one another, ensuring proper distribution and thickness of the bonding agents, and durability. For example, as seen in FIG. 84, one embodiment has a plurality of face-ledge BGPFs 7000 extending from the face support ledge wall 4690. As seen in FIGS. 74, 75, 83, and 85, the forward ledge 4680 may include a plurality of forward ledge BGPFs 7100 extending from the forward ledge 4680, which may include a plurality of face-crown transition BGPFs 7200, seen best in FIG. 83. While the plurality of forward ledge BGPFs 7100 project from the forward ledge 4680, the subset of face-crown transition BGPFs 7200 are distinguished as those having a portion of them adjacent to the face plate 4610, as defined by any of the previously disclosed methods. The rear ring portion 4630 may also have a plurality of rear ring BGPFs 7300 extending from the crown-supporting ledge 4636. Any disclosed relationship with respect to any one of the face-ledge BGPFs 7000, forward ledge BGPFs 7100, face-crown transition BGPFs 7200, and/or rear ring BGPFs 7300, may apply to any of the BGPFs.

Referring now to FIG. 84, one embodiment includes at least 2 face-ledge BGPFs 7000 located at an elevation above center face 205, and at least 2 face-ledge BGPFs 7000 located at an elevation below center face 205. The center of each face-ledge BGPFs 7000, in a x-axis 208 direction, is located a face-ledge BGPF x-axis offset distance 7010, measured horizontally along x-axis 208 direction to the vertical center face plane VCFP, which contains the y-axis 207. In one embodiment at least one of the face-ledge BGPFs 7000 located at an elevation above center face 205 and toeward of center face 205 has a first face-ledge BGPF x-axis offset distance 7010 that is greater than a second face-ledge BGPF x-axis offset distance 7010 of at least one of the face-ledge BGPFs 7000 located at an elevation above center face 205 and heelward of center face 205. Similarly, in another embodiment at least one of the face-ledge BGPFs 7000 located at an elevation below center face 205 and toeward of center face 205 has a third face-ledge BGPF x-axis offset distance 7010 that is greater than a fourth face-ledge BGPF x-axis offset distance 7010 of at least one of the face-ledge BGPFs 7000 located at an elevation below center face 205 and heelward of center face 205. In a further embodiment the first face-ledge BGPF x-axis offset distance 7010 is not equal to the third face-ledge BGPF x-axis offset distance 7010, and/or the second face-ledge BGPF x-axis offset distance 7010 is not equal to the fourth face-ledge BGPF x-axis offset distance 7010. In still another embodiment the third face-ledge BGPF x-axis offset distance 7010 is at least 1 mm greater than the first face-ledge BGPF x-axis offset distance 7010, and/or the fourth face-ledge BGPF x-axis offset distance 7010 is at least 1 mm greater than the second face-ledge BGPF x-axis offset distance 7010, while in further embodiments the at least 1 mm distance is at least 2 mm, 3 mm, 4 mm, 5 mm, or 6 mm. Yet another embodiment has only two face-ledge BGPFs 7000 located at an elevation above center face 205, and only two face-ledge BGPFs 7000 located at an elevation below center face 205. In one embodiment having 2 face-ledge BGPFs 7000 located at an elevation above center face 205, the face-ledge BGPFs 7000 are located at least 30 mm apart, measured along the x-axis 208, and in further embodiments at least 35 mm, 40 mm, 45 mm, or 50 mm. In another embodiment having 2 face-ledge BGPFs 7000 located at an elevation above center face 205, the face-ledge BGPFs 7000 are located no more than 90 mm apart, measured along the x-axis 208, and in further embodiments no more than 80 mm, 75 mm, 70 mm, or 65 mm.

Figure 83:
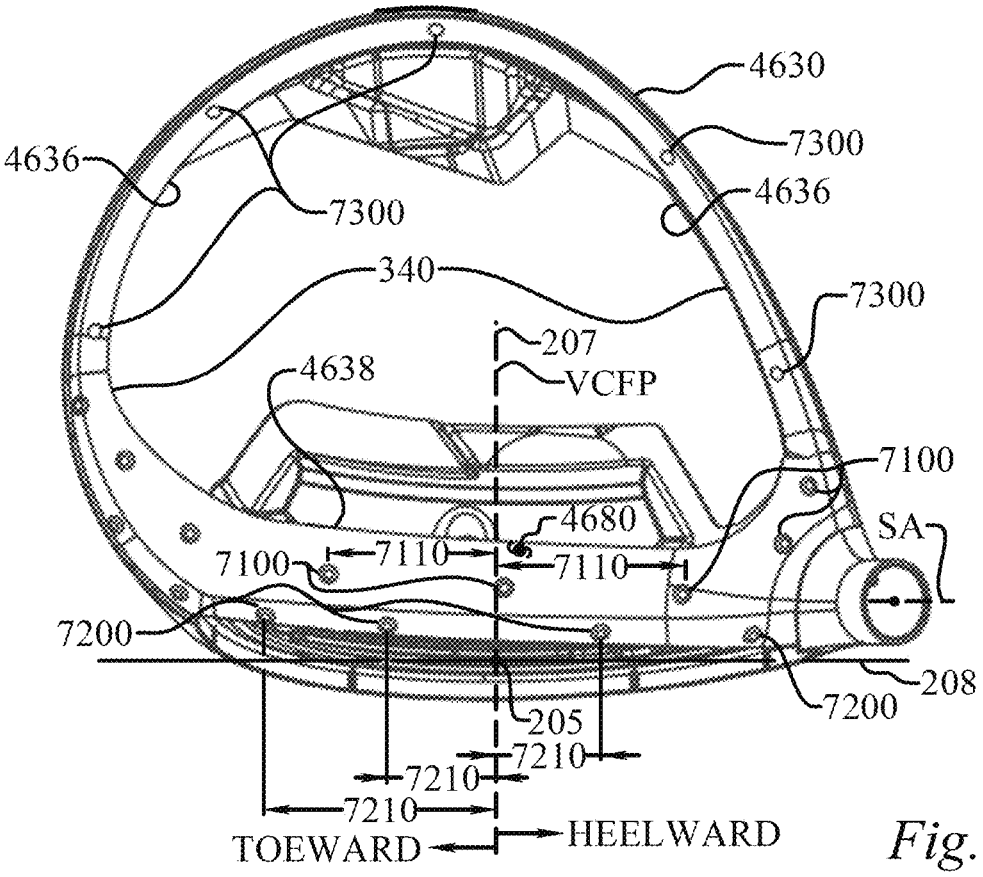
FIG. 83 is a top view of the club head with the crown and face plate removed.

Similarly, as seen best in FIG. 83, the plurality of face-crown transition BGPFs 7200 includes at least a first face-crown transition BGPF 7200 located toeward of face center 205, and at least a second face-crown transition BGPF 7200 located heelward of face center 205. The center of each face-crown transition BGPF 7200, in a x-axis 208 direction, is located a face-crown transition BGPF x-axis offset distance 7210, measured horizontally along x-axis 208 direction to the vertical center face plane VCFP. Thus the first face-crown transition BGPF 7200 has a first face-crown transition BGPF x-axis offset distance 7210, and the second face-crown transition BGPF 7200 has a second face-crown transition BGPF x-axis offset distance 7210. In one embodiment the first face-crown transition BGPF x-axis offset distance 7210 is not equal to the second face-crown transition BGPF x-axis offset distance 7210. In a further embodiment the first face-crown transition BGPF x-axis offset distance 7210 is not equal to the first face-ledge BGPF x-axis offset distance 7010, and/or the second face-crown transition BGPF x-axis offset distance 7210 is not equal to the second face-ledge BGPF x-axis offset distance 7010. In yet another embodiment the absolute value of the difference between the first face-crown transition BGPF x-axis offset distance 7210 and first face-ledge BGPF x-axis offset distance 7010 is at least 1 mm, while in further embodiments at least 2 mm, 3 mm, 4 mm, or 5 mm. Similarly, in another embodiment the absolute value of the difference between the second face-crown transition BGPF x-axis offset distance 7210 and second face-ledge BGPF x-axis offset distance 7010 is at least 1 mm, while in further embodiments at least 2 mm, 3 mm, 4 mm, or 5 mm. In a further embodiment no face-crown transition BGPF 7200 have a face-crown transition BGPF x-axis offset distance 7210 equal to a face-ledge BGPF x-axis offset distance 7010 for any face-ledge BGPF 7000 located above center face 705, and/or no face-crown transition BGPF 7200 have a face-crown transition BGPF x-axis offset distance 7210 equal to a face-ledge BGPF x-axis offset distance 7010 for any face-ledge BGPF 7000 located below center face 705. In a further embodiment no face-crown transition BGPF 7200 have a face-crown transition BGPF x-axis offset distance 7210 within plus or minus 2 mm of a face-ledge BGPF x-axis offset distance 7010 for any face-ledge BGPF 7000 located above center face 705, and/or no face-crown transition BGPF 7200 have a face-crown transition BGPF x-axis offset distance 7210 within plus or minus 2 mm of a face-ledge BGPF x-axis offset distance 7010 for any face-ledge BGPF 7000 located below center face 705, while in further embodiments the disclosed plus/minus 2 mm range is broadened to 3 mm, 4 mm, 5 mm, or 6 mm. In a further embodiment at least a portion of one of the face-crown transition BGPFs 7200 is located in front of the center face offset loft plane 5100, while in further embodiments at least a portion of 2, 3, or 4 face-crown transition BGPFs 7200 are located in front of the center face offset loft plane 5100. In one embodiment each face-crown transition BGPFs 7200 is located at least 5 mm away from the nearest adjacent face-crown transition BGPFs 7200, measure along the x-axis 208, and in further embodiments at least 10 mm, 12.5 mm, or 15 mm.

Similarly, as seen best in FIG. 83, the plurality of forward ledge BGPFs 7100 includes at least a first forward ledge BGPF 7100 located toeward of face center 205, and at least a second forward ledge BGPF 7100 located heelward of face center 205. The center of each forward ledge BGPFs 7100, in a x-axis 208 direction, is located a forward ledge BGPFs x-axis offset distance 7110, measured horizontally along x-axis 208 direction to the vertical center face plane VCFP. Thus the first forward ledge BGPF 7100 has a first forward ledge BGPF x-axis offset distance 7110, and the second forward ledge BGPF 7100 has a second forward ledge BGPF x-axis offset distance 7110. In one embodiment the first forward ledge BGPF x-axis offset distance 7110 is not equal to the second forward ledge BGPF x-axis offset distance 7110. In a further embodiment the first forward ledge BGPF x-axis offset distance 7210 is not equal to the first face-ledge BGPF x-axis offset distance 7010, and/or the second forward ledge BGPF x-axis offset distance 7210 is not equal to the second face-ledge BGPF x-axis offset distance 7010. In yet another embodiment the absolute value of the difference between the first forward ledge BGPF x-axis offset distance 7110 and first face-ledge BGPF x-axis offset distance 7010 is at least 1 mm, while in further embodiments at least 2 mm, 3 mm, 4 mm, or 5 mm. Similarly, in another embodiment the absolute value of the difference between the second forward ledge BGPF x-axis offset distance 7110 and second face-ledge BGPF x-axis offset distance 7010 is at least 1 mm, while in further embodiments at least 2 mm, 3 mm, 4 mm, or 5 mm. In a further embodiment no forward ledge BGPFs 7100 have a forward ledge BGPF x-axis offset distance 7110 equal to a face-ledge BGPF x-axis offset distance 7010 for any face-ledge BGPF 7000 located above center face 705, and/or no forward ledge BGPFs 7100 have a forward ledge BGPF x-axis offset distance 7110 equal to a face-ledge BGPF x-axis offset distance 7010 for any face-ledge BGPF 7000 located below center face 705. Another embodiment has at least two forward ledge BGPFs 7100 in close proximity to the shaft axis. An imaginary cylinder having a diameter of 50 mm is positioned on the shaft axis so the center of the cylinder is on the shaft axis, with the cylinder extending parallel to the shaft axis from the ground plane to the highest point on the hosel portion. Then, the location of at least two forward ledge BGPFs 7100 are located within the imaginary cylinder. While in a further embodiment the diameter of the imaginary cylinder is 45 mm, and in further embodiments is 40 mm, 35 mm, 30 mm, or 25 mm.

As seen in FIGS. 63, the forward ledge BGPFs 7100 extend from the adjacent forward ledge 4680 a forward ledge BGPF distance 7120. Likewise, as seen in FIG. 66, the face-ledge BGPFs 7000 extend from the adjacent face support ledge wall 4690 a face-ledge BGPF distance 7020. Similarly, as seen in FIG. 75, the face-crown transition BGPFs 7200 extend from the adjacent forward ledge 4680 a face-crown transition BGPF distance 7220. In one embodiment the forward ledge BGPF distance 7120, and/or the face-crown transition BGPF distance 7220 are at least 0.1 mm, and in further embodiments at least 0.15 mm, 0.20 mm, 0.25 mm, or 0.30 mm. In another embodiment the forward ledge BGPF distance 7120, the face-ledge BGPF distance 7020, and/or the face-crown transition BGPF distance 7220 are no more than 0.6 mm, and in further embodiments no more than 0.5 mm, 0.45 mm, 0.4 mm, or 0.35 mm. In one embodiment the face-ledge BGPF distance 7020 is less than the forward ledge BGPF distance 7120 and/or the face-crown transition BGPF distance 7220. In a further embodiment the forward ledge BGPF distance 7120 is equal to the face-crown transition BGPF distance 7220. In another embodiment the face-ledge BGPF distance 7020 is at least 3% of the insert recess wall length 4693, and in further embodiments at least 4%, 5%, or 6%. In another embodiment the face-ledge BGPF distance 7020 is no more than 10% of the insert recess wall length 4693, and in further embodiments no more than 9%, 8%, or 7%.

The crown 4620 has a crown thickness 4629, seen in FIG. 70A. In one embodiment the portion of the crown 4620 between the offset loft plane 5100 and the crown leading edge 4625 has a crown thickness 4629 is less than 0.95 mm, while in further embodiments it is less than 0.90 mm, 0.85 mm, 0.80 mm, 0.75 mm, 0.70 mm, or 0.65 mm. In another embodiment the portion of the crown 4620 between the offset loft plane 5100 and the crown leading edge 4625 has a crown thickness 4629 is at least 0.35 mm, while in further embodiments it is at least 0.40 mm, 0.45 mm, 0.50 mm, 0.55 mm, 0.60 mm, or 0.65 mm. In another embodiment the crown thickness 4629 is constant between the offset loft plane 5100 and the crown leading edge 4625; while in a further embodiment the crown thickness 4629 is constant between a forward ledge rear edge 4683, seen in FIGS. 70A, and the crown leading edge 4625. As seen in FIG. 70B, the crown leading edge 4625 occurs at the intersection of a crown leading edge sidewall surface and a crown exterior surface, and the crown leading edge sidewall surface extends to a crown interior surface, which is bonded to the forward ledge 4680. In one embodiment the crown leading edge sidewall surface is substantially parallel, meaning plus/minus 5 degrees, to the insert recess wall 4692; while in a further embodiment the length of the crown leading edge sidewall surface is no less than 75% of the crown thickness 4629 over the forward ledge 4680, and no less than 85% or 95% in further embodiments.

In yet another embodiment a portion of the crown 4620 covering the opening 340, seen in FIGS. 14A and 83, extending from the forward ledge rear edge 4683 to an inner edge of the crown-supporting ledge 4636, has a crown thickness 4629 that varies from a minimum opening crown thickness to a maximum opening crown thickness. In one embodiment the minimum opening crown thickness is less than the crown thickness 4629 between the forward ledge rear edge 4683 and the crown leading edge 4625; and/or the maximum opening crown thickness is greater than the crown thickness 4629 between the forward ledge rear edge 4683 and the crown leading edge 4625. In one embodiment the minimum opening crown thickness is at least 5% less than the crown thickness 4629 between the forward ledge rear edge 4683 and the crown leading edge 4625, while in further embodiments it is at least 10%, 15%, or 20% less. In another embodiment the maximum opening crown thickness is at least 5% greater than the crown thickness 4629 between the forward ledge rear edge 4683 and the crown leading edge 4625, while in further embodiments it is at least 10%, 15%, 20%, 25%, 35%, 45%, 55%, 65%, or 75% greater.

One embodiment includes at least one reinforcement rib 8000, seen in FIG. 56, integrally formed with the crown 4620 and/or sole insert 4640, having a rib length 8010, a rib thickness measured in the same direction as the adjacent crown thickness 4629, and a rib width 8020. In one embodiment the rib length 8010 is at least 35% of the face profile length 4212, and in additional embodiments at least 50%, 60%, or 70%. In another embodiment the rib length 8010 is no more than the face profile length 4212, and in additional embodiments no more than 90%, 80%, or 75%. In another embodiment the rib width 8020 is no more than a predetermined % of the maximum forward ledge thickness 4681, the minimum forward ledge thickness 4681, the crown thickness 4629, the maximum crown thickness 4629, the minimum crown thickness 4629, or the ledge wall thickness 4699; wherein in one embodiment the predetermined % is 100%, and in further embodiments it is 90%, 80%, 70%, or 60%. In another embodiment the rib width 8020 is at least a predetermined % of the maximum forward ledge thickness 4681, the minimum forward ledge thickness 4681, the crown thickness 4629, the maximum crown thickness 4629, the minimum crown thickness 4629, or the ledge wall thickness 4699; wherein in one embodiment the predetermined % is 25%, and in further embodiments it is 30%, 35%, 40%, or 45%.

In one embodiment the forward ledge BGPF distance 7120, the face-crown transition BGPF distance 7220, and/or the face-ledge BGPF distance 7020 is no more than a predetermined % of the maximum forward ledge thickness 4681, the minimum forward ledge thickness 4681, the crown thickness 4629, the maximum crown thickness 4629, the minimum crown thickness 4629, or the ledge wall thickness 4699; wherein in one embodiment the predetermined % is 45%, and in further embodiments it is 40%, 35%, 30%, or 25%. In another embodiment the forward ledge BGPF distance 7120, the face-crown transition BGPF distance 7220, and/or the face-ledge BGPF distance 7020 is at least a predetermined % of the maximum forward ledge thickness 4681, the minimum forward ledge thickness 4681, the crown thickness 4629, the maximum crown thickness 4629, the minimum crown thickness 4629, or the ledge wall thickness 4699; wherein in one embodiment the predetermined % is 5%, and in further embodiments it is 10%, 15%, or 20%.

Figure 74:
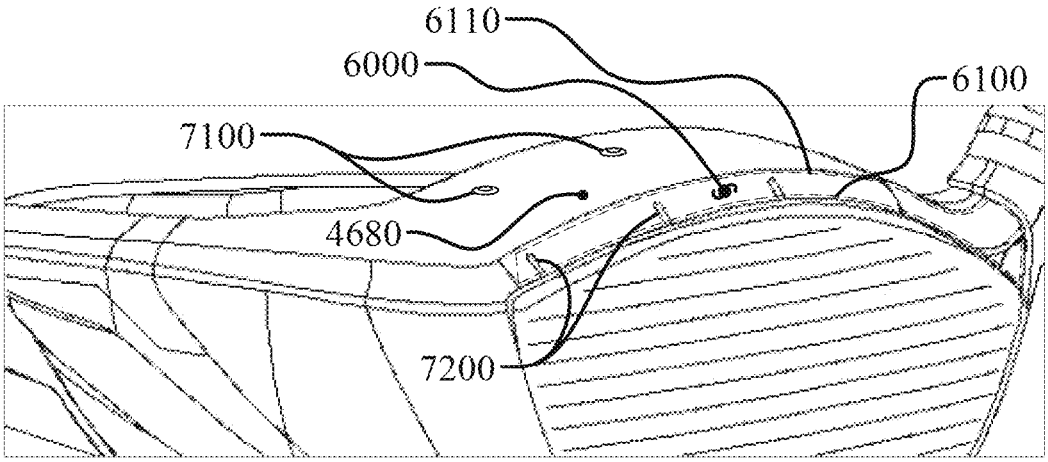
FIG. 74 is a partial perspective view of the club head with the crown panel removed.
Figure 75:
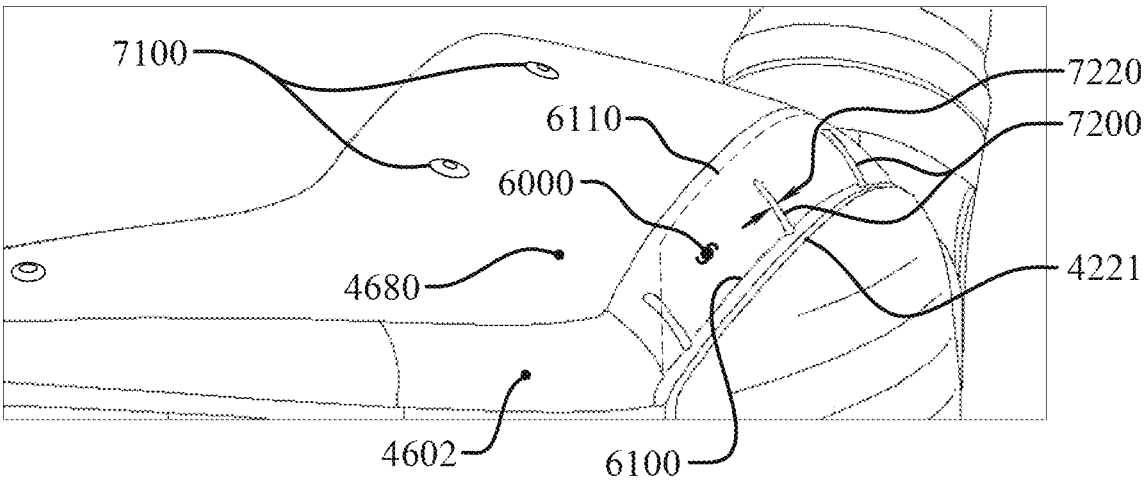
FIG. 75 is a partial perspective view of the club head with the crown panel removed.

While the face-ledge BGPFs 7000, the forward ledge BGPFs 7100, and the face-crown transition BGPFs 7200 are illustrated as having a round perimeter shape in FIGS. 83-85, and rectangular in the embodiments of FIGS. 74 and 75, they may have any perimeter shape, including, but not limited to, rectangles, stars, triangles, polygons, including, but not limited to, concave polygons, constructible polygons, convex polygons, cyclic polygons, decagons, digons, dodecagons, enneagons, equiangular polygons, equilateral polygons, henagons, hendecagons, heptagons, hexagons, Lemoine hexagons, Tucker hexagons, icosagons, octagons, pentagons, regular polygons, stars, and star polygons; triangles, including, but not limited to, acute triangles, anticomplementary triangles, equilateral triangles, excentral triangles, tritangent triangles, isosceles triangles, medial triangles, auxiliary triangles, obtuse triangles, rational triangles, right triangles, scalene triangles, Reuleaux triangles; parallelograms, including, but not limited to, equilateral parallelograms: rhombuses, rhomboids, and Wittenbauer's parallelograms; Penrose tiles; rectangles; rhombus; squares; trapezium; quadrilaterals, including, but not limited to, cyclic quadrilaterals, tetrachords, chordal tetragons, and Brahmagupta's trapezium; equilic quadrilateral kites; rational quadrilaterals; strombus; tangential quadrilaterals; tangential tetragons; trapezoids; polydrafters; annulus; arbelos; circles; circular sectors; circular segments; crescents; lunes; ovals; Reuleaux polygons; rotors; spheres; semicircles; triquetras; Archimedean spirals; astroids; paracycles; cubocycloids; deltoids; ellipses; smoothed octagons; super ellipses; and tomahawks; polyhedra; prisms; pyramids; and sections thereof, just to name a few.

The size and location of the face-ledge BGPFs 7000, the forward ledge BGPFs 7100, and the face-crown transition BGPFs 7200 are essential for performance and durability. Each BGPF has a BGPF contact area which is the surface area of the BGPF intended to be in contact with the adjoining component, whether it be the crown 4620, the face plate 4610, the sole insert 4640, and/or the skirt panel(s). In one embodiment the BGPF contact area is no more than 10 $mm^2$, while in further embodiments it is no more than 7.5 $mm^2$, 6.5 $mm^2$, 5.5 $mm^2$, or 4.5 $mm^2$. In a further embodiment the BGPF contact area is at least 1 $mm^2$, while in further embodiments it is at least 1.5 $mm^2$, 2.0 $mm^2$, 2.5 $mm^2$, or 3.0 $mm^2$.

A total face-ledge BGPF contact area is the sum of the BGPF contact area of each face-ledge BGPFs 7000; likewise, the total face-crown transition BGPF contact area is the sum of the BGPF contact area of each face-crown transition BGPFs 7200. In one embodiment the total face-crown transition BGPF contact area is at least 5% greater than the total face-ledge BGPF contact area, while in further embodiments it is at least 10%, 15%, 20%, or 25% greater. In another embodiment the total face-crown transition BGPF contact area is no more than 250% of the total face-ledge BGPF contact area, while in further embodiments it is no more than 225%, 200%, 175%, or 150%.

Figure 71:
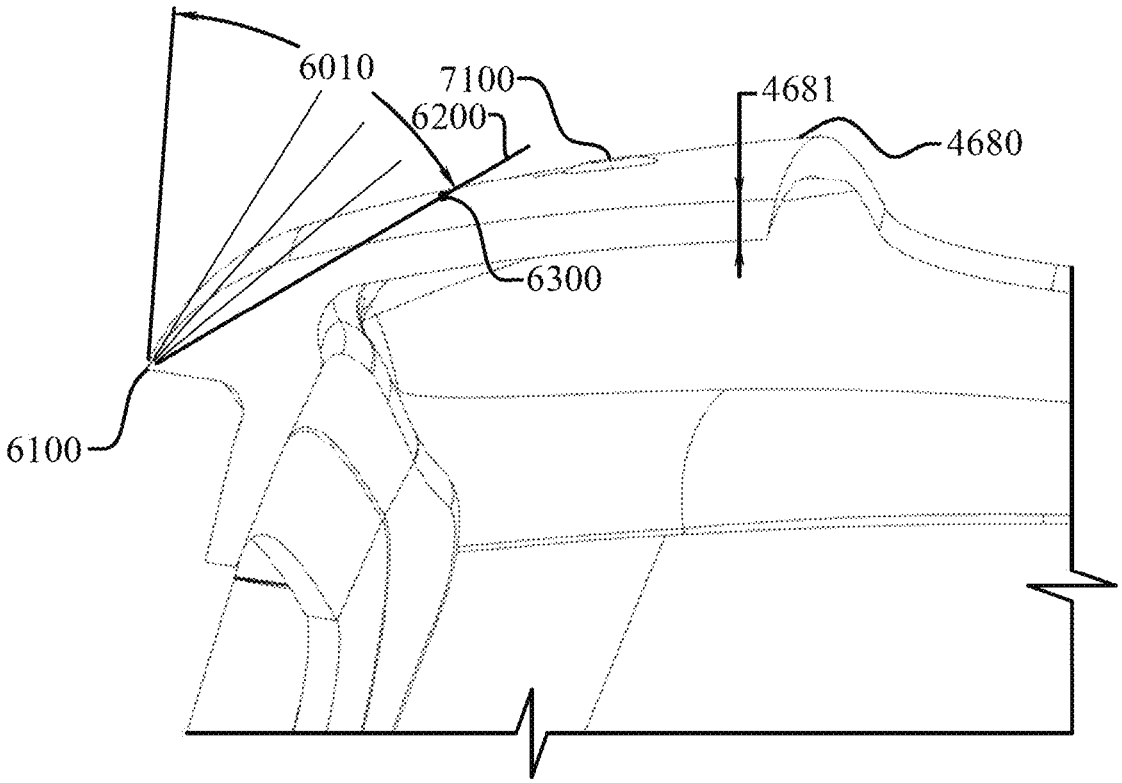
FIG. 71 is a cross-sectional view of an upper-front portion of the club head.

The forward ledge 4680 has a forward ledge thickness 4681, seen in FIG. 71, which is located at least 2 mm behind the rearwardmost point on the face support ledge wall 4690. The forward ledge thickness 4681 may vary from a minimum forward ledge thickness to a maximum forward ledge thickness. In one embodiment the maximum forward ledge thickness is at least 1.0 mm, and at least 1.1 mm, 1.2 mm, or 1.3 mm in further embodiments. Further, in one embodiment the minimum forward ledge thickness is no more than 0.9 mm, and no more than 0.85 mm, 0.80 mm, or 0.75 mm in further embodiments. In another embodiment the maximum forward ledge thickness occurs for at least 5 mm toeward and heelward from the center face 205 location, measured in the x-axis 208 direction; while in further embodiments the 5 mm range is expanded to 7.5 mm, 10 mm, or 12.5 mm. In a further embodiment the minimum forward ledge thickness occurs for at least 5 mm measured in the x-axis 208 direction, while in a further embodiment the minimum forward ledge thickness occurs both on the heel side and toe side of face center 205, while in still a further embodiment the minimum forward ledge thickness occurs in the region of the forward ledge 4680 aligned above the face plate 4610. Extending at least portions of the crown 4620 in front of the various offset loft planes unexpectedly allowed for a reduction in forward ledge thickness, while maintaining durability, in part due to the strength of the crown and the associated bonding agent; thereby freeing up mass that could be reallocated elsewhere in the head to achieve more desirably mass properties.

As previously discussed, relationships between the various components of the club head are essential to achieve the desired performance and durability. The disclosed relationships account for different stiffnesses and deflections of the components including the associated support structures, as well as tight curvatures of the components adjacent the face plate 4610. This difficulty is further compounded by the use of multiple materials both in the exposed outer shell components, as well as the underlying support components. Now some additional specific embodiments will be discussed to illustrate the complexities associated with components made of varied materials having widely variable material properties, while achieving the needed stiffness to support discretionary mass requited to achieve the desired placement of the center of gravity and moments of inertia, while also accommodating the desired deflection characteristics of the face plate 4610, and distribution of the impact forces, as well as the associated deformation, while ensuring components secured via bonding agents do not pop off of the clubhead; all the foregoing complicated by the proximity of bonded components to the face plate 4610 and their curvatures.

With reference now to FIG. 54, while the front body portion 4602 and the rear ring portion 4630 may be separate and distinct components mechanically joined, adhesively bonded, welded, and/or brazed together, they may also be formed as a single unitary component, as seen in the fairway wood embodiment of FIG. 88. Additionally, the front body portion 4602 may be formed as a unitary body, or may be composed of multiple components joined together such as disclosed in detail in U.S. patent application Ser. No. 17/560,054, which is incorporated by reference herein in its entirety. Regardless, in the illustrated embodiment of FIG. 54 the front body portion 4602 includes the forward ledge 4680 to support and engage a portion of the crown 4620, and forms the face opening for receipt of the face plate 4610. The front body portion 4602 has an internal surface which is exposed to the hollow void created in the finished club head, and an external surface opposite the internal surface; thus, the outer surface of the forward ledge 4680 is part of the outer surface of the front body portion 4602. In one embodiment the crown 4620 completely covers the forward ledge 4680 between the heel-side crown-to-face junction point 4700 and the toe-side crown-to-face junction point 4800.

In one embodiment at least a portion of the front body portion 4602 is formed of a metal alloy having a density of less than 5 g/cc, and in a further embodiment less than 3 g/cc, and in yet a further embodiment less than 2 g/cc. In another embodiment at least a portion of the front body portion 4602 located below the elevation of center face 205 is formed of a metal alloy having a density of at least 5 g/cc, and in a further embodiment at least 7 g/cc. Thus, in one embodiment at least a portion of the front body portion 4602 located above the elevation of center face 205 is formed of a metal alloy having a density of less than 5 g/cc, 3 g/cc, or 2 g/cc; while at least a portion of the front body portion 4602 located below the elevation of center face 205 is formed of a metal alloy having a density of at least 5 g/cc, 7 g/cc, 9 g/cc, or 11 g/cc. In one embodiment the forward ledge 4680 is formed of a metal alloy having a density that is no more than two times the density of the crown 4620 and/or sole insert 4640.

In one embodiment at least a portion of the front body portion 4602 is formed of nonmetallic material having a density of less than 2 g/cc, and in a further embodiment less than 1.75 g/cc, and in yet a further embodiment less than 1.5 g/cc. In another embodiment at least a portion of the front body portion 4602 located below the elevation of center face 205 is formed of a metal alloy having a density of at least 5 g/cc, and in a further embodiment at least 7 g/cc. Thus, in one embodiment at least a portion of the front body portion 4602 located above the elevation of center face 205 is formed of a non-metal material having a density of less than 2 g/cc, 1.75 g/cc, or 1.5 g/cc; while at least a portion of the front body portion 4602 located below the elevation of center face 205 is formed of a metal alloy having a density of at least 5 g/cc, 7 g/cc, 9 g/cc, or 11 g/cc.

In one embodiment the rear ring portion 4630 is formed of a metal alloy having a density of less than 5 g/cc, and in a further embodiment less than 3 g/cc, and in yet a further embodiment less than 2 g/cc. In another embodiment at least a portion of the rear ring portion 4630 is formed to also incorporate a metal alloy having a density of at least 5 g/cc, and in a further embodiment at least 7 g/cc, 9 g/cc, 11 g/cc, 13 g/cc, 15 g/cc, or 17 g/cc. Thus, in one embodiment all of the rear ring portion 4630 located above the elevation of center face 205 is formed of a metal alloy having a density of less than 5 g/cc, 3 g/cc, or 2 g/cc; while at least a portion of the rear ring portion 4630 located below the elevation of center face 205 is formed of a metal alloy having a density of at least 5 g/cc, 7 g/cc, 9 g/cc, or 11 g/cc.

In one embodiment rear ring portion 4630 is formed of non-metallic material having a density of less than 2 g/cc, and in a further embodiment less than 1.75 g/cc, and in yet a further embodiment less than 1.5 g/cc. In another embodiment at least a portion of the rear ring portion 4630 located below the elevation of center face 205 is formed of a metal alloy having a density of at least 5 g/cc, and in a further embodiment at least 7 g/cc, 9 g/cc, 11 g/cc, 13 g/cc, 15 g/cc, or 17 g/cc. Thus, in one embodiment all of the rear ring portion 4630 located above the elevation of center face 205 is formed of a nonmetal material having a density of less than 2 g/cc, 1.75 g/cc, or 1.5 g/cc; while at least a portion of the rear ring portion 4630 located below the elevation of center face 205 is formed of a metal alloy having a density of at least 5 g/cc, 7 g/cc, 9 g/cc, 11 g/cc, 13 g/cc, 15 g/cc, or 17 g/cc.

In one embodiment the crown 4620 is formed of at least 3, 5, or 7 unidirectional prepreg plies with each having a crown unidirectional fiber areal weight and a crown unidirectional prepreg resin content, and in another embodiment the crown unidirectional fiber areal weight of the at least 3 unidirectional prepreg plies is equal. In a further embodiment the face plate 4610 includes at least 3 unidirectional prepreg plies with each having a face unidirectional fiber areal weight equal to the crown unidirectional fiber areal weight of at least one of the crown unidirectional prepreg plies and a face unidirectional prepreg resin content, while in a further embodiment the face unidirectional fiber areal weight of at least 3 unidirectional face plies is equal to the crown unidirectional fiber areal weight of at least three of the crown unidirectional prepreg plies. In another embodiment the crown 4620 includes at least one prepreg layer that is a weave and has a weave layer fiber areal weight that is at least 200% of the crown unidirectional fiber areal weight. In another embodiment the weave layer fiber areal weight is at least 200 gsm, 220 gsm, or 240 gsm; while in another embodiment the crown unidirectional fiber areal weight is no more than 100 gsm, and no more than 70 gsm in a further embodiment. In yet another embodiment the weave layer is a twill weave layer.

In one embodiment the sole insert 4640 is formed of at least 3, 4, 5, 6, or 7 unidirectional prepreg plies with each having a sole unidirectional fiber areal weight and a sole unidirectional prepreg resin content, and in another embodiment the sole unidirectional fiber areal weight of the at least 3 unidirectional prepreg plies is equal. In a further embodiment the sole unidirectional fiber areal weight is greater than the crown unidirectional fiber areal weight and/or the face unidirectional fiber areal weight. In another embodiment the sole unidirectional fiber areal weight is at least 20, 30, or 40 gsm greater than the crown unidirectional fiber areal weight and/or the face unidirectional fiber areal weight. While in another series of embodiments the sole unidirectional fiber areal weight is no more than 70, 60, 50, 40, or 30 gsm greater than the crown unidirectional fiber areal weight and/or the face unidirectional fiber areal weight.

The sole insert 4640 may have X sole unidirectional plies, the crown 4620 may have Y crown unidirectional plies, and the face plate 4610 may have Z face unidirectional plies. In one embodiment X is greater than Y, while in a further embodiment X is at least 2 greater than Y, and in an even further embodiment X is at least 3 greater than Y. In a further embodiment X is no more than 6 greater than Y, and no more than 5 or 4 in further embodiments. Z is at least four times X and/or Y in one embodiment, while in another embodiment Z is at least five, six, or seven times X and/or Y in further embodiments. In another series of embodiments Z is no more than fifteen times X and/or Y, and no more than twelve times, ten times, or eight times in further embodiments.

Further, the resin of the unidirectional prepreg plies is essential to performance and balancing the stiffness and deflection capabilities and durability of the various components of the club head. Thus the resin of the crown unidirectional prepreg plies has a crown resin elongation to break, likewise the sole insert unidirectional prepreg plies has a sole insert resin elongation to break, and the face insert unidirectional prepreg plies has a face insert resin elongation to break. In one embodiment the face insert resin elongation to break is greater than the crown resin elongation to break and/or the sole insert resin elongation to break, while in another embodiment the face insert resin elongation to break is at least 2%, and at least 2.1%, 2.2%, or 2.3% in further embodiments. In another embodiment the crown resin elongation to break and/or the sole insert resin elongation to break is less than 2%, and in further embodiments less than 1.9%, 1.8%, 1.7%, 1.6%, or 1.5%. Further, the resin content of the unidirectional plies is also essential and in one embodiment any of these relationships are achieve while having the face unidirectional prepreg resin content differ from the crown unidirectional prepreg resin content and/or sole unidirectional prepreg resin content by less than a predetermined resin content variation. In one embodiment the predetermined resin content variation is 4%, and in further embodiments it is 3%, 2.5%, 2%, 1.5%, or 1%. Similarly, in another embodiment the crown unidirectional prepreg resin content and sole unidirectional prepreg resin content vary from each other by less than the predetermined resin content variation. The disclosed resin content is the pre-cured resin content of the indicated unidirectional prepreg play. The overall components also have a final cured resin content, specifically a cured face resin content, a cured crown resin content, and/or a cured sole resin content. In one embodiment the cured face resin content is less than the cured crown resin content, and/or the cured sole resin content, while in a further embodiment either, or both, the cured crown resin content and/or the cured sole resin content is 40% or greater, while in a further embodiment the cured face resin content is 39.5% or less. In another embodiment the cured face resin content is at least 36%, and at least 37% or 38% in further embodiments.

Returning now to the embodiments, such as those seen in FIGS. 86-91, having a face plate 4610 that is welded, or brazed in place, with or without a face support ledge wall 4690, seen in FIG. 63, in such embodiments the forward ledge 4680 has a forward sidewall 4685, seen in FIG. 88, with a sidewall height 4686, seen in FIG. 89. Further, in these embodiments the face plate 4610 has a perimeter thickness 9030 at the perimeter of the face plate 9020. The forward sidewall 4685 may be cast with the forward ledge 4680, milled into the forward ledge 4680, or molded with the forward ledge 4680. In one embodiment the sidewall height 4686 is at least 25% of the perimeter thickness 9030, and in further embodiments is at least 30%, 35%, 40%, or 45%. In another series of embodiments the sidewall height 4686 is no more than 85%, 80%, 75%, 70%, or 65% of the perimeter thickness 9030. In a further embodiment the sidewall height 4686 is equal to, or greater than, the forward ledge thickness 4681 of a portion of the forward ledge 4680 located in front of the shaft axis plane and/or the offset loft plane 5100. In further embodiments the sidewall height 4686 is at least 5%, 10%, or 15% greater than the forward ledge thickness 4681 of a portion of the forward ledge 4680 located in front of the shaft axis plane and/or the offset loft plane 5100.

In one embodiment, with reference again to FIGS. 63, 70, and 71, the insert recess wall 4692 has a recess wall leading edge 6100, abbreviated RWLE. Any of the relationships disclosed with respect to the simple proximity method and the offset plane method regarding whether another component is "adjacent to" or "adjacent the" perimeter of the face plate 4610, and/or in defining attributes of those components and their relationships, apply equally to a third method, referred to as the RWLE zone method, based upon the recess wall leading edge 6100. In this method, when analyzing any vertical section parallel to the vertical center face plan VCFP, an offset loft plane 5100 is positioned to contact the recess wall leading edge 6100, as seen in FIG. 71, and referred to as the RWLE contact loft plane. The RWLE contact loft plane is then rotated about the recess wall leading edge 6100 through a RWLE angle 6010 to establish a RWLE plane 6200, as seen in FIG. 71, with the intersection of a surface of any component with the RWLE plane 6200 establishing a RWLE plane intersection 6300, illustrated one the forward ledge 4680 in FIG. 71, but easily understood with respect to the crown 4620 in FIG. 70. This process is repeated in vertical sections offset at 1 mm increments from the vertical center face plane VFCP across the entire face topline perimeter edge 4215, with the portion of the club head located in front of the RWLE planes 6200, which is the same as the portion in front of the RWLE plane intersections 6300, defining the analysis region 6000 seen in FIGS. 61, 74, and 75, which has a analysis region leading edge 6100 and an analysis region trailing edge 6110, which corresponds to the RWLE plane intersections 6300. In one embodiment any component is "adjacent to" or "adjacent the" perimeter of the face plate 4610 if it is within the analysis region 6000; and again all the disclosed relationships mentioned with respect to the simple proximity method and/or the offset plane method apply equally to the RWLE zone method. In one embodiment the RWLE angle 6010 is 40 degrees, while in further embodiments it is 35, 30, 25, or 20 degrees.

Referring again to FIG. 70A, the offset plane method is also useful in analyzing the roughness of an adjacent component (i.e. the crown 4620, the sole insert 4640, and/or the skirt insert) located in front of the offset loft plane 5100, meaning between the offset loft plane 5100 and the loft plane 5000. For simplicity of explanation the crown 4620 in front of the offset loft plane 5100 will be discussed, but the relationships apply to any of the other components. The crown 4620 in front of the offset loft plane 5100 is determined in vertical sections, such as the vertical center face plane, or any vertical plane offset therefrom, and has a forward crown surface roughness. Similarly the face plate 4610 has a face surface roughness.

Surface textures or roughness can be conveniently characterized based a surface profile, i.e., a surface height as a function of position on the surface. A surface profile is typically obtained by interrogating a sample surface with a stylus that is translated across the surface. Deviations of the stylus as a function of position are recorded to produce the surface profile. In other examples, a surface profile can be obtained based on other contact or non-contact measurements such as with optical measurements. Surface profiles obtained in this way are often referred to as "raw" profiles. Alternatively, surface profiles for a golf club striking surface can be functionally assessed based on shot characteristics produced when struck with surfaces under wet conditions.

For convenience, a control layer is defined as a striking face configured so that shots are consistent under wet and dry playing conditions. Generally, satisfactory roughened or textured striking surfaces (or other control surfaces) provide ball spins of at least about 2000 rpm, 2500 rpm, 3000 rpm, or 3500 rpm under wet conditions when struck with club head speeds of between about 75 mph and 120 mph. Such control surfaces thus provide shot characteristics that are substantially the same as those obtained with conventional metal woods. Stylus or other measurement based surface roughness characterizations for such control surfaces are described in detail below.

A surface profile is generally processed to remove gradual deviations of the surface from flatness. For example, a wood-type golf club striking face generally has slight curvatures from toe-to-heel and crown-to-sole to improve ball trajectory, and a "raw" surface profile of a striking surface or a cover layer on the striking surface can be processed to remove contributions associated with these curvatures. Other slow (i.e., low spatial frequency) contributions can also be removed by such processing. Typically features of size of about 1 mm or greater (or spatial frequencies less than about 1/mm) can be removed by processing as the contributions of these features to ball spin about a horizontal or other axis tend to be relatively small. A raw (unprocessed) profile can be spatially filtered to enhance or suppress high or low spatial frequencies. Such filtering can be required in some measurements to conform to various standards such as DIN or other standards. This filtering can be performed using processors configured to execute a Fast Fourier Transform (FFT).

Generally, a patterned roughness or texture is applied to a substantial portion of a striking surface or at least to an impact area. For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. Generally, such patterned roughness need not extend across the entire striking surface and can be provided only in a central region that does not extend to a striking surface perimeter.

Striking surface roughness can be characterized based on a variety of parameters. A surface profile is obtained over a sampling length of the striking surface and surface curvatures removed as noted above. An arithmetic mean $R_a$ is defined a mean value of absolute values of profile deviations from a mean line over a sampling length of the surface. For a surface profile over the sampling length that includes N surface samples each of which is associated with a mean value of deviations $Y_i$, from the mean line, the arithmetic mean $R_a$ is:

$$R_a = \frac{1}{N}\sum_{i=1}^{N}|Y_i|,$$

wherein i is an integer i=1, . . . , N. The sampling length generally extends along a line on the striking surface over a substantial portion or all of the striking area, but smaller samples can be used, especially for a patterned roughness that has substantially constant properties over various sample lengths. Two-dimensional surface profiles can be similarly used, but one dimensional profiles are generally satisfactory and convenient. For convenience, this arithmetic mean is referred to herein as a mean surface roughness.

A surface profile can also be further characterized based on a reciprocal of a mean width $S_m$ of the profile elements. This parameter is used and described in one or more standards set forth by, for example, the German Institute for Standardization (DIN) or the International Standards Organization (ISO). In order to establish a value for $S_m$, an upper count level (an upward surface deviation associated with a peak) and a lower count level (a downward surface deviation associated with a valley) are defined. Typically, the upper count level and the lower count level are defined as values that are 5% greater than the mean line and 5% less than the mean line, but other count levels can be used. A portion of a surface profile projecting upward over the upper count level is called a profile peak, and a portion projecting downward below the given lower count level is called a profile valley. A width of a profile element is a length of the segment intersecting with a profile peak and the adjacent profile valley. $S_m$ is a mean of profile element widths $S_{mi}$ within a sampling length:

$$S_m = \frac{1}{K}\sum_{i=1}^{K}S_{mi}$$

For convenience, this mean is referred to herein as a mean surface feature width.

In determining $S_m$, the following conditions are generally satisfied: 1) Peaks and valleys appear alternately; 2) An intersection of the profile with the mean line immediately before a profile element is the start point of a current profile element and is the end point of a previous profile element; and 3) At the start point of the sampling length, if either of the profile peak or profile valley is missing, the profile element width is not taken into account. Rpc is defined as a reciprocal of the mean width $S_m$ and is referred to herein as mean surface feature frequency.

Another surface profile characteristic is a surface profile kurtosis Ku that is associated with an extent to which profile samples are concentrated near the mean line. As used herein, a the profile kurtosis Ku is defined as:

$$Ku = \frac{1}{R_q^4} \cdot \frac{1}{N} \sum_{i=1}^{N} (Y_i)^4,$$

wherein $R_q$ a square root of the arithmetic mean of the squares of the profile deviations from the mean line, i.e., $$R_q = \left( \frac{1}{N} \sum_{i=1}^{N} Y_i^2 \right)^{1/2}.$$

Profile kurtosis is associated with an extent to which surface features are pointed or sharp. For example, a triangular wave shaped surface profile has a kurtosis of about 0.79, a sinusoidal surface profile has a kurtosis of about 1.5, and a square wave surface profile has a kurtosis of about 1.

Other parameters that can be used to characterize surface roughness include $R_z$ which is based on a sum of a mean of a selected number of heights of the highest peaks and a mean of a corresponding number of depths of the lowest valleys. One or more values or ranges of values can be specified for surface kurtosis Ku, mean surface feature width $S_m$, and arithmetic mean deviation $R_a$ (mean surface roughness) for a particular golf club striking surface and/or other component of the club head.

In one embodiment the forward crown surface roughness is the forward crown mean surface roughness c-$R_a$, and the face surface roughness is the face mean surface roughness f-$R_a$. In one such embodiment the forward crown mean surface roughness c-$R_a$ is at least 1 μm less than the face mean surface roughness f-$R_a$, and in further embodiments at least 1.5 μm less, 2.0 μm less, 2.5 μm less, or 3 μm less. In a further embodiment at least a portion of the face plate 4610 has a face mean surface roughness f-$R_a$ is at least 2.0 μm, and in further embodiments at least 2.5 μm, 3.0 μm, 3.5 μm, or 4.0 μm. In a further embodiment at least 50% of the external surface of the face plate 4610 has a face mean surface roughness f-$R_a$ is at least 2.0 μm, and in further embodiments at least 2.5 μm, 3.0 μm, 3.5 μm, or 4.0 μm. In still another embodiment at least 70% of the external surface of the face plate 4610 has a face mean surface roughness f-$R_a$ is at least 2.0 μm, and in further embodiments at least 2.5 μm, 3.0 μm, 3.5 μm, or 4.0 μm. Similarly, in one embodiment at least 50% of the crown 4620 located in front of the offset loft plane 5100 has a face mean surface roughness f-$R_a$ of less than 3.0 μm, and in further embodiments less than 2.5 μm, 2.0 μm, or 1.5 μm. In another embodiment at least 75% of the crown 4620 located in front of the offset loft plane 5100 has a face mean surface roughness f-$R_a$ of less than 3.0 μm, and in further embodiments less than 2.5 μm, 2.0 μm, or 1.5 μm. In still another embodiment at least 90% of the crown 4620 located in front of the offset loft plane 5100 has a face mean surface roughness f-$R_a$ of less than 3.0 μm, and in further embodiments less than 2.5 μm, 2.0 μm, or 1.5 μm. Such relationships balance diminishing returns and trade-offs regarding performance of the face plate 4610 and aerodynamic performance of the club head.

Any of the metal alloy components disclosed herein may be formed by casting, forging, stamping, metal injection molding (MIM), metal additive manufacturing (metal AM), and/or freeform injection molding that combines MIM and metal AM. Metal additive manufacturing (metal AM) includes, but is not limited to, powder bed additive manufacturing, metal binder jetting manufacturing, sheet lamination manufacturing, direct energy deposition manufacturing, and bound powder extrusion. One such embodiment utilizes powder bed fusion (PBF) methods employing the use of either a laser or electron beam to melt and fuse the metal powder into a solid. This technique includes the following metal additive manufacturing methods: electron beam melting (EBM), direct metal laser sintering (DMLS), selective heat sintering (SHS), selective laser melting (SLM), and selective laser sintering (SLS). One such metal binder jetting manufacturing embodiment utilizes metal powders that are jetted onto a build platform to print objects using either a continuous or drop on demand (DOD) approach, followed by application of a liquid binder combine the powder layer by layer, building the desired object, followed by post-processing steps of sintering and/or infiltration to be strengthened. One such sheet lamination process includes the joining of sheets, or strips, of material together layer by layer through bonding, ultrasonic welding or ultrasonic additive manufacturing, or brazing to build an object. Sheet lamination methods are low-temperature processes and can bond different materials together. In a direct energy deposition manufacturing embodiment a focused energy source, such as a laser or electron beam, is directed at the building material to melt it while it is simultaneously being deposited layer by layer, and/or may incorporate use of a heated nozzle to deposit melted material onto the specified surface where it solidifies, which may include powder DED such as laser metal deposition (LMD) and/or laser engineering net shaping (LENS), as well as wire DED techniques such as electron beam additive manufacturing (EBAM).

The front body portion 4602 and/or the rear ring portion 4630 may be formed of titanium alloy, a steel alloy, a boron-infused steel alloy, a copper alloy, a beryllium alloy, aluminum alloy, magnesium alloy, nonmetallic material, composite material, hard plastic, resilient elastomeric material, and/or carbon-fiber reinforced thermoplastic with short or long fibers, and/or any other materials and coatings disclosed herein, and any method of formation and attachment disclosed herein. In one embodiment the front body portion 4602, the rear ring portion 4630, the face plate 4610, the crown 4620, and/or sole plate 4640 can comprise a thermoplastic material, such as fiber-reinforced thermoplastic. In certain embodiments, the front body portion 4602, the rear ring portion 4630, the face plate 4610, the crown 4620, and/or sole plate 4640 comprise a polyamide material such as nylon. Particular examples include polyphthalamide (PPA) resin, polycarbonate resin, etc., reinforced with carbon fibers (e.g., chopped fibers). The composite material can include 20% to 60% fiber by mass, or by volume. Particular examples include 20% to 50% fiber, 30% to 40% fiber, 60% fiber or less, 50% fiber or less, 40% fiber or less, 30% fiber or less, etc., by mass or by volume. In certain embodiments, the front body portion 4602, the rear ring portion 4630, the face plate 4610, the crown 4620, and/or sole plate 4640 can be injection molded. Any of these components may includes a metal film deposited on its surface. The front body portion 4602, the rear ring portion 4630, the face plate 4610, the crown 4620, and/or sole plate 4640 can comprise PPA or similar resins compatible with primer materials for metal film deposition. The front body portion 4602, the rear ring portion 4630, the face plate 4610, the crown 4620, and/or sole plate 4640 may comprise a composite material, such as a fiber-reinforced plastic or a chopped-fiber compound (e.g., bulk molded compound or sheet molded compound), or an injection-molded polymer either alone or in combination with prepreg plies. In one embodiment the front body portion 4602, the rear ring portion 4630, the face plate 4610, the crown 4620, and/or sole plate 4640 achieve desirable strain relationships by being formed of a polyamide resin, while in a further embodiment the polyamide resin includes fiber reinforcement, and in yet another embodiment the polyamide resin includes at least 35% fiber reinforcement. In one such embodiment the fiber reinforcement includes long-glass fibers having a length of at least 10 millimeters pre-molding and produce a finished component having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the component, however it may also reduce the elongation to break therefore a careful balance must be struck to maintain sufficient elongation. Therefore, one embodiment includes 35-55% long fiber reinforcement, while in an even further embodiment has 40-50% long fiber reinforcement. One specific example is a long-glass fiber reinforced polyamide 66 compound with 40% carbon fiber reinforcement, such as the XuanWu XW5801 resin having a tensile strength of 245 megapascal and 7% elongation at break. Long fiber reinforced polyamides, and the resulting melt properties, produce a more isotropic material than that of short fiber reinforced polyamides, primarily due to the three-dimensional network formed by the long fibers developed during injection molding. Another advantage of long-fiber material is the almost linear behavior through to fracture resulting in less deformation at higher stresses. In one particular embodiment the front body portion 4602, the rear ring portion 4630, the face plate 4610, the crown 4620, and/or sole plate 4640 is formed of a polycaprolactam, a polyhexamethylene adipinamide, or a copolymer of hexamethylene diamine adipic acid and caprolactam, however other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties. In one embodiment at least two of the front body portion 4602, the rear ring portion 4630, the face plate 4610, the crown 4620, and/or sole plate 4640 are separately formed of thermoplastic material having compatible resins and are subsequently joined via heat and/or pressure, and without the use of a bonding agent; wherein in a further embodiment this is true for the front body portion 4602, the rear ring portion 4630, and in another embodiment this is true for the front body portion 4602 and the face plate 4610, and in still another embodiment this is true for the front body portion 4602, the rear ring portion 4630, and the crown 4620, while in still a further embodiment this is true for the front body portion 4602, the rear ring portion 4630, the crown 4620, and the face plate 4610, and in a final embodiment this is true for all five of the listed components. In another embodiment a first component selected from the front body portion 4602, the rear ring portion 4630, the face plate 4610, the crown 4620, and/or sole plate 4640 is formed using a thermoset resin, and second component is selected from the same the five components is injection molded and over-molded the first component to joint the first component and the second component. In another embodiment at least two of the front body portion 4602, the rear ring portion 4630, the face plate 4610, the crown 4620, and/or sole plate 4640 are joined via through the use of a thermoset adhesive tape or a thermoset gasket located between a portion of the two components, and application of heat and/or pressure bonds the two components together.

In another embodiment the front body portion 4602, the rear ring portion 4630, the face plate 4610, the crown 4620, and/or sole plate 4640 is injection molded and is formed of a material having a high melt flow rate, namely a melt flow rate (275°/2.16 Kg), per ASTM D1238, of at least 10 g/10 min. A further embodiment the front body portion 4602, the rear ring portion 4630, the face plate 4610, the crown 4620, and/or sole plate 4640 is formed of a primary non-metallic material having a density of less than 1.75 grams per cubic centimeter and a primary tensile strength of at least 200 megapascal; while another embodiment has a density of less than 1.50 grams per cubic centimeter and a tensile strength of at least 250 megapascal. In a further embodiment the front body portion 4602, the rear ring portion 4630, the face plate 4610, the crown 4620, and/or sole plate 4640 is formed of a secondary metallic material having a secondary density of 1.8-3.0 grams per cubic centimeter and a secondary tensile strength that is greater than the primary tensile strength and at least 200 megapascal, while still maintaining a secondary percent elongation to break that is 75-200% of a primary percent elongation to break. While in yet a further embodiment the secondary metallic material has a secondary portion density of 1.8-3.0 grams per cubic centimeter and a secondary tensile strength that is greater than the primary tensile strength and at least 250 megapascal, while still maintaining a secondary percent elongation to break that is 100-185% of the primary percent elongation to break; and in an even further embodiment the secondary metallic material has a secondary density of 2.5-4.5 grams per cubic centimeter and a secondary tensile strength is at least 475 megapascal, while maintaining a secondary percent elongation to break that is 115-165% of the primary percent elongation to break.

In addition to those noted above, some examples of metals and metal alloys that can be used to form the components include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys. In addition to those noted above, some examples of nonmetallic composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites). Further, some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®). Additionally, as discussed above, typically the face-to-crown transition region is painted in a conventional wood-type club head, and this paint chips over time due to repeated impacts. The inventors expected the front portion of the nonmetal crown 4620 and/or sole insert 4640 to chip or crack due to repeated high face impacts. Surprisingly, however, it was found that the nonmetallic crown 4620 and/or sole insert 4640 held up just as well as a painted club head and in some instances was even more robust. The inventors did not see any cracking or chipping of the nonmetallic crown 4620 and/or sole insert 4640 under extreme durability testing.

Another advantage of the club head 4600 is that the large size of the crown 4620 removes seams between the crown and body that are visible to the golfer from an address view in conventional wood-type club heads, providing a cleaner look and a more precise and accurate topline for visual alignment. The boundaries of the crown 4620 in the club head 4600 are instead located more on the lateral aspects of the club head where they are less visible and less distracting to a golfer, while allowing the golfer to focus more on the topline as desired. Furthermore, the topline produce by the juncture of the crown and face plate is predesigned by the shapes of the components themselves and does not rely on manual painting, which can lead to a lot of variability in the topline from club head to club head. The present disclosure is not limited to drivers, but is also intended to be applied to fairway woods, hybrids, irons, or putters.

As previously noted, the unique club head construction has resulted in more discretionary mass to achieve desirable mass properties. For example, Tables 3-5 below provides several mass properties of exemplary embodiments of the golf club head 4600, with the club head oriented with a face angle of 0 degrees.

TABLE 3

| | Example 1 | Example 2 | Example 3 | Example 4 | Example 5 |
|---|---|---|---|---|---|
| CGX | −5 to 5 mm | −4 to 4 mm | −3 to 3 mm | −2.5 to 2.5 mm | −1.5 to 1.5 mm |
| CGY | 33-50 mm | 35-47 mm | 35-45 mm | 35-44 mm | 36-44 mm |
| CGZ | −10 to 0 mm | −7 to −1 mm | −6 to −1.5 mm | −5 to −2.5 mm | −4 to −3 mm |
| ZUP | 18-30 mm | 20-28 mm | 21-27 mm | 22-27 mm | 23-27 mm |
| DELTA1 | 20-40 mm | 23-36 mm | 24-35 mm | 25-34 mm | 26-32 mm |
| DELTA2 | 34-42 mm | 35-40 mm | 35.5-39 mm | 35.5-38 mm | 35.5-38 mm |
| MASS | 180-210 g | 195-208 g | 197-206 g | 199-205 g | 200-205 g |
| IXX | 300-440 kg · mm$^2$ | 310-430 kg · mm$^2$ | 320-420 kg · mm$^2$ | 340-420 kg · mm$^2$ | 360-420 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 480-700 kg · mm$^2$ | 500-675 kg · mm$^2$ | 520-625 kg · mm$^2$ | 540-600 kg · mm$^2$ | 560-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

TABLE 4

| | Example 6 | Example 7 | Example 8 | Example 9 | Example 10 |
|---|---|---|---|---|---|
| MASS | 180-200 g | 182.5-197.5 | 185-195 g | 185-194 g | 185-193 g |
| CGX | −5 to 5 mm | −4 to 4 mm | −3 to 3 mm | −2.5 to 2.5 mm | −1.5 to 1.5 mm |
| CGY | 33-50 mm | 35-47 mm | 35-45 mm | 35-44 mm | 36-44 mm |
| CGZ | −10 to 0 mm | −7 to −1 mm | −6 to −1.5 mm | −5 to −1.5 mm | −4 to −1.5 mm |
| ZUP | 18-30 mm | 20-28 mm | 21-27 mm | 22-27 mm | 23-27 mm |
| DELTA1 | 20-40 mm | 23-36 mm | 24-35 mm | 25-34 mm | 26-32 mm |
| DELTA2 | 34-42 mm | 35-40 mm | 35.5-39 mm | 35.5-38 mm | 35.5-38 mm |
| IXX | 300-440 kg · mm$^2$ | 310-430 kg · mm$^2$ | 320-420 kg · mm$^2$ | 340-420 kg · mm$^2$ | 360-420 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 480-700 kg · mm$^2$ | 500-675 kg · mm$^2$ | 520-625 kg · mm$^2$ | 540-600 kg · mm$^2$ | 560-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

TABLE 5

| | Example 11 | Example 12 | Example 13 | Example 14 | Example 15 |
|---|---|---|---|---|---|
| MASS | 200-210 g | 201-209 g | 202-208 g | 202-207 g | 202-206 g |
| CGX | −5 to 5 mm | −4 to 4 mm | −3 to 3 mm | −2.5 to 2.5 mm | −1.5 to 1.5 mm |
| CGY | 38-50 mm | 39-47 mm | 40-45 mm | 41-45 mm | 42-45 mm |
| CGZ | −10 to 0 mm | −7 to −1 mm | −6 to −1.5 mm | −5 to −1.5 mm | −4 to −1.5 mm |
| ZUP | 18-30 mm | 20-28 mm | 21-27 mm | 22-27 mm | 23-27 mm |
| DELTA1 | 24-40 mm | 26-36 mm | 28-35 mm | 29-34 mm | 30-32 mm |
| DELTA2 | 34-42 mm | 35-40 mm | 35.5-39 mm | 35.5-38 mm | 35.5-37 mm |
| IXX | 340-450 kg · mm$^2$ | 350-445 kg · mm$^2$ | 360-440 kg · mm$^2$ | 370-435 kg · mm$^2$ | 380-430 kg · mm$^2$ |
| IYY | 265-350 kg · mm$^2$ | 275-340 kg · mm$^2$ | 285-330 kg · mm$^2$ | 295-320 kg · mm$^2$ | 300-315 kg · mm$^2$ |
| IZZ | 530-700 kg · mm$^2$ | 540-675 kg · mm$^2$ | 550-625 kg · mm$^2$ | 560-600 kg · mm$^2$ | 570-600 kg · mm$^2$ |
| CFX | 45-70 mm | 45-70 mm | 45-70 mm | 45-70 mm | 45-70 mm |
| CFY | 9-18 mm | 11-16 mm | 12-15 mm | 12.5-14.5 mm | 13-14 mm |
| CFZ | 35-45 mm | 37-43 mm | 38-41 mm | 38-40 mm | 38-40 mm |
| BP PROJ | −5 to 5 mm | −4 to 4 mm | −3 to 3 mm | −2 to 3 mm | −1 to 3 mm |
| BODY LIE (CASTING) | 53-60 degrees | 54-59 degrees | 55-58 degrees | 55-58 degrees | 55-58 degrees |
| ASM LIE (FCT IN STD) | 51.25-58.25 degrees | 52-57 degrees | 53-56.5 degrees | 53-56.5 degrees | 53-56.5 degrees |
| LOFT | 6-12 degrees | 7-12 degrees | 8-12 degrees | 8.5-12 degrees | 9-12 degrees |
| VOLUME | 390-500 cm$^3$ | 400-490 cm$^3$ | 410-480 cm$^3$ | 420-470 cm$^3$ | 430-465 cm$^3$ |

In the tables above, if a value is not defined herein, the definitions used in U.S. patent Ser. No. 10/195,497 and/or U.S. patent application Ser. No. 17/722,748 are to be applied, both of which are herein incorporated by reference in their entirety. As used in the tables above, "BP PROJ" means "projected CG location," also referred to as "balance point" projection, or "CG projection." In fact, CFZ is measured in the same manner as DELTA2, as defined in U.S. patent Ser. No. 10/195,497 but is measure to a projection of center face 205, in the y-axis direction, onto the imaginary vertical shaft axis plane thereby defining a point referred to as the CFZ point, and the shortest distance from the CFZ point to the shaft axis is the CFZ value.

In the club head 4600, the crown 4620 can have a larger external surface area, such as between 10,000 mm$^2$ and 15,000 mm$^2$, between 11,000 mm$^2$ and 15,000 mm$^2$, between 12,000 mm$^2$ and 15,000 mm$^2$, between 12,500 mm$^2$ and 15,000 mm$^2$, between 12,600 mm$^2$ and 15,000 mm$^2$, between 12,650 mm$^2$ and 15,000 mm$^2$, between 12,700 mm$^2$ and 15,000 mm$^2$, between 12,750 mm$^2$ and 15,000 mm$^2$, and/or between 12,800 mm$^2$ and 15,000 mm$^2$. In a particular embodiment the crown 4620 has an external surface area of about 12,694 mm$^2$.

The surface area of the crown-supporting ledge (the entire ledge area around the upper opening of the body, including ledge portions 4680, 4682, and 4636) can be between 3,000 mm$^2$ and 4,000 mm$^2$, between 3,200 mm$^2$ and 3,900 mm$^2$, between 3,400 mm$^2$ and 3,800 mm$^2$, between 3,600 mm$^2$ and 3,700 mm$^2$, and/or between 3,611 mm$^2$ and 3,682 mm$^2$. The disclosure contains a delicate interplay of relationships of the various components, variables within each component as well, as relationships across the components, which impact the performance, sound, feel, durability, and manufacturability of the golf club head. The disclosed relationships are more than mere optimization, maximization, or minimization of a single characteristic or variable, and are often contrary to conventional design thinking, yet have been found to achieve a unique balance of the trade-offs associated with competing criteria such as durability, acoustics, vibration, fatigue resistance, weight, and ease of manufacture. The relationships disclosed do more than maximize or minimize a single characteristic such as characteristic time (CT), coefficient of restitution (COR) at a single point such as face center or offset/distributed COR, moments of inertia, deflection of a single component, rigidity of a single component, ductility of a single component, stiffness of the overall club head, deflection of a single component, frequency of a single components, damping, and/or changes in mode frequencies of the individual components, rather, the relationships achieve a unique balance among these characteristics, which are often conflicting, to produce a club head that has improved feel, sound, durability, and/or performance. After all, the interaction of the numerous components of the present golf club head, particularly when they have such varied material properties, has the potential to adversely impact the sound and feel of the golf club head, as well as its durability, manufacturability, and overall performance. The aforementioned balance requires trade-offs among the competing characteristics recognizing key points of diminishing returns. Further, it is important to recognize that all the associated disclosure and relationships apply equally to all embodiments and should not be interpreted as being limited to the particular embodiment being discussed when a relationship is mentioned. The aforementioned balances require trade-offs among the competing characteristics recognizing key points of diminishing returns, as often disclosed with respect to open and closed ranges for particular variables and relationships. Proper functioning of each component, and the overall club head, on each and every shot, over thousands of impacts during the life of a golf club, is critical. Therefore, this disclosure contains unique combinations of components and relationships that achieve these goals. While the relationships of the various features and dimensions of a single component play an essential role in achieving the goals, the relationships of features and/or characteristics across multiple components are just as critical, if not more critical, to achieving the goals. Further, the relative length, width, thickness, geometry, and material properties of various components, and their relationships to one another and the other design variables disclosed herein, influence the performance, durability, feel, sound, safety, and ease of manufacture. Additionally, many embodiments have identified upper and/or lower limits ranges of relationships when extension outside the range the performance may suffer and adversely impact the goals. While some relationships may appear unrelated, durability of a crown extending to the extent disclosed herein has been avoided in the past due to durability issues, despite obvious advantages regarding creation of a topline, reduction in the thickness of portions of the forward body portion and the associated weight savings that permits more discretionary mass to be located as desired to achieve the disclosed mass properties, as well as the elimination of unsightly joints and seams when looking down on the club head at address. For instance the curvature of the crown near the crown leading edge, the extent to which it extends below the crown apex, particularly near the hosel portion, and/or the proud nature of the crown leading edge with respect to the face, or the proud nature of the crown perimeter edge with respect to the rear ring portion—namely the intermediary stepped down wall 4638, the relation of the crown leading edge to the vertical forward hosel plane, the extent to which the crown creates the perimeter of the club head, the elevation of the heel-side crown-to-face junction point and toe-side crown-to-face junction point, and/or the intersection of the heel-side stepped down wall and toe-side stepped down wall with the insert recess wall, as well as the associated elevations of the intersection, the notch and its size and associated thickness variations, the insert recess wall and face support ledge wall characteristics and relationships to the face plate and crown, the material properties of the various club head components and bonding agents, all play a significant role in the durability of the crown, the face plate, the forward body portion, and the club head in general.

In addition to the various features described herein, any of the golf club heads disclosed herein may also incorporate additional features, which can include any of the following features:

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The technology described herein may also be combined with other features and technologies for golf clubs, such as:

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

Additionally, in addition to the various features described herein, any of the golf club heads disclosed herein may also incorporate additional features, which can include any of the features disclosed in U.S. patent application Ser. Nos. 63/292,708, 17/547,519, 17/360,179, 17/560,054, 17/124,134, 17/531,979, 17/722,748, 17/505,511, 17/560,054, 17/389,167, 17/006,561, 17/137,151, 16/806,254, 17/321,315, 17/696,664, 17/565,580, 17/727,963, 16/288,499, 17/530,331, 17/586,960, 17/884,027, 13/842,011, 16/817,311, 17/355,642, 17/722,748, 17/132,645, 17/696,664, 17/884,027, 17/390,615, 17/586,960, 17/691,649, 17/224,026, 17/560,054, 17/164,033, 17/107,474, 17/526,981, 16/352,537, 17/156,205, 17/132,541, 17/565,580, 17/360,179, 17/355,642, 17/727,963, 17/824,727, 17/722,632, 17/712,041, 17/696,664, 17/695,194, 17/691,649, 17/686,181, 63/305,777, 17/577,943, 17/570,613, 17/569,810, 17/566,833, 17/565,580, 17/566,131, 17/566,263, 17/564,077, 17/560,054, 63/292,708, 17/557,759, 17/558,387, 17/645,033, 17/547,519, 17/541,107, 17/530,331, 17/526,981, 17/526,855, 17/524,056, 17/522,560, 17/515,112, 17/513,716, 17/505,511, 17/504,335, 17/504,327, 17/494,416, 17/493,604, 63/261,457, 17/479,785, 17/476,839, 17/477,258, 17/476,025, 17/467,709, 17/403,516, 17/399,823, 17/390,615, 63/227,889, 17/389,167, 17/387,181, 17/378,407, 17/368,520, 17/360,179, 17/355,642, 17/330,033, 17/235,533, 17/233,201, 17/228,511, 17/224,026, 17/216,185, 17/198,030, 17/191,617, 17/190,864, 17/183,905, 17/183,057, 17/181,923, 17/171,678, 17/171,656, 17/164,033, 17/156,205, 17/564,077, 17/124,134, 17/107,447, 63/292,708, 63/305,777, and 63/338,818, all of which are herein incorporated by reference in their entirety. Additionally, in addition to the various features described herein, any of the golf club heads disclosed herein may also incorporate additional features, which can include any of the features disclosed in U.S. Pat. Nos. 11,213,726, 8,777,776, 7,278,928, 7,445,561, 9,409,066, 8,303,435, 7,874,937, 8,628,434, 8,608,591, 8,740,719, 8,777,776, 9,694,253, 9,683,301, 9,468,816, 8,777,776, 8,262,509, 7,901,299, 8,119,714, 8,764,586, 8,227,545, 8,066,581, 9,409,066, 10,052,530, 10,195,497, 10,086,240, 9,914,027, 9,174,099, and 11,219,803, all of which are herein incorporated by reference in their entirety.

The above-described embodiments are just examples of possible implementations of the disclosed technologies, and are set forth for a clear understanding of the principles of the present disclosure. Any process descriptions or blocks in flow diagrams should be understood as representing modules, segments, or portions of processes for implementing specific functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure.

Many variations and modifications may be made to the above-described embodiment(s) without departing substantially from the spirit and principles of the present disclosure. Further, the scope of the present disclosure includes any and all combinations and sub-combinations of all elements, features, and aspects disclosed herein and in the documents that are incorporated by reference. All such combinations, modifications, and variations are included herein within the scope of the present disclosure, and all possible claims to individual aspects or combinations of elements or steps are intended to be supported by the present disclosure.

We claim:

1. A golf club head comprising:

a golf club body having a face, a crown and a sole together defining an interior cavity, the golf club body including a heel and a toe portion, and having face origin x, y and z axes which are orthogonal to each other having their origin at USGA center face; and wherein the golf club head has a face alignment feature on the face and delineating a transition between at least a first portion of the face located within the face alignment feature and having a first face surface characteristic, and a second portion of the face located adjacent the face alignment feature and having a second face surface characteristic contrasting the first face surface characteristic;

the face alignment feature having:

a curved upper elongate side with an upper side length, a lower elongate side with a lower side length, and a face alignment feature height;

the face alignment feature height includes a greatest face alignment feature height that is at least 10% of CFY, where CFY is the distance measured in the y-axis direction from center face to a shaft axis plane;

the upper side length including a toeward upper side length and a heelward upper side length;

the lower side length including a toeward lower side length and a heelward lower side length;

wherein:

each point along the upper elongate side has an upper elongate side elevation, measured vertically down to a ground plane, and each point along the lower elongate side has a lower elongate side elevation, measured vertically down to the ground plane, wherein the upper elongate side elevation varies throughout the upper side length from a minimum upper elongate side elevation to a maximum upper elongate side elevation that is at least 2.5% greater than the minimum upper elongate side elevation;

the golf club head has a center of gravity located at an elevation Zup above the ground plane;

each point along the upper elongate side has an upper elongate apex-plane offset distance, measured vertically upward to an apex plane, and each point along the lower elongate side has a lower elongate apex-plane offset distance, measured vertically upward to the apex plane, wherein the apex plane is a plane parallel to the ground plane and contacting a crown apex, an apex height is the distance between the apex plane and the ground plane, and the upper elongate apex-plane offset distance varies throughout the upper side length from a minimum upper elongate apex-plane offset distance to a maximum upper elongate apex-plane offset distance, with the minimum upper elongate apex-plane offset distance being at least 10% of Zup, and the maximum upper elongate apex-plane offset distance being no more than 120% of Zup; and the upper side length is at least 100% of Zup, and no more than 50 times the greatest face alignment feature height.

2. The golf club head of claim 1, wherein the upper side length is at least 75% of the apex height and at least 35% of a club head depth, the upper side length is no more than 44 times the greatest face alignment feature height, and the greatest face alignment feature height is 15-70% of CFY.

3. The golf club head of claim 2, wherein the face alignment feature height varies.

4. The golf club head of claim 2, wherein the maximum upper elongate side elevation is no more than 25% greater than the minimum upper elongate side elevation.

5. The golf club head of claim 4, wherein the upper side length is greater than the lower side length.

6. The golf club head of claim 4, wherein the toeward upper side length is 105-170% of the heelward upper side length.

7. The golf club head of claim 2, wherein the face alignment feature includes a toe-side elongate side joining the upper elongate side to the lower elongate side, a heel-side elongate side joining the upper elongate side to the lower elongate side, and the toe-side elongate side and the heel-side elongate side are not vertical.

8. The golf club head of claim 7, wherein an extension of the toe-side elongate side and an extension the heel-side elongate side intersect at a location below the ground plane.

9. The golf club head of claim 2, wherein the face includes an exterior face coating having a coating thickness, and the coating thickness is reduced in the face alignment feature.

10. The golf club head of claim 9, wherein the exterior face coating is entirely removed within the face alignment feature.

11. The golf club head of claim 10, wherein the face includes a face opening and a face plate welded in the face opening, a fusion zone is present around the face plate and establishes a center of fusion perimeter around the face plate, the face plate has a face plate maximum thickness, the face alignment feature is located at least a safety zone distance above the center of fusion perimeter, and the safety zone distance is at least 50% of the face plate maximum thickness.

12. The golf club head of claim 11, wherein the face plate is formed of a maraging steel alloy and the portion of the face creating the face opening is formed of a stainless steel alloy, and the face alignment feature is only located on the stainless steel alloy portion and exposes a portion of the stainless steel alloy.

13. The golf club head of claim 11, wherein the coating thickness is 0.3-15 microns, the second portion of the face has a CIELab gloss value of less than about 40, and the face alignment feature is a laser created face alignment feature whereby the entire coating thickness has been removed within the face alignment feature.

14. The golf club head of claim 2, wherein the face has a face surface roughness, and the face alignment feature has an alignment feature surface roughness that is at least 10 μin greater than the face surface roughness.

15. The golf club head of claim 14, wherein the alignment feature surface roughness is at least twice the face surface roughness.

16. The golf club head of claim 2, wherein at least a portion of the face alignment feature has an upper elongate apex-plane offset distance of at least 30% of Zup.

17. The golf club head of claim 16, wherein the maximum upper elongate apex-plane offset distance is at least 100% greater than the minimum upper elongate apex-plane offset distance, CFY is 11-16 mm, a head origin y-axis (CGy) coordinate is 33-50 mm, Zup is 18-30 mm, an Ixx moment of inertia about a golf club head center of gravity x-axis generally parallel to the origin x-axis is at least 300 $kg \cdot mm^2$, an Iyy moment of inertia about a golf club head center of gravity y-axis generally parallel to the origin y-axis is 285-330 $kg \cdot mm^2$, and an Izz moment of inertia about a golf club head center of gravity z-axis generally parallel to the origin z-axis is at least 500 $kg \cdot mm^2$.

18. The golf club head of claim 17, wherein the maximum upper elongate apex-plane offset distance occurs at a point located heelward of a vertical center face plane, the minimum upper elongate apex-plane offset distance occurs at a point located toeward of the vertical center face plane, CFY is 12-15 mm, the head origin y-axis (CGy) coordinate is 35-47 mm, Zup is 20-28 mm, the Ixx moment of inertia is at least 320 $kg \cdot mm^2$, the Iyy moment of inertia is 295-320 $kg \cdot mm^2$, and the Izz moment of inertia is at least 540 $kg \cdot mm^2$.

19. The golf club head of claim 18, wherein the minimum upper elongate apex-plane offset distance occurs at a point located between the vertical center face plane and a parallel plane containing the crown apex, CFY is 12.5-14.5 mm, the head origin y-axis (CGy) coordinate is 35-44 mm, Zup is 22-27 mm, the Ixx moment of inertia is at least 340 $kg \cdot mm^2$, the Iyy moment of inertia is no more than 315 $kg \cdot mm^2$, and the Izz moment of inertia is at least 560 $kg \cdot mm^2$.

20. The golf club head of claim 17, wherein at least a portion of the face and a portion of the crown are formed of nonmetallic material.

21. The golf club head of claim 17, wherein the golf club head has a crown height to face height ratio of at least 1.12.

22. The golf club head of claim 2, wherein the club head has:

a. a Sight Adjusted Perceived Face Angle (SAPFA) of from about 0 to about 10 degrees; and b. a Sight Adjusted Perceived Face Angle 25 mm Heelward (SAPFA25H) of from about −5 to about 0 degrees and not equal to the Sight Adjusted Perceived Face Angle (SAPFA); and c. a Sight Adjusted Perceived Face Angle 25 mm Toeward (SAPFA25T) of from 1 to about 9 degrees.

23. The golf club head of claim 22, wherein:

a. the Sight Adjusted Perceived Face Angle (SAPFA) is from about 0.5 to about 4 degrees; and b. the Sight Adjusted Perceived Face Angle 25 mm Toeward (SAPFA25T) is from about 2 to about 4 degrees.

24. The golf club head of claim 1, wherein the second portion of the face has a CIELab gloss value of less than about 40.

25. The golf club head of claim 24, wherein first portion of the face has a first portion CIELab brightness, and the difference between the first portion CIELab brightness and the second portion CIELab brightness is at least 10.

26. The golf club head of claim 24, wherein second portion of the face has a second portion CIELab brightness of less than about 40.

27. The golf club head of claim 24, wherein the face alignment feature has a contrasting color or shade difference ($\Delta E^*_{ab}$) greater than 60, wherein the contrasting color or shade difference ($\Delta E^*_{ab}$) is between the first portion of the face and the second portion of the face.

* * * * *